United States Patent [19]

Yerkes et al.

[11] 4,141,071

[45] Feb. 20, 1979

[54] AUTOMATIC DIAMETRIC DIMENSION CONTROL FOR MILL FOR ROLLING ROUND BARS

[75] Inventors: Ronald W. Yerkes; Richard S. Hostetter, Jr., both of Orchard Park, N.Y.; Vinko Primorac, Bethlehem, Pa.

[73] Assignee: Bethlehem Steel Corporation, Bethlehem, Pa.

[21] Appl. No.: 778,807

[22] Filed: Mar. 17, 1977

[51] Int. Cl.[2] ..... B21B 37/12; G05B 5/02

[52] U.S. Cl. ..... 364/472; 72/8; 364/105; 364/107

[58] Field of Search ..... 235/151–151.1, 235/150.1; 364/472, 105, 107; 72/8–16

[56] References Cited

U.S. PATENT DOCUMENTS

| | | | |
|---|---|---|---|
| Re. 27,370 | 5/1972 | McNaugher | 72/8 |
| 3,574,280 | 4/1971 | Smith, Jr. | 72/8 |
| 3,592,031 | 7/1971 | Sutton | 72/8 |
| 3,650,135 | 3/1972 | Skelton | 72/8 |
| 4,037,087 | 7/1977 | Foulds | 235/151.1 |

OTHER PUBLICATIONS

Hershberger: A Microprocessor Based Gauge Controller for Metals Rolling Applications.
IEEE Trousart on Industrial Electronics and Control Instrumentation, vol. IECl-22, No. 3, Aug. 75, pp. 333–337.

*Primary Examiner*—Felix D. Gruber
*Attorney, Agent, or Firm*—Joseph J. O'Keefe; Michael J. Delaney; George G. Dower

[57] ABSTRACT

A mill for rolling round bars, having a penultimate and a last stand with mutually perpendicular roll axes, is provided with a control system for varying the roll gaps of said stands and for axially aligning the rolls in the last stand. A gauge measures the diameters of the bar about its entire periphery and supplies a computer with this data. In addition, data, indicative of lengthwise variations in predetermined diameters of the bar, are supplied to the computer. The computer uses these data to compute an optimum diameter profile of the bar. The computer then calculates adjustments to the rolls in these last two stands to obtain this optimum profile. If substantial improvement in the performance of the mill can be obtained by these adjustments, the computer actuates means for adjusting these rolls whereby this profile may be realized.

13 Claims, 115 Drawing Figures

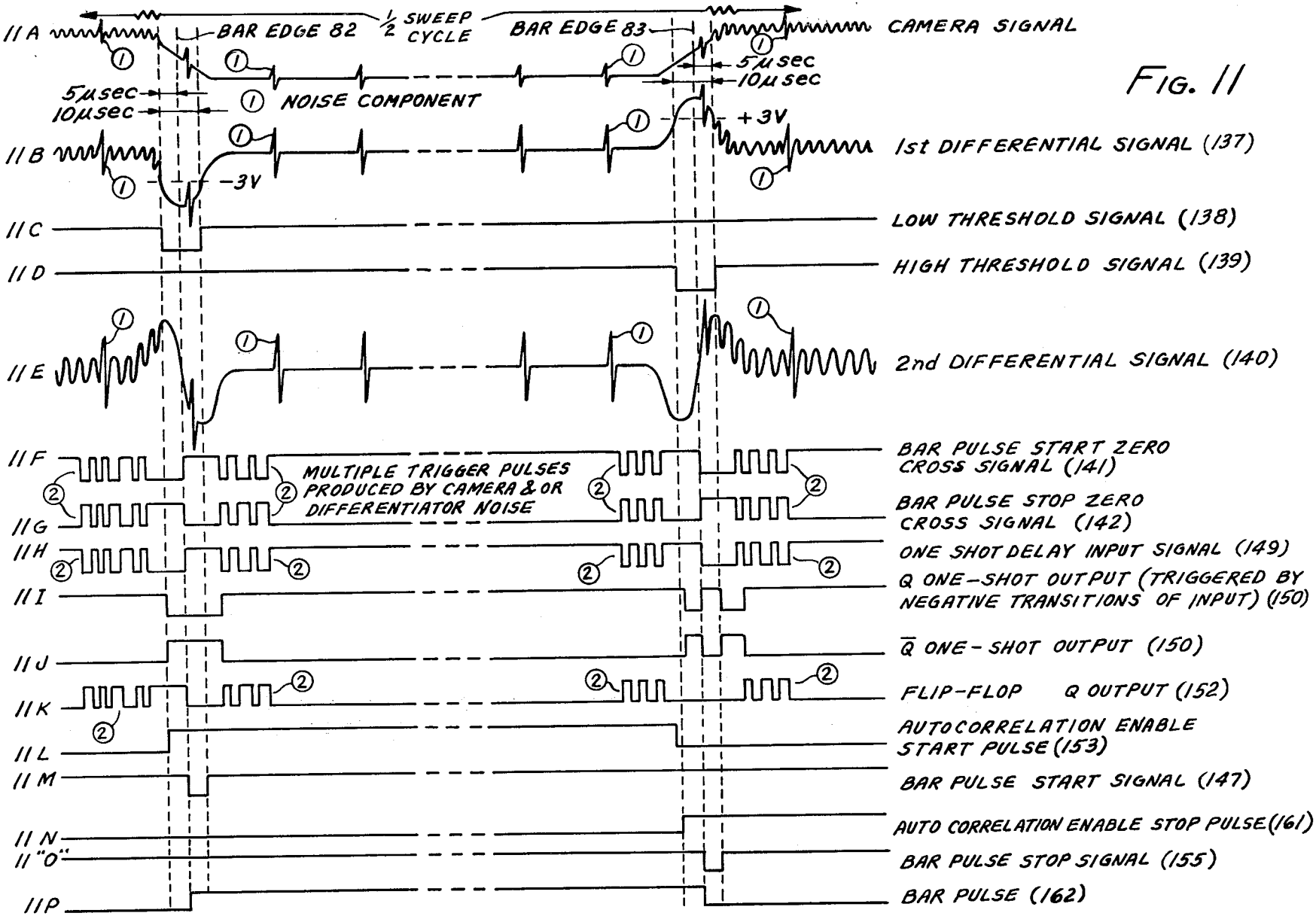
FIG. 11
CAMERA SIGNAL
1st DIFFERENTIAL SIGNAL (137)
LOW THRESHOLD SIGNAL (138)
HIGH THRESHOLD SIGNAL (139)
2nd DIFFERENTIAL SIGNAL (140)
BAR PULSE START ZERO CROSS SIGNAL (141)
BAR PULSE STOP ZERO CROSS SIGNAL (142)
ONE SHOT DELAY INPUT SIGNAL (149)
Q ONE-SHOT OUTPUT (TRIGGERED BY NEGATIVE TRANSITIONS OF INPUT) (150)
Q̄ ONE-SHOT OUTPUT (150)
FLIP-FLOP Q OUTPUT (152)
AUTOCORRELATION ENABLE START PULSE (153)
BAR PULSE START SIGNAL (147)
AUTO CORRELATION ENABLE STOP PULSE (161)
BAR PULSE STOP SIGNAL (155)
BAR PULSE (162)
BAR EDGE 83
BAR EDGE 82
½ SWEEP CYCLE
NOISE COMPONENT
MULTIPLE TRIGGER PULSES PRODUCED BY CAMERA & OR DIFFERENTIATOR NOISE
5μ sec
10μ sec
+3V
-3V
11A
11B
11C
11D
11E
11F
11G
11H
11I
11J
11K
11L
11M
11N
11"O"
11P

COMPUTER #3 DISK MAP
FOR GAGE PROGRAMS

HEXADECIMAL CORE MAP

| TYPE | NAME | POSITION IN COMMON AREA | | COMMON NAME | CORE LOCATION | DESCRIPTION |
|---|---|---|---|---|---|---|
| ARRAY | IFLDC1 | 0000 | IN | FCOMP1 | 9700 | HEAD 1 FIELD OF VIEW COMPENSATION MAP |
| ARRAY | IFLDC2 | 0000 | IN | FCOMP2 | 9800 | HEAD 2 FIELD OF VIEW COMPENSATION MAP |
| VARIABLE | IMULT1 | 0000 | IN | CORCOM | 9900 | HEAD 1 SLOPE CORRECTION |
| VARIABLE | IMULT2 | 0001 | IN | CORCOM | 9901 | HEAD 2 SLOPE CORRECTION |
| VARIABLE | IOFST1 | 0002 | IN | CORCOM | 9902 | HEAD 1 OFFSET CORRECTION |
| VARIABLE | IOFST2 | 0003 | IN | CORCOM | 9903 | HEAD 2 OFFSET CORRECTION |
| VARIABLE | ITMP1 | 0000 | IN | TMPOFF | 9904 | HEAD 1 AUTO-RECALIBRATION SLOPE CORRECTION |
| VARIABLE | ITMP2 | 0001 | IN | TMPOFF | 9905 | HEAD 2 AUTO-RECALIBRATION SLOPE CORRECTION |
| VARIABLE | IMASK1 | 0000 | IN | MSKCOM | 9906 | HEAD 1 RIGHT MASK REFERENCE VALUE |
| VARIABLE | IMASK2 | 0001 | IN | MSKCOM | 9907 | HEAD 2 RIGHT MASK REFERENCE VALUE |
| VARIABLE | IWINDX | 0002 | IN | MSKCOM | 9908 | WINDOW FOR NO X DEFLECT & RIGHT DEFLECT FOR HEAD 1 & HEAD 2 |
| VARIABLE | IGAGDM | 0003 | IN | MSKCOM | 9909 | SPARE - NO FUNCTION |
| ARRAY | ILFMSK | 0000 | IN | LEFTCL | 990A | LEFT MASK REFERENCE VALUES FOR HEAD 1 & HEAD 2 |
| ARRAY | IWINDO | 000A | IN | LEFTCL | 9914 | WINDOWS FOR EACH LEFT MASK ON HEAD 1 & HEAD 2 |
| VARIABLE | ISCNST | 0001 | IN | MASGAG | 9E5D | TARGET ANGLE FOR POSITIONING PROGRAM "GAGPOS" |
| VARIABLE | IBANGL | 0002 | IN | MASGAG | 9E5E | ANGULAR POSITION OF SCANNER IN COUNTS (255=90°) |
| VARIABLE | IANGLE | 0003 | IN | MASGAG | 9E5F | ANGULAR POSITION OF SCANNER IN DEGREES |
| VARIABLE | NSAMPL | 0006 | IN | MASGAG | 9E62 | THE NUMBER OF SAMPLES TO BE AVERAGED PER READING |
| ARRAY | IBDGT1 | 0007 | IN | MASGAG | 9E63 | PROFILE TABLE (CONTAINS 90-2° SLOTS) |
| ARRAY | IBDGT2 | 0065 | IN | MASGAG | 9EC1 | HISTOGRAM TABLE FOR HEAD 1 & HEAD 2 |
| ARRAY | IBDGT3 | 010C | IN | MASGAG | 9F68 | HISTOGRAM TABLE FOR DIFFERENCE BETWEEN HEAD 1 & HEAD 2 |
| VARIABLE | IDVLIM | 0161 | IN | MASGAG | 9FBD | MAXIMUM ALLOWABLE DEVIATION |
| VARIABLE | ICLFLG | 0162 | IN | MASGAG | 9FBE | CALIBRATION FLAG (PREVENTS CALLS TO CMPNST) |
| VARIABLE | IDEV1 | 0163 | IN | MASGAG | 9FBF | DEVIATION OF HEAD 1 FOR A SINGLE READING |
| VARIABLE | IDEV2 | 0164 | IN | MASGAG | 9FC0 | DEVIATION OF HEAD 2 FOR A SINGLE READING |
| VARIABLE | IPOS1 | 0165 | IN | MASGAG | 9FC1 | BAR POSITION OF HEAD 1 FOR A SINGLE READING |
| VARIABLE | IPOS2 | 0166 | IN | MASGAG | 9FC2 | BAR POSITION OF HEAD 2 FOR A SINGLE READING |
| VARIABLE | NGOOD1 | 0167 | IN | MASGAG | 9FC3 | FOR HEAD 1 - # OF GOOD SAMPLES AVERAGED IN A READING |
| VARIABLE | NGOOD2 | 0168 | IN | MASGAG | 9FC4 | FOR HEAD 2 - # OF GOOD SAMPLES AVERAGED IN A READING |
| VARIABLE | IERR | 0000 | IN | GAGERR | 57FB | GAGE ERROR CODE |
| VARIABLE | IRECAL | 0001 | IN | GAGERR | 57FC | RECALIBRATION FLAG (FALSE = NO RECALIBRATION DONE) |
| VARIABLE | IHMD2 | 0001 | IN | BDCCOM | 5701 | HOT METAL DETECTOR - FINISHING STAND |
| VARIABLE | ICDAIM | 0028 | IN | BDCCOM | 5728 | COLD AIM SIZE |
| VARIABLE | IGRADE | 0029 | IN | BDCCOM | 5729 | % CARBON |
| VARIABLE | IHAIM1 | 002A | IN | BDCCOM | 572A | HOT AIM SIZE FOR HEAD 1 |
| VARIABLE | IHAIM2 | 002B | IN | BDCCOM | 572B | HOT AIM SIZE FOR HEAD 2 |

FIG. 16A

HEXADECIMAL CORE MAP

| TYPE | NAME | POSITION IN COMMON AREA | | COMMON NAME | CORE LOCATION | DESCRIPTION |
|---|---|---|---|---|---|---|
| VARIABLE | ISEC | 0000 | IN | MONCOM | 5400 | CURRENT SECONDS |
| VARIABLE | IMIN | 0001 | IN | MONCOM | 5401 | CURRENT MINUTES |
| VARIABLE | IHOUR | 0002 | IN | MONCOM | 5402 | CURRENT HOUR |
| VARIABLE | IMONTH | 0005 | IN | MONCOM | 5405 | CURRENT MONTH |
| VARIABLE | IDATE | 0006 | IN | MONCOM | 5406 | CURRENT DATE |
| VARIABLE | IYEAR | 0007 | IN | MONCOM | 5407 | CURRENT YEAR |
| VARIABLE | ITMP22 | 0001 | IN | SYSCOM | 5450 | BAR TEMPERATURE AT FINISHING STAND |
| ARRAY | ITRABF | 0000 | IN | TRKCOM | 5580 | TOLERANCE LIMITS FOR CURRENT BAR AT FINISHING STAND |

FIG. 16B

M: IDL

GAGTSK (FUNCTIONAL FLOWCHART)

GAGTSK

SUBCLL

GAGE OFFLINE SYSTEM

MNEMONICS ARE AS FOLLOWS:

HS - HISTOGRAM FOR EACH HEAD
MP - BUILDS FIELD OF VIEW COMPENSATION MAPS
PR - ROTATES SCANNER 90 DEGREES AND BUILDS PROFILE TABLE
PL - PLOTS PROFILE TABLE
RP - BUILDS PROFILE TABLE ON RIGHT MASK DATA
CL - PERFORMS A CALIBRATION CHECK ON LEFT AND RIGHT MASKS
TY - PRINTS MAPS, SLOPE & OFFSET FACTORS, AND MASK VALUES
SC - ROTATES SCANNER TO DESIRED ANGLE
OF - ALLOWS ENTRY OF SLOPE AND OFFSET CORRECTION FACTORS
ZE - ZEROES ALL MAPS AND CORRECTION FACTORS !!!CAUTION!!!
LF - LEFT MASK DRIFT TEST
RT - RIGHT MASK DRIFT TEST (ALSO ALLOWS ENTRY OF WINDOW)
TR - DISK TRANSFER OF GAGE COMMON TO CONTROL SYS. AREA
XT - EXITS TO MONITOR AND ATTEMPTS TO WRITE COMMON AREA CONTAINING MAPS, SLOPE AND OFFSET CORRECTION FACTORS, MASK VALUES, AND WINDOW VALUES TO THE DISK. THE DISK FILE WILL ONLY BE UPDATED IF DISK SWITCH 12 IS UP. THIS FILE IS READ FROM THE DISK WHEN THIS TASK (20) IS CALLED BY THE MONITOR.

FIG. 21B

GAGEIN

GAGEIN

GAGMAP

GAGMAP

DATE TIME

HEAD 1 FIELD OF VIEW COMPENSATION MAP

| | -1.6 | -1.2 | -0.8 | -0.4 | 0.0 | +0.4 | +0.8 | +1.2 | +1.6 |
|---|---|---|---|---|---|---|---|---|---|
| 0.000 | 99.0 | -1.0 | -1.0 | -0.2 | 0.0 | 0.4 | 2.8 | 10.2 | 108.0 |
| 0.016 | 98.8 | -0.8 | -1.0 | -0.2 | 0.0 | 0.6 | 3.0 | 10.6 | 108.4 |
| 0.032 | 99.0 | -0.8 | -1.0 | 0.0 | 0.0 | 0.4 | 3.2 | 11.0 | 108.8 |
| 0.048 | 3.0 | -1.0 | -1.0 | 0.0 | 0.0 | 0.6 | 3.2 | 11.6 | 109.2 |
| 0.064 | 3.0 | -1.0 | -1.0 | 0.0 | 0.0 | 0.6 | 3.6 | 12.0 | 109.6 |
| 0.080 | 2.6 | -1.0 | -1.0 | 0.0 | 0.0 | 0.6 | 3.8 | 12.8 | 110.2 |
| 0.096 | 2.4 | -1.2 | -0.8 | 0.0 | 0.0 | 0.8 | 4.2 | 13.4 | 110.6 |
| 0.112 | 2.0 | -1.0 | -0.8 | 0.0 | 0.0 | 0.8 | 4.2 | 14.2 | 111.0 |
| 0.128 | 1.8 | -1.4 | -0.8 | 0.0 | 0.0 | 0.8 | 4.4 | 14.6 | 111.6 |
| 0.144 | 1.4 | -1.2 | -0.8 | 0.0 | 0.0 | 1.0 | 4.8 | 15.6 | 112.0 |
| 0.160 | 1.2 | -1.2 | -0.8 | 0.0 | 0.0 | 1.0 | 4.8 | 16.4 | 112.8 |
| 0.176 | 1.0 | -1.0 | -0.8 | 0.0 | 0.0 | 1.2 | 5.2 | 17.2 | 113.4 |
| 0.192 | 0.6 | -1.2 | -0.6 | 0.0 | 0.0 | 1.2 | 5.4 | 17.8 | 114.2 |
| 0.208 | 0.4 | -1.2 | -0.8 | 0.0 | 0.0 | 1.2 | 5.6 | 18.8 | 114.6 |
| 0.224 | 0.2 | -1.2 | -0.6 | 0.0 | 0.0 | 1.4 | 6.0 | 19.6 | 115.6 |
| 0.240 | 0.0 | -1.2 | -0.6 | 0.0 | 0.0 | 1.4 | 6.2 | 20.4 | 116.4 |
| 0.256 | -0.2 | -1.2 | -0.4 | 0.0 | 0.0 | 1.6 | 6.8 | 21.2 | 117.2 |
| 0.272 | -0.2 | -1.2 | -0.4 | 0.0 | 0.0 | 1.6 | 7.0 | 105.4 | 117.8 |
| 0.288 | -0.2 | -1.2 | -0.4 | 0.0 | 0.0 | 1.8 | 7.2 | 105.6 | 118.8 |
| 0.304 | -0.4 | -1.2 | -0.4 | 0.0 | 0.0 | 1.8 | 7.8 | 106.0 | 119.6 |
| 0.320 | -0.6 | -1.2 | -0.4 | 0.0 | 0.2 | 2.0 | 8.0 | 106.2 | 120.6 |
| 0.336 | -0.8 | -1.2 | -0.4 | 0.0 | 0.2 | 2.2 | 8.4 | 106.8 | 121.2 |
| 0.352 | -0.8 | -1.0 | -0.2 | 0.0 | 0.2 | 2.2 | 8.8 | 107.0 | 205.4 |
| 0.368 | -1.0 | -1.0 | -0.2 | 0.0 | 0.2 | 2.4 | 9.2 | 107.2 | 205.6 |
| 0.384 | -1.0 | -1.0 | -0.2 | 0.0 | 0.4 | 2.4 | 9.6 | 107.8 | 206.0 |

HEAD 2 FIELD OF VIEW COMPENSATION MAP

| | -1.6 | -1.2 | -0.8 | -0.4 | 0.0 | +0.4 | +0.8 | +1.2 | +1.6 |
|---|---|---|---|---|---|---|---|---|---|
| 0.000 | 10.2 | 2.6 | 0.2 | 0.0 | 0.0 | 0.6 | 3.2 | 10.4 | 108.4 |
| 0.016 | 9.6 | 2.4 | 0.0 | 0.0 | 0.0 | 0.6 | 3.4 | 11.0 | 108.8 |
| 0.032 | 9.2 | 2.2 | 0.0 | 0.0 | 0.0 | 0.6 | 3.6 | 11.4 | 109.2 |
| 0.048 | 8.8 | 2.0 | 0.0 | 0.0 | 0.0 | 0.6 | 3.8 | 12.0 | 109.6 |
| 0.064 | 8.4 | 2.0 | 0.0 | 0.0 | 0.0 | 0.8 | 4.0 | 12.4 | 110.0 |
| 0.080 | 8.0 | 1.8 | 0.0 | 0.0 | 0.0 | 0.8 | 4.4 | 13.0 | 110.4 |
| 0.096 | 7.4 | 1.6 | 0.0 | 0.0 | 0.0 | 1.0 | 4.6 | 13.6 | 111.0 |
| 0.112 | 7.2 | 1.6 | 0.0 | 0.0 | 0.0 | 1.0 | 4.6 | 14.0 | 111.4 |
| 0.128 | 6.6 | 1.4 | 0.0 | 0.0 | 0.0 | 1.0 | 4.8 | 14.6 | 112.0 |
| 0.144 | 6.4 | 1.4 | 0.0 | 0.0 | 0.0 | 1.2 | 5.2 | 15.2 | 112.4 |
| 0.160 | 6.2 | 1.2 | 0.0 | 0.0 | 0.0 | 1.2 | 5.4 | 16.0 | 113.0 |
| 0.176 | 5.8 | 1.0 | 0.0 | 0.0 | 0.0 | 1.4 | 5.8 | 16.6 | 113.6 |
| 0.192 | 5.4 | 1.0 | 0.0 | 0.0 | 0.0 | 1.4 | 6.0 | 17.0 | 114.0 |
| 0.208 | 5.2 | 0.8 | 0.0 | 0.0 | 0.0 | 1.4 | 6.2 | 17.4 | 114.6 |
| 0.224 | 4.8 | 0.8 | 0.0 | 0.0 | 0.0 | 1.6 | 6.6 | 105.2 | 115.2 |
| 0.240 | 4.8 | 0.8 | 0.0 | 0.0 | 0.0 | 1.6 | 6.8 | 105.4 | 116.0 |
| 0.256 | 4.2 | 0.6 | 0.0 | 0.0 | 0.2 | 1.8 | 7.2 | 105.8 | 116.6 |
| 0.272 | 4.0 | 0.6 | 0.0 | 0.0 | 0.2 | 1.8 | 7.4 | 106.0 | 117.0 |
| 0.288 | 3.8 | 0.6 | 0.0 | 0.0 | 0.2 | 2.0 | 7.8 | 106.2 | 117.4 |
| 0.304 | 3.8 | 0.4 | 0.0 | 0.0 | 0.2 | 2.0 | 8.2 | 106.6 | 205.2 |
| 0.320 | 3.4 | 0.4 | 0.0 | 0.0 | 0.2 | 2.2 | 8.4 | 106.8 | 205.4 |
| 0.336 | 3.2 | 0.2 | 0.0 | 0.0 | 0.4 | 2.6 | 8.8 | 107.2 | 205.8 |
| 0.352 | 3.0 | 0.2 | 0.0 | 0.0 | 0.4 | 2.6 | 9.2 | 107.4 | 206.0 |
| 0.368 | 2.8 | 0.2 | 0.0 | 0.0 | 0.4 | 2.8 | 9.6 | 107.8 | 206.2 |
| 0.384 | 2.6 | 0.2 | 0.0 | 0.0 | 0.4 | 3.0 | 10.0 | 108.2 | 206.6 |

FIG. 24C

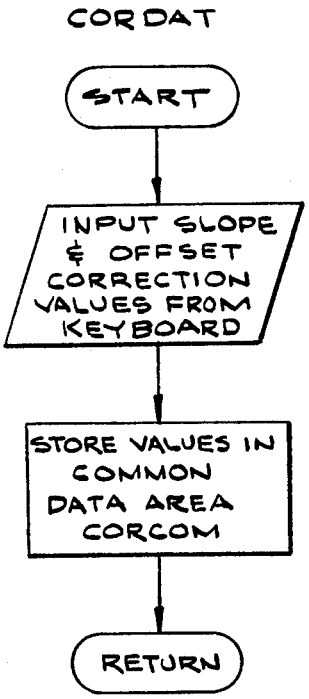
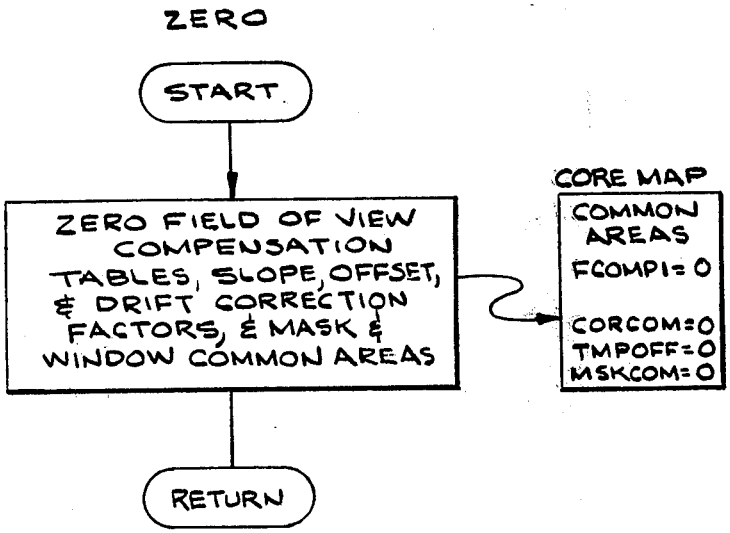
FIG. 26

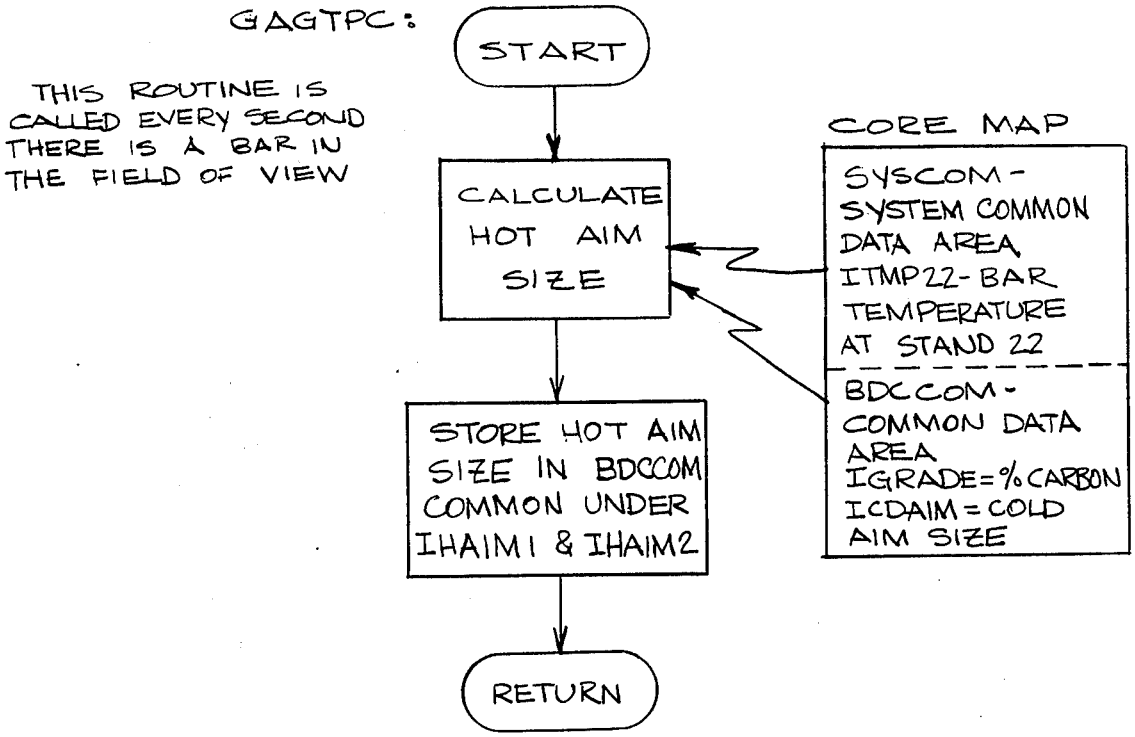
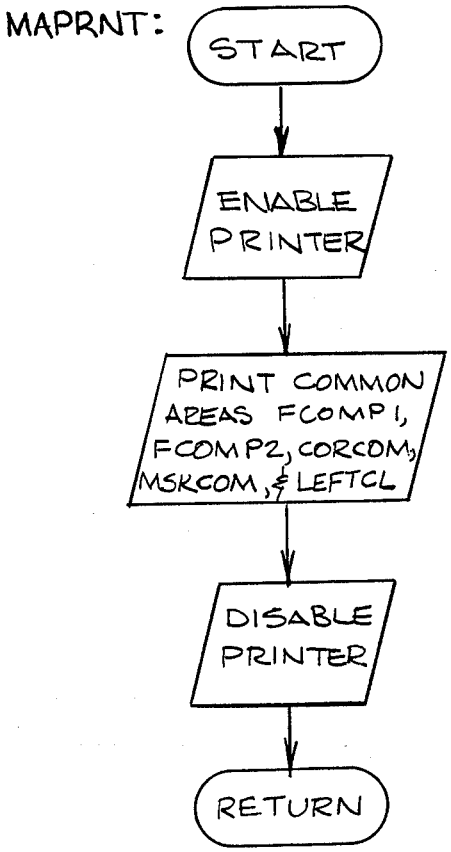
FIG.-27A

GAGE CALIBRATION DATA

DATE TIME

HEAD 1 FIELD OF VIEW COMPENSATION MAP

| | -1.6 | -1.2 | -0.8 | -0.4 | 0.0 | +0.4 | +0.8 | +1.2 | +1.6 |
|---|---|---|---|---|---|---|---|---|---|
| 0.000 | 99.0 | -1.0 | -1.0 | -0.2 | 0.0 | 0.4 | 2.8 | 10.2 | 108.0 |
| 0.016 | 98.8 | -0.8 | -1.0 | -0.2 | 0.0 | 0.6 | 3.0 | 10.6 | 108.4 |
| 0.032 | 99.0 | -0.8 | -1.0 | 0.0 | 0.0 | 0.4 | 3.2 | 11.0 | 108.8 |
| 0.048 | 3.0 | -1.0 | -1.0 | 0.0 | 0.0 | 0.6 | 3.2 | 11.6 | 109.2 |
| 0.064 | 3.0 | -1.0 | -1.0 | 0.0 | 0.0 | 0.6 | 3.6 | 12.0 | 109.6 |
| 0.080 | 2.6 | -1.0 | -1.0 | 0.0 | 0.0 | 0.6 | 3.8 | 12.8 | 110.2 |
| 0.096 | 2.4 | -1.2 | -0.8 | 0.0 | 0.0 | 0.8 | 4.2 | 13.4 | 110.6 |
| 0.112 | 2.0 | -1.0 | -0.8 | 0.0 | 0.0 | 0.8 | 4.2 | 14.2 | 111.0 |
| 0.128 | 1.8 | -1.4 | -0.8 | 0.0 | 0.0 | 0.8 | 4.4 | 14.6 | 111.6 |
| 0.144 | 1.4 | -1.2 | -0.8 | 0.0 | 0.0 | 1.0 | 4.8 | 15.6 | 112.0 |
| 0.160 | 1.2 | -1.2 | -0.8 | 0.0 | 0.0 | 1.0 | 4.8 | 16.4 | 112.8 |
| 0.176 | 1.0 | -1.0 | -0.8 | 0.0 | 0.0 | 1.2 | 5.2 | 17.2 | 113.4 |
| 0.192 | 0.6 | -1.2 | -0.6 | 0.0 | 0.0 | 1.2 | 5.4 | 17.8 | 114.2 |
| 0.208 | 0.4 | -1.2 | -0.8 | 0.0 | 0.0 | 1.2 | 5.6 | 18.8 | 114.6 |
| 0.224 | 0.2 | -1.2 | -0.6 | 0.0 | 0.0 | 1.4 | 6.0 | 19.6 | 115.6 |
| 0.240 | 0.0 | -1.2 | -0.6 | 0.0 | 0.0 | 1.4 | 6.2 | 20.4 | 116.4 |
| 0.256 | -0.2 | -1.2 | -0.4 | 0.0 | 0.0 | 1.6 | 6.8 | 21.2 | 117.2 |
| 0.272 | -0.2 | -1.2 | -0.4 | 0.0 | 0.0 | 1.6 | 7.0 | 105.4 | 117.8 |
| 0.288 | -0.2 | -1.2 | -0.4 | 0.0 | 0.0 | 1.8 | 7.2 | 105.6 | 118.8 |
| 0.304 | -0.4 | -1.2 | -0.4 | 0.0 | 0.0 | 1.8 | 7.8 | 106.0 | 119.6 |
| 0.320 | -0.6 | -1.2 | -0.4 | 0.0 | 0.2 | 2.0 | 8.0 | 106.2 | 120.6 |
| 0.336 | -0.8 | -1.2 | -0.4 | 0.0 | 0.2 | 2.2 | 8.4 | 106.8 | 121.2 |
| 0.352 | -0.8 | -1.0 | -0.2 | 0.0 | 0.2 | 2.2 | 8.8 | 107.0 | 205.4 |
| 0.368 | -1.0 | -1.0 | -0.2 | 0.0 | 0.2 | 2.4 | 9.2 | 107.2 | 205.6 |
| 0.384 | -1.0 | -1.0 | -0.2 | 0.0 | 0.4 | 2.4 | 9.6 | 107.8 | 206.0 |

HEAD 2 FIELD OF VIEW COMPENSATION MAP

| | -1.6 | -1.2 | -0.8 | -0.4 | 0.0 | +0.4 | +0.8 | +1.2 | +1.6 |
|---|---|---|---|---|---|---|---|---|---|
| 0.000 | 10.2 | 2.6 | 0.2 | 0.0 | 0.0 | 0.6 | 3.2 | 10.4 | 108.4 |
| 0.016 | 9.6 | 2.4 | 0.0 | 0.0 | 0.0 | 0.6 | 3.4 | 11.0 | 108.8 |
| 0.032 | 9.2 | 2.2 | 0.0 | 0.0 | 0.0 | 0.6 | 3.6 | 11.4 | 109.2 |
| 0.048 | 8.8 | 2.0 | 0.0 | 0.0 | 0.0 | 0.6 | 3.8 | 12.0 | 109.6 |
| 0.064 | 8.4 | 2.0 | 0.0 | 0.0 | 0.0 | 0.8 | 4.0 | 12.4 | 110.0 |
| 0.080 | 8.0 | 1.8 | 0.0 | 0.0 | 0.0 | 0.8 | 4.4 | 13.0 | 110.4 |
| 0.096 | 7.4 | 1.6 | 0.0 | 0.0 | 0.0 | 1.0 | 4.6 | 13.6 | 111.0 |
| 0.112 | 7.2 | 1.6 | 0.0 | 0.0 | 0.0 | 1.0 | 4.6 | 14.0 | 111.4 |
| 0.128 | 6.6 | 1.4 | 0.0 | 0.0 | 0.0 | 1.0 | 4.8 | 14.6 | 112.0 |
| 0.144 | 6.4 | 1.4 | 0.0 | 0.0 | 0.0 | 1.2 | 5.2 | 15.2 | 112.4 |
| 0.160 | 6.2 | 1.2 | 0.0 | 0.0 | 0.0 | 1.2 | 5.4 | 16.0 | 113.0 |
| 0.176 | 5.8 | 1.0 | 0.0 | 0.0 | 0.0 | 1.4 | 5.8 | 16.6 | 113.6 |
| 0.192 | 5.4 | 1.0 | 0.0 | 0.0 | 0.0 | 1.4 | 6.0 | 17.0 | 114.0 |
| 0.208 | 5.2 | 0.8 | 0.0 | 0.0 | 0.0 | 1.4 | 6.2 | 17.4 | 114.6 |
| 0.224 | 4.8 | 0.8 | 0.0 | 0.0 | 0.0 | 1.6 | 6.6 | 105.2 | 115.2 |
| 0.240 | 4.8 | 0.8 | 0.0 | 0.0 | 0.0 | 1.6 | 6.8 | 105.4 | 116.0 |
| 0.256 | 4.2 | 0.6 | 0.0 | 0.0 | 0.2 | 1.8 | 7.2 | 105.8 | 116.6 |
| 0.272 | 4.0 | 0.6 | 0.0 | 0.0 | 0.2 | 1.8 | 7.4 | 106.0 | 117.0 |
| 0.288 | 3.8 | 0.6 | 0.0 | 0.0 | 0.2 | 2.0 | 7.8 | 106.2 | 117.4 |
| 0.304 | 3.8 | 0.4 | 0.0 | 0.0 | 0.2 | 2.0 | 8.2 | 106.6 | 205.2 |
| 0.320 | 3.4 | 0.4 | 0.0 | 0.0 | 0.2 | 2.2 | 8.4 | 106.8 | 205.4 |
| 0.336 | 3.2 | 0.2 | 0.0 | 0.0 | 0.4 | 2.6 | 8.8 | 107.2 | 205.8 |
| 0.352 | 3.0 | 0.2 | 0.0 | 0.0 | 0.4 | 2.6 | 9.2 | 107.4 | 206.0 |
| 0.368 | 2.8 | 0.2 | 0.0 | 0.0 | 0.4 | 2.8 | 9.6 | 107.8 | 206.2 |
| 0.384 | 2.6 | 0.2 | 0.0 | 0.0 | 0.4 | 3.0 | 10.0 | 108.2 | 206.6 |

FIG. 27B

GAGE CALIBRATION DATA

DATE TIME

HEAD 1 OFFSET CORRECTION= 16
HEAD 1 SLOPE CORRECTION = 13
HEAD 2 OFFSET CORRECTION= 16
HEAD 2 SLOPE CORRECTION = 14

| | HEAD 1 | HEAD 2 | WINDOW | |
|---|---|---|---|---|
| LEFT MASK 1 | 0.2158 | 0.2144 | 00AA | 00AA |
| LEFT MASK 2 | 0.2140 | 0.2124 | 012E | 012E |
| LEFT MASK 3 | 0.2142 | 0.2118 | 0191 | 0191 |
| LEFT MASK 4 | 0.2148 | 0.2112 | 01F4 | 01F4 |
| LEFT MASK 5 | 0.2178 | 0.2122 | 0278 | 0278 |
| RIGHT MASK | 0.5006 | 0.5000 | 005C | |

FIG. 27C

GAGE CALIBRATION CHECK

DATE TIME

| | HEAD 1 | HEAD 2 | WINDOW | |
|---|---|---|---|---|
| LEFT MASK 1 | 0.2158 | 0.2144 | 00AA | 00AA |
| LEFT MASK 1 DEVIATION | 0.0000 | -0.0006 | 00AA | 00AA |
| LEFT MASK 1 (+) SLOPE | 172 | 200 | 00AA | 00AA |
| LEFT MASK 1 (-) SLOPE | 176 | 200 | 00AA | 00AA |
| LEFT MASK 2 | 0.2140 | 0.2124 | 012E | 012E |
| LEFT MASK 2 DEVIATION | 1.9998 | 1.9998 | 012E | 012E |
| LEFT MASK 2 (+) SLOPE | 174 | 190 | 012E | 012E |
| LEFT MASK 2 (-) SLOPE | 178 | 192 | 012E | 012E |
| LEFT MASK 3 | 0.2142 | 0.2118 | 0191 | 0191 |
| LEFT MASK 3 DEVIATION | 0.0000 | -0.0004 | 0191 | 0191 |
| LEFT MASK 3 (+) SLOPE | 172 | 182 | 0191 | 0191 |
| LEFT MASK 3 (-) SLOPE | 178 | 184 | 0191 | 0191 |
| LEFT MASK 4 | 0.2148 | 0.2112 | 01F4 | 01F4 |
| LEFT MASK 4 DEVIATION | 0.0000 | -0.0004 | 01F4 | 01F4 |
| LEFT MASK 4 (+) SLOPE | 174 | 182 | 01F4 | 01F4 |
| LEFT MASK 4 (-) SLOPE | 178 | 186 | 01F4 | 01F4 |
| LEFT MASK 5 | 0.2178 | 0.2122 | 0278 | 0278 |
| LEFT MASK 5 DEVIATION | 0.0000 | -0.0008 | 0278 | 0278 |
| LEFT MASK 5 (+) SLOPE | 166 | 176 | 0278 | 0278 |
| LEFT MASK 5 (-) SLOPE | 170 | 174 | 0278 | 0278 |
| RIGHT MASK | 0.5006 | 0.5000 | 005C | |
| RIGHT MASK DEVIATION | 0.0000 | -0.0010 | 005C | |
| RIGHT MASK (+) SLOPE | 176 | 182 | 005C | |
| RIGHT MASK (-) SLOPE | 182 | 184 | 005C | |
| CALIBRATION CONSTANTS | 0.0002 | 0.0010 | | |
| ANALOG TEST | 1.0262 | 1.0252 | 005C | |
| ANALOG TEST (+) SLOPE | 142 | 140 | 005C | |
| ANALOG TEST (-) SLOPE | 142 | 136 | 005C | |
| DIGITAL TEST | 1.0242 | 1.0240 | | |

FIG. 30F

TYPE A 1 to ENTER WINDOW.

0

ENTER 1 FOR RIGHT MASK REBUILD.

0

ENTER CYCLE TIME IN SECONDS - XXX

010

| | | |
|---|---|---|
| 19:31:53 | 0 | -5 |
| 19:32: 3 | 0 | -5 |
| 19:32:13 | 0 | -5 |
| 19:32:23 | 0 | -5 |
| 19:32:33 | 0 | -4 |
| 19:32:43 | 0 | -5 |
| 19:32:54 | 0 | -6 |
| 19:33: 4 | 0 | -5 |
| 19:33:14 | 0 | -5 |
| 19:33:24 | 0 | -5 |
| 19:33:34 | 0 | -5 |
| 19:33:44 | 0 | -6 |
| 19:33:54 | 0 | -5 |
| 19:34: 4 | 0 | -5 |
| 19:34:14 | 0 | -5 |

FIG. 31D

```
TYPE A 1 TO ENTER NEW LEFT MASK WINDOWS.
0
TYPE A 1 FOR LEFT MASK TABLE REBUILD.
0
ENTER CYCLE TIME IN SECONDS - XXX
020
        20:23:10      0  0 0 0 0        -3 -2 -2 -2 -3
        20:23:46      0  0 1 0 0        -2 -2 -2 -3 -3
        20:24:22      0 -1 0 0 0        -2 -2 -3 -3 -4
        20:24:57      0  0 0 0 0        -3 -3 -2 -2 -4
        20:25:33      0  0 0 0 0        -3 -2 -2 -2 -3
```

FIG. 33E

PROFIL

PROFIL

PROFIL

DATE TIME

AIMSIZE = 0.5096

| | | | | | | | | | |
|---|---|---|---|---|---|---|---|---|---|
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 2 | 0 | 2 | 2 | 4 | 2 |
| 2 | 4 | 4 | 4 | 2 | 4 | 4 | 6 | 6 | 8 |
| 8 | 8 | 8 | 6 | 8 | 8 | 2 | 0 | 0 | 2 |
| 2 | 0 | 2 | 2 | 2 | 0 | 2 | 0 | 0 | 0 |
| 2 | 0 | 2 | 0 | 2 | 0 | 0 | 0 | 0 | 2 |
| 0 | 2 | 2 | 0 | 2 | 0 | 2 | 0 | 2 | 0 |
| 0 | 0 | 2 | 0 | 0 | 0 | 0 | 0 | 0 | 0 |
| 0 | 0 | 0 | 0 | | | | | | |

HEAD1 AIMSIZE = 0.5094 HEAD2 AIMSIZE = 0.5094

RTPROF

RTPROF

DATE TIME

HEAD1 AIMSIZE = 0.5006 HEAD2 AIMSIZE = 0.5000

GAGPRO

GAGPRO

GAGPRO

GAGHST

```
DATE                TIME
HEAD NO. 1

# SAMPLES/READING = 20          # READINGS =     50
AIMSIZE = 0.4962

MEAN = -0.0000            STD. DEV. =  0.0002

    0    5.00
    0    4.80
    0    4.60
    0    4.40
    0    4.20
    0    4.00
    0    3.80
    0    3.60
    0    3.40
    0    3.20
    0    3.00
    0    2.80
    0    2.60
    0    2.40
    0    2.20
    0    2.00
    0    1.80
    0    1.60
    0    1.40
    0    1.20
    0    1.00
    0    0.80
    0    0.60
    2    0.40  *
    7    0.20  ******
   28    0.00  ***************************
    9   -0.20  ********
    3   -0.40  **
    1   -0.60  *
    0   -0.80
    0   -1.00
    0   -1.20
    0   -1.40
    0   -1.60
    0   -1.80
    0   -2.00
    0   -2.20
    0   -2.40
    0   -2.60
    0   -2.80
    0   -3.00
    0   -3.20
    0   -3.40
    0   -3.60
    0   -3.80
    0   -4.00
    0   -4.20
    0   -4.40
    0   -4.60
    0   -4.80
    0   -5.00
READINGS OUT OF RANGE =     0
EACH MARK =  1.00 READINGS
```

FIG.-42C

```
DATE                    TIME
HEAD NO. 2

# SAMPLES/READING = 20          # READINGS =    50
AIMSIZE = 0.4962


MEAN =  0.0002            STD. DEV. =  0.0002

    0    5.00
    0    4.80
    0    4.60
    0    4.40
    0    4.20
    0    4.00
    0    3.80
    0    3.60
    0    3.40
    0    3.20
    0    3.00
    0    2.80
    0    2.60
    0    2.40
    0    2.20
    0    2.00
    0    1.80
    0    1.60
    0    1.40
    0    1.20
    0    1.00
    1    0.80  *
    0    0.60
   13    0.40  ************
   27    0.20  ***************************
    8    0.00  *******
    1   -0.20  *
    0   -0.40
    0   -0.60
    0   -0.80
    0   -1.00
    0   -1.20
    0   -1.40
    0   -1.60
    0   -1.80
    0   -2.00
    0   -2.20
    0   -2.40
    0   -2.60
    0   -2.80
    0   -3.00
    0   -3.20
    0   -3.40
    0   -3.60
    0   -3.80
    0   -4.00
    0   -4.20
    0   -4.40
    0   -4.60
    0   -4.80
    0   -5.00
READINGS OUT OF RANGE =     0
EACH MARK =  1.00 READINGS
```

FIG.- 42 D

FIG.43
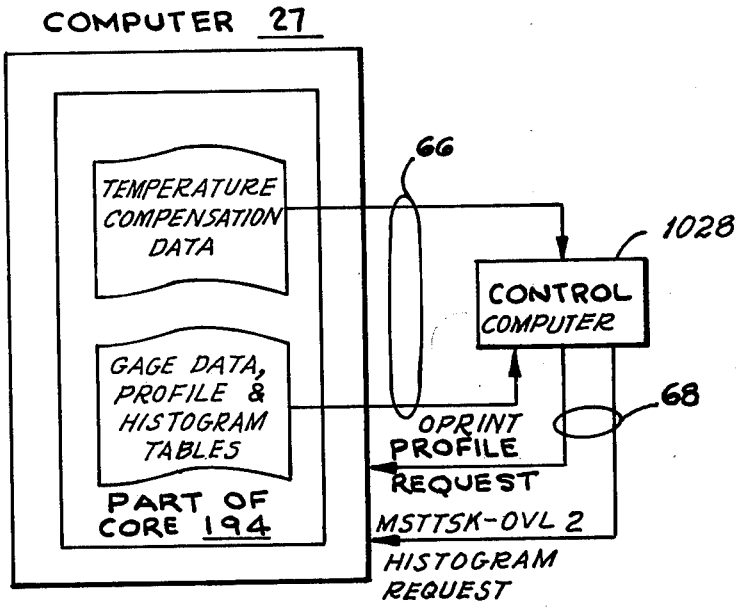
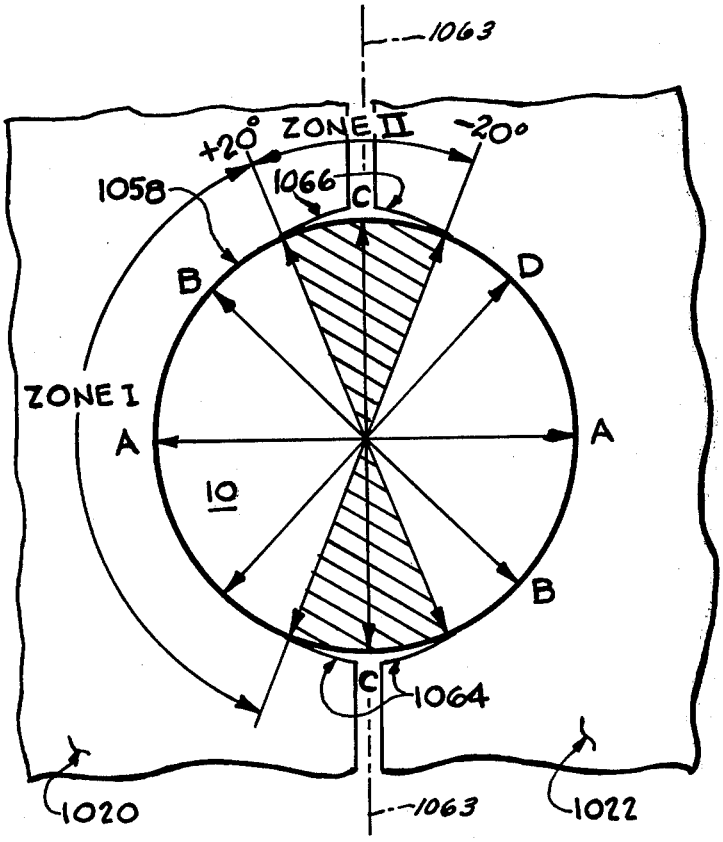
FIG.44

AUTOMATIC DIAMETRIC DIMENSION CONTROL FOR MILL FOR ROLLING ROUND BARS

BACKGROUND OF THE INVENTION

This invention relates to rolling mill control systems. More particularly, it relates to a system for controlling the diametric dimensions of a round bar in the finishing stands of a bar mill.

Automatic control of rolling mills is broadly old, particularly insofar as the rolling of flat products, e.g., sheet steel, is concerned. In these mills, the thickness dimension of the product is either continuously or periodically measured. The roll gap of one or more stands of the rolling mill is then varied, in accordance with a mathematical relationship, to obtain a product of the desired dimensions.

This same basic control philosophy has been followed in the past in connection with mills for rolling rounds bars. In bar mills, however, changing the roll gap in a stand causes all other dimensions about the periphery of the bar to change, also. This phenomenon has been recognized, and control systems have been devised that measure the diameter of a bar at the roll pass line and also in a direction perpendicular thereto. However, such systems have been unsatisfactory in producing a product of accurate dimensions for several reasons. First, it is quite likely that the maximum and the minimum bar diameters may occur at a point on the bar that does not coincide with the particular diameters measured. Thus, the measured diameters give no valuable information relative to either the maximum or the minimum diameter or the extent of out-of-roundness of the bar. Furthermore, these systems do not satisfactorily account for the fact that changing the roll gap changes the dimensions about the entire periphery of the bar. In addition, these prior art systems do not consider the effect of lengthwise variations in diameter due to such factors as roll eccentricity, finishing temperature variations in the bar, variations in tension control, etc.

It is the object of the present invention to provide an improved system and method for controlling the last two stands of a bar mill whereby bars of more uniform diametric size are produced to closer tolerance specifications.

SUMMARY OF THE INVENTION

We have discovered that the foregoing object can be obtained by, first of all, providing means for maintaining the bar in a state of substantially nonvarying tension as it enters and leaves the last two stands of the rolling mill. Sensor means is provided for detecting the diametric dimensions of the bar as it leaves the last stand of the mill. This means comprises: (1) means for producing a diameter signal indicative of a diameter of the bar, and (2) means for causing means (1) to scan the bar periphery in response to a scanning control signal.

Programmed computer means is provided for: (1) producing the scanning control signal for the sensor means, (2) receiving the diameter signal from the sensor means for each diametric position, (3) receiving the aim diameter of the bar and any data needed for compensating the diameter signal received, (4) producing and storing data representative of the diameter profile of the bar, and (5) computing the adjustments to the rolls in these stands to optimize the bar diametric size.

Further means is provided for performing these adjustments.

In the preferred embodiment of the invention, the sensor means and the programmed computer means are utilized to produce histograms of lengthwise variations in predetermined diameters of the bar. These histograms are then used, among other purposes, in the computation of the adjustments to the rolls in the last two stands to optimize the bar diametric size.

BRIEF DESCRIPTION OF THE DRAWINGS

FIGS. 1A–43 relate to the preferred bar diameter gage of the subject invention. They also briefly describe a typical control system embodying such a gage.

FIGS. 44–57 relate specifically to the subject system.

FIG. 1A is a block diagram of a computerized electro-optical gaging system having dual cameras on a scanner.

FIG. 2 is a diagram of a bar cross section showing maximum and minimum tolerance limits in dotted circles, and includes a four-plane overlay related to bar profile orientation.

FIG. 3 is a computer printout of bar profile deviation vs. scanner angular position in relation to the four-plane overlay of FIG. 2, and includes an operating data header.

FIG. 4 is a block diagram of camera electronics for each camera head of the dual camera system shown in FIG. 1.

FIG. 5 is a sectional view of a masked photocathode used in an image dissector tube used in the FIG. 4 camera electronics.

FIG. 6 is a cross-sectional view of the masked photocathode shown in FIG. 5.

FIG. 7 is a block diagram of a bidirectional sweep generator used in the camera electronics shown in FIG. 4.

FIG. 8 is a timing diagram of pulses generated by the bidirectional sweep generator, master clock, window pulse generator, and AGC blanking circuits shown in the camera electronics of FIG. 4.

FIG. 9 is a block diagram of the camera pulse processor used in the camera electronics shown in FIG. 4.

FIG. 10 is a block diagram of an autocorrelator used in the camera pulse processor shown in FIG. 9.

FIG. 11 is a timing diagram of various raw camera signal, differentiator, autocorrelator and bar pulses occurring in the pulse processor shown in FIG. 9.

FIG. 12 is a circuit diagram of a P.M. AGC circuit shown in a camera self-balancing measuring loop incorporated in the camera electronics shown in FIG. 4.

FIG. 13 is a block diagram of a bar size and position accumulator used in the camera electronics shown in FIG. 4.

FIG. 14 is a block diagram of the computer shown in FIG. 1 and includes references to computer flow charts and printouts shown in FIGS. 15 to 42D.

FIG. 15 is a computer DISC MAP.

FIGS. 16A–B is a computer CORE MAP.

FIGS. 17A–E, 18, 19, 20A–B, 21A–B and 22 are flow charts of computer SERVICE PROGRAMS.

FIGS. 24A–C, 25, 26, 27A–C, 28 and 29 are flow charts of computer COMPENSATION PROGRAMS.

FIGS. 30A–F are flow charts of computer CALIBRATION PROGRAM.

FIGS. 31A–D, 32A–C and 33A–E are flow charts of computer RECALIBRATION PROGRAMS.

FIGS. 34, 35, 36A–D, 37A–E, 38A–B, 39A–B, 40, 41A–C are flow charts of computer PROFILE & POSITION PROGRAMS.

FIGS. 42A–D are flow charts of computer HISTOGRAM PROGRAM.

FIG. 43 is a flow chart showing the computer in FIG. 1 communicating with a control system which utilizes the profile and histogram of the present invention.

FIG. 44 is an explanatory diagram defining certain relationships of a bar in the roll pass in the last stand of the subject bar mill.

FIG. 45 is a graph showing lengthwise variations along certain diameters of the bar as a result of roll eccentricity.

FIG. 46 is a block diagram of the software for the subject invention.

FIG. 47 is a plot of a typical bar diameter profile.

FIG. 49 is a plot of the Zone I profile of a typical bar.

FIGS. 50A–50E are plots of possible Zone II profiles for the bar of FIG. 49.

FIG. 51 is a flow chart of the program for determining critical points in the bar profile.

FIG. 52 is a plot of the distributions of the critical points used to compute the percentage of the bar that is being rolled within tolerance.

DESCRIPTION OF THE PREFERRED EMBODIMENT

Figure 1:
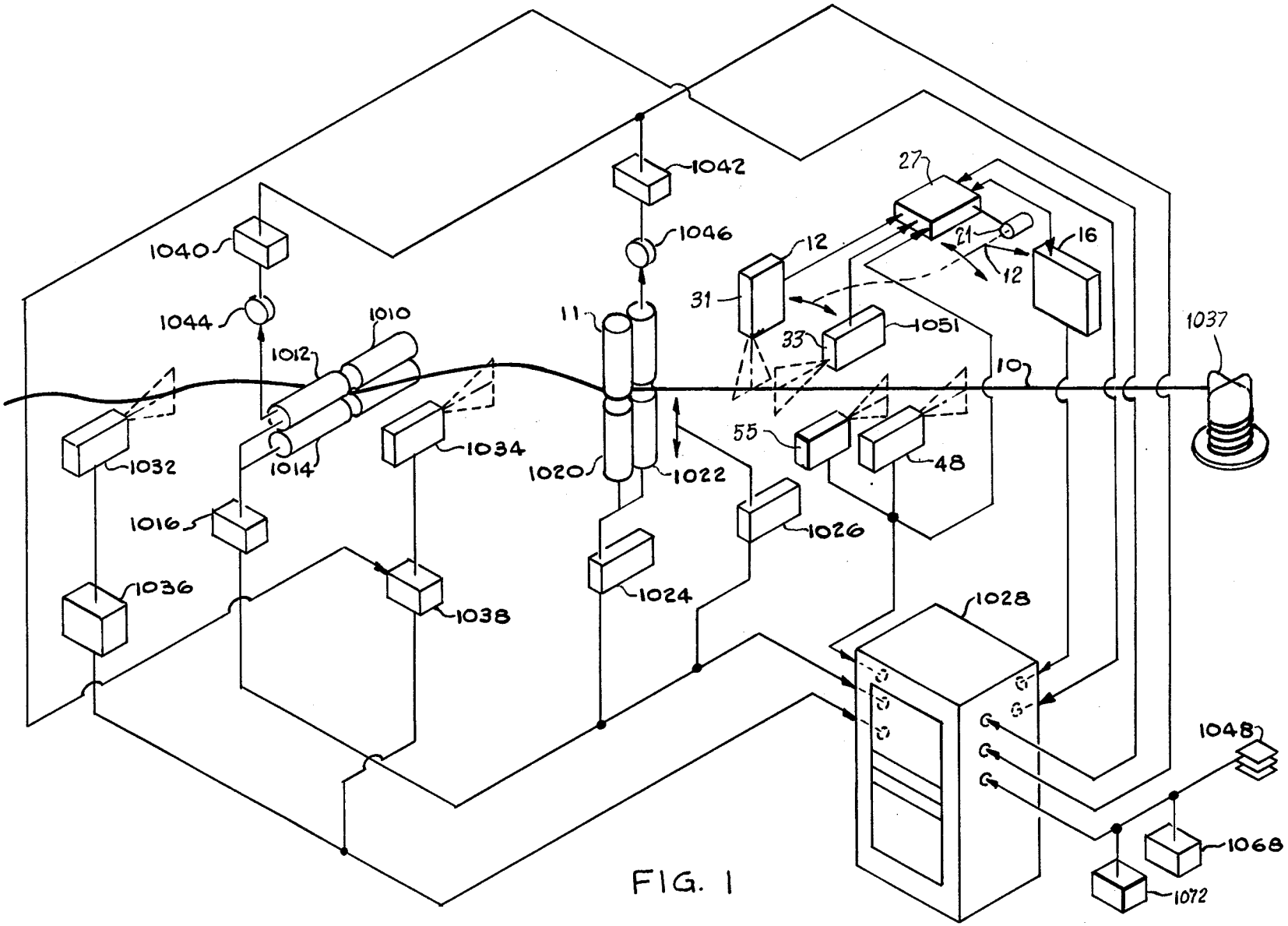
FIG. 1 is a schematic diagram of a portion of a typical bar mill to be controlled in accordance with the present invention.

FIG. 1 is a schematic diagram of the last two stands of a typical 18-stand bar mill. As shown, the penultimate stand 1010, known in the art as the leader stand, comprises a pair of horizontal rolls 1012 and 1014 adapted to have the gap between them adjusted by means of gap controller 1016. The last stand 11, known in the art as the finishing stand, comprises a pair of vertical rolls 1020 and 1022. The gap between these rolls 1020 and 1022 can be adjusted by means of gap controller 1024, and axial adjustment of these rolls can be made by means of controller 1026. The controllers 1016, 1024, and 1026 are connected to a computer 1028 that controls them.

Computer 1028 is preferably a Digital Equipment Corporation PDP-11/05 equipped with a 256K work RK11 disk, a dual TU56 tape drive and a UDC11 hardware interface unit. The assembly language and the Fortran programs used with this computer were compiled by means of Digital Equipment Corporation compilers MACRO-11, described in Manual DEC-11-OMACA-A-D and FORTRAN-V4A described in Manual DEC-11-LFIVAA-D, and compatible with DEC-11 Object Time System Version 20A, respectively.

A bar 10 is shown passing through these stands 1010 and 11. It is imperative that the bar 10 be in a state of substantially nonvarying tension as it enters and leaves these last two stands. The simplest way to insure substantially nonvarying tension is to maintain the bar in a tension-free state. Such a state is approximated by providing loop height scanner 1032 between the penultimate stand 1010 and the stand (not shown) before it and loop height scanner 1034 between the penultimate and the last stands 1010 and 11, respectively. No loop height scanner is required after the bar 10 leaves the last stand 11, inasmuch as the bar 10 is either coiled by a coiler 1037 or passed onto a hot bed, neither of which exerts any substantial tension on bar 10.

The loop height scanners 1032 and 1034 are connected to loop height regulators 1036 and 1038, respectively. These regulators send signals to the computer 1028 that indicate the height of the loops respectively being regulated. If the height of either or both of these loops is outside of its specified range, means (not shown) is provided to calculate the required speed correction and send a speed changing signal to speed regulator 1040, if stand 1010 needs correction, and speed regulator 1042, if stand 1018 needs correction. Speed regulators 1040 and 1042 are provided with tachometers 1044 and 1046, respectively.

The computer 1028 is supplied with pertinent input information from an external source 1048, e.g., the roller and/or the mill office terminal 1068. This information comprises, inter alia, bar size and shape limits and the cold aim diameter of the bar 10. In addition, the computer 1028 is supplied with the roll pass diameter so that it can be determined that that particular pass diameter is suitable for the bar size to be rolled. Assuming the bar 10 is steel, the carbon content of the steel must be specified because of its effect on shrinkage from the hot rolling temperature to room temperature.

The temperature of the bar 10 is sensed by a pyrometer 48 as the bar leaves the last stand 11. The output from the pyrometer 48 is supplied to the computer 1028 where it is utilized, along with the carbon content of the bar, to compensate for shrinkage by converting cold aim size to hot aim size and converting bar diameter gage hot bar readings to room temperature diameter measurements. Normally, steel bars are rolled within the temperature range of 900° C. to 1100° C. Preferably, the pyrometer 48 should be that disclosed in allowed copending U.S. patent application Ser. No. 522,363, to John J. Roche et al., filed Nov. 8, 1974, now U.S. Pat. No. 4,015,476 and assigned to the assignee of the present invention.

Disposed as close as practical to the exit of stand 11 is sensor means, e.g., bar diameter gauge 1051, for producing a signal indicative of a diameter of the bar 10. This means comprises identical orthogonally disposed scanning heads 12. Drive means 14 is connected to the computer 1028 and is adapted to rotate each head through an arc of 90° in response to a command from the computer 1028. This results in a scan of 180°, which yields the diameters about the entire periphery of the bar.

The bar diameter gauge 1015, is preferably an electro-optical device in which the scanning heads are back-lighted electronic cameras. A complete scan of the bar is accomplished in three seconds. Each scanning head outputs 83 readings per second. Each of these readings is an average of four readings at three millisecond intervals.

Figure 1A:
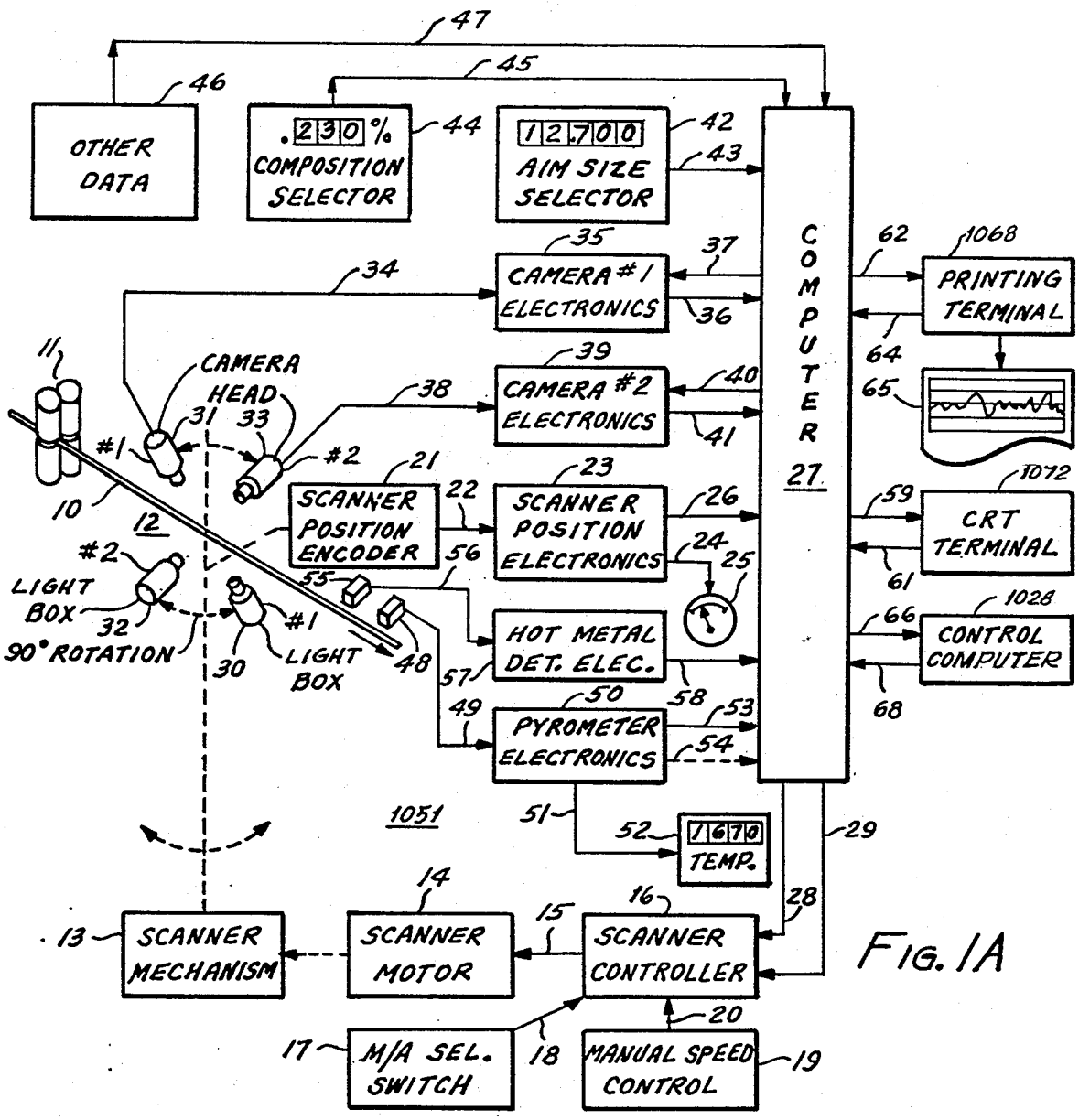

Referring more specifically to FIGS. 1A–43, particularly FIG. 1A, there is shown a computerized electro-optical bar diameter gage having dual back-lighted cameras mounted on a scanner 12 in a hot steel bar rolling mill. The gaging system measures two orthogonal diameters of bar 10, for example, beyond the exit side of roll stand 11 while the scanner 12 scans the peripheral surface of bar 10 a prescribed angular displacement. As explained in detail below, the two diameter signals and a scanner position signal are fed to a computer which plots the lateral profile of bar 10 and adjusts the rolls in the last two rolling mill stands. Ultimately, the bar profile data are displayed, recorded and transmitted to a rolling mill control system which uses these data to control diametric size of the bar by (a) setting the lateral gap of the rolls in stand 11, (b) setting the vertical alignment of the rolls in stand 11 and (c) setting the lateral gap of the rolls in the stand immediately preceding stand 11, viz., stand 1010.

More specifically, dual head scanner 12 consists of reversible scanner mechanism 13 driven by motor 14 which is energized over wire 15 by variable speed controller 16. Two-mode selector switch 17 provides for either manual or automatic scanner operation as signalled over wire 18 to controller 16. This depends on whether a gaging system operator or the computer is to exercise optional manual or automatic scanner 12 control. Under manual control mode, manual speed, start-stop and scanner 12 direction control originates in control device 19 and these signals are fed over wire 20 to controller 16. Under automatic control mode, the manual control signal sources are disabled and scanner controller 16 receives corresponding signals from the computer as will be explained below.

Scanner position encoder 21 is coupled to mechanism 13 and generates an analog signal representing the absolute position of scanner 12 rotation. The encoder signal is fed over wire 22 to scanner position electronics 23 where it is converted to both analog and digital scanner position signals. The analog scanner position signals are fed over wire 24 to scanner position indicator 25 which may be observed by the gage operator when the scanning operation is under manual control. The digital scanner position signals are fed over wire 26 to a computer 27 where they are assimilated with computer command signals under automatic control mode of scanner 12.

Computer 12 is similar to the above-described computer 1028, insofar as its functioning and programming are concerned in relation to a bar diameter control system. Computer 27 is described herein solely in connection with the description of the preferred bar diameter gage 1051, and is not to be confused with computer 1028, which is the computer described in connection with the description of the preferred embodiment of the subject bar diameter control system.

Computer 27 then generates start-stop signals and speed control signals as described below. These signals are fed over respective wires 28 and 29 to scanner speed controller 16. During the automatic control mode, the digital scanner position signals are used in bar profile determining operations, also described below.

Figure 2:
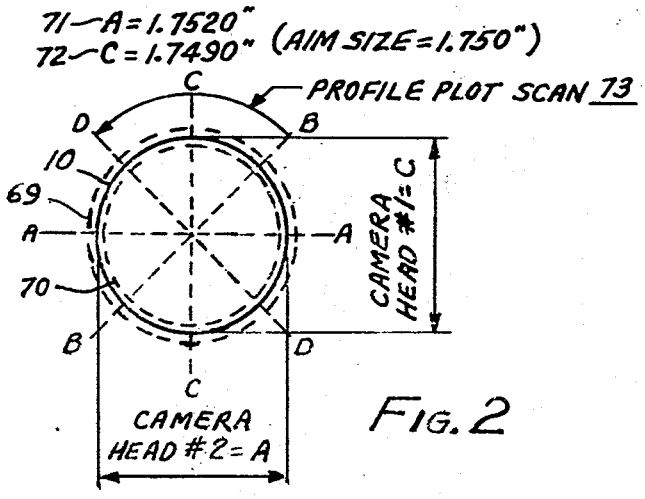

Mechanism 13 of dual head scanner 12 is adapted to mount first and second backlighted electronic camera heads orthogonally to each other so as to be perpendicular to bar 10 during peripheral scanning of bar 10 through a prescribed angular displacement. Bar 10 profile plot scan is shown in FIGS. 1A and 2 as 90° rotation by scanner 12. This will gather enough camera signals to permit later plotting of 180° lateral profile of bar 10. A 180° profile plot is quite useful to a mill operator, and the data for such a plot are essential for the mill control computer described below.

First light box 30 is located opposite first electronic camera head 31 so that when bar 10 intercepts light from box 30 a bar shadow having a width proportional to bar diameter at a first lateral position will be imaged on first electronic camera head 31. Similarly, second light box 32 is located opposite second electronic camera head 33 so that when bar 10 intercepts light from box 32 a bar shadow having a width proportional to bar diameter at a second lateral position, orthogonal to the first, will be imaged on second electronic camera head 33. The arrangement of first back-lighted camera head, shown in FIG. 4 and described below, is typical of both camera heads.

Each light box 30, 32 is arranged to produce a light source perpendicular to bar 10 larger than the largest size bar 10 to be gaged in the camera field-of-view. For example, the camera field-of-view referred to below is three inches (7.62 cm.) and the light source used therewith is four inches (10.16 cm.). In addition, the wavelength and intensity of light boxes 30, 32 must be compatible with the sensitivity characteristics of electronic camera heads 31, 33. Typically, blue light from a D.C. fired fluorescent light source is preferred for the electronic camera heads described below.

The first shadow of bar 10, together with excess light beyond bar 10 edges directed from back light box 30, causes first electronic camera head 31 to generate a first camera signal. This signal consists of a raw camera pulse mixed with noise which is fed over wire 34 to first camera electronics 35. As described below in connection with FIG. 4, the first camera signal is processed to remove the noise and produce digital bar size and bar position signals which are fed over cable 36 to computer 27. Gage enable and other signals are fed over cable 37 from computer 27 to first camera electronics 35.

Simultaneously, the second shadow of bar 10, together with excess light beyond bar 10 edges directed by back light box 32, causes second electronic camera head 33 to generate a second camera signal. Similarly, this signal consists of a raw camera pulse mixed with noise which is fed over wire 38 to second camera electronics 39. The second camera signal is processed to remove the noise and produce digital bar size and position signals which are fed over cable 41 to computer 27. Gage enable and other signals are fed over cable 40 from computer 27 to second camera electronics 39.

Computer 27 in the present electro-optical bar gaging system also receives bar 10 aim size digital signals from thumbwheel selector 42 by way of cable 43. Aim size signals, exemplified as 1.7500 inches (4.445 cm.), are used to determine bar 10 profile deviation and other purposes described below. In addition, computer 27 also receives a bar 10 composition digital signal from thumbwheel selector 44 by way of cable 45. Composition signal, which is exemplified as 0.230% and represents percent carbon in the bar 10, is used as a factor in calculating hot bar aim size from cold bar aim size and other purposes described below. Further, computer 27 also receives appropriate order data signals, including date, time and size tolerances for bar 10, from source 46 by way of cable 47. Alternatively, any one or all of the aim size signals, composition signals, and other data signals may be supplied by a control system directly associated with rolling bar 10, depending upon the preference of the bar gaging system user.

In order to make temperature corrections to the diameter measurements of moving hot bar 10, a Land Co. optical pyrometer head 48 is provided adjacent scanner 12 and aimed at moving hot bar 10. Optical pyrometer head 48 is adapted to generate a high-response raw temperature signal which is fed over cable 49 to Land Co. pyrometer electronics 50. The raw temperature signal is corrected by scaling and linearizing circuits in pyrometer electronics 50 and the corrected temperature signal, exemplified as 1670° F. (910° C.), is fed over cable 51 to digital indicator 52. In addition, the corrected temperature signal is fed over cable 53 to computer 27 where it is used to compensate for hot bar 10 shrinkage.

Installation problems may preclude a Land Co. optical pyrometer head 48 and pyrometer electronics 50 from providing a corrected temperature signal to computer 27 and indicator 52 with desired accuracy and rate of response. If such is the case, an alternative to the Land Co. pyrometer arrangement may be to replace it with an optical field scanning pyrometer system disclosed in U.S. Pat. No. 4,015,476. Briefly, the optical field scanning pyrometer system consists of a rapidly oscillating mirror mounted in a pyrometer head and aimed at a field-of-view through which hot bar 10 will travel. The hot bar is imaged through a slit and onto a high-response infrared detector in the pyrometer head. The infrared detector feeds a peak detector and sample-and-hold circuits to measure and store a nonlinear signal of bar 10 temperature. The stored nonlinear signal may be fed over cable 53 to computer 27 where it must be scaled and/or linearized. The stored temperature signal is updated every scan of the oscillating mirror, for example every 20 ms., by a busy-ready flag pulse fed over dotted-line cable 54. In addition, the stored temperature is scaled and linearized with less frequent up-dating and may be fed to bar temperature indicator 52. Provisions are made for adjusting field scanning frequency and width of field-of-view to suit a variety of installations.

One other feature of the present bar gaging system is an automatic recalibration system. As described below, this feature is initiated each time the trailing end of hot bar 10 is detected leaving mill rolls 11. For this reason, hot metal detector 55 detects the presence and absence of hot bar 10 and feeds a corresponding signal over wire 56 to hot metal detector electronics 57. A presence/absence signal is fed over cable 58 to computer 27 where it initiates the automatic recalibration system mentioned above.

All of the scanner position signals, first and second camera signals, aim size signal, composition signal, other signals, temperature signal and hot metal presence/absence signal fed over respective cables 26, 36, 41, 43, 45, 47, 53 and 58 are assimilated by computer 27 to perform a variety of functions under control of a group of computer off-line and on-line programs detailed below. One of these functions is to generate the scanner start-stop signal on cable 28 and the scanner speed control signals on cable 29, both under automatic scanning mode control. Another function is to feed bar diameter data, bar profile deviation data overlaid on commercial tolerance references and operating header data from computer 27 over cable 59 to CRT terminal 60, and to accept interaction between a standard keyboard on terminal 60 and computer 27 by way of cable 61.

Figure 3:
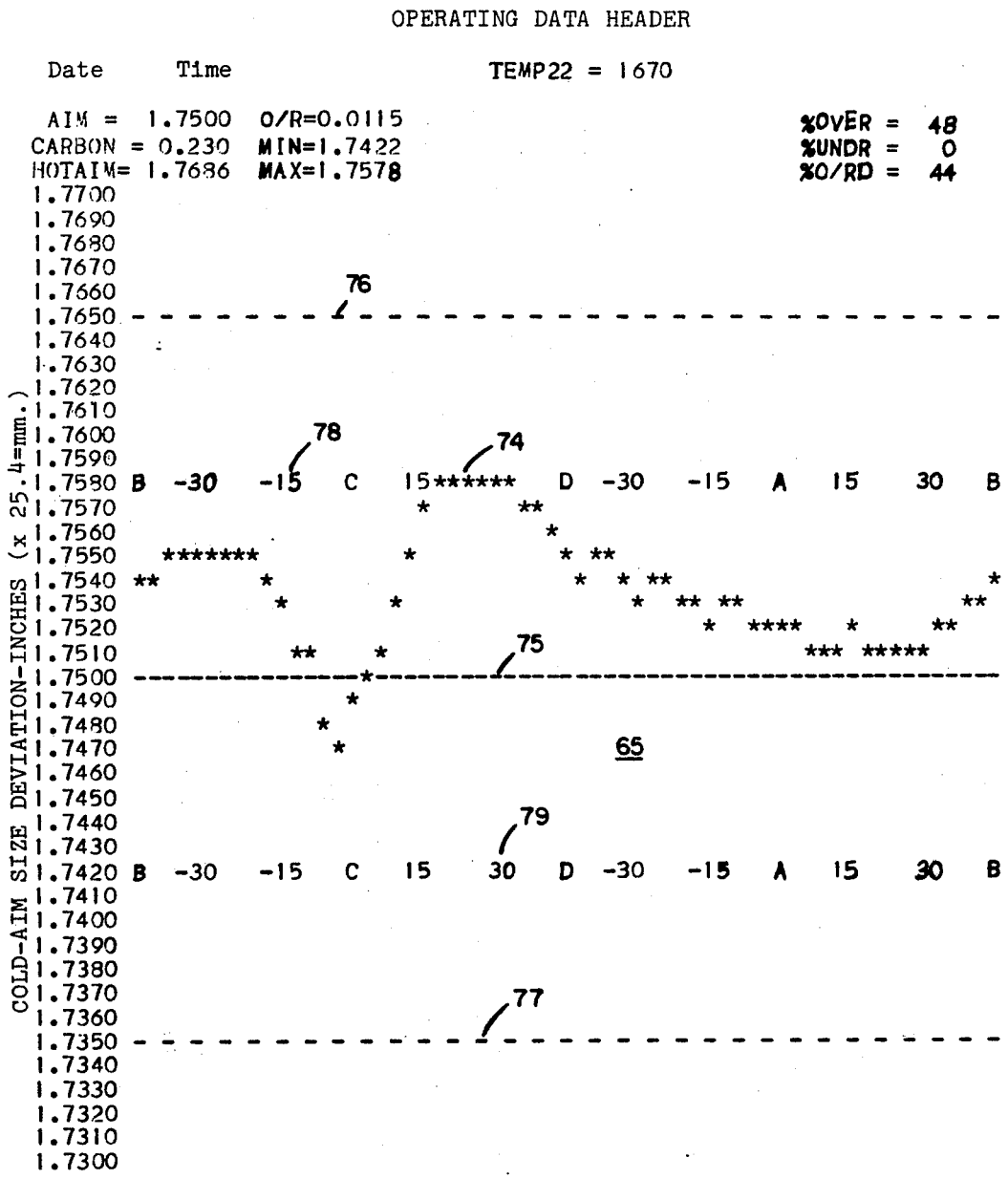

Another function of computer 27 is to feed bar diameter data, bar profile data overlaid on commercial tolerance references and operating header data from computer 27 over cable 62 to printing terminal 63, and to accept interactions between a standard keyboard on terminal 63 and computer 27 by way of cable 64. Printing terminal 63 produces printout 65 which is illustrated in FIG. 3. Still another function of computer 27 is to feed bar 10 profile data and gaging system histograms over cable 66 to control system 67 in response to corresponding request signals fed back to computer 27 by way of cable 68.

Turning now to FIG. 2, there is shown a cross-sectional diagram illustrating the lateral profile of bar 10. The bar is shown traveling into the paper. Dotted circular lines 69 and 70 are illustrative of maximum and minimum standard commercial tolerances for aim size diameter. Also illustrative by dotted straight lines are planes A—A, B—B, C—C and D—D which are of particular interest to a rolling mill operator and a control computer for determining the roll gap and alignment relationships of mill rolls 11 shown in FIG. 1. During non-scanning operations, it is preferred to bring scanner 12 to rest, at least temporarily, so that first camera head 31 and second camera head 33 will measure the diameters at planes C—C and A—A, respectively. The A plane dimension of bar 10 is illustrated at 71 as 1.7520 inches and the C plane dimension of bar 10 is illustrated at 72 as 1.7490 inches, the aim size being 1.7500 inches for illustrative purposes.

During bar scanning operations, it is preferred that second camera head 33 start profile plot scan 73 at plane B—B, continue counter-clockwise 90° through plane C—C, and stop at plane D—D. At the same time, first camera head 31 starts scanning at plane D—D, continues counter-clockwise 90° through plane A—A and stops at plane B—B. In this manner, first and second camera heads 31, 33 scan a 180° lateral peripheral surface of bar 10 and this scan is plotted from plane B—B to C—C, D—D, A—A and ends back at B—B. Other methods of scanning may be used. For example, scanning rotation may be clockwise instead of counter-clockwise. Also, scanner 12 may start at any plane or point in between, then scan 90° and return to the starting position, thereby permitting any 180° portion of bar 10 to be plotted by rotating cameras 31, 33 only 90°.

The resulting profile plot of bar 10 corrected to cold size is computer printout 65 shown in FIG. 3. Here bar profile 74 is overlaid on a specific size, size tolerance and bar position format generated by computer 27 shown in FIG. 1A. The computer-generated format includes an operating data header; bar profile deviations from the actual cold aim size, selected by device 42 in FIG. 1A, is the Y-axis variable; and the scanner 12 angular position is the X-axis variable. The Y-axis printout is graduated in 0.0010 inch increments above and below aim size dotted baseline 75 and extends beyond maximum and minimum full-commercial tolerance reference lines 76, 77. Reference lines 76, 77 are printed as dashed lines parallel to the X-axis. In addition, maximum and minimum half-commercial tolerance reference lines 78, 79 are printed parallel to the X-axis as alpha-numeric lines at fifteen angular degree increments of the 180° bar profile plate. At zero and each 45° increment, the FIG. 2 cross-section plane designations B, C, D, A and B are printed, while the intervening 15° and 30° increments are so printed relative to the A and C positions.

It should be noted that the display on CRT terminal 60 is substantially the same as computer printout 65, with two exceptions. That is, in addition to the bar profile deviation plot and computer-generated format, computer 27 also generates an additional display format of the FIG. 2 dotted-line scanning planes A—A, B—B, C—C and D—D as well as the actual numerical bar sizes A and C shown as items 71 and 72 in FIG. 2. Second, full tolerance limits are not displayed if half tolerance is the aim of the system. Thus, CRT terminal 60 displays bar profile, bar diameter and bar scanning plane information in a form that is unique and quite useful to an operator of the bar gaging system as well as an operator of a rolling mill where the bar gage is used.

Electronic Camera Head

Figure 4:
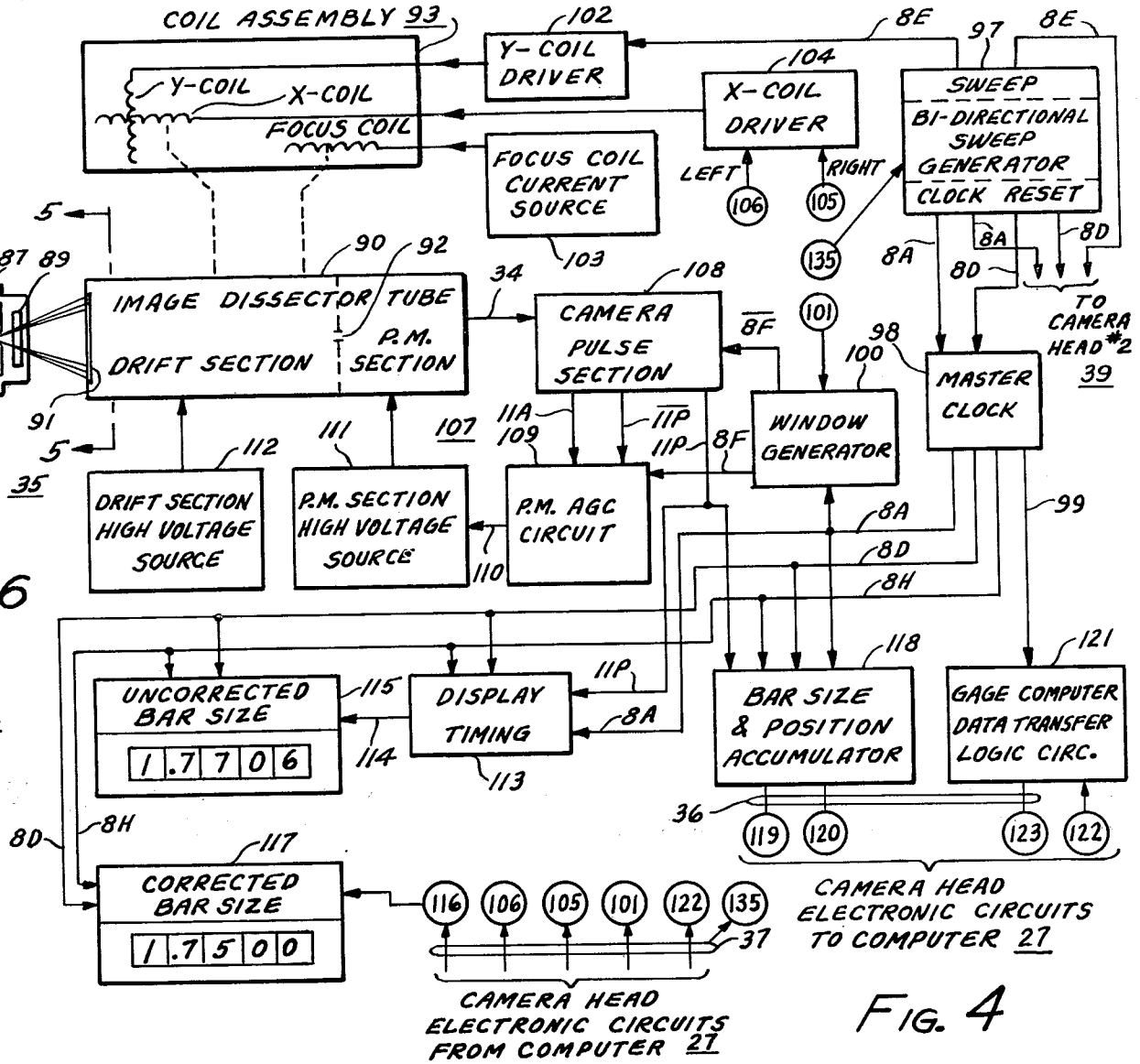

A typical back-lighted electronic camera head used in the present electro-optical bar gaging system is shown in FIG. 4 as camera head 31 placed along an optical axis on the opposite side of bar 10 from light box 30. This arrangement illuminates field-of-view 80 and produces bar shadow 81 that varies vertically proportional to the lateral dimension between hot bar edges 82, 83. An end view of hot bar 10 makes it appear stationary but in actual practice bar 10 vibrates in orbit 84 while traveling longitudinally at speeds up to 4000 ft./min. (1219 m./min.). For this reason, hot bar shadow 81 not only varies vertically proportional to bar size, but is also displaced horizontally and vertically within the confines of about a three inch diameter bar orbit 84. This phenomenon requires a larger field-of-view 80 than does a stationary bar, thereby increasing the problems of precision bar measurements.

Because the bar shadow 81 varies vertically and its position varies both horizontally and vertically, camera head 31 is provided with telecentric lens system 85 which is designed to admit only parallel light rays with a focal plane extending from at least the nearest horizontal edge of bar orbit 84 to at least the farthest horizontal edge of bar orbit 84. This is accomplished by seven-element lens 86 having a four-inch field-of-view 80 within which three inch bar orbit 84 is centered vertically. Other properties of lens 86 include an image size reduction of 2:1 and a telecentric lens stop 87 having a very narrow horizontal optical aperture 88 through which bar shadow 81 passes. Transmission of bar shadow 81 is limited by optical filter 89 to pass only blue light from light box 31, thereby eliminating undesirable effects of other light sources in the field-of-view which have different wavelengths.

Accordingly, telecentric lens system 85 produces a horizontally-oriented bar shadow 81 that varies vertically between bar edges 82, 83 and remains sharply in focus while bar 10 vibrates in orbit 84. Bar shadow 81 is the same size along the optical axis, but as it is displaced vertically away from the optical axis in either direction it becomes larger according to a nonlinear function. This phenomenon is caused by a combination of electronic, coil and lens nonlinearities and is referred to as field-of-view error which will be corrected by computer 27 as described below.

Bar shadow 81 transmitted by telecentric lens system 85 is imaged upon image responsive device 90 which is capable of being scanned at least at 300 Hz., has a resolving power of at least 1 part in 10,000, and has a high sensitivity to blue light. Preferably, device 90 is an image dissector (I.D.) tube having photocathode electrode 91 with a central image translating area which receives the bar shadow 81 image. Photocathode electrode 91 is located behind a light-transmitting face in the drift section of I.D. tube 90. Photoelectrons emitted by photocathode electrode 91 are focused by external means to pass through electron aperture 92 so they can enter the photomultiplier (P.M.) section of image dissector tube 90. Preferably, device 90 is an ITT Co. high resolution image dissector tube No. F4052RP.

Camera head 31 also includes cylindrical deflection and focus coil assembly 93 surrounding the cylindrical body of image dissector tube 90. Coil assembly 93 includes separate Y-axis and X-axis deflection coils and a focus coil, each energized from separate external sources. Standard mu metal shielding surrounds the exterior cylindrical wall of coil assembly 93, thereby providing effective shielding against radial magnetic fields. A preferred coil assembly 93 designed for use with the above noted I.D. tube 90 is Washburn Laboratory, Inc. No. YF2308-CC3C.

Occasionally, the standard mu metal shielding in the Washburn Laboratory, Inc. coil assembly 93 may not provide enough shielding against both radial and axial magnetic field sources. For example, when I.D. tube 90 is operating at a high sensitivity level and scanner 12 rotates camera head 31 through earth's magnetic field and/or electro-magnetic fields present in rolling mills, I.D. tube 90 output may differ at one time or another from that when I.D. tube 90 is stationary. If this condition is encountered in practice, an alternative solution exists which requires modifying the Washburn standard mu metal shielding to improve the attenuation of axial magnetic fields. Essentially, this involves extending the standard Washburn cylindrical mu metal shield axially toward lens system 85 and closing down the end at filter 89, except for an optical aperture to image bar shadow 81 onto photocathode electrode 91 in tube 90. Additional axial magnetic field attenuation may be achieved by a second cylindrical mu metal shield surrounding the extended standard shield. Moreover, the standard coil shield may be used without extension, but axial field attenuation may be achieved by adding a second and possibly a third cylindrical mu metal shield extending axially as in the first instance.

Still referring to FIG. 4, the present electrooptical bar gaging system may experience other calibration drift and variations in optical image dissector tube 90, and other electronic nonlinearities inherent in the bar gaging system. These drift and variable gaging conditions may be identified by providing on-line calibration checks and subsequently correcting the calibrated bar signals as described below. These calibration checks are made possible by modifying image dissector tube 90 to provide a masked photocathode electrode 91 as shown in FIG. 5.

Figure 6:
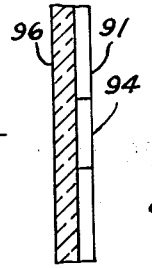
Figure 5:
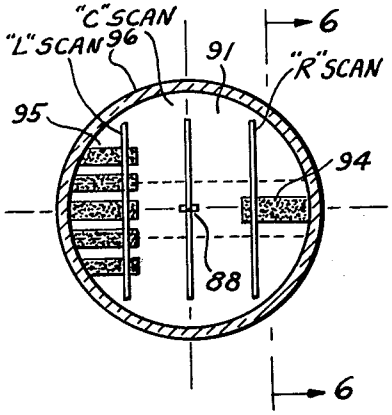

As can be seen in FIG. 5, masked photocathode electrode 91 includes patterned image non-translating areas adjacent image translating areas. More specifically, calibration masks 94, 95 are made by selectively depositing the usual photoresponsive material of photocathode electrode 91 onto image transmitting glass face 96 using a precision mask to form the calibration reference patterns. For example, calibration mask 94 may consist of a single 0.250 inch mask centered on the right side of photocathode electrode 91. Calibration mask 94 is referred to as "right mask" and may be used for on-line checking of bar gaging system calibration drift under RTMASK computer program described below. Calibration mask 95 may consist of five 0.100 inch wide masks spaced 0.100 inch apart on the left side of photocathode electrode 91. Calibration mask 95 is referred to as "left mask" and may be used for on-line checking of variations in bar gaging system optical and electronic nonlinearities under LFTMSK computer program described below. FIG. 6 is an enlarged cross-section taken through FIG. 5 to show the right mask 94 void in masked photocathode electrode 91, the void extending to glass face 96 of image dissector tube 90.

During all bar gaging system operations a single-axis bidirection sweep signal is applied to the Y-axis deflection coil and a fixed amount of current applied to the focus coil, both as described below. Under normal bar gaging operations, there is no current applied to the X-axis deflection coil. This causes the Y-axis scan to traverse the "C" scan, or central image translating area of photocathode electrode 91 as shown in FIG. 5. Whenever detector 55 determines there is no bar 10 in the camera field-of-view, computer 27 may select either right or left calibration mask 94, 95 by applying a positive or negative bias current to the X-axis deflection coil. This X-axis bias shifts the Y-axis scan of photocathode electrode 91 to corresponding "R" scan and "L" scan positions on opposite sides of "C" scan as shown in FIG. 5.

The X-axis bias has the effect of shifting the right calibration mask 94, or the left calibration mask 95, over electron aperture 92 in the image dissector tube 90. When the single Y-axis scan voltage is applied to the Y-axis deflection coil, the image of right or left calibration mask 94, 95 is effectively moved up and down across electron aperture 92 in the same manner as actual bar shadow 81 is moved at the "C" scan position.

It should be noted that the raw camera pulse on wire 34 has the same pulse width when either the right or left calibration mask 94, 95 is selected by computer 27 as occurs when a bar shadow 81 having a corresponding size and position is imaged on the central area of photocathode electrode 91. Hence, the masked photocathode electrode 91 affords an effective way of on-line checking of bar gaging system drift as well as changes in optical and electronic nonlinearities.

Camera Electronics

Typical camera electronics used in the present electro-optical bar gaging system is shown in FIG. 4 as first camera electronics 35. The second camera electronics 39 is a duplicate of first camera electronics 35 except for bidirectional sweep generator 97. Details of camera electronics 35 may best be understood by referring to FIGS. 4 and 7 through 13. All electronic components therein are conventional solid-state devices and include TTL logic elements where logic symbols indicate or imply their use.

Figure 7:
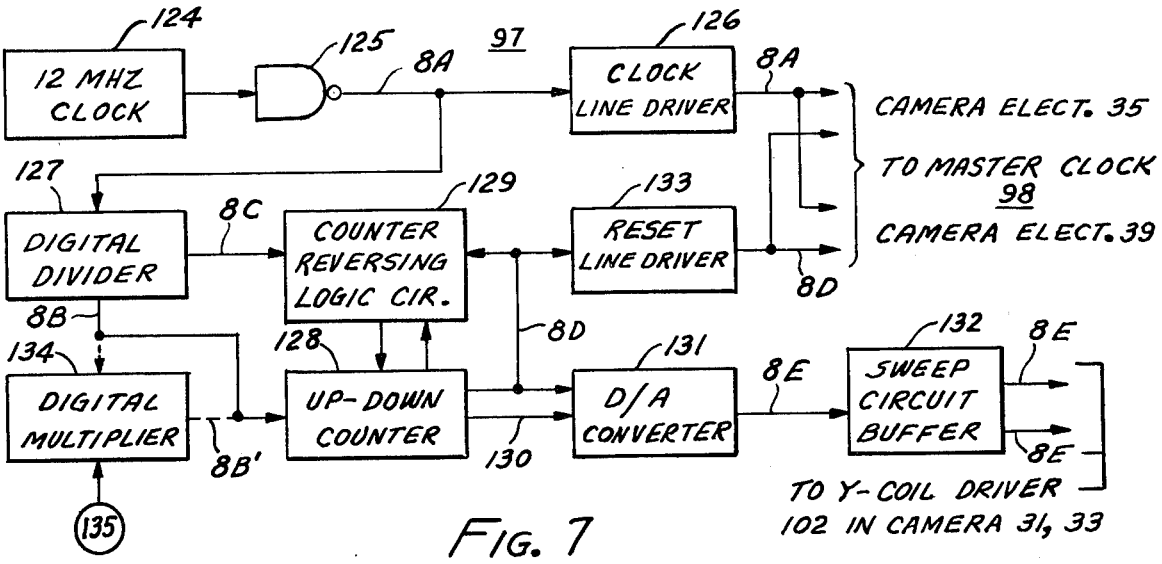
Figure 8:
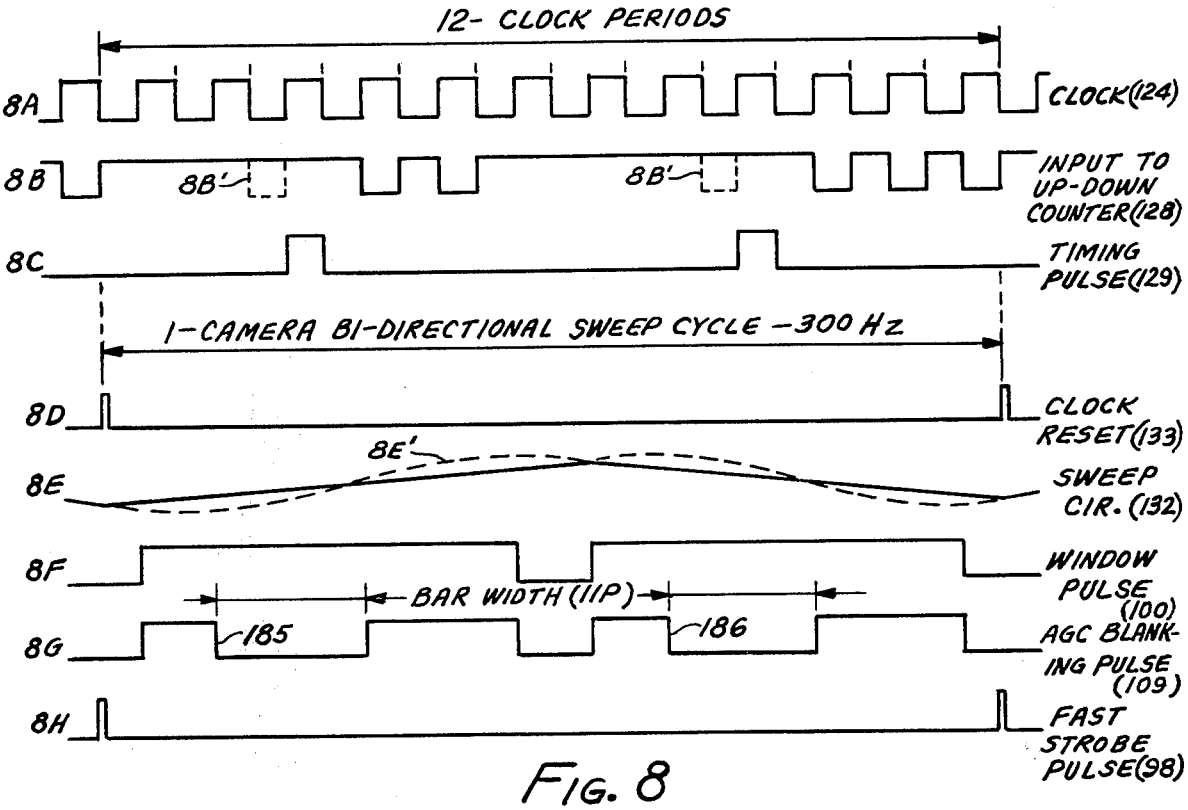

Generally, FIG. 4 shows bidirectional sweep generator 97 which is shared by both camera electronics 35, 39. Bidirectional sweep generator 97 is shown in FIGS. 7 and 8 and includes a 12 MHz. crystal oscillator 124 that provides a train of basic square wave clock pulses 8A for the entire electro-optical bar gaging system. Except for actual measurement of processed bar pulses, all digital operations are synchronized with clock pulse 8A in addition to bidirectional sweep signal 8E and sweep reset pulse 8D, the latter two being generated in sweep circuitry at approximately 300 Hz. Clock pulse 8A and bidirectional sweep signal 8E are synchronized by sweep reset pulse 8D every sweep cycle so that sweep signal 8E may be divided for any purpose by using the appropriate sub-multiple of clock pulse 8A. Clock pulse 8A is used for actual measurements, while pulses for other bar gaging system requirements are derived by dividing clock pulse 8A down all the way to the frequency of bidirectional sweep signal 8E. It should be noted that the absolute frequency value of clock pulse 8A and bidirectional sweep signal 8E is not critical because the bar gaging system is calibrated by actually placing standard size bars in each camera's field-of-view. However, sweep stability and sweep linearity are highly critical, since they directly affect the bar gaging system accuracy.

Master clock 98 shown in FIG. 4 receives a train of the 12 MHz. clock pulse 8A and the 300 Hz. sweep reset pulses 8D from bidirectional sweep generator 97. Master clock 98 includes buffers, digital counter, divider and logic circuits to supply all synchronized pulses used throughout camera electronics 35 for timing and measuring purposes. These include buffered 12 MHz. clock pulses 8A, buffered 300 Hz. sweep reset pulses 8D. Additional pulses generated within are a 300 Hz. fast strobe pulse 8H of short duration and a data ready pulse similar to pulse 8H but longer in duration. The data ready pulse is outputed on wire 99 and the other pulses carry their same identity to other circuits shown in FIG. 4.

Although there is a separate master clock 98 for each camera electronics 35 and 39, the same 12 MHz. train of clock pulses 8A and sweep reset pulses 8D serve both. Therefore, both master clocks 98 will always be in phase and have identical waveshapes when they are working correctly. This, of course, is a great aid in troubleshooting and servicing.

Window generator 100 receives the 12 MHz. clock pulse 8A from master clock 98 and, by means of gates and logic circuitry, generates window pulse 8F once every half of each bidirectional sweep cycle as shown in timing diagram FIG. 8. An inverted window pulse $\overline{8F}$ is also generated. Both window pulses 8F, $\overline{8F}$ are fed to other circuits described below. The width and timing of window pulses 8F, $\overline{8F}$ are determined by a control pulse on wire 101 fed from computer 27. Briefly, the width of window pulses 8F, $\overline{8F}$ is related to the time required for sweep signal 8E to sweep only the photocathode electrode 91, this being only a major portion of each up or down half of an entire 300 Hz. sweep cycle. For example, if the camera field-of-view is three inches and lens is four inches, as they are herein, then the three inch field-of-view is imaged down centrally to cover the entire face of photocathode electrode 91. Over-scanning of photocathode electrode 91 results in each up and down half of bidirectional sweep cycle 8E. This over-scanning is equally divided into two time intervals at the beginning and ending of each up and down half of bidirectional sweep cycle 8E. Thus, the sum of the durations of window pulse 8F (about 75%) and the overscan (about 25%) equal the duration of each up and down half of bidirectional sweep cycle 8E. As an alternative arrangement, window pulse width may be established manually by selective gating means not shown to replace the computer 27 control signal on wire 101.

During computer 27 programs RTMASK, LFTMSK, GAGRCL, CALIBR, and RTPROF described below, window generator 100 is programmed by way of wire 101 to modify the normal size and timing of window pulses 8F, $\overline{8F}$. During RTMASK, GAGRCL, and RTPROF, window pulse size and timing are set for the size and location of right calibration mask 94 in FIG. 5. During LFTMSK, five window pulses sized and timed for each size and location of left calibration mask 95 elements are generated one at a time to selectively cover the entire left calibration mask 95. During CALIBR, window pulse size and timing are selectively set for size and location of right calibration mask 94 and each of the five left calibration masks 95. The size of the normal window pulses 8F, $\overline{8F}$ is set by subroutine GAGEIN described below.

Still referring to FIG. 4, bidirectional sweep signal 8E is fed from bidirectional sweep generator 97 to Y-coil deflection driver 102 and into the vertical or Y-deflection coil in coil assembly 93. Constant current from focus coil current source 103 is fed to the focus coil in coil assembly 93. The magnitude of focus current is adjusted to focus all electrons emitted from each point on the photocathode surface 91 to a corresponding single point in the plane of the electron aperture 92.

X-coil driver 104 is connected to the horizontal or X-deflection coil in coil assembly 93. Under normal bar gaging operations there is no effective current applied to X-deflection coil. Therefore, the vertical single-scan of the Y-axis may occur as the "C" scan centrally in the image translating area of photocathode electrode 91 as shown in FIG. 5. During calibration checks by computer 27 under programs RTMASK and LFTMSK described below, positive and negative bias is applied alternately by control wires 105 and 106 from computer 27 to X-coil driver 104. This will cause the vertical single scan of the Y-axis to shift to either the "R" scan or "L" scan position corresponding to the right mask 94 or the left mask 95, depending on which bias control wire 105, 106 is energized. As an alternative arrangement, the positive and negative bias currents may be selected manually from a source not shown instead of computer 27 supplying them.

In summarizing the image dissector tube 90 scanning effected by coil assembly 93, only single-scan Y-axis, or vertical, bidirectional scanning is present at any time, this occurring continuously as an up and down sweep with no blanking. Under normal bar gaging operations there is no X-axis sweep, there being only a positive or negative bias applied to check gage system calibration when not measuring bar shadow 81.

As bar shadow 81 is scanned over the camera field-of-view, output current from image dissector tube 90 drops sharply as bar shadow 81 is met, then rises again when the bar shadow is past. This current change, together with electrical noise from the mill environment, is converted to a voltage, amplified in a preamplifier not shown in FIG. 4 and is the raw camera signal output from camera head 31 and appears on wire 34. That is, the raw camera signal at this point consists of a not too well defined bar pulse mixed with noise.

Image dissector tube 90 in camera head 31, operates in a self-balancing measuring loop 107 together with camera pulse processor 108, photomultiplier (P.M.) AGC circuit 109 which produces a variable control voltage on wire 110, and a voltage-controlled high voltage source 111 for P.M. section of tube 90. The drift section of tube 90 is also fed from a separate but stable drift section high voltage source 112.

Figure 9:
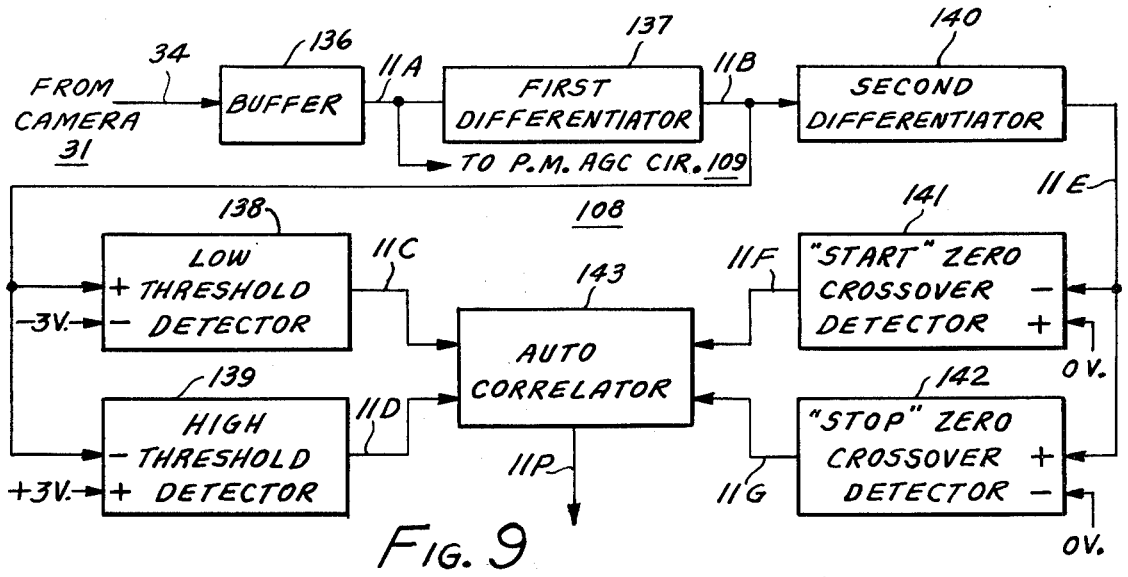
Figure 10:
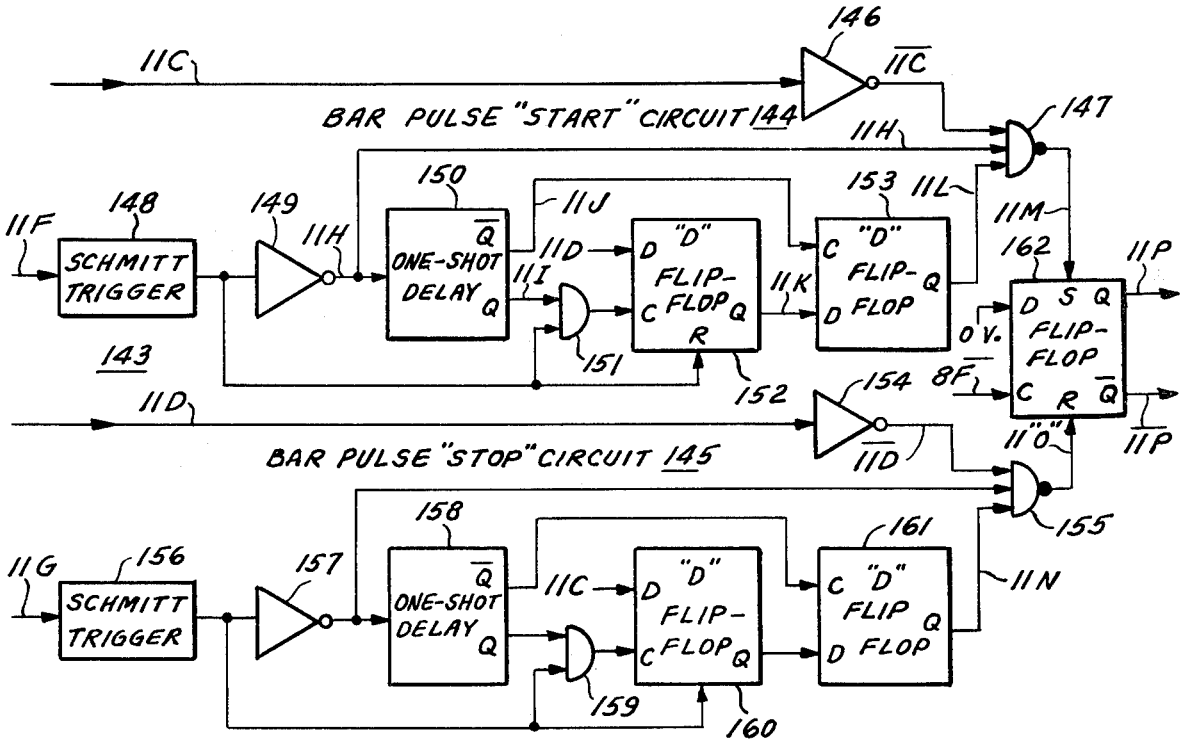

Camera pulse processor 108 is shown in FIGS. 9 and 10 with FIG. 11 illustrating the processor timing pulses. Included are a buffer, double differentiators, level detectors, zero-crossing detectors and an autocorrelator to remove noise from the raw camera signal and from differentiators. Signals so treated are combined with inverted window pulse 8F in processor logic to ensure that only bar pulses of proper amplitude and occurring at the correct time, will be passed outward for measurement purposes. This also prevents passage of bar pulses when the window is not open. Camera pulse processor 108 produces a buffered camera signal 11A and precision square wave bar pulses 11P, $\overline{11P}$ generated by an internal flip-flop. Bar pulse width varies proportional to bar shadow 81 and therefore proportional to bar dimension between bar edges 82 and 83.

Figure 12:
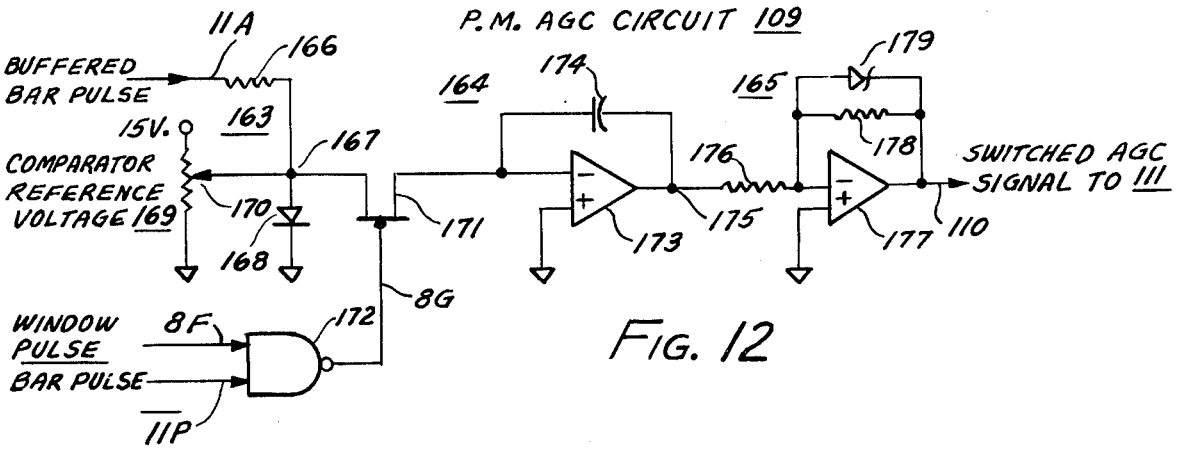

P.M. AGC circuit 109, which is shown in FIG. 12 and described below, receives buffered camera signal 11A and includes a comparator, a switched-integrator and an amplifier for producing a switched variable control voltage on wire 110. This control voltage is fed to P.M. section high voltage source 11 for the purpose of varying the gain of image dissector tube 90. The comparator establishes a reference gain level and an internal logic circuit generates an AGC blanking pulse 8G by combining window pulse 8F with inverted bar pulse $\overline{11P}$. The AGC blanking pulse effectively defined the time intervals when the camera signal should be sampled.

Action of the self-balancing measuring loop 107 will now be described. When there is no bar 10 in the gaging system, only light from box 30 is imaged on photocathode electrode 91. This causes the P.M. section in image dissector tube 90 to generate a current to flow on wire 34 which is proportional to the intensity of light from box 30. The gain of P.M. section in tube 90 is adjusted to a high level initially by the effective level of AGC control voltage produced by circuit 109. As light intensity deteriorates, or the image dissector tube 90 ages, AGC circuit 109 automatically compensates for this by adjusting the level of P.M. section high voltage from source 111 to vary the gain of the P.M. section of tube 90 and thereby maintain a constant amplitude of the camera signal.

When bar 10 is imposed in the path of light from box 30, AGC circuit 109 also functions to maintain a constant output amplitude from image dissector tube 90. Self-balancing measuring loop 107 thereby permits operation of image dissector tube 90 at a high sensitivity level while maintaining a reasonably high signal-to-noise ratio which is desirable for effective raw camera pulse processing.

Still referring to FIG. 4, precision bar pulses 11P, clock pulses 8A, clock reset pulses 8D and fast strobe pulses 8H are fed to display timing 113. Logic circuits therein are arranged to count clock pulses 8A for the duration of each of two bar pulses 11P occurring during a bidirectional sweep cycle, then dividing by two. Counting is synchronized by clock reset pulse 8D which occurs at the bottom of each bidirectional sweep signal 8E. Logic circuits are strobed by fast strobe pulse 8H in preparation for a binary bar size signal being outputed on wire 114 for display purposes. In order to avoid display flicker, the binary bar size signals are averaged over a predetermined number of bidirectional sweeps, such as 4, 32, 512 sweeps, by means not shown.

Binary bar size signals are fed over wire 114 to digital indicator 115. This device includes integrated counter-decoder-display modules calibrated to display in decimal digits the uncorrected size of bar 10 obtained anywhere in the camera field-of-view. The term uncorrected bar size is applied to bar dimensions at this part of the bar gaging system because no correction for optical and/or electronic nonlinearities, bar temperature and bar composition has been made.

Computer 27 does make corrections to the uncorrected bar size signals and feeds a corrected binary bar size signal over wire 116 to corrected bar size digital indicator 117. This digital indicator is structured the same as digital indicator 115. Both bar size indicators 115, 117 have visual displays adapted to be synchronized and updated every 512 sweeps under control of clock reset pulses 8D and fast strobe pulses 8H. It is to be noted that the difference between readings on bar size indicators 115, 117 signifies to a bar gage operator, and to a rolling mill operator, that (a) the correction features of the bar gaging system are working as required, and (b) that the rolling mill is rolling aim size product.

Computer correction of bar pulses 11P is based upon accurately determining not only bar size but also bar centerline position in the camera field-of-view with respect to the optical axis of camera head 31. To do this, bar pulses 11P, clock pulses 8A, clock reset pulses 8D and fast strobe pulses are fed to bar size and position accumulator 118 which is illustrated in block diagram FIG. 13 and the timing of pulses is shown in FIG. 8. Two separate counter and latch circuits, each under control of a common control gate, provide binary bar size output signals on wire 119 and binary bar centerline position output signals on wire 120. The binary bar size signals on wire 119 are developed similarly to the uncorrected bar size signals associated with display timing circuits 113 described above. The binary bar position signals permit corrections to be made of the bar size signals to an accuracy of 1 part in 256 of the camera field-of-view.

Transfer of all data between the computer 27 and other parts of the bar gaging system is carried out by gage-computer data transfer logic circuit 121. Logic circuit 121 receives a command signal over wire 122 which is indicative of computer 27 being of such state as to permit data transfer. Command signal 122 is logically combined with the "data ready" pulse on wire 99, which is generated by master clock 98 as described above. Their combined presence causes logic circuit 121 to generate a "request to send" signal on wire 123 and synchronize the timing of the gaging system with computer 27.

Bidirectional Sweep Generator

Reference will now to made to bidirectional sweep generator 97 shown in FIG. 7 block diagram and FIG. 8 timing diagram. In order to make bar size measurements to a system accuracy of quarter commercial tolerance in a three inch field-of-view, the bidirectional sweep of the Y-axis in image dissector tube 90 must be extremely linear and repeatable. Conventional analog sweep circuits are generally difficult to design and maintain to the level of linearity required herein. But if a sacrifice in system accuracy is acceptable for some gaging systems, then analog sweep circuits may be considered. However, to meet the high accuracy requirements of the present gaging system, the bidirectional sweep of the Y-axis is generated by digital means with a crystal oscillator for a time base, digital counters, and a thirteenbit digital-to-analog converter that develops the actual bidirectional sweep waveform 8E. Digital provisions are made to modify sweep waveform 8E as described below.

The time base provided is a highly stable 12 MHz. crystal clock oscillator 124 having a square wave output. Buffer 125 prevents nonuniform loading of time base 124 during sweep operations and feeds a train of clock pulses 8A to differential line driver 126. Output from driver 126 is fed as clock pulse 8A to master clock 98 in each camera electronics 35, 39. Buffer 125 output also feeds clock pulses 8A to digital divider 127 which has counting and logic devices that generate waveforms 8B and 8C. Waveform 8B is an input to up-down counter 128, a 13-bit binary reversing counter. Waveform 8B is 5/12 of the basic clock oscillator frequency, or 5 MHz. Waveform 8C is a timing pulse fed to counter reversing logic circuit 129 and occurs twice in a 12 clock cycle period. Waveform 8B uses five pulse locations in a period of 12 clock cycles and waveform 8C uses two locations. This leaves five unused pulse locations in a period of 12 clock cycles.

When the counter reversing logic circuit 129 senses that up-down counter 128 has reached a full count of all 1's, it gates a count-down enable signal back to counter 128. The timing of the count-down enable occurs at the first timing pulse 8C after the full count is reached. When counter 128 senses the count-down enable signal, it begins down counting on the next clock pulse 8B. When the counter reversing logic circuit 129 senses all 0's in counter 128, it generates a count-up enable signal on the next occurrence of timing pulse 8C. Counter 128 will begin counting up on the next clock pulse 8B.

Up-down counter 128 has a 13-bit binary output which is fed over wire 130 to 13-bit binary digital-to-analog converter 131. Digital-to-analog (D/A) converter 131 tracks counter 128 and produces an extremely linear analog bidirectional sweep signal 8E. This signal is buffered in sweep circuit buffer 132, to prevent overloading of D/A converter 131, and then fed as sweep signal 8E to Y-coil driver 102 in camera electronics 35, 39.

When up-down counter 128 reaches the last down bit, it generates reset pulse 8D which resets logic circuit 129 and D/A converter 131. Differential line driver 133 feeds the reset signal to master clock 98 in camera electronics 35, 39.

As mentioned above, there are five unused pulse locations in a period of 12 clock cycles. These may be used to provide an accurate nonlinear modification to the extremely linear sweep signal 8E by incorporating digital multiplier 134 in series between digital divider 127 and up-down counter 128 as shown by dotted lines in FIG. 7. Digital multiplier 134 will receive waveform 8B instead of up-down counter 128 and by means of a suitable multiplier generate modified waveform 8B'. Up-down counter 128 will receive modified waveform 8B' and, together with the timing pulse 8C influence on the command signal, will alter the total up-count or total down-count depending on the specific value of the multiplier. This modification will still produce a sawtooth sweep with slightly curved sides as indicated by modified sweep signal 8E'.

The multiplier for digital multiplier 134 is fed over wire 135 and may originate at computer 27. Alternatively, the digital multiplier may be set by manual means not shown. Regardless of its source the multiplier may be used to make sweep corrections for overcoming optical and/or electronic errors for which no other correction provisions have been made herein.

Camera Pulse Processor

The camera pulse processor 108 is shown in FIG. 9, 10 block diagrams and FIG. 11 timing diagram. Camera pulse processor 108 converts the raw camera pulse on lead 34 into a precise bar output pulse on lead 11P that has a width with well-defined edges that accurately represents the dimensional relationship between bar edges 82 and 83. Because of the differentiator, autocorrelator and other design features described below, camera pulse processor 108 is very well suited to process the raw camera pulses at the camera scanning rate of up to about 300 Hz., yet eliminate the effects of camera signal and differentiator noises.

Turning now to FIG. 9, camera pulse processor 108 is shown in block diagram form where alpha designations refer to FIG. 11 waveforms. The raw camera signal from lead 34 is buffered and amplified by buffer 136 to produce signal 11A. The 11A signal is differentiated by first differentiator 137 which has an output 11B. The first differential signal 11B is fed to low and high threshold detectors 138, 139 which have respective outputs 11C and 11D. Threshold detectors 138, 139 produce output signals when their plus (+) input has a lower voltage than their minus (−) input.

The first differentiated signal 11B is differentiated again in second differentiator 140 to produce output 11E. The second differentiated signal 11E is fed to start and stop zero cross-over detectors 141, 142. These detectors are set up to trigger on positive and negative zero crossing transitions greater than 1 mv., thereby producing bar pulse start zero and stop zero outputs 11F and 11G, respectively. The bar pulse start zero and stop zero outputs 11F and 11G, together with low and high threshold signals 11C and 11D, are fed to fixed-delay autocorrelator 143. Bar pulse start zero and stop zero signals 11F and 11G are processed internally in respective autocorrelator circuits as will be described below. Low and high threshold signals 11C and 11D define narrow windows during which the bar pulse start and stop signals 11M and 11"O" are triggered, thereby establishing precise timing for the leading and trailing edges of bar output pulse 11P.

As mentioned above, electronic camera 31 signal on lead 34 may also contain electrical noise. This may be high frequency, low amplitude noise which is frequently coupled magnetically into the electronic camera signal from high-current, SCR-fired, mill drive motor controllers located near electronic camera 31. Without fixed-delay autocorrelator 143, this noise will cause false triggering of bar output pulse 11P. For example, when a transition of camera signal 11A produces a first differentiated voltage 11B lower than a −3 volt threshold of detector 138, a low threshold signal 11C would be enabled which will allow start zero crossing detector 141 to generate a bar output pulse start trigger signal. Since the gain of differentiators 137 and 140 increases with input frequency, a low-amplitude, high-frequency noise spike may produce a first differentiator 137 output signal 11B lower than the −3 volt threshold of detector 138. This is precisely what will happen in rolling mill environments without enhancement of bar pulse generating circuitry.

For this reason, the fixed-delay autocorrelator 143 included in raw camera pulse processor 108 actually includes separate autocorrelator bar pulse start and stop circuits 144 and 145, respectively, as shown in FIG. 10. Bar pulse start and stop circuits 144 and 145 are provided to discriminate between second differentiated signals 11E generated by high frequency noise from those generated by valid bar pulse signals. During the falling edge of camera signal 11A, the second differentiated signal 11E rises to a positive voltage for about 10 microseconds before swinging to a negative voltage. For illustrative reasons, this detail is not shown to scale in FIG. 11 signal 11E waveform. Zero crossing detection of the second differentiated signal 11E by detectors 141 and 142 is the trigger point for the start and stop bar pulses of signals 11M and 11"O", thereby establishing the leading and trailing edges of bar output pulse 11P.

Autocorrelator bar start and stop circuits 144 and 145 take advantage of the respective 10 microsecond rise and fall period of second differentiated signal 11E. This is done by generating autocorrelator enable start and stop signals 11L and 11N as described below. Autocorrelator start enable signal 11L is generated when second differentiated signal 11E is continuously positive for at least one-half of this 10 microsecond period before swinging negative. Similarly, autocorrelator stop enable signal 11N is generated when second differentiated signal 11E is continuously negative for at least one-half of the 10 microsecond period before swinging positive.

Autocorrelator start and stop enable signals 11L and 11N are logically "anded" in circuits 144 and 145 with respective low threshold signals 11C and 11D and bar pulse start and stop zero crossing signals 11F and 11G to generate bar pulse start and stop signals 11M and 11"O". These signals cause the precise generation of bar output pulse 11P. It will now be apparent that high frequency noise which causes respective positive and negative excursions of the second differentiated signal 11E of less than 5 microseconds duration will not generate autocorrelator enable start and stop signals 11L and 11N, thus preventing triggering of bar output pulse 11P.

Still referring to FIG. 10, operation of autocorrelator bar pulse start circuit 144 will now be described. Operation of autocorrelator bar pulse stop circuit 145 is identical to circuit 144 with the exception that it responds to a second differentiated signal 11E which is continuously negative for 10 microseconds before swinging positive. Both circuits 144 and 145 employ conventional logic devices.

Low threshold signal 11C is inverted in amplifier 146 and fed to one of three inputs of NAND gate 147, the latter providing the bar pulse start signal 11M under proper logic conditions.

Bar pulse start zero crossing signal 11F is conditioned in Schmitt trigger 148 and inverted in amplifier 149, thereby producing trigger signal 11H which is fed to NAND gate 147 and one-shot delay device 150. A negative going transition of signal 11H triggers one-shot delay device 150 which produces a 5 microsecond logic "1" pulse 11I at Q output, and a 5 microsecond logic "0" pulse 11J at $\overline{Q}$ output. Pulse 11I is fed to one of two inputs to AND gate 151. Schmitt trigger 148 output is also fed to the other input of AND gate 151 as well as to the reset input of flip-flop device 152. Pulse 11J is fed to the clock input of flip-flop device 153. The high threshold signal 11D is wired to the data input of flip-flop 152 to enable the autocorrelator start circuit 144 during the falling edge of camera signal 11A and disable this circuit during the rising edge of signal 11A.

If signal 11H is going negative, the input to inverter 149 is going positive. This positive going action removes the reset condition on flip-flop 152 and puts a logic "1" on one input of AND gate 151. Gate 151 will now pass pulse 11I to the clock input of flip-flop 152, thus forcing a logic "1" pulse 11K at Q output. After a 5 microsecond delay, one-shot delay 150 will time out, thereby causing output $\overline{Q}$ to change state and go to a logic "1" pulse 11J. This action also clocks the input of flip-flop device 153 which has its data input fed by signal 11K from the Q output flip-flop device 152.

If signal 11K is a logic "1", flip-flop 153 output Q will be set, thereby producing start enable signal 11L. Signal 11L, which was generated from signal 11H, is logically combined with signals 11H and $\overline{\mathbf{11C}}$, the inverted low threshold signal, in NAND gate 147 to produce the bar pulse start signal 11M. Thus, it will now be readily recognizable that a bar pulse signal is delayed, then combined with itself to perform a fixed-delay autocorrelation function.

If during the 5 microsecond period controlled by one-shot delay device 150, the output of Schmitt trigger 148 goes low, indicating that the second differentiated signal 11E is too narrow to be a valid bar signal, the reset of flip-flop 152 goes low and forces signal 11K to a logic "0". When one-shot delay device 150 times out after 5 microseconds, signal 11J will clock flip-flop 153 with its data input in a low state. This will force the Q output of flip-flop 153 to a logic "0" and prevents any further processing of the bar signal.

One-shot delay device 150 is retriggerable so that it may accommodate consecutive triggering pulses 11H. If multiple trigger pulses having a short duration of less than 5 microseconds trigger one-shot delay device 150, Q output signal I will stay high for all pulses and finally time-out 5 microseconds after the last triggering pulse. AND gate 151 allows flip-flop 152 to re-clock itself on each pulse. Since the output of one-shot delay device 150 stays high continuously during these multiple triggering pulses, the combining of signal 11I with the Schmitt triggering pulse in AND gate 151 guarantees that the clock line on flip-flop 152 will undergo a logic transition from "0" to "1" for each triggering pulse.

As noted above, the bar pulse stop circuit 145 was identical with circuit 144, the exception being that stop circuit 145 is triggered by a continuous negative going second differentiated signal 11E before swing positive. For this reason, it will be apparent to those skilled in the art that inverter 154, NAND gate 155, Schmitt trigger 156, inverter 157, one-shot delay 158, AND gate 159, flip-flop 160, and flip-flop 161 devices have construction and operating features the same as their counterpart in circuit 144. Therefore, it is felt an explanation of these devices is unnecessary to show how NAND gate 155 produces the bar pulse stop signal 11"O".

Having eliminated both the electrical noise in the raw camera bar pulse signal and the noise produced by differentiators 137 and 140, the bar pulse start and stop signals 11M and 11"O" produced in respective circuits 144 and 145 now precisely define the timing of bar pulse leading and trailing edges in relation to bar edges 82 and 83. Therefore, signals 11M and 11"O" are fed respectively to the set and reset inputs of flip-flop device 162. An inverted window pulse $\overline{\mathbf{8F}}$ shown in FIG. 8 and fed from window generator 100 is fed to the clock input of flip-flop device 162. The data input for flip-flop 162 is tied to 0 volts. This will enable device 162 to produce the bar output pulse only during the presence of a window pulse 8F. The width and timing of the window pulse is different for bar gaging operations than in calibration checking operations as explained above.

During bar gaging operations the Q output of device 162 provides a precise bar output pulse 11P whose leading and trailing edges are free of noise and accurately define the lateral dimension of bar 10. During calibration checking operations where computer 27 selects RTMASK or LFTMSK programs, bar pulse 11P will accurately define right and left mask 94 and 95 dimensions.

P.M. AGC Circuit

The AGC circuit 109 for the photomultiplier (P.M.) section of image dissector tube 90 is shown in FIG. 12. P.M. AGC circuit 109, which is an essential portion of self-balancing measuring loop 107, includes comparator 163, switched integrator 164 and driver amplifier 165. Amplifier 165 drives P.M. section high voltage source 111 with a switched variable control voltage by way of wire 110. The switched variable control voltage acts as an automatic gain control for tube 90. This is done by varying P.M. section high voltage source 111 to maintain anode current in tube 90 at a constant reference value.

Buffered camera signal 11A is applied to one input of comparator 163 through summing resistor 166 to summing junction 167. Summing junction 167 is limited to positive-going inputs by diode 168. A comparator reference voltage from source 169 is adjusted at potentiometer slider 170 for the purpose of offsetting the bar pulse and establishing a nominal value of the switched control signal that will ultimately set high voltage source 111 at a nominal gain-producing value.

The buffered and offset camera signal at summing junction 167 is connected to electronic switch 171 in switched integrator 164. The window pulse 8F and the inverted bar pulse $\overline{\mathbf{11P}}$ are logically combined in AND gate 172 to produce AGC blanking pulse 8G shown in FIG. 8. When a window pulse is present and a bar pulse is absent, the AGC blanking pulse 8G causes electronic switch 171 to conduct current to integrator amplifier 173 and to charge integrating capacitor 174. When both window pulse 8F and bar pulse 11P are present, electronic switch 171 opens and allows integrator output at junction 175 to maintain the nominal value input to driver amplifier 165.

Driver amplifier 165 consists of summing resistor 176 connected at one end to integrator output junction 175 and the other end to the input of operational amplifier 177. Feedback resistor 178 controls the gain of driver amplifier 165. Zener diode 179 limits the gain of driver amplifier 165 so as not to produce too high a switched control voltage on wire 110 that would overdrive high voltage power supply 111. In summary, when an AGC blanking pulse 8G is absent, the buffered camera signal 11A is conducted through AGC circuit 109 and varies the P.M. section high voltage supply 111. During the presence of an AGC blanking pulse, 11A is inhibited and the output of P.M. AGC circuit 109 maintained at a constant reference value determined by the charge on capacitor 174 in integrator 164.

Bar Size and Position Accumulator

Figure 13:
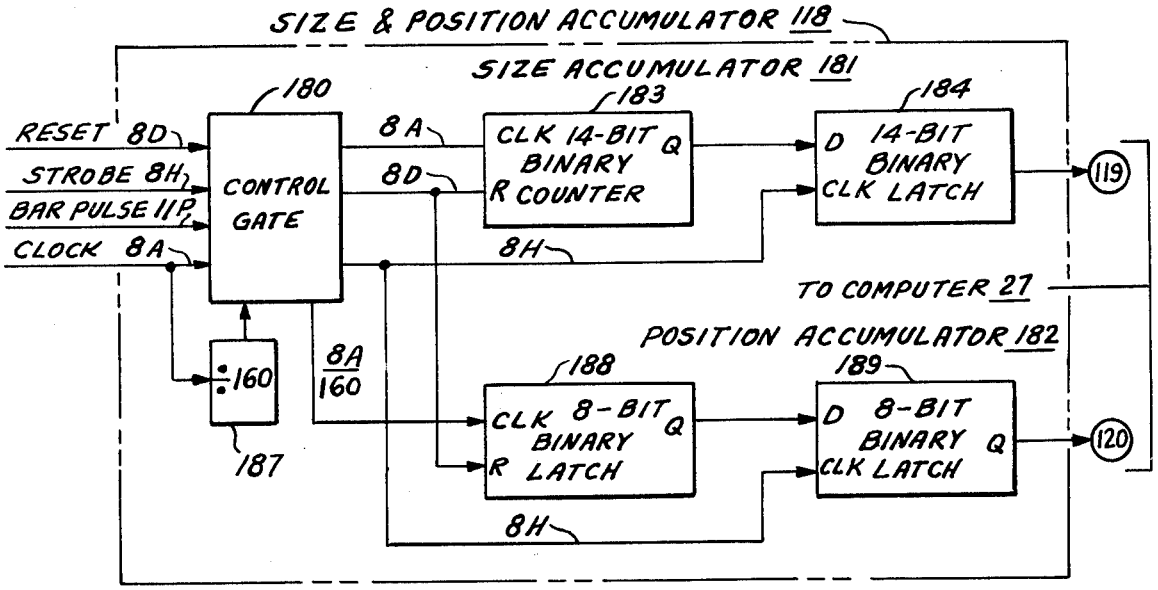

The size and position accumulator 118 is shown in FIG. 13 with reference being made to FIGS. 8 and 11 timing diagrams. In the present bar gaging system, uncorrected digital bar size and bar position data fed to computer 27 are developed similar to, but separately and independently from, uncorrected digital bar size data displayed on indicator 115. Accumulator 118 is provided with control gate 180 which assimilates bar pulse 11P, clock pulse 8A, clock reset pulse 8D and fast strobe pulse 8H in bar size accumulator circuit 181 and bar position accumulator circuit 182. Circuit 182 determines the bar centerline anywhere in the camera field-of-view. Both circuits 181, 182 are synchronized by clock reset pulse 8D and both are strobed by fast strobe pulse 8H every complete sweep cycle.

Control gate 180 detects the leading and trailing edges of each bar pulse 11P and divides by two the number of clock pulses 8A occurring during the two bar pulses present during the up and down halves of the sweep cycle. Control gate 180 directs these clock pulses to the clock input of 14-bit binary counter 183 in bar size circuit 181 where a count of two bar pulses divided by two is registered. At the end of a first sweep cycle this size pulse count in counter 183 is transferred into the data input of 14-bit binary latch 184, presuming a previous application of the fast strobe pulse 8H has been applied to the latch's clock input. At the beginning of the second cycle, counter 183 is cleared by clock reset pulse 8D and is ready to receive a new pulse count.

Fourteen-bit digital data, representing uncorrected bar size between bar edges 82 and 83 from the first sweep cycle, is stored in latch 184 for a second sweep cycle. During the second sweep cycle this data is transferred over cable 119 to computer 27 for correction under computer program CMPNST described below. At the end of the second sweep cycle, counter 183 data is strobed into latch 184 by pulse 8H, thus repeating the cycle. The counting of bar size pulses is always one sweep cycle ahead of the latched bar size data in bar size accumulator circuit 181.

Control gate 180 also detects the first 11P bar pulse edge at 185 during the up-half of a sweep cycle and the first 11P bar pulse edge at 186 during the down-half of the same sweep cycle is shown in waveform 8G in FIG. 8. Control gate 180 determines the sweep time between pulse 11P leading edges 185 and 186 and divides this time by two, thereby establishing what will be referred to as the bar centerline position sweep time. In addition, control gate 180 also includes a bar position time base developed by dividing the train of 12 MHz. clock pulses 8A by a factor of 160 in divider 187, thereby generating 8A/160 clock pulses. 8A/160 clock pulses are directed to the clock input of 8-bit binary counter 188 in bar position accumulator 182 for the duration of the bar centerline position sweep time. The count registered in counter 188 represents centerline position of bar 10 located anywhere in the camera field-of-view. This bar centerline position was determined totally independently of the bar size measurement made in size accumulator 181 or elsewhere.

At the end of a first sweep cycle the bar centerline position count in counter 188 is transferred into the data input of 8-bit binary latch 189, presuming a previous application of fast strobe pulse 8H has been applied to the latch's clock input. At the beginning of the second cycle, counter 188 is cleared by clock pulse 8D and is ready to receive a new bar centerline position pulse count.

Eight-bit data representing bar centerline position in the camera field-of-view is stored in latch 189 for a second sweep cycle. During the second sweep cycle this data is transferred over cable 120 to computer 27 for use in making optical error corrections to the bar size data in accumulator 181 under computer program CMPNST described below. At the end of the second sweep cycle latch, counter 188 data is strobed into latch 189 by pulse 8H, thus repeating the cycle. Counting of bar centerline pulses is always one sweep cycle ahead of the latched data in bar position accumulator 182.

Bar position accumulator 182 divides one-half of a sweep cycle into 256 increments at 0.016 inch per increment. The optical centerline of camera head 31, 33 is at the 128th increment. The incremental total represents 4.096 inches of Y-axis sweep applied to the Y-axis deflection coil with a usable field-of-view of approximately three inches. The unusable field-of-view is 1.096 inches, the distance the Y-axis deflection coil sweeps off the top and bottom edges of photocathode electrode 91.

Computer

Figure 14:
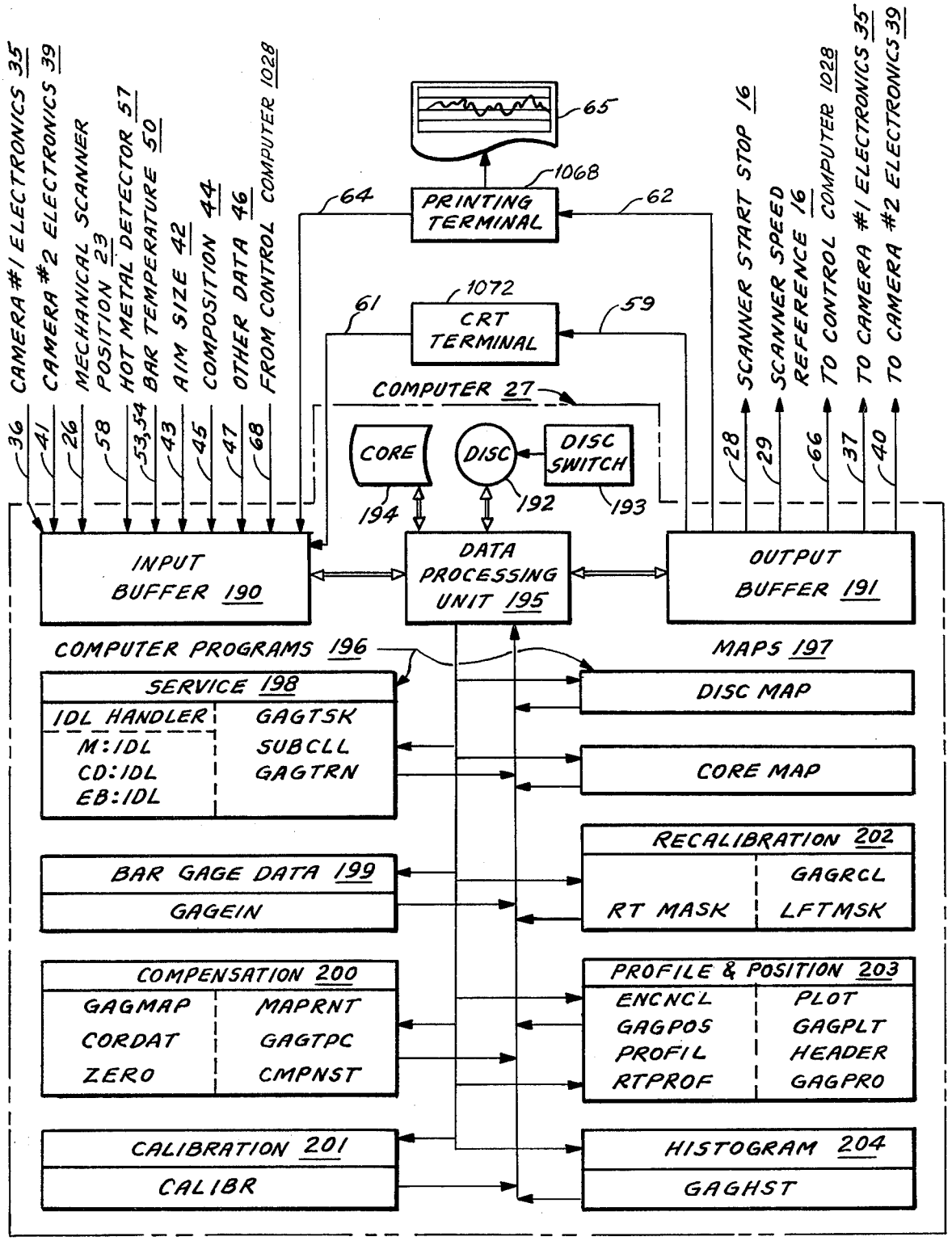

A block diagram of a computer 27 suitable for use with the electro-optical bar gage 1051 is illustrated in FIG. 14. Computer 27 is a digital system programmed to perform the various functions described below. A commercially available mini-computer may be used, or if desired, computer 27 may be shared in overall rolling mill control computer installation. Computer 27 is exemplified herein as a Westinghouse Electric Co. model W-2500 with an operating system for accommodating various levels of tasks as noted below:

Computer 27 is provided with conventional main components including input buffer 190, output buffer 191, disc storage 192, disc switches 193, core storage 194, all communicating by various channels with data processing unit 195. Computer 27 operations are controlled sequentially according to off-line and on-line computer programs 196. These comprise: computer maps 197, service programs 198, bar gage data program 199, compensation programs 200, calibration program 201, recalibration programs 202, profile and position programs 203, and histogram programs 204, all covered in FIGS. 15–43 described below.

All communications with the bar gaging system computer 27 from external sources are by way of input buffer 190 which includes means for converting input analog and digital signals to digital form. These include signals fed by wires or cables into the computer as follows: first camera electronics 35 on cable 36; second camera electronics 39 on cable 41; mechanical scanner position 23 on wire 26, hot metal detector 57 on wire 58; bar temperature 50 on cables 53, 54; bar aim size 42 on wire 43; bar composition 44 on wire 45; other data 46 on cable 47; control computer 1028 on cable 68; CRT terminal 1072 on cable 61; and printing terminal 1068 on cable 64.

All communications with bar gaging system computer 27 to external sources are by way of output buffer 191 which also includes means for converting output signals to digital and analog form. These include signals fed by wires or cables from the computer as follows: scanner start-stop 16 on cable 28; scanner speed reference 16 on cable 29, control computer 1028 on cable 66; first camera electronics 35 on cable 37; and second camera electronics 39 on cable 40.

Individual wires in signal cables have been used through the drawings and these have been cables according to their source and function as described above.

CRT terminal 1072 includes a keyboard for operator interaction with computer 27.

Printing terminal 1068 includes a keyboard for operator interaction with computer 27. Terminal 1068 computer printout 65 includes a plot of bar profile deviation shown in FIG. 3, as well as tabular data in various figures listed below.

Generally, it is permissible for both terminals 1072 and 1068 to plot the same data. All interactions from either keyboard are by way of program mnemonics listed, for example, in FIG. 21B.

Disc switches 193 include switches designated "switch 10" and "switch 12" in the programs below. These switches must be turned to "WRITE ENABLE" to update programs or data on the disc.

Computer Programs

The following table lists flow charts of individual and groups of programs associated with computer programs 196 used herein.

| FIG. NO. | FLOW CHART IDENTIFICATION | USED OFF-LINE | USED ON-LINE |
|---|---|---|---|
| | MAPS (197) | | |
| 15 | DISC MAP | X | |
| 16A,B | CORE MAP | X | X |
| | SERVICE PROGRAMS (198) | | |
| | IDL HANDLER | | |
| 17A-E | M:IDL | X | X |
| 18 | CD:IDL | X | X |
| 19 | EB:IDL | X | X |
| 20A,B | GAGTSK | X | |
| 21A,B | SUBCLL | X | |
| 22 | GAGTRN | X | |
| | BAR GAGE DATA PROGRAM (199) | | |
| 23A-D | GAGEIN | X | X |
| | COMPENSATION PROGRAMS (200) | | |
| 24A-C | GAGMAP | X | |
| 25 | CORDAT | X | |
| 26 | ZERO | X | |
| 27A-C | MAPRNT | X | |
| 28 | GAGTPC | X | X |
| 29 | CMPNST | X | X |
| | CALIBRATION PROGRAM (201) | | |
| 30A-F | CALIBR | X | |
| | RECALIBRATION PROGRAMS (202) | | |
| 31A-D | RTMASK | X | |
| 32A-C | GAGRCL | | X |
| 33A-E | LFTMSK | X | |
| | PROFILE & POSITION PROGRAMS (203) | | |
| 34 | ENCNGL | X | X |
| 35 | GAGPOS | X | X |
| 36A-D | PROFIL | X | |
| 37A-E | RTPROF | X | |
| 38A-B | PLOT | X | |
| 39A-B | GAGPLT | | X |
| 40 | HEADER | X | X |
| 41A-C | GAGPRO | | X |
| | HISTOGRAM PROGRAM (204) | | |
| 42A-D | GAGHST | X | X |
| 43 | PROFILE & HISTOGRAM INTERFACE WITH CONTROL SYSTEM | X | X |

MAPS (197)

Figure 15:
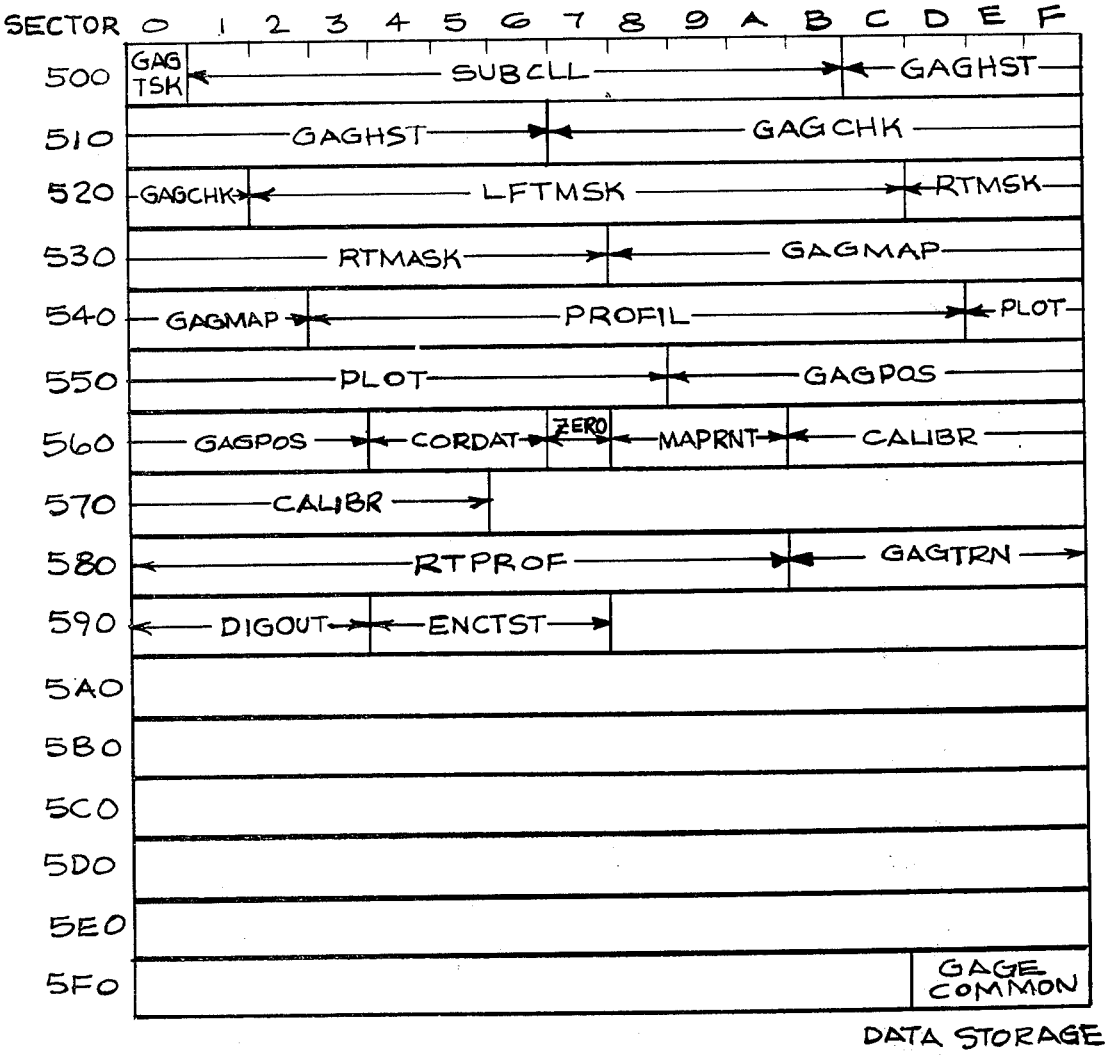
Figure 17A:
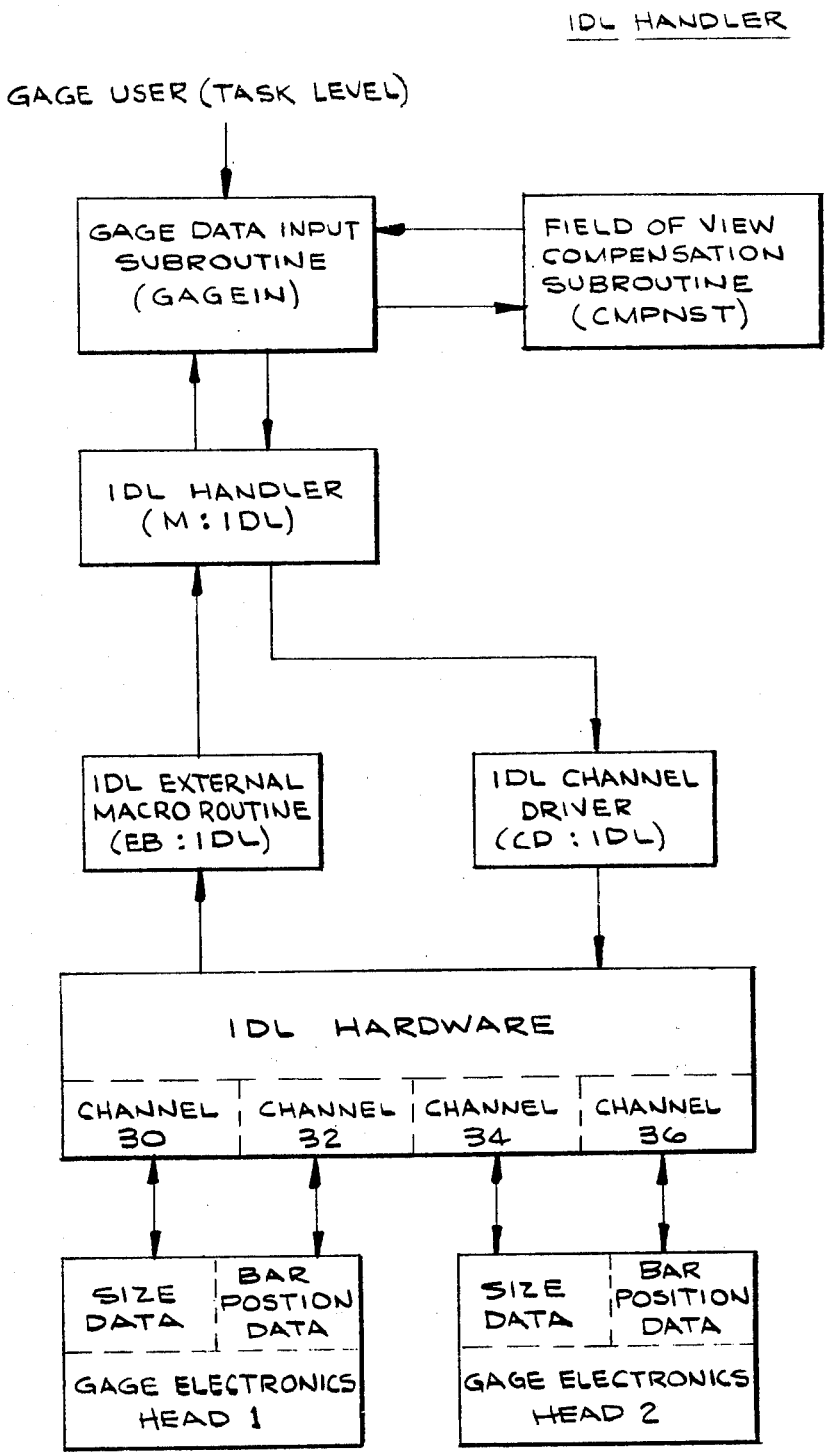
Figure 17B:
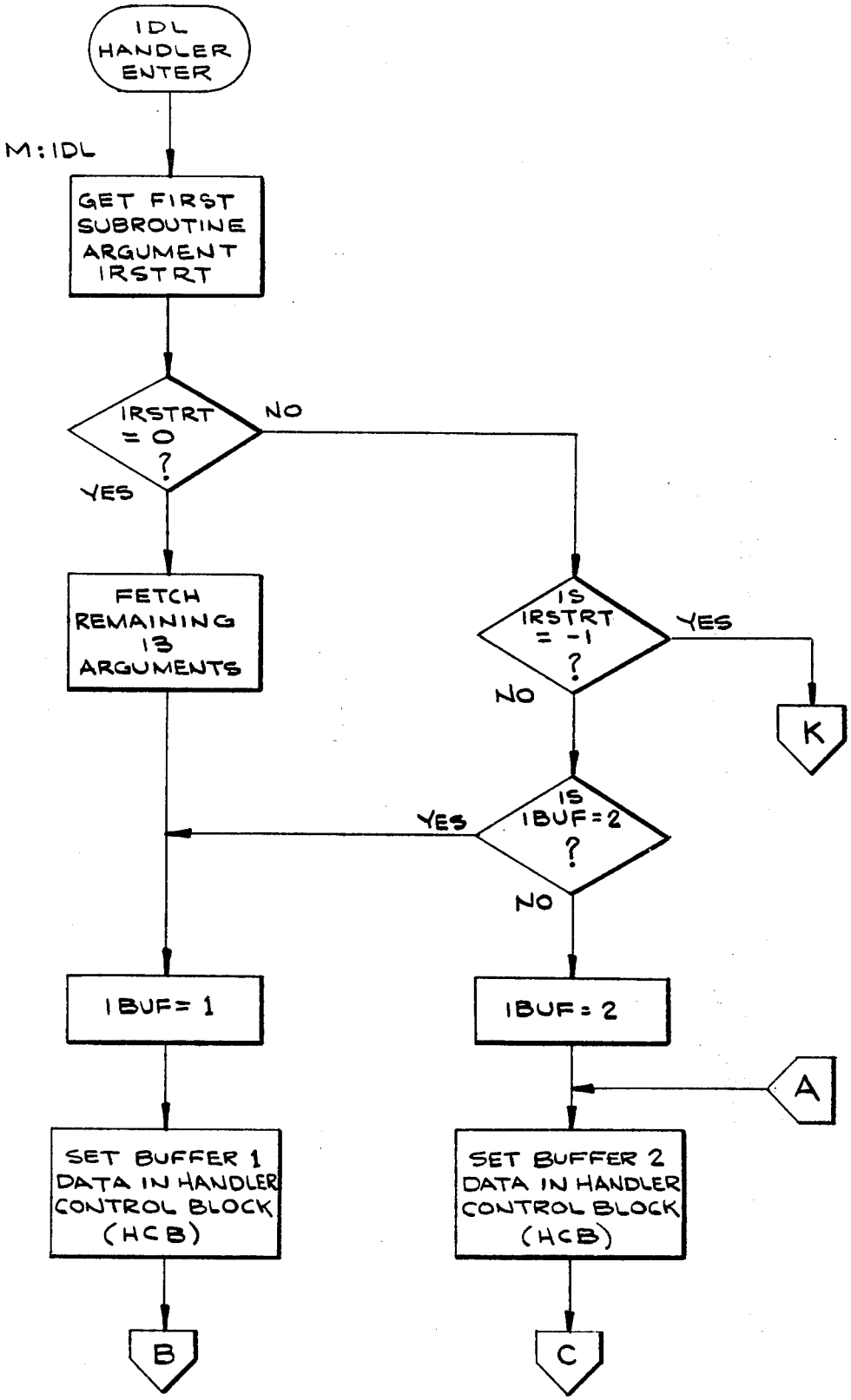
Figure 17C:
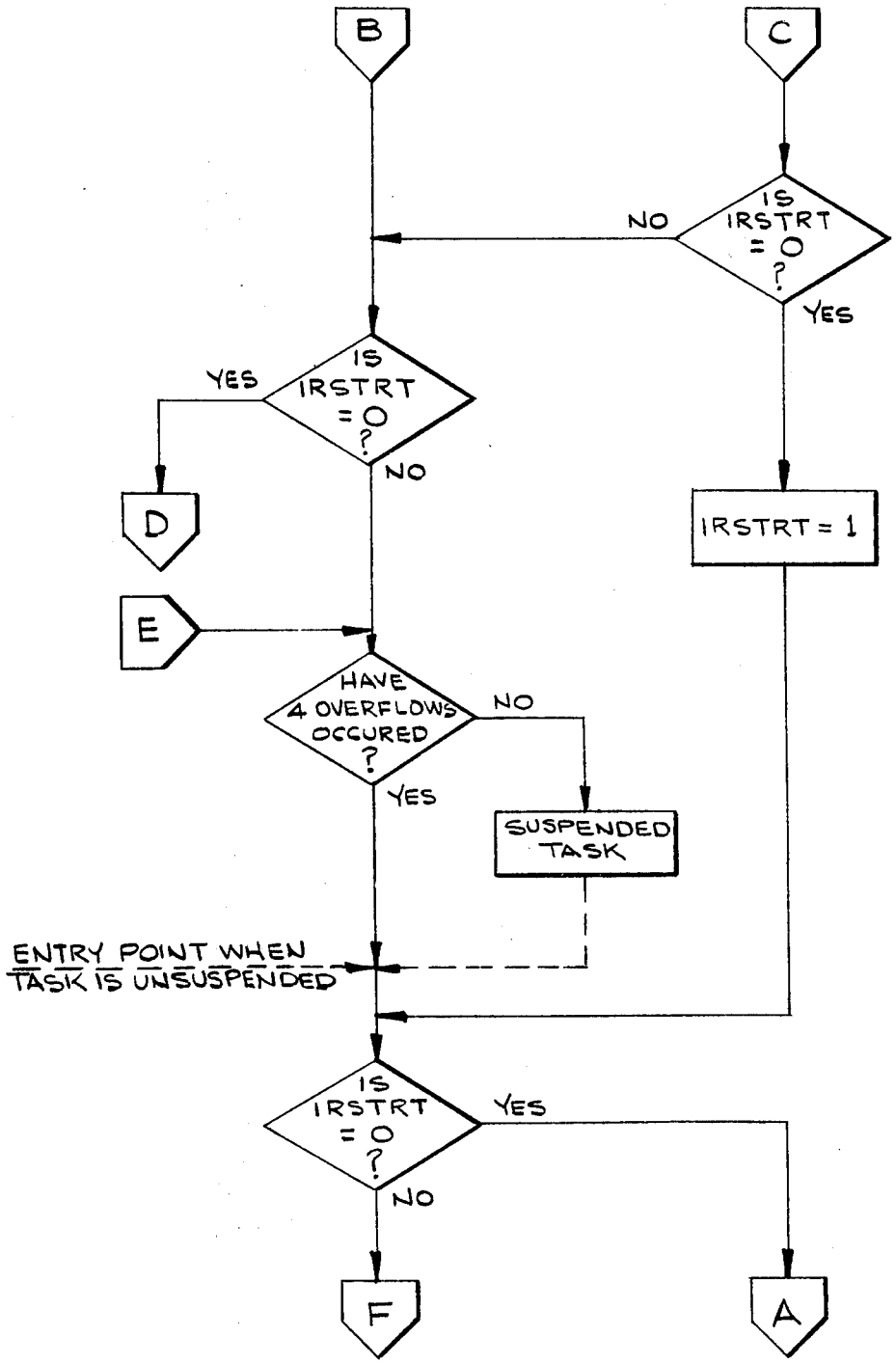
Figure 17D:
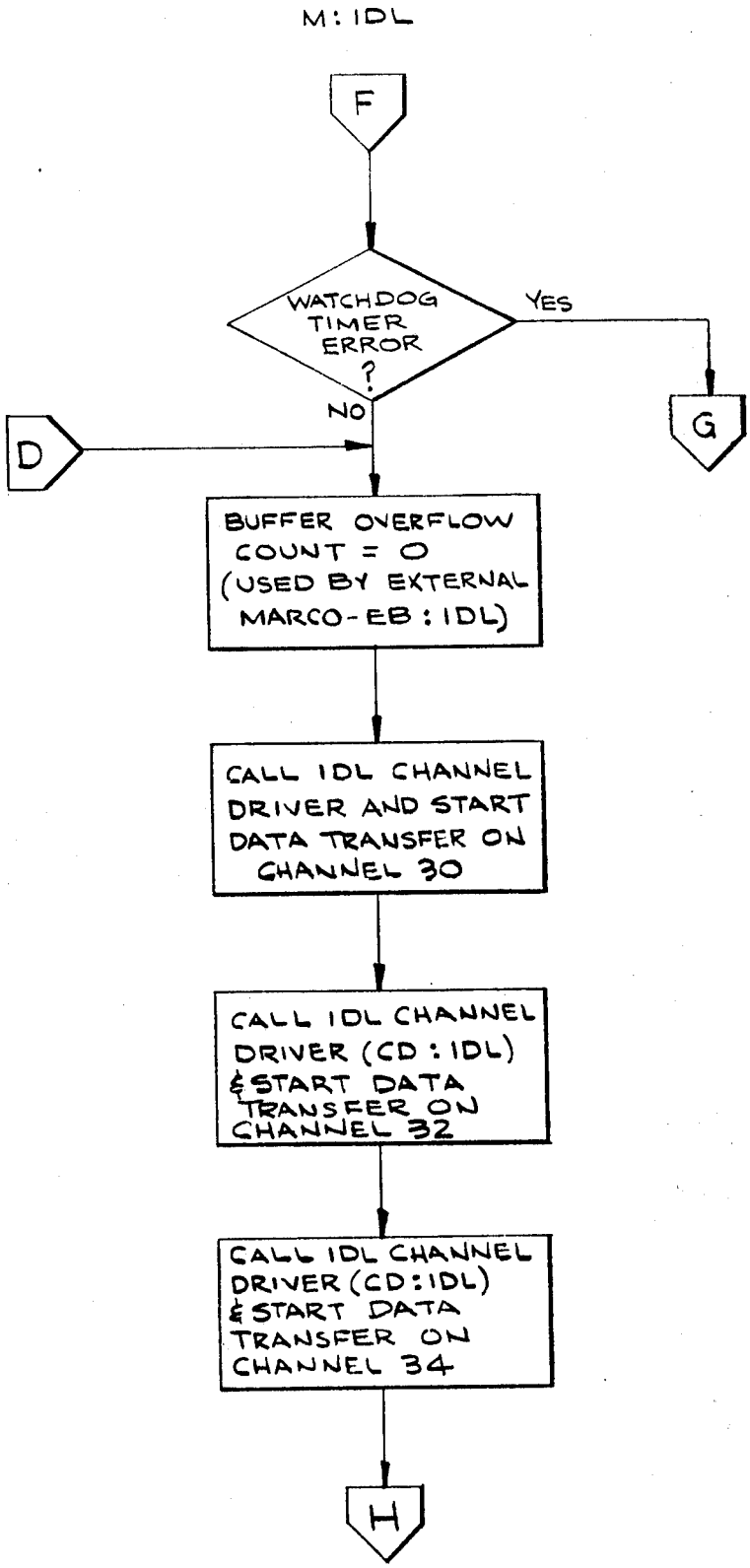
Figure 17E:
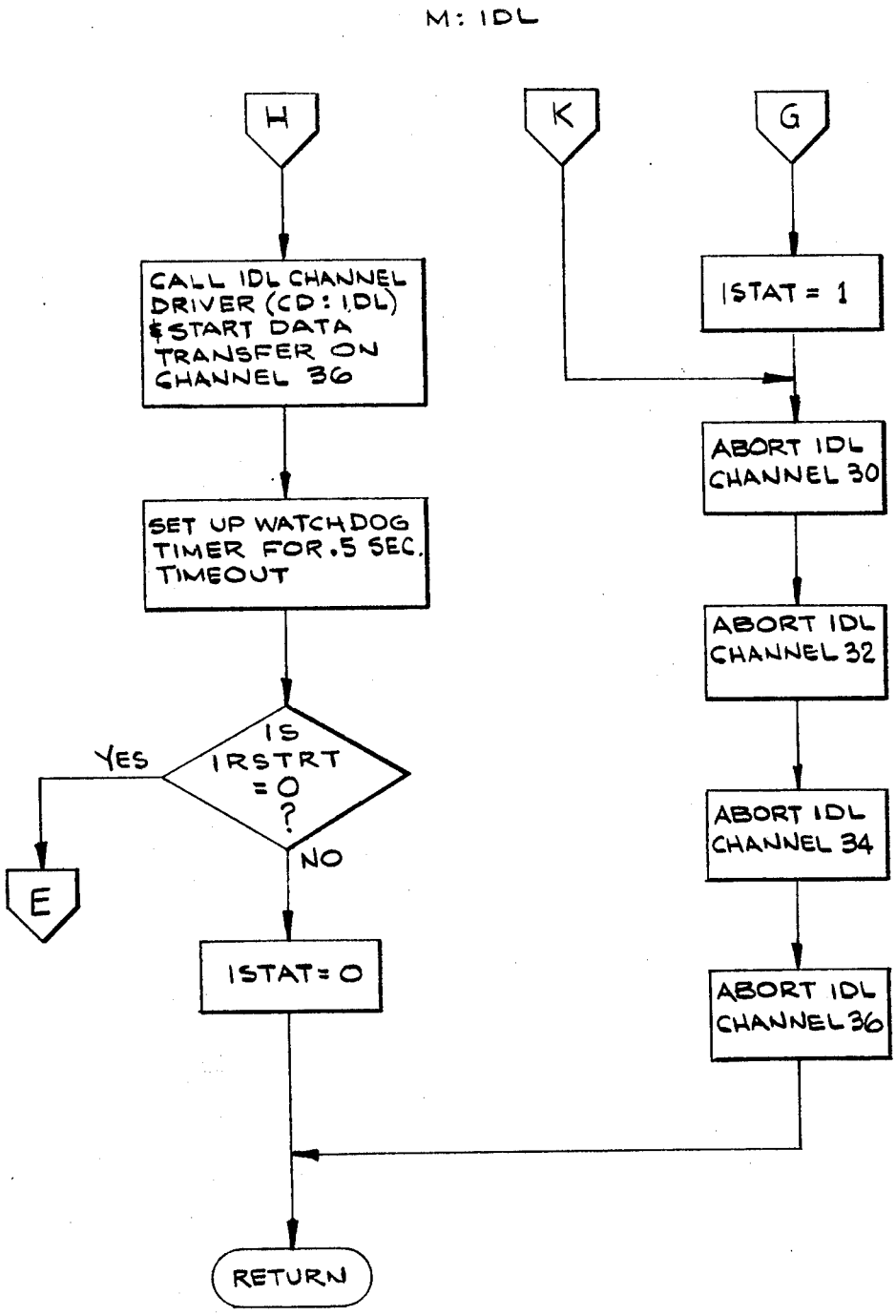

DISC MAP, see FIG. 15. Program address in disc storage 192.

CORE MAP, see FIGS. 16A,B. Program address in hexadecimal core storage 194.

SERVICE PROGRAMS (198)

IDL Handler, M:IDL, see FIGS. 17A-E. This routine handles all data transfers between the IDL hardware (channels 30, 32, 34 and 36) and the gage data input subroutine-GAGEIN. It communicates to the IDL hardware via the IDL channel driver CD:IDL. A double buffering scheme is used to speed up the total data transfer time by initiating an additional IDL transfer on all four channels to a second data buffer just before exiting from the handler. In this way data can be transferred into this second buffer by the IDL hardware using service request interrupts SRI's executed in the out-of-sequence range while the gage software is busy processing data from the first buffer. When this processing is completed, the handler is re-entered. If the data transfer on the second buffer is not complete, the task is suspended until the IDL external MACRO routine detects four buffer overflow interrupts. The task is unsuspended by the IDL external MACRO routine EB:IDL when four buffer overflows have been counted. If the data transfer on the second buffer is complete, or after the task is unsuspended by EB:IDL, the buffers are effectively switched and a data transfer using buffer 1 is initiated and an exit is made from the handler. The gage software now processes the data in buffer 2 and repeats the above sequence.

A watchdog timer with a 0.5 second timeout is set before initiating each IDL transfer. If four buffer overflows are not returned within this time period, the clock routine will unsuspend the task and sets the variable ISTAT=1 to indicate an IDL transfer timeout error.

The variable IBUF is set by this routine to indicate which buffer, 1 or 2, contains data from the last IDL transfer. The variable IRSTRT must initially be set to 0 by the calling task so that this routine knows when entry has been made for the first time. When IRSTRT=0, the double buffering mechanism is initialized. This routine then sets IRSTRT=1 to indicate that the double buffering operation is in progress. If entry to the handler is made with IRSTRT=−1, an abort IDL command is sent to all four IDL channels to stop any transfer in progress. This command is usually initiated by the calling task before doing a call exit so that all IDL transfers are halted.

This routine calls the IDL channel driver CD:IDL and utilizes the IDL external MACRO routine EB:IDL. Therefore these routines must be linked with the IDL handler M:IDL.

Figure 18:
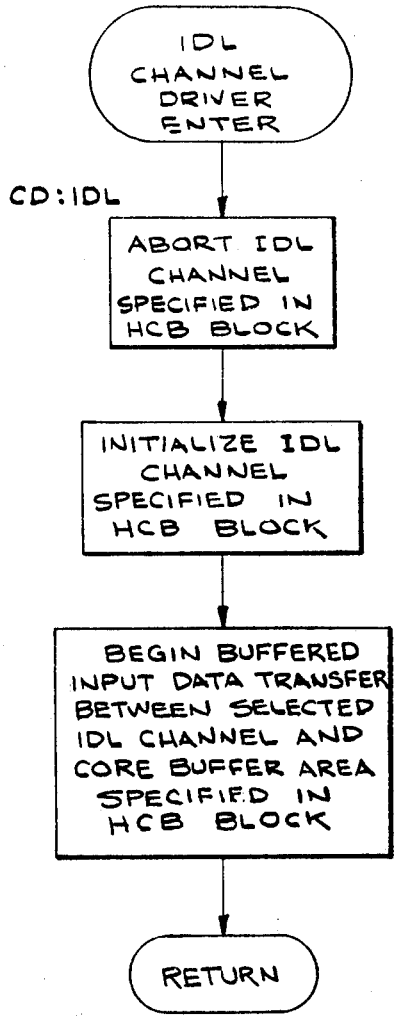

IDL Handler, CD:IDL, See FIG. 18. This routine is used to transfer data from the handler control blocks (HCB) defined in the IDL handler M:IDL to the IDL hardware (channels 30, 32, 34, 36). Control is transferred to this routine by loading the address of the HCB into the B register and jumping to CD:IDL (CD:IDL must be declared external). The HCB is a 9 word table having the following format:

| Word No. | Explanation | Example Using Channel 30 |
|---|---|---|
| 0 | Forced Buffer Input IDL Code | DAT X'B30' |
| 1 | Abort IDL Code | DAT X'F30' |
| 2 | Return Address - 1 | ADL RTR1-1 |
| 3 | Blank | DAT 0 |
| 4 | Buffer Input IDL COde | DAT X'530' |
| 5 | Core Location Containing Addr. to data | DAT X'11FB' |
| 6 | Number of Words to be Transferred | DAT 20 |
| 7 | Address of Data Buffer | SIZE 1 |

-continued

| Word No. | Explanation | Example Using Channel 30 |
|---|---|---|
| 8 | SRI Address Vector (100+SRI × 2) | DAT 354 |

This routine performs three functions using the HCB table. First, an abort code (HCB - word 1) is sent out on the I/O subsystem. The lower seven bits of this word define the channel number to be aborted. Second, a forced buffer input (HCB - word 0) is sent out on the I/O subsystem. This command initializes the IDL hardware on the selected channel. Third, the buffered input transfer code is sent out on the I/O subsystem to initiate the data transfer. The data is transferred into core memory from the selected IDL channel via service request interrupts (SRI). The pointers and counters used by the SRI's are set up by this routine using data supplied in the HCB's.

Figure 19:
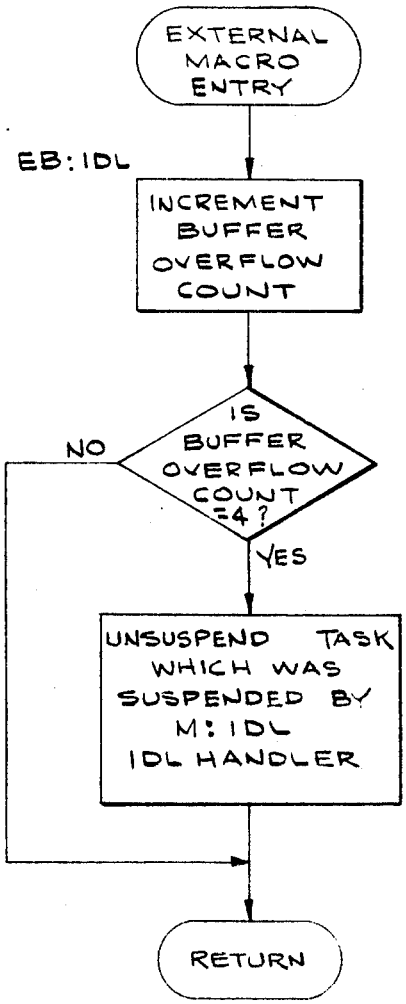

IDL Handler, EB:IDL, see FIG. 19. This routine is called by the POS/1 buffer overflow service request interrupt routine in the out-of-sequence instruction range in response to buffer overflow interrupts which occur when a buffered input data transfer on any of the IDL channels 30, 32, 34 or 36 is completed. Each entry to this routine causes the buffer overflow count word (ECB7) in the external MACRO control block to be incremented. When this count reaches 4, the task which was suspended by the IDL handler M:IDL is unsuspended. If this count is not 4, return is made to the POS/1 buffer overflow exit routine M:BOX and the state of the suspended task is unchanged. Thus, when the IDL handler M:IDL requests data from all four IDL channels it clears the buffer overflow count and suspends the task. It will be unsuspended when the IDL external MACRO routine counts four completion buffer overflow interrupts.

Figure 20A:
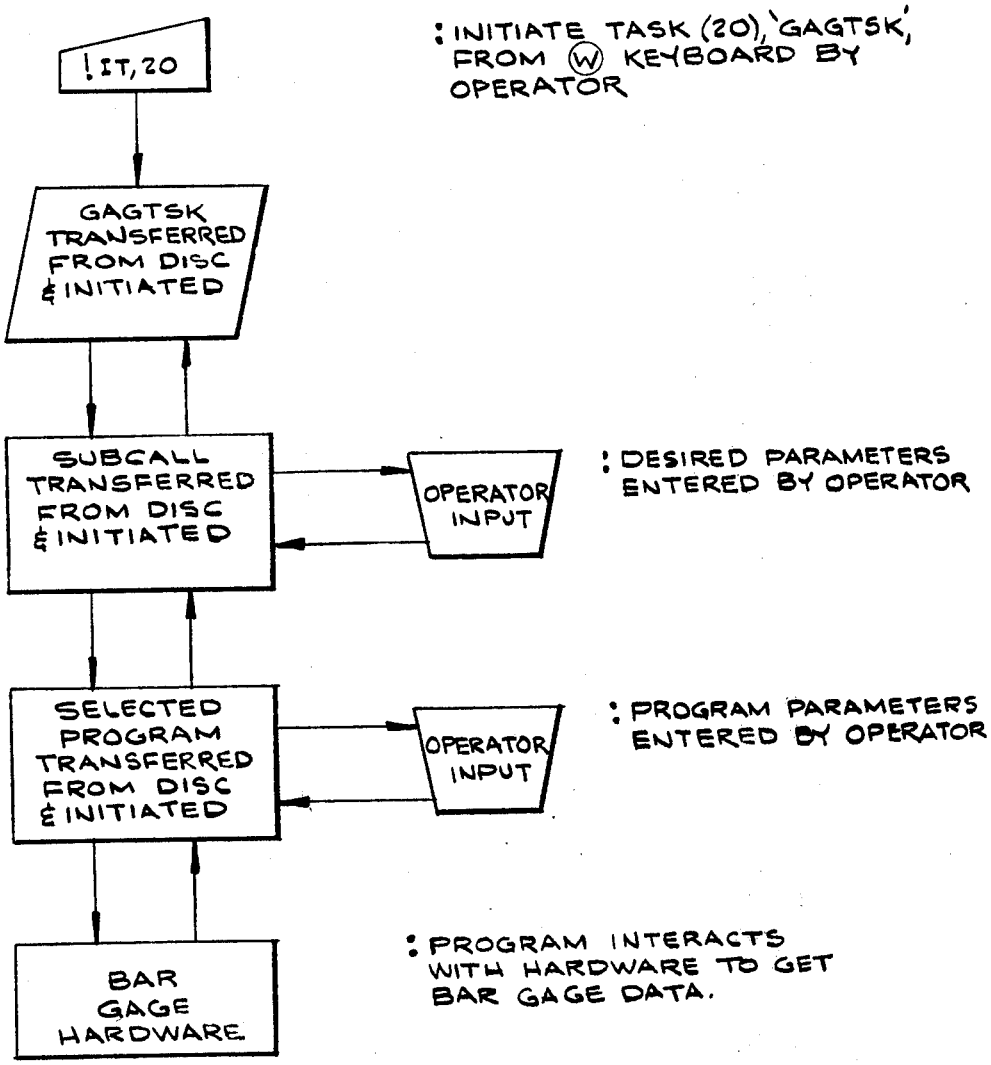
Figure 20B:
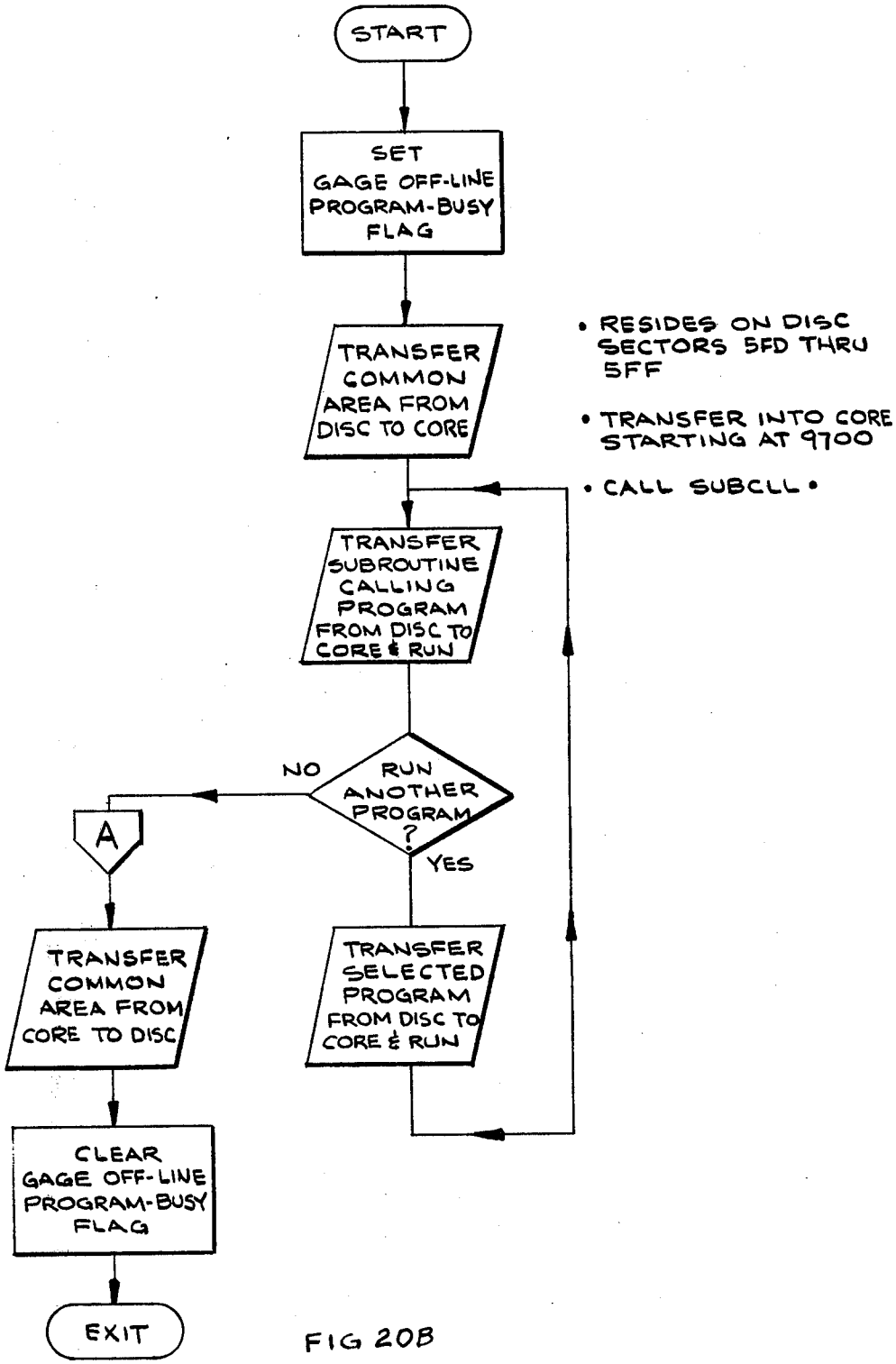

GAGTSK, see FIGS. 20A–B. This disc resident task (Task 20) is an off-line task designed to read off-line gage subroutine overlays into core from disc and transfer control to them. GAGTSK calls a particular subroutine into core in response to mnemonic parameters passed to it by the operator interactive subroutine caller overlay SUBCLL. All programs and their mnemonics are described in the listing of the subroutine SUBCLL. GAGTSK also transfers a disc resident common area into core, and, if disc sector switch 12 is write enabled, writes the updated common area back to the disc when exiting from the task.

An off-line busy flag IGAGOF is set on entry to this task, and is cleared upon exit.

Figure 21A:
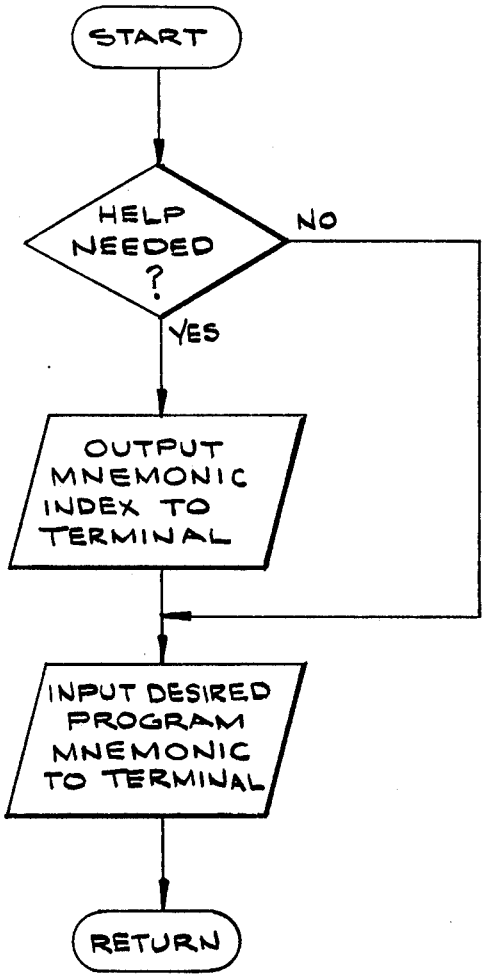

SUBCLL, see FIGS. 21A–B. This disc resident subroutine is an overlay, run in the off-line mode, by means of which an operator may interact with the gage off-line system to run any of the available off-line bar diameter gage programs. It is transferred from disc to core and run by the off-line gage task GAGTSK (Task 20) by means of a system monitor disc-read-and-transfer-control routine. Operator entered mnemonics determine subroutine disc sectors which are returned as subroutine parameters to GAGTSK, which in turn transfers and runs the desired subroutine overlay. Subroutine functions are described in this program listing, and are available to the operator in response to his request for assistance.

Figure 22:
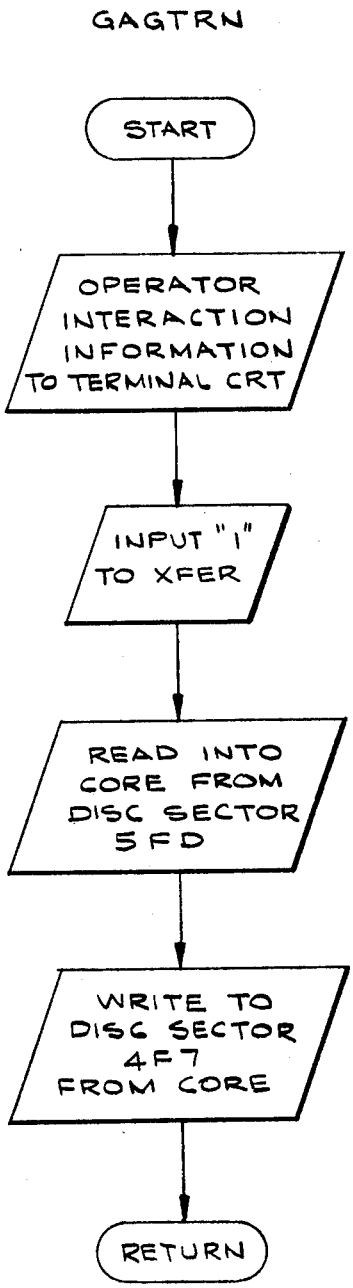
Figure 23A:
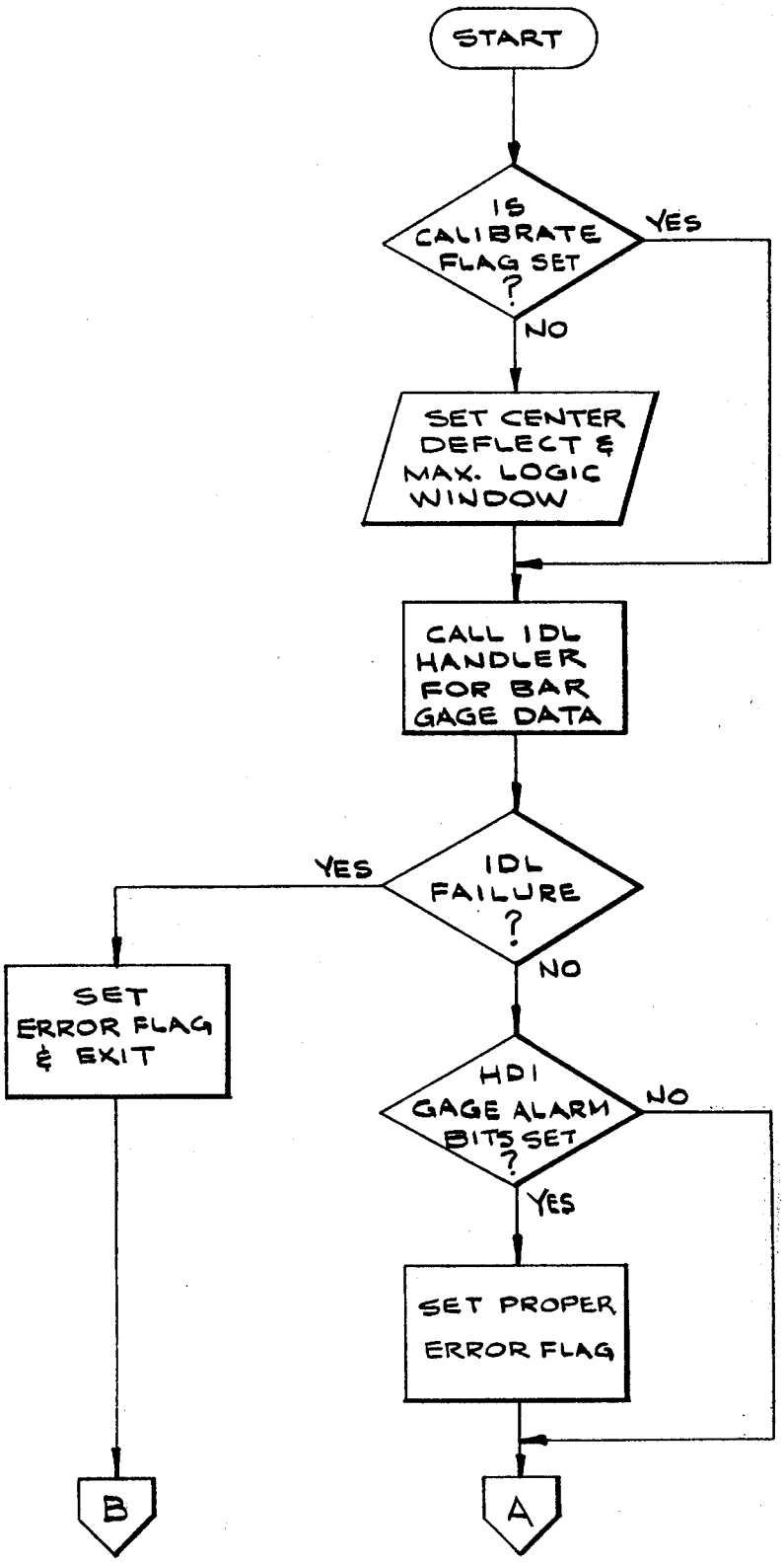
FIGS. 23A–D are flow charts of computer BAR GAGE DATA PROGRAM.
Figure 23B:
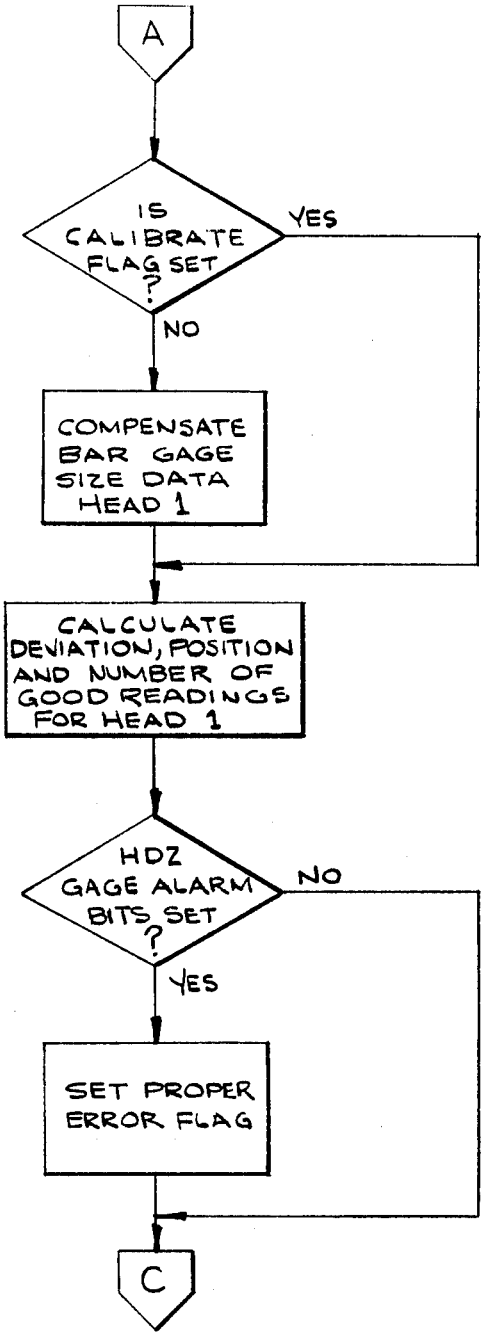
Figure 23C:
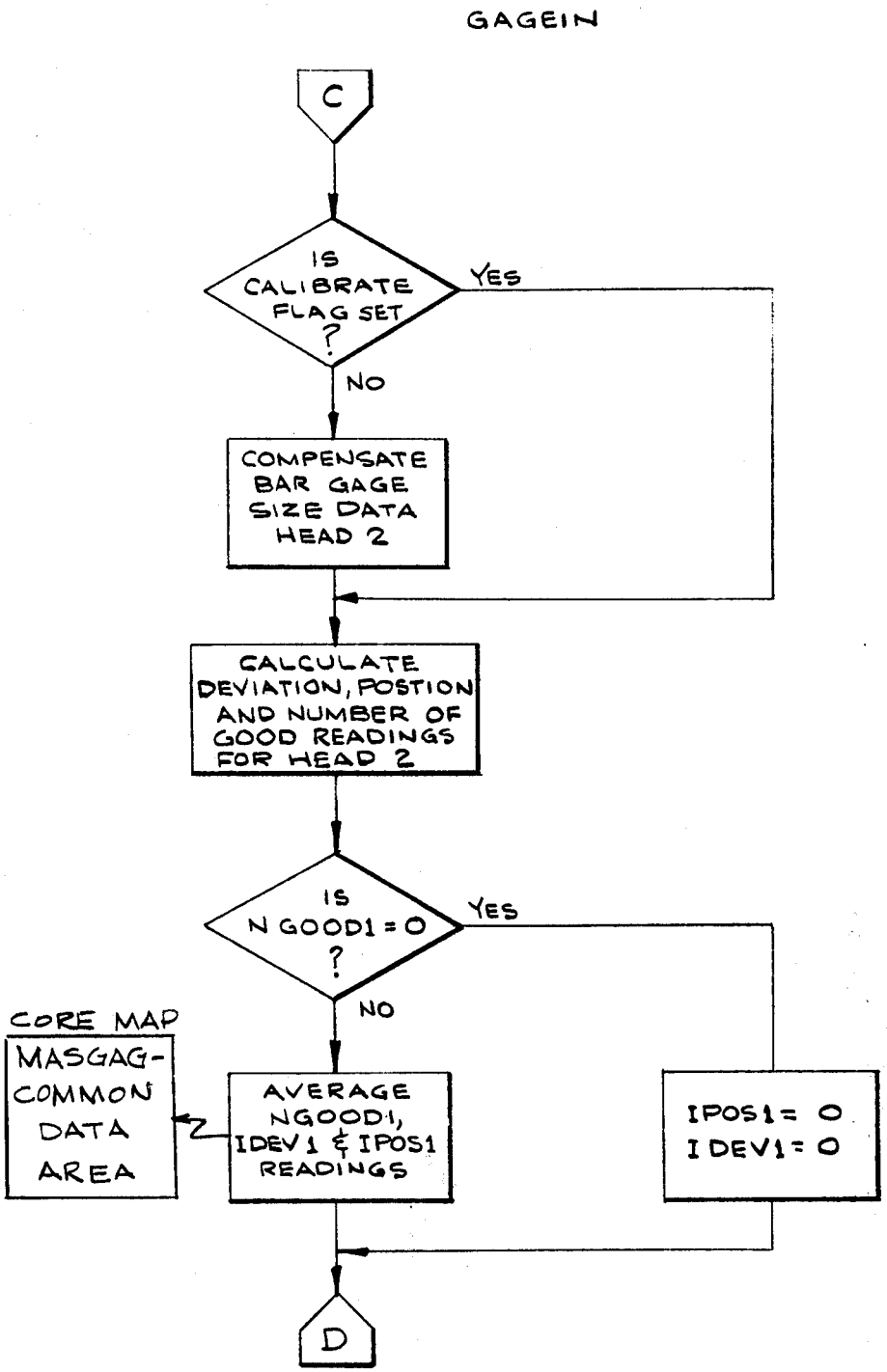
Figure 23D:
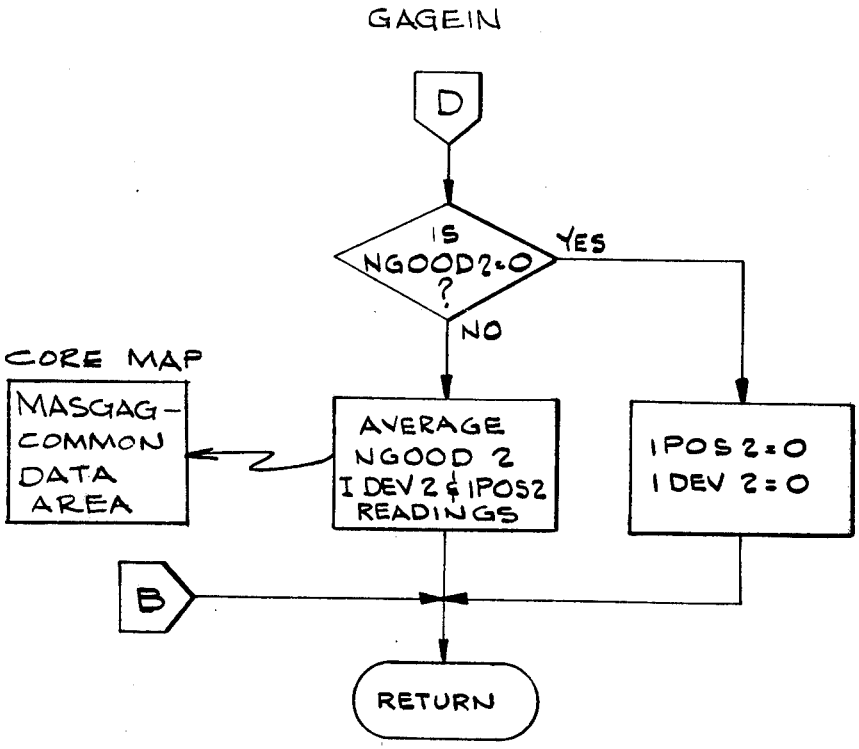

GAGTRN, see FIG. 22. This program runs in the gage off-line system. It transfers the 572 word gage data block from disc area 5FD to control system disc area 4F7. It performs a disc-core-disc transfer using the gage common area for intermediate storage. Disc switch 10 must be write enabled.

BAR GAGE DATA PROGRAM (199)

GAGEIN, see FIGS. 23A–D. This auxiliary subroutine is always appended to any subroutine requiring bar gage data. It calls the IDL handler (M:IDL, CD:IDL, EB:IDL), also appended, to actually acquire the data, and the compensate subroutine (CMPNST), also appended, if compensation is required. It averages the good readings returned, both bar position and diameter, calculates deviations, and stores the results in common tables. Validity tests are made and error flags set as needed.

COMPENSATION PROGRAMS (200)

Figure 24A:
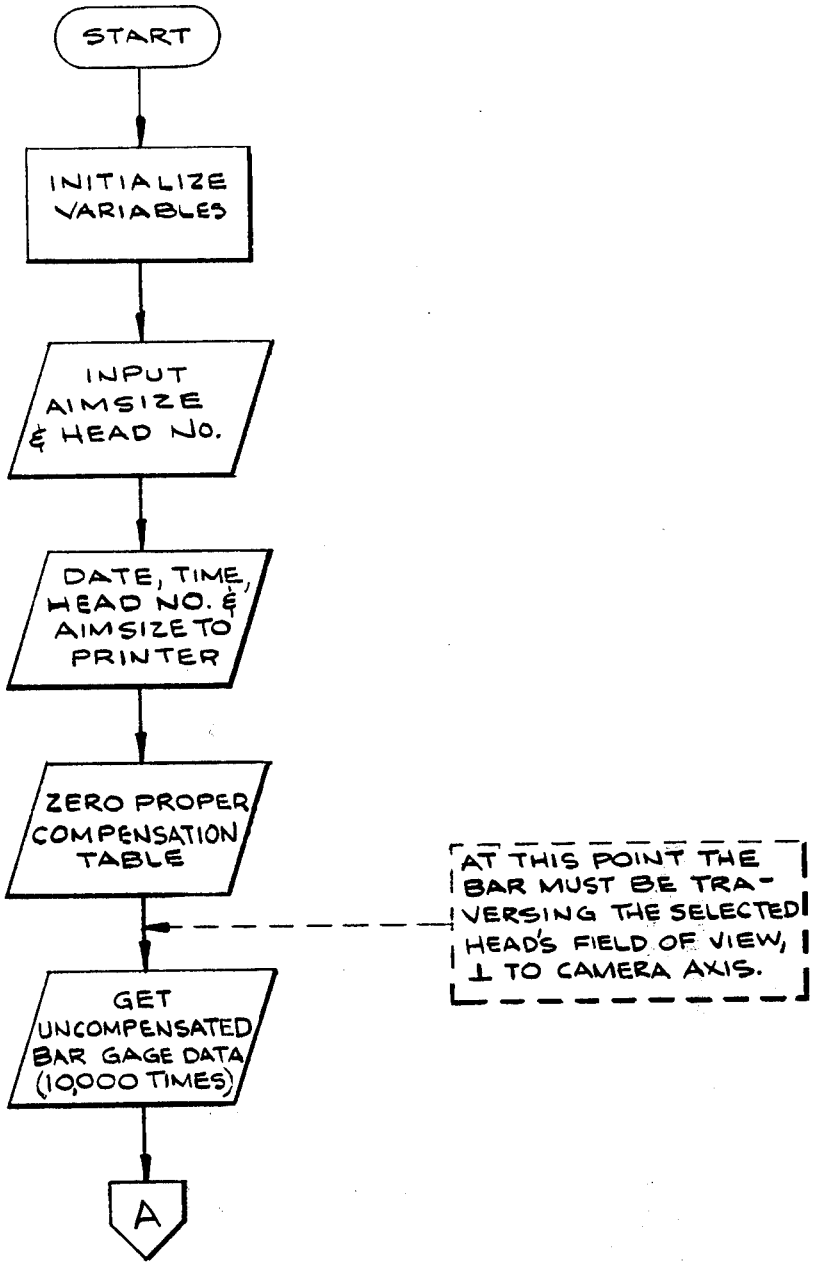
Figure 24B:
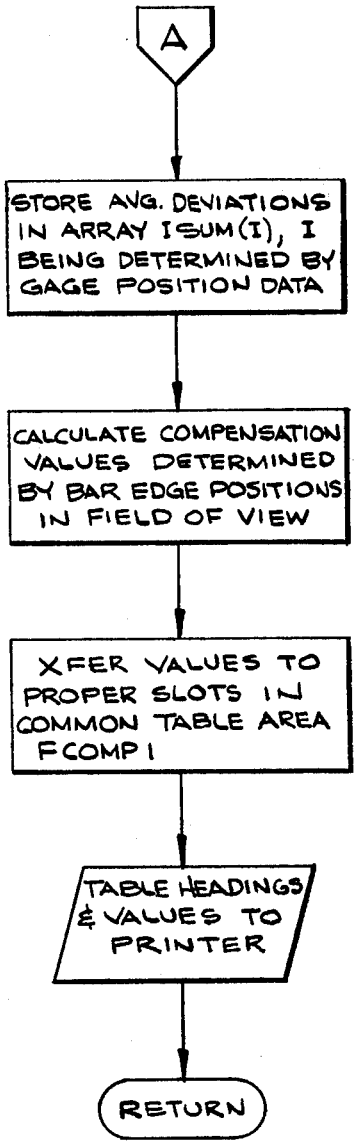

GAGMAP, see FIGS. 24A–C. This disc resident subroutine is an overlay, run in the off-line mode, which generates a set of compensation tables used by on-line bar diameter gage tasks and subprograms, and those off-line gage programs requiring compensated size data. The tables reside in a common area, and are used to compensate for image-tube non-linearity across its field-of-view. The tables are formatted and output to printer 1068. This program is required to be run before any bar-diameter data can be considered valid. It is invoked by the subroutine SUBCLL, and requires operator interaction.

Each compensation table consists of 256 entries corresponding to the 256 possible bar positions. Element one represents the bottom of the total 4.096 inches field and element 256 represents the top of the field. Each element contains correction data to be subtracted from the measured bar size based on the positions of the top and bottom edges of the bar. The actual correction is performed by subroutine CMPNST. Using the edge 82, 83 positions rather than the center position allows the map to be used for all sizes of bar 10.

During the map building procedure, a ½ inch machined sample bar 10 is moved ±1.5 inches back and forth in a plane perpendicular to the optical axis. While bar 10 is being moved, GAGMAP is executed in the off-line calibration system. This program processes 10,000 measurements and calculates the average deviation at each increment of bar position. These intermediate results are stored in a 256 element table called ISUM.

The final compensation map based on bar edge 82, 83 positions is generated from the ISUM table by the following steps:

1. The compensation map is cleared.

2. A computer simulation is performed in which an imaginary ½ inch bar 10 is positioned at 0.016 inches above the center of the field-of-view (slot 129). The positions of the top and bottom bar edges 82, 83 are calculated as follows:

$$\text{Top Edge 83} = \frac{[\text{field-of-view center position} + 0.016 + \text{bar size}/2)]}{0.016} \quad \text{(Eq.1)}$$

$$\text{Bottom edge 82} = \frac{[\text{field-of-view center position} + 0.016 - (\text{bar size}/2)]}{0.016} \quad \text{(Eq.2)}$$

3. The value stored in the map at the upper edge 83 position (144) is the sum of the deviation stored in ISUM table corresponding to the position of the center of bar 10 (129) and the value stored in the map at the lower edge 82 position (113).

$$IMAP\text{ (upper edge 83 position)} = ISUM\text{ (center bar position)} + IMAP\text{ (lower edge position)} \quad \text{(Eq.5)}$$

$$IMAP(144) = ISUM(129) + IMAP(113) \quad \text{(Eq.6)}$$

4. Steps 2 and 3 are repeated by incrementing the center position of the bar 10 to 0.032 inch above the center of the field-of-view, then 0.048 inch, 0.064 inch, etc. This is repeated until the upper edge 83 of bar 10 goes beyond +1.5 inches above the center of the field-of-view.

$$IMAP(145) = ISUM(130) + IMAP(114)$$
$$IMAP(146) = ISUM(131) + IMAP(115)$$
$$IMAP(147) = ISUM(132) + IMAP(116)$$
$$\vdots$$
$$IMAP(220) = ISUM(205) + IMAP(189)$$
$$IMAP(221) = ISUM(206) + IMAP(190)$$

The upper half of the map is now complete.

5. The lower half of the map is filled in the same manner. Based on the same ½ inch sample bar 10 located at the center of the field-of-view (128) the positions of the upper and lower edges 83, 82 are calculated.

$$\text{Top Edge 83} = \left(\text{field-of-view center} + \frac{\text{bar size}}{2}\right) \div 0.016 \quad \text{(Eq.7)}$$

$$\text{Bottom Edge 82} = \left(\text{field-of-view center} - \frac{\text{bar size}}{2}\right) \div 0.016 \quad \text{(Eq.8)}$$

$$\text{Top Edge 83} = (2.048 + 0.5/2)/0.016 = 143 \quad \text{(Eq.9)}$$

$$\text{Bottom edge 82} = (2.048 - 0.5/2)/0.016 = 112 \quad \text{(Eq.10)}$$

6. The map value for lower edge 82 of the bar (112) is the sum of the deviation stored in ISUM corresponding to the position of the center of the bar (128) and the map value stored at upper edge 83 of bar 10 (143).

$$IMAP\text{ (lower edge 82 position)} = ISUM\text{ (center bar position)} + IMAP\text{ (upper edge 83 position)} \quad \text{(Eq.11)}$$

$$IMAP(112) = ISUM(128) + IMAP(143) \quad \text{(Eq.12)}$$

7. Steps 5 and 6 are repeated by successively decrementing bar 10 position by 0.016 inch from the center of the field-of-view until the lower edge 82 of bar 10 goes beyond −1.5 inches from the center of the field-of-view.

$$IMAP(111) = ISUM(127) + IMAP(142)$$
$$IMAP(110) = ISUM(126) + IMAP(141)$$
$$IMAP(109) = ISUM(125) + IMAP(140)$$
$$\vdots$$
$$IMAP(36) = ISUM(52) + IMAP(67)$$
$$IMAP(35) = ISUM(53) + IMAP(68)$$

The lower half of the map is now complete.

8. Map positions above 221 and below 35 are not used. These positions correspond to the unused portion of the field-of-view in the shadow of the photocathode tube illustrated in FIG. 5.

9. Map elements 111 to 143 are zero. This corresponds to an area ±0.25 inch from the center of the field-of-view.

10. The maps corresponding to camera #1 and camera #2 are shown in FIG. 24C and are stored in a common data area labeled FCOMP1 and FCOMP2 respectively.

CORDAT, see FIG. 25. This program runs under the gage off-line system. Its purpose is to allow the operator to enter the slope and offset correction factors for each head. The four variables are:

IMULT1 — Slope correction factor for head 1
IOFST1 — Offset correction factor for head 1
IMULT2 — Slope correction factor for head 2
IOFST2 — Offset correction factor for head 2

Slope correction is added to all bars by the field-of-view compensation subroutine CMPNST based on the following formula:

Size = (0.5-Size)*IMULT1 Offset correction is added to all bar sizes by the field-of-view compensation subroutine CMPNST based on the following formula:

Size = Size - IOFST1

ZERO, see FIG. 26. This program runs in the offline gage system. Its purpose is to zero all compensation maps, all slope and offset correction factors, and all right mask recalibration constants.

MAPRNT, see FIGS. 27A–C. This program runs under the off-line gage system. It does not require operator intervention. Its purpose is to print the field-of-view compensation maps, slope and offset correction factors, and left and right mask values, all as shown in FIGS. 27B and 27C.

GAGTPC, see FIG. 28. This program calculates hot aim size based on an internally stored compensation equation. Three variables are required for this equation. First, the % carbon is obtained from IGRADE in common area BDCCOM. Second, the bar temperature is obtained from ITMP22 in common area SYSCOM. Third, the cold aim size is obtained from ICDAIM in common area BDCCOM. The calculated hot aim size is stored in IHAIM1 and IHAIM2 in common BDCCOM.

Figure 29:
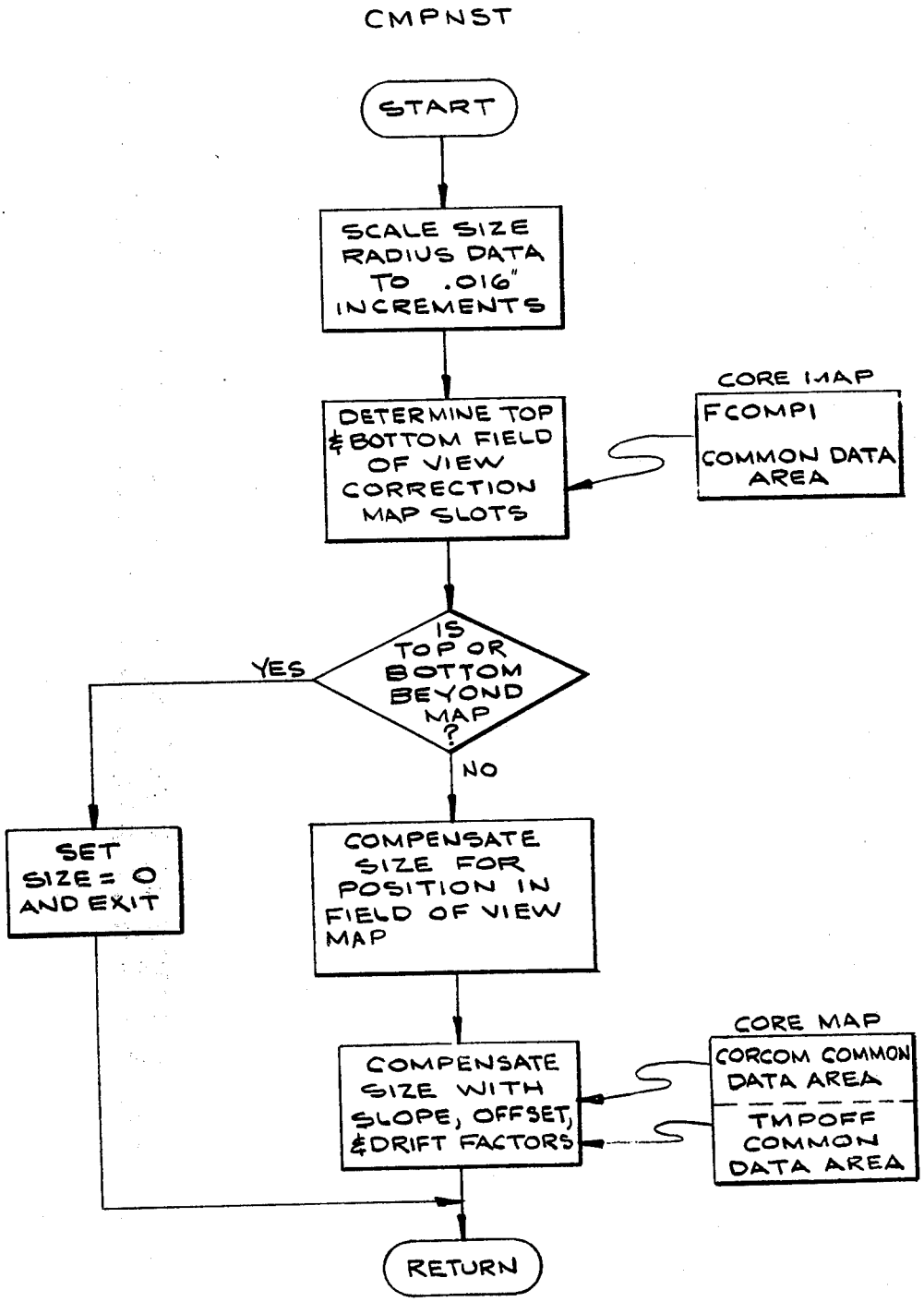
Figure 30A:
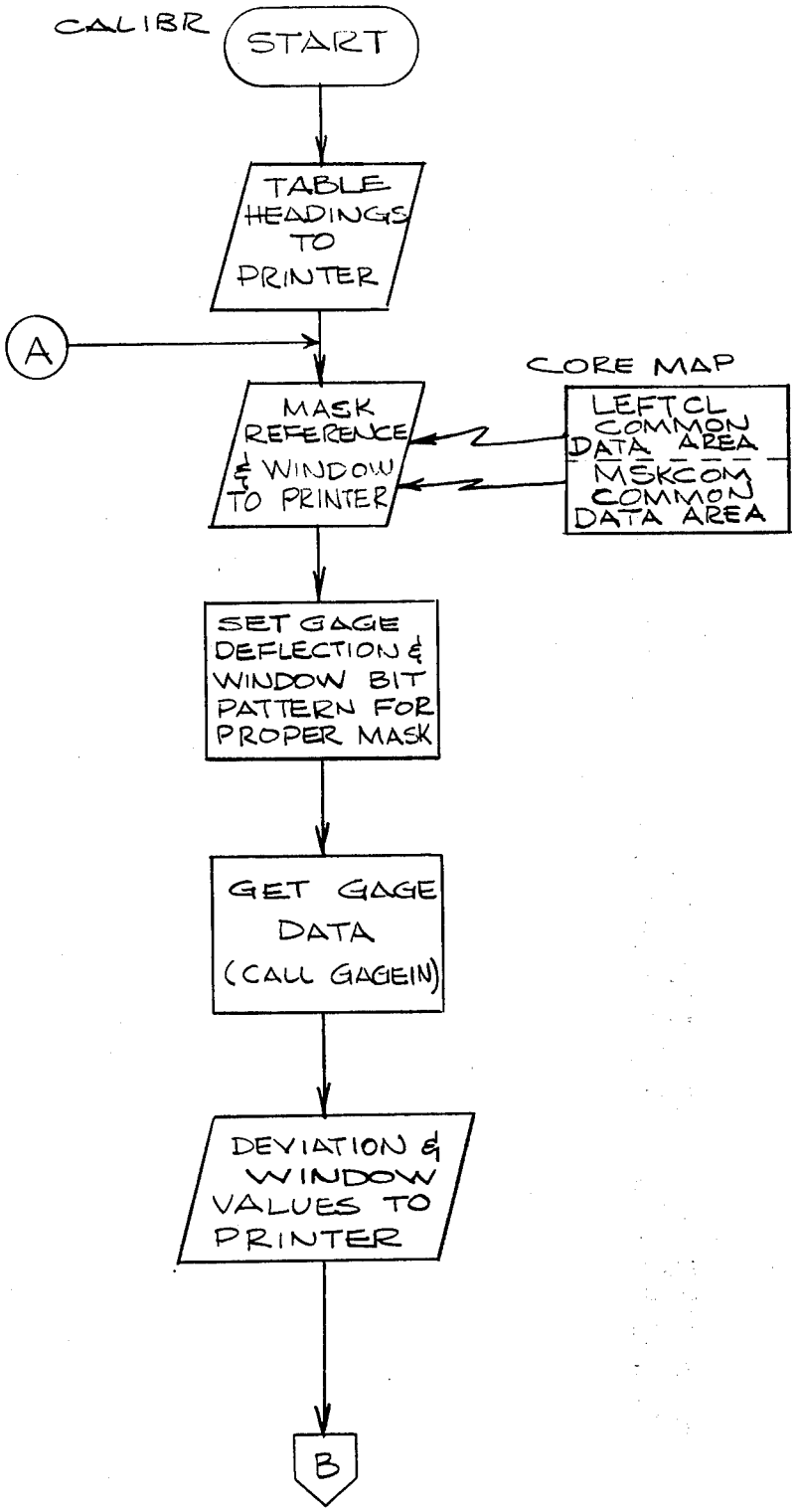
Figure 30B:
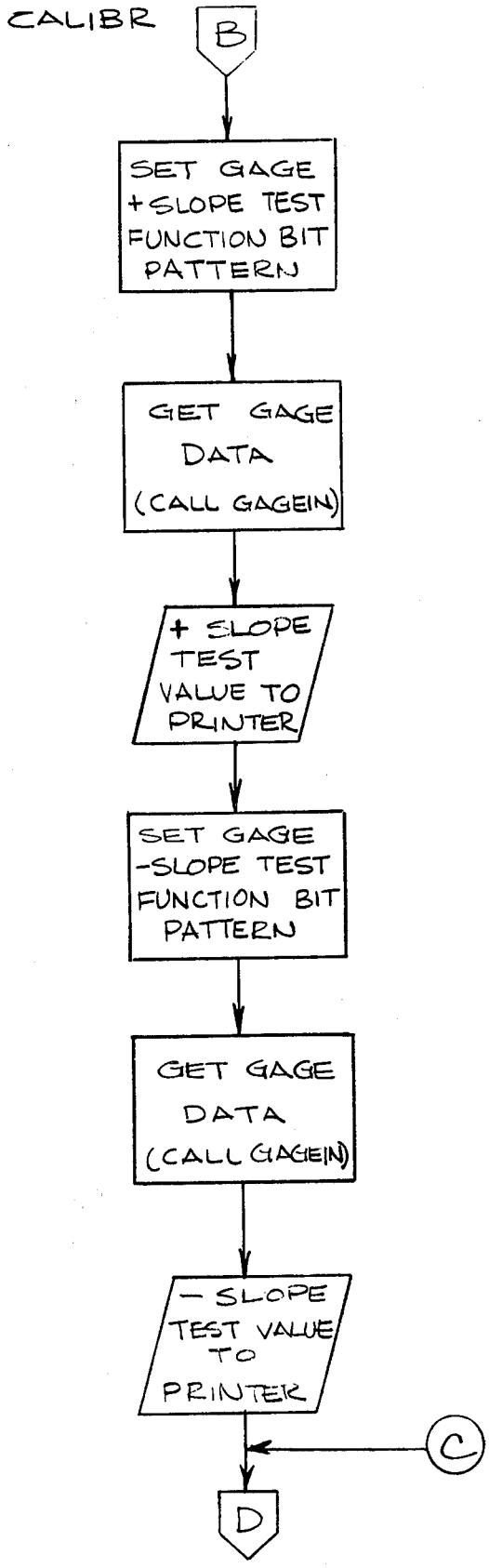
Figure 30C:
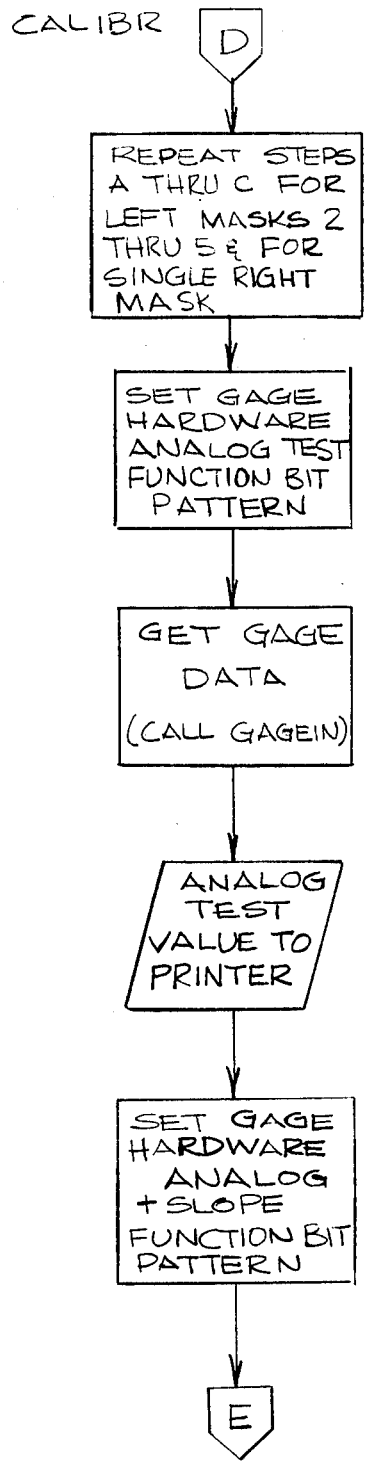
Figure 30D:
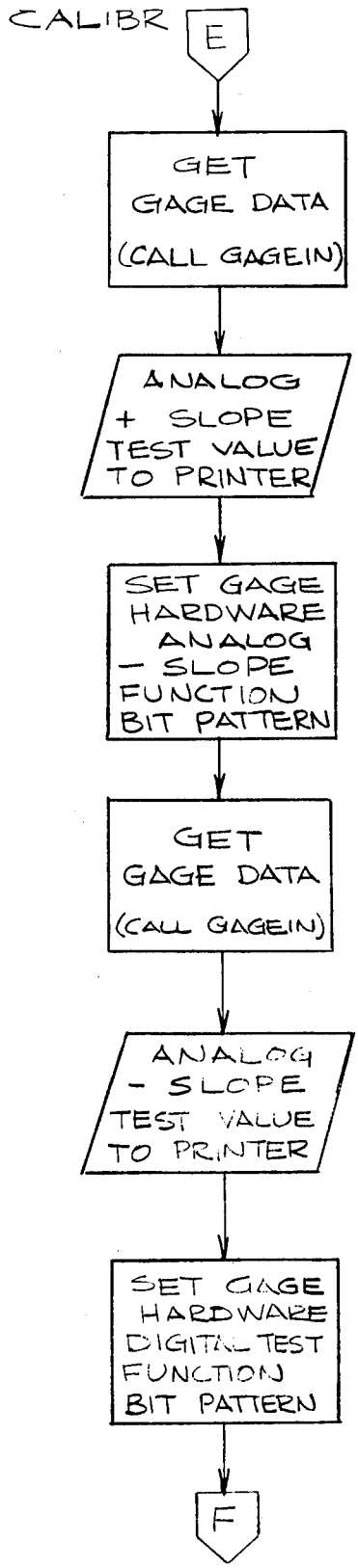
Figure 30E:
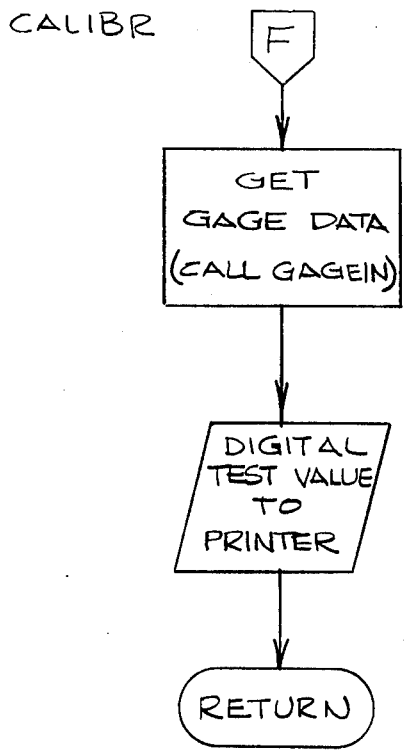
Figure 31A:
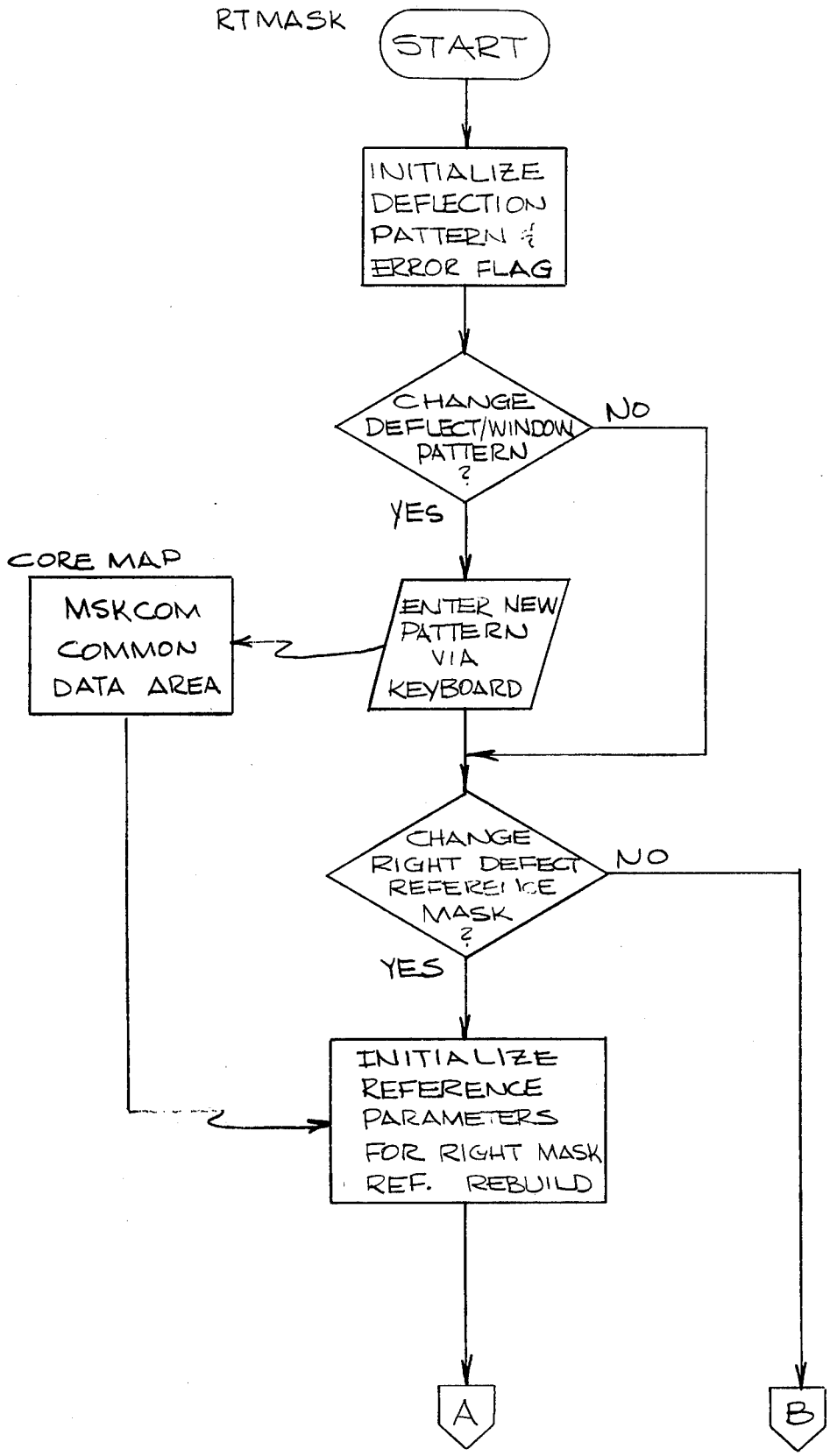
Figure 31B:
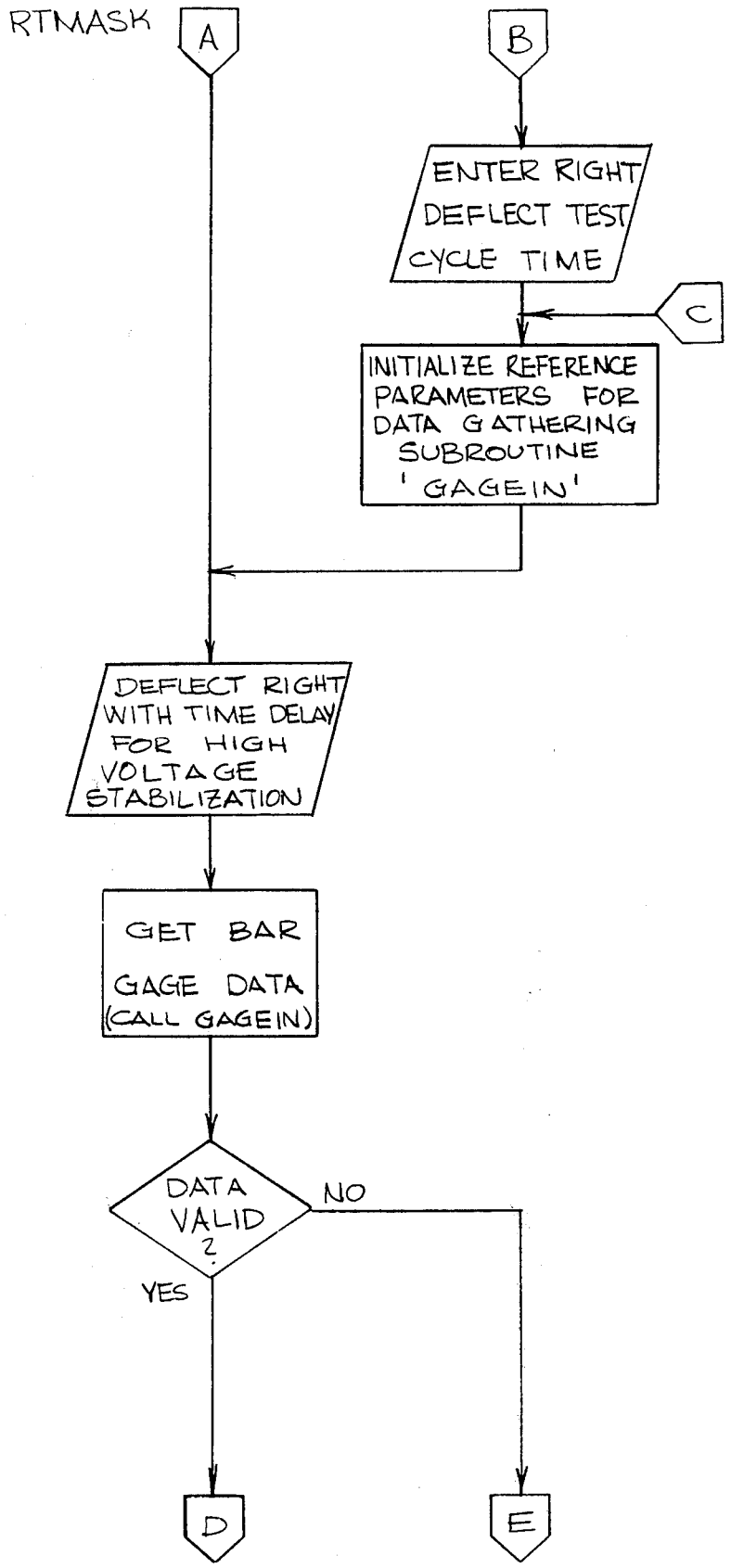
Figure 31C:
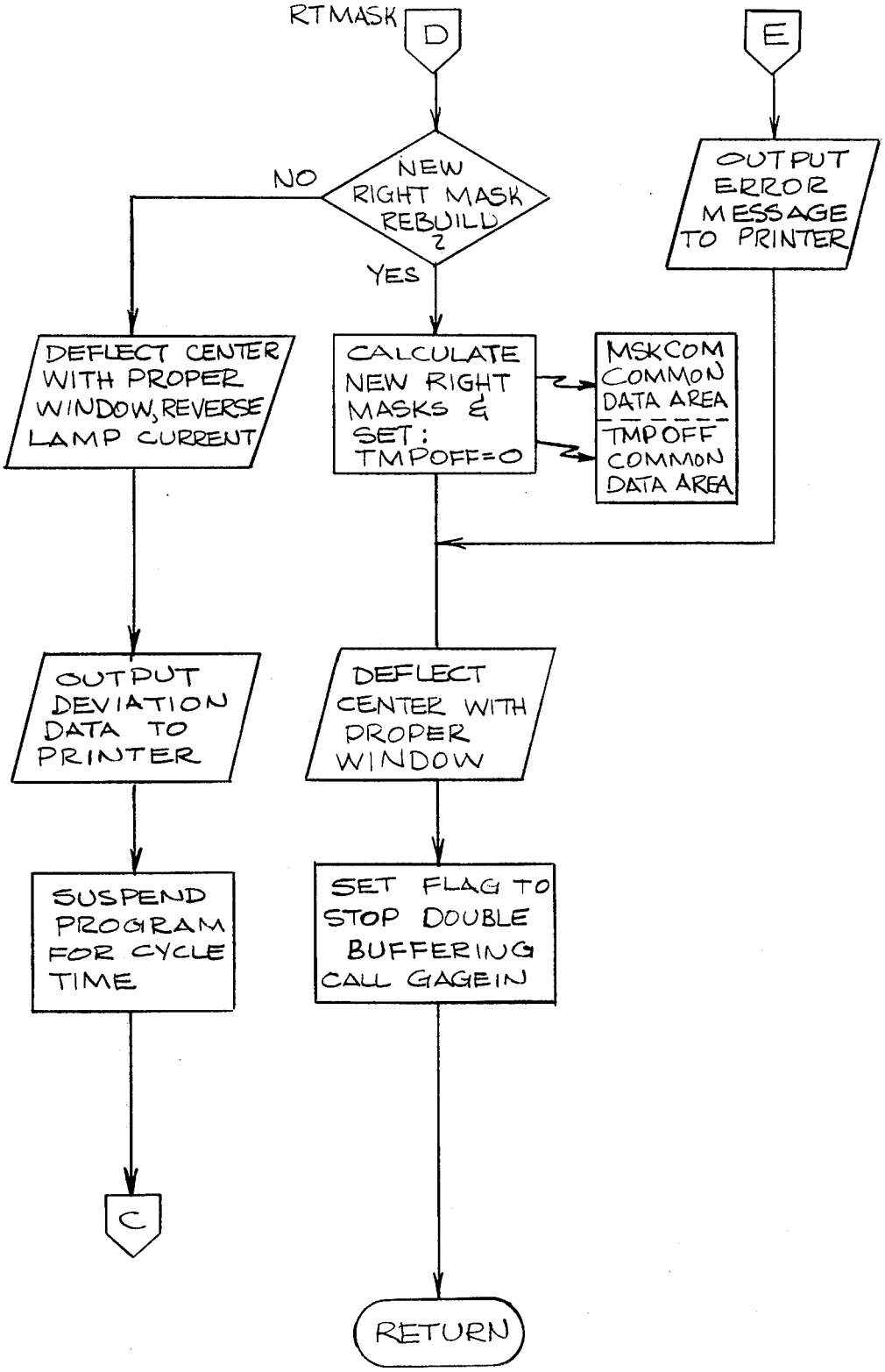

CMPNST, see FIG. 29. This auxiliary subroutine is appended to any subroutine requiring gage diameter data compensation. Specifically, this subroutine linearizes the bar measurement data for its position in the gage field-of-view, corrects the measurement data for slope and offset data per subroutine CORDAT, and performs automatic recalibration from right mask data generated by subroutine GAGRCL.

Bar 10 size data from each head is linearized by the CMPNST subroutine using compensation maps FCOMP1 and FCOMP2 generated by off-line program GAGMAP. Compensation is performed by the following steps.

1. The bar size and position data from accumulator 118 are used to determine the positions of the upper and lower edges 83, 82 of the bar 10 in the compensation map as follows:

Upper edge 83 position = (center bar position + bar size/2)/0.016

Lower edge 82 position = (center bar position − bar size/2)/0.016

If the center of a 1 inch bar is positioned ¾ inch above the center of the field-of-view the position of the bar center is 2.048 inches + 0.75 inch = 2.798 inches. The upper and lower bar edge positions are determined as previously described. That is:

$$\text{Upper Edge 83 Position} = \left(2.748'' + \frac{1.0''}{2}\right) \div 0.016'' = 203 \quad \text{(Eq.13)}$$

-continued $$\text{Lower Edge 82 Position} = (2.748'' - \frac{1.0''}{2}) \div 0.016'' = 140 \quad \text{(Eq.14)}$$

2. The compensation values corresponding to the upper and lower bar edges 83, 82 are obtained from the map and assigned values ICOR1 and ICOR2 respectively.

ICOR1 = IMAP (Upper Edge 83 Position) (Eq.15)

ICOR2 = IMAP (Lower Edge 82 Position) (Eq.16)

3. If both upper and lower edges 83, 82 are above the center of the field-of-view, then:

Corrected Bar Size = Uncorrected Size − ICOR1 + ICOR2 (Eq.17)

4. If both upper and lower edges 83, 82 are below the center of the field-of-view, then;

Corrected Bar Size = Uncorrected Size + ICOR1 − ICOR2 (Eq.18)

5. If upper edge 83 is above the center of the field-of-view and lower edge 82 below, then:

Corrected Bar Size = Uncorrected Size −ICOR1 − ICOR2 (Eq.19)

CALIBRATION PROGRAM (201)

CALIBR, see FIGS. 30A–F. This program runs in the off-line gage system. It does not require operator intervention. Its purpose is to establish a performance log for the gage on printer 1068. It performs the following functions:

1. Deflect to each left and right mask 95, 94 and:

a. Measure and print size of each mask;

b. Calculate and print deviation from stored mask value;

c. Measure and print (+) slope value;

d. Measure and print (−) slope value;

e. Print window value used for each mask.

2. Measure and print analog test size, + and − slope values.

3. Measure and print digital test.

4. Print calibration update values used by recalibration.

RECALIBRATION PROGRAMS (202)

RTMASK, see FIGS. 31A–D. This disc resident subroutine is an overlay, run in the off-line mode, by means of which any of the following bar diameter gage functions may be exercised:

1. Right deflect electronic window gates may be changed to accommodate changes in image-dissector 90 parameters. 2. Right deflect diameter reference values, stored in common tables, may be updated to compensate for drift, component aging, etc. 3. If no changes are desired, the program can be run cyclicly, with a deviation printout on printer 1068 for each head to observe electronic and temperature related drift, see FIG. 31D.

Upon return from this subroutine, the image-dissector 90 sweep is returned to the center, a full electronic window gate is restored, and the current through the back-light source lamps is reversed to prolong lamp life. This program is designed primarily as a long-term drift check tool, with the additional capability of updating the window gates and reference table values. It is invoked by the subroutine SUBCLL, and requires operator interaction.

Figure 32A:
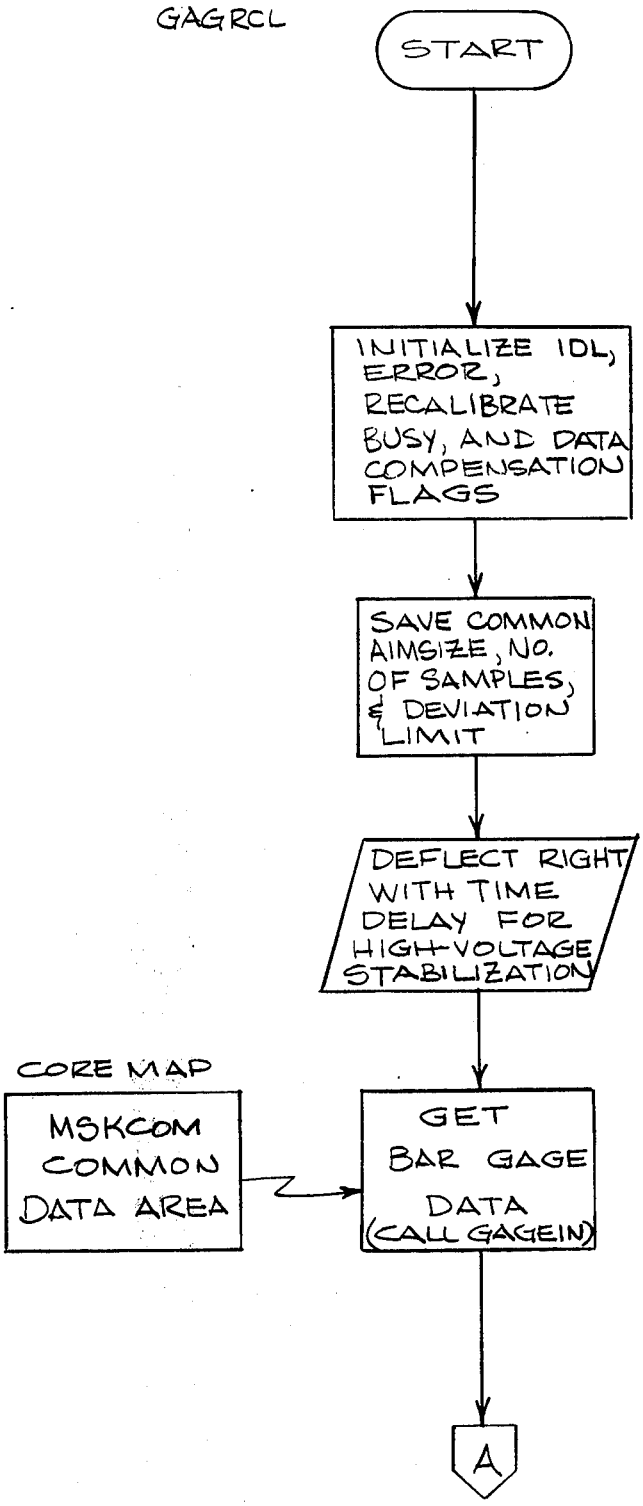
Figure 32B:
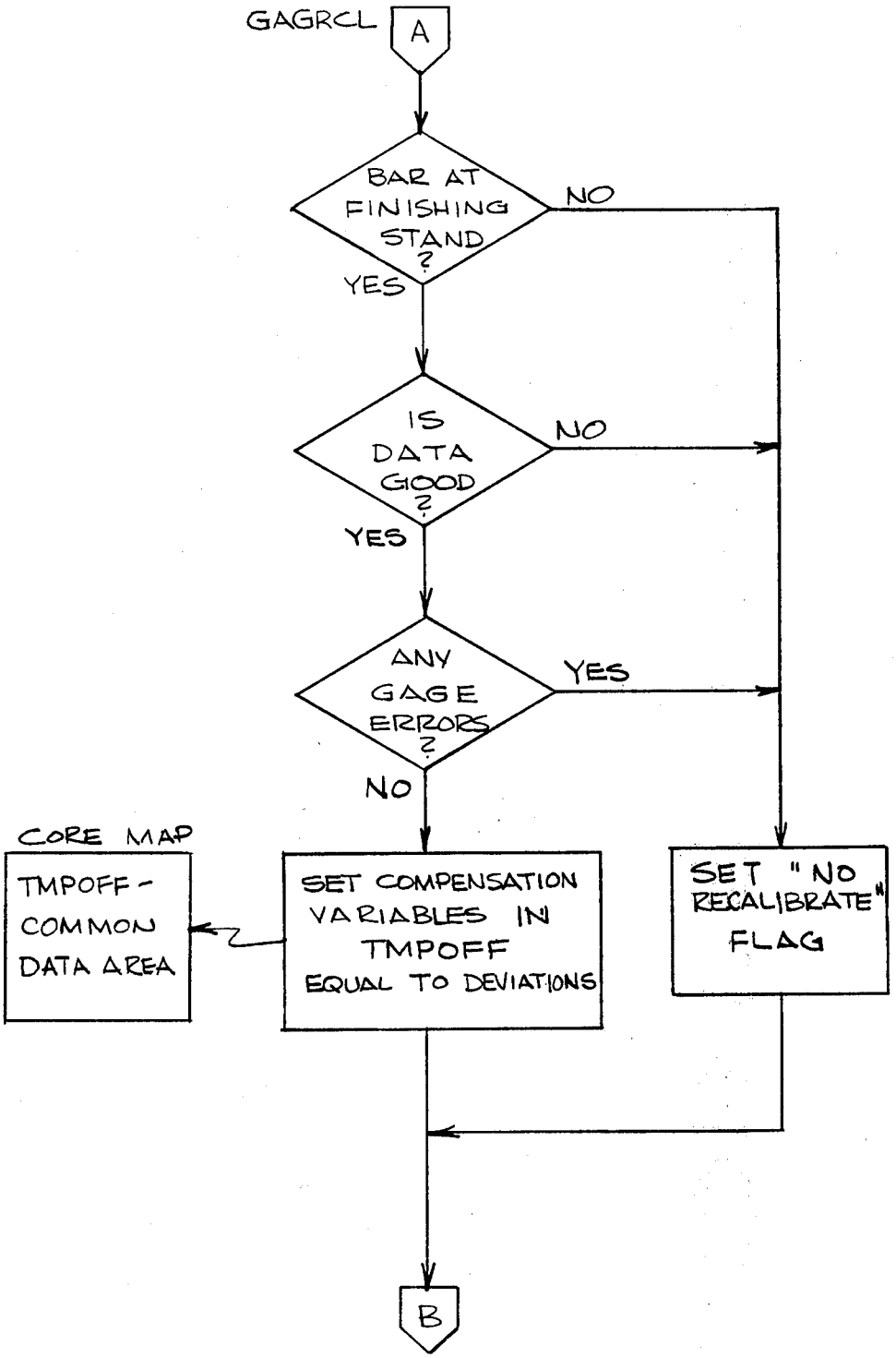
Figure 32C:
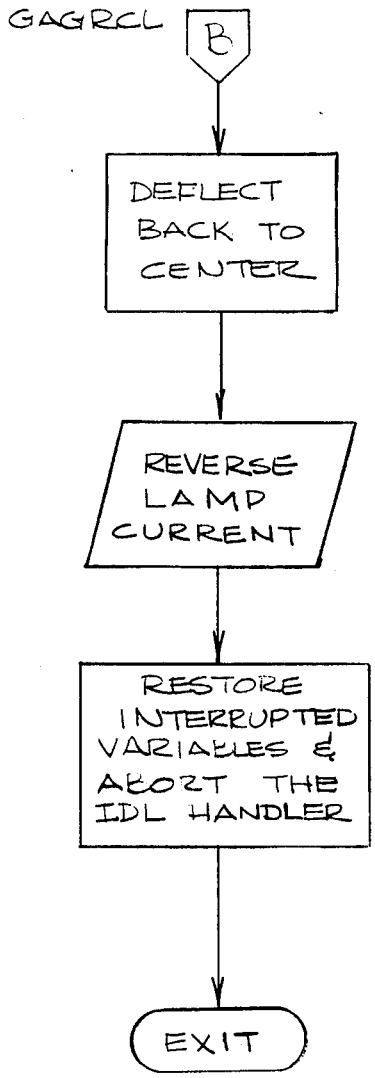
Figure 33A:
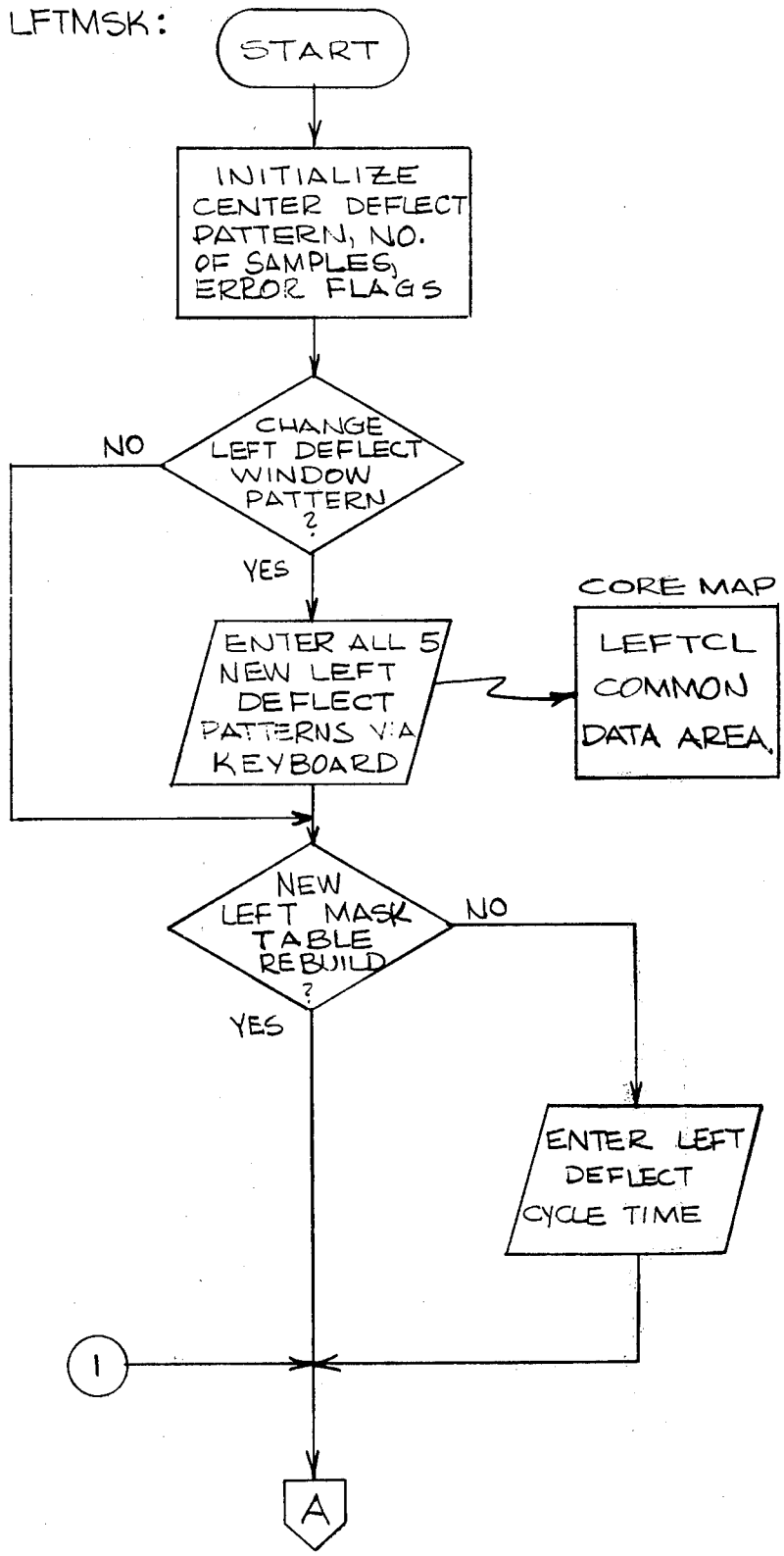
Figure 33B:
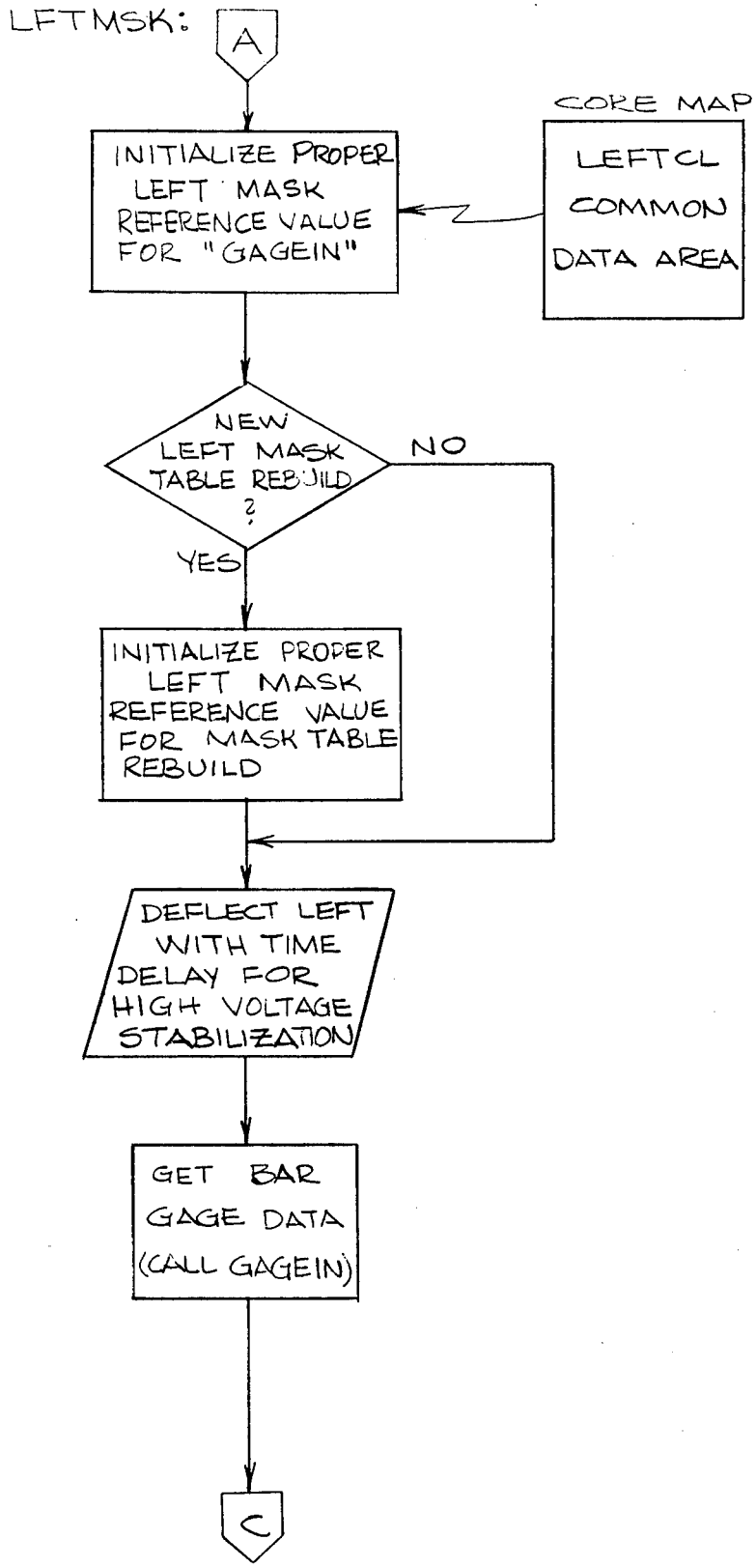
Figure 33C:
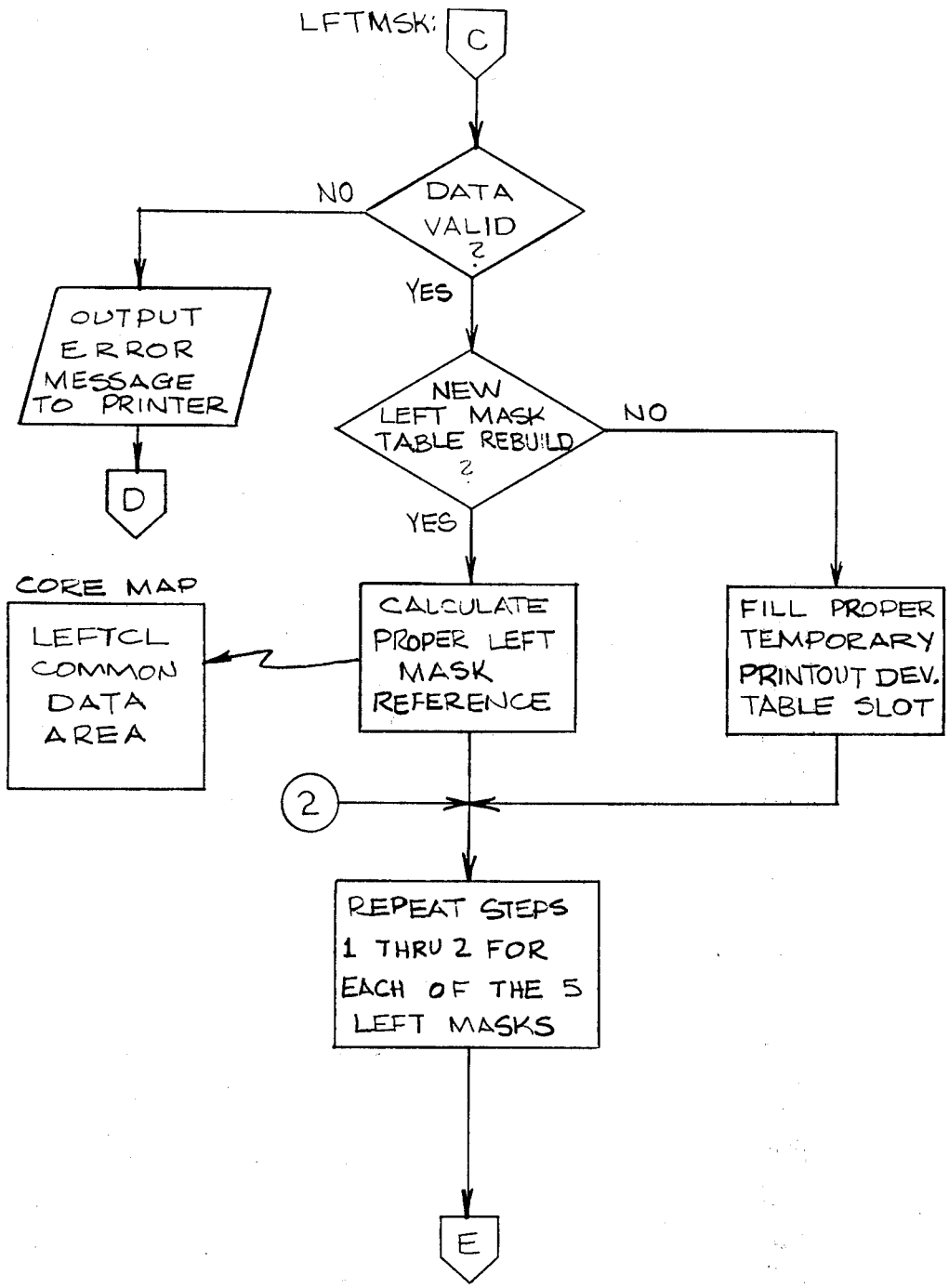
Figure 33D:
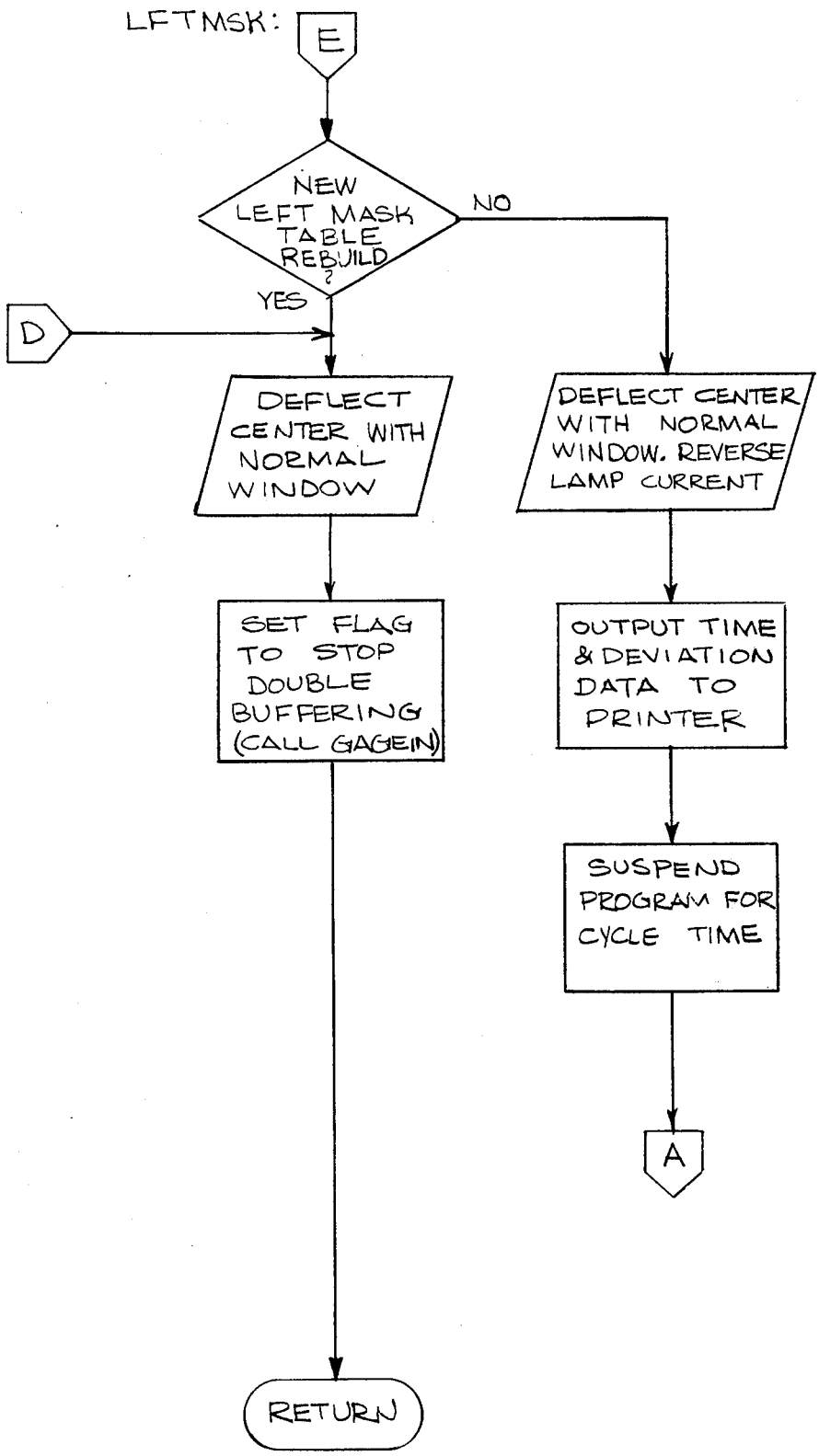

GAGRCL, see FIGS. 32A–C. This program is run under the on-line system. It requires no operator interaction. Its purpose is to automatically recalibrate the bar diameter gage periodically by updating the drift correction terms ITMP1 and ITMP2. It deflects the camera sweep to scan the right mask 94 and equates the drift terms with any deviations from an initial calibration reference value. Before exit, the sweep is returned to the center with a normal window, and the back-light-source current is reversed.

The automatic recalibration system provides the means to maintain gage accuracy by checking the calibration whenever bar 10 is not in the gage field-of-view. This recalibration system is implemented after bar 10 clears the gage, and before the next one passes through, as determined by a signal from hot metal detector electonics 57. This is accomplished using software to calculate scaling factors based on the differences between an on-line measurement of a known internal reference, right mask 94, and an off-line measurement of the same internal reference made during system calibration. Following a recalibration, the measurements on the next bar 10 in the gage field-of-view is corrected using these scaling factors.

The key to the recalibration measurement is masked photocathode electrode 91 on the front of the image dissector tube 90. The mask pattern is shown in FIG. 5. The photocathode electrode 91 has five 0.1 inch wide masks spaced 0.1 inches apart on the left side and a single 0.25 inch mask centered on the right side. Construction and operating features of image dissector tube 90 and photocathode 91 are described above in FIGS. 4, 5, 6. There are "C" scan, "R" scan and "L" scan positions established by X-axis bias. There is no distinction between right mask camera signals and bar camera signals. If no adjustments are made to the electronics, the measurement of the right mask at time $T_1$ should be the same as the measurement at time $T_2$. Any differences are assumed to be electronic drift.

The recalibration system only uses right mask 94 to calculate the correction factors. The five left masks 95 are only used in the off-line calibration system for linearity checks. The right masks for both cameras are measured and saved on the disc by executing the right mask program "RT" in the off-line calibration system. The two variables are stored in core in common data area MSKCOM under the names IMASK1 and IMASK2. This data is transferred from disc to common area MSKCOM in core when the control system is activated.

The on-line measurement of right mask 94 is performed by the GAGRCL task. After hot metal detector 55 detects the tail end of bar 10 being rolled clearing the gage, GAGRCL deflects both dissector tube images to the right and measures mask 94. The difference between the measured value from camera 1 and IMASK1 is stored in variable ITMP1 in common data area TMPOFF. The difference for camera 2 is stored in ITMP2 in area TMPOFF. These values represent changes in the gage measurement from the initial calibration to the on-line recalibration.

The on-line correction function is performed in subroutine CMPNST using variables ITMP1 and ITMP2. A slope correction is applied to each measurement based on the following formula:

For Camera Head 1:

$$\text{Corrected Bar Size} = \text{Bar Size} - \left(\frac{\text{Bar Size} \times ITMP1}{0.5''}\right) \quad \text{(Eq.20)}$$

-continued

For Camera Head 2:

$$\text{Corrected Bar Size} = \text{Bar Size} - \left(\frac{\text{Bar Size} \times ITMP2}{0.5''}\right) \quad \text{(Eq.21)}$$

As an example for an $ITMP1 = 0.0006''$:

The corrected size for a 0.5" bar =

$$0.5'' - \frac{[0.5'' \times 0.0006'']}{0.5''} = 0.4994'' \quad \text{(Eq.22)}$$

The corrected size for a 1.0" bar =

$$1.0'' - \frac{[1.0'' \times 0.0006'']}{0.5''} = 0.9988'' \quad \text{(Eq. 23)}$$

The corrected size for a 1.5" bar =

$$1.5'' - \frac{[1.5'' \times 0.0006'']}{0.5''} = 1.4982'' \quad \text{(Eq.24)}$$

The amount of correction for a ½ inch bar is equal to the values ITMP1 and ITMP2. Similarly, the correction is 2 X ITMP1 for a 1.0 inch bar and 3 X ITMP1 for a 1.5 inch bar. This is because lens 86 reduction is ½. Thus a ½ inch bar is projected as a 0.25 inch shadow on photocathode electrode 91 which is the approximate width of right mask 94.

LFTMSK, see FIGS. 33A–E. This disc resident subroutine is an overlay, run in the off-line mode, by means of which any of the following bar diameter gage functions may be exercised:

1. Left-deflect electronic window gates, used to select each of the five left-deflect bar references on left mask 95, may be changed to accommodate changes in image-dissector tube 90 parameters.

2. Left-deflect diameter reference values, stored in common tables, may be updated to compensate for drift, component aging, etc.

3. If no changes are desired, the program can be run cyclicly, with a deviation printout on printer 1068 of each of the five left-deflect etched bar references for each head, to observe electronic and temperataure related drift, see FIG. 33E. Maximum cycle time is 32,000 seconds.

Upon return from this subroutine, the image-dissector tube 90 sweep is returned to the center, a full electronic window gate is restored, and the current through the back-light source lamps is reversed, to prolong lamp life. This program is designed as a field-of-view and electronic drift check tool, with the additional capability of updating the window gates and reference table values. It is invoked by the subroutine SUBCLL, and requires operator interaction.

PROFILE AND POSITION PROGRAMS (203)

Figure 34:
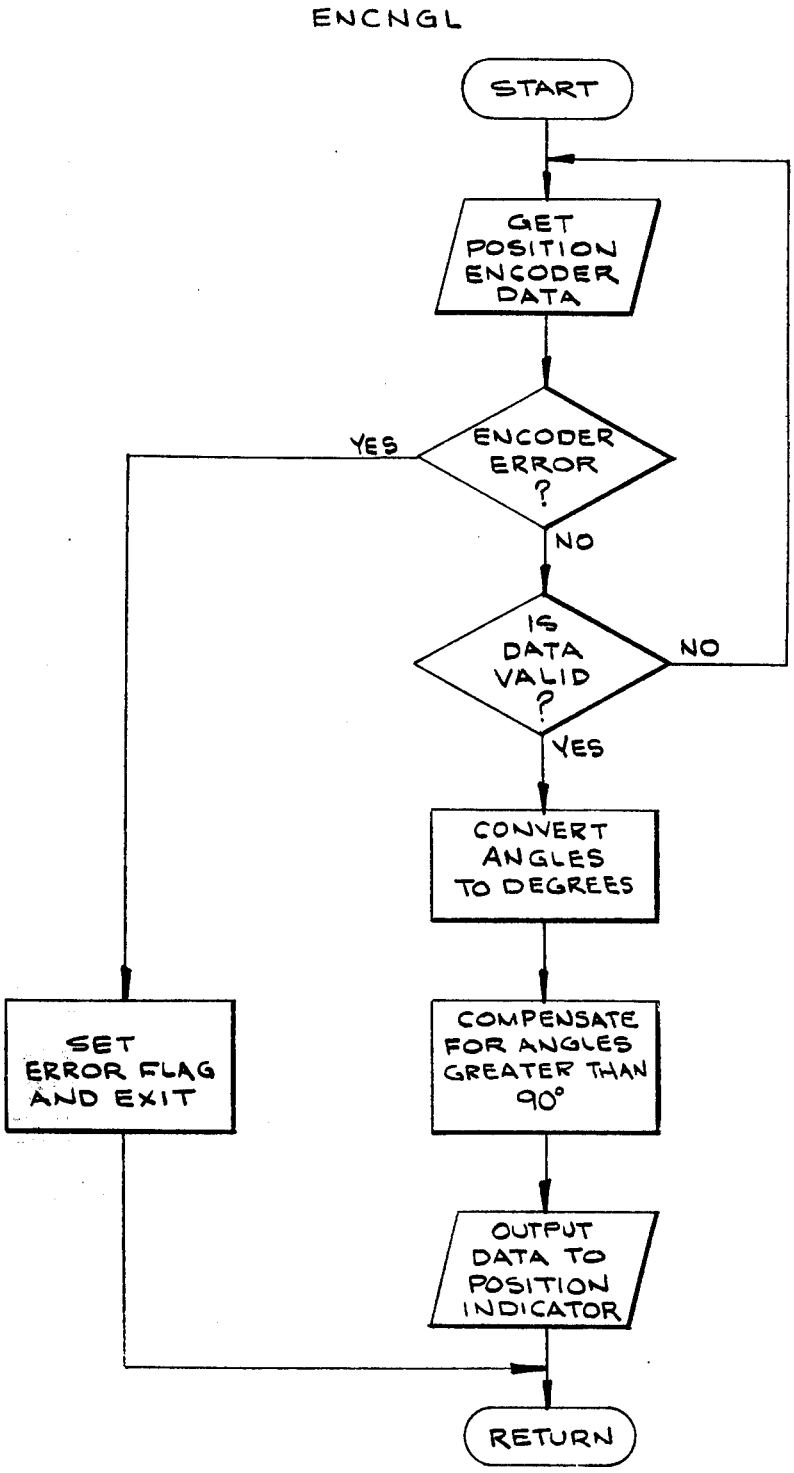

ENCNGL, see FIG. 34. This auxiliary subroutine is appended to any subroutine requiring the angular position of the bar diameter gage heads. It reads the position encoder electronics 23, checks validity, puts both the binary and decimal values of position into common, and sets an error flag in the event of encoder failure.

Figure 35:
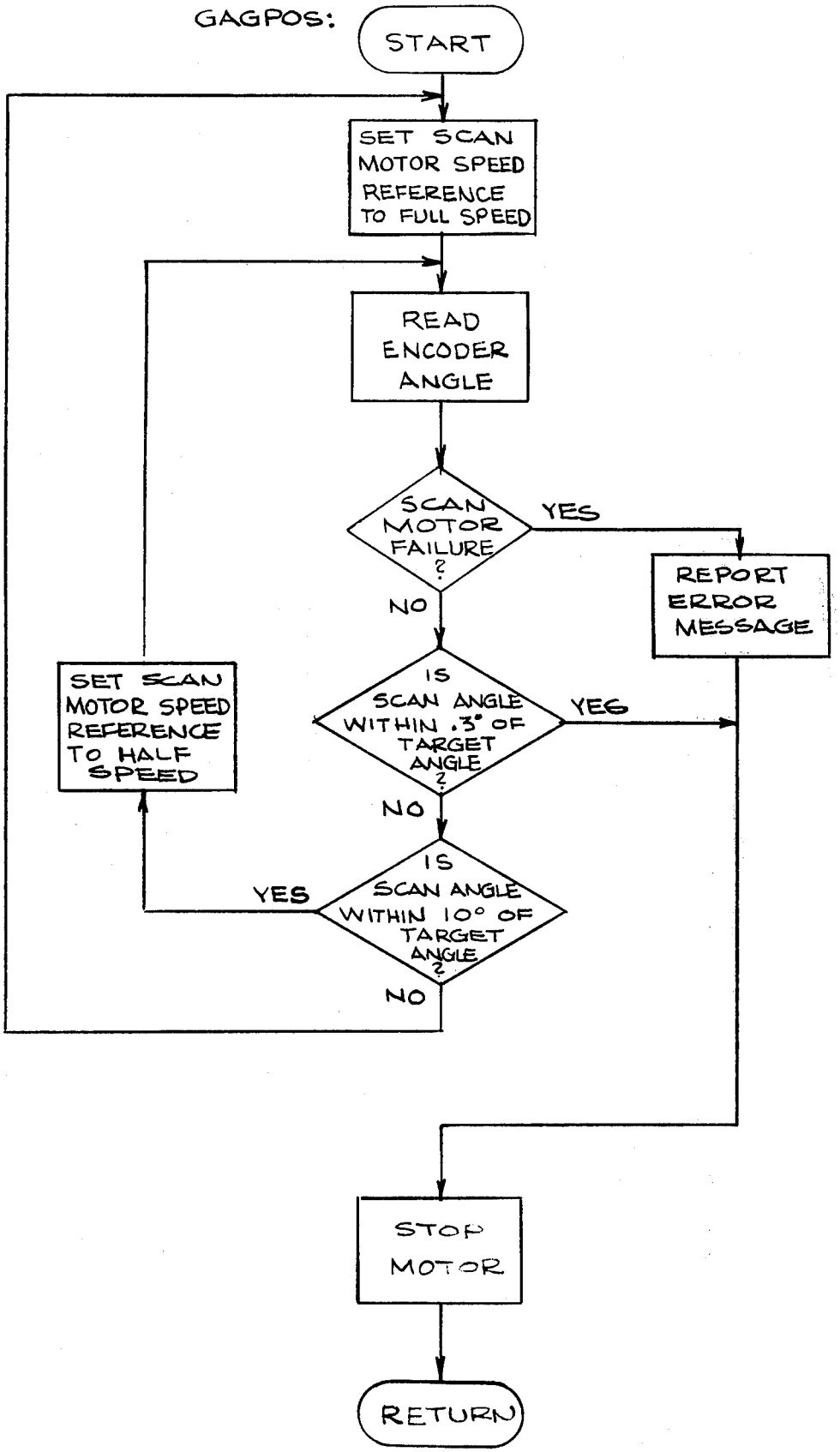
Figure 36A:
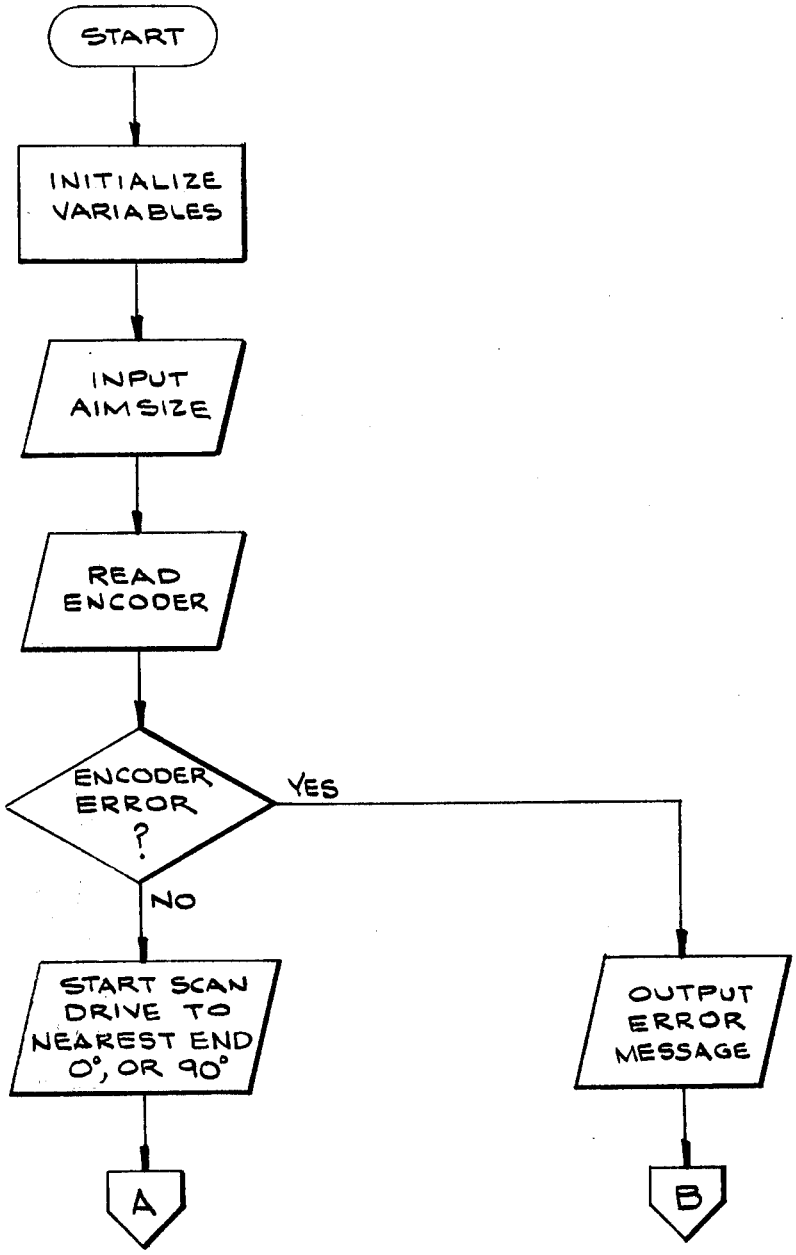
Figure 36B:
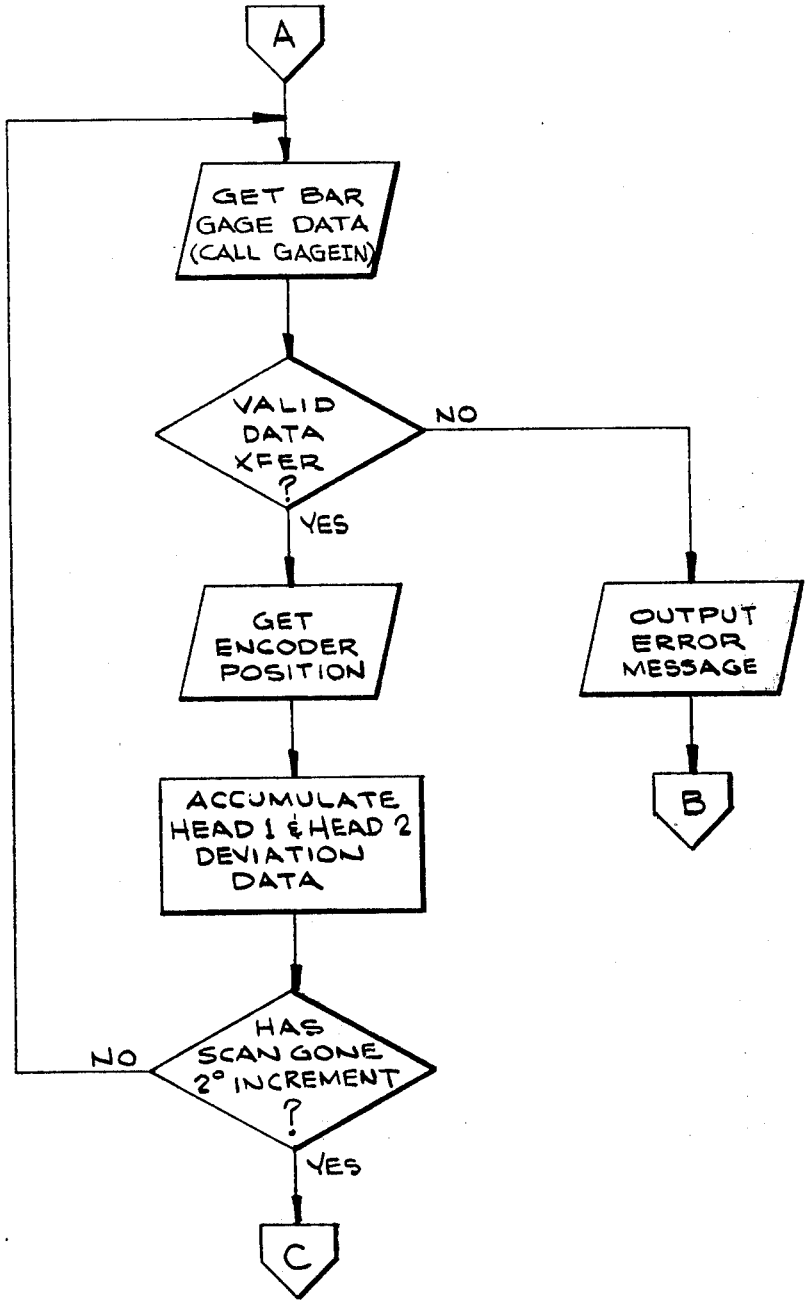
Figure 36C:
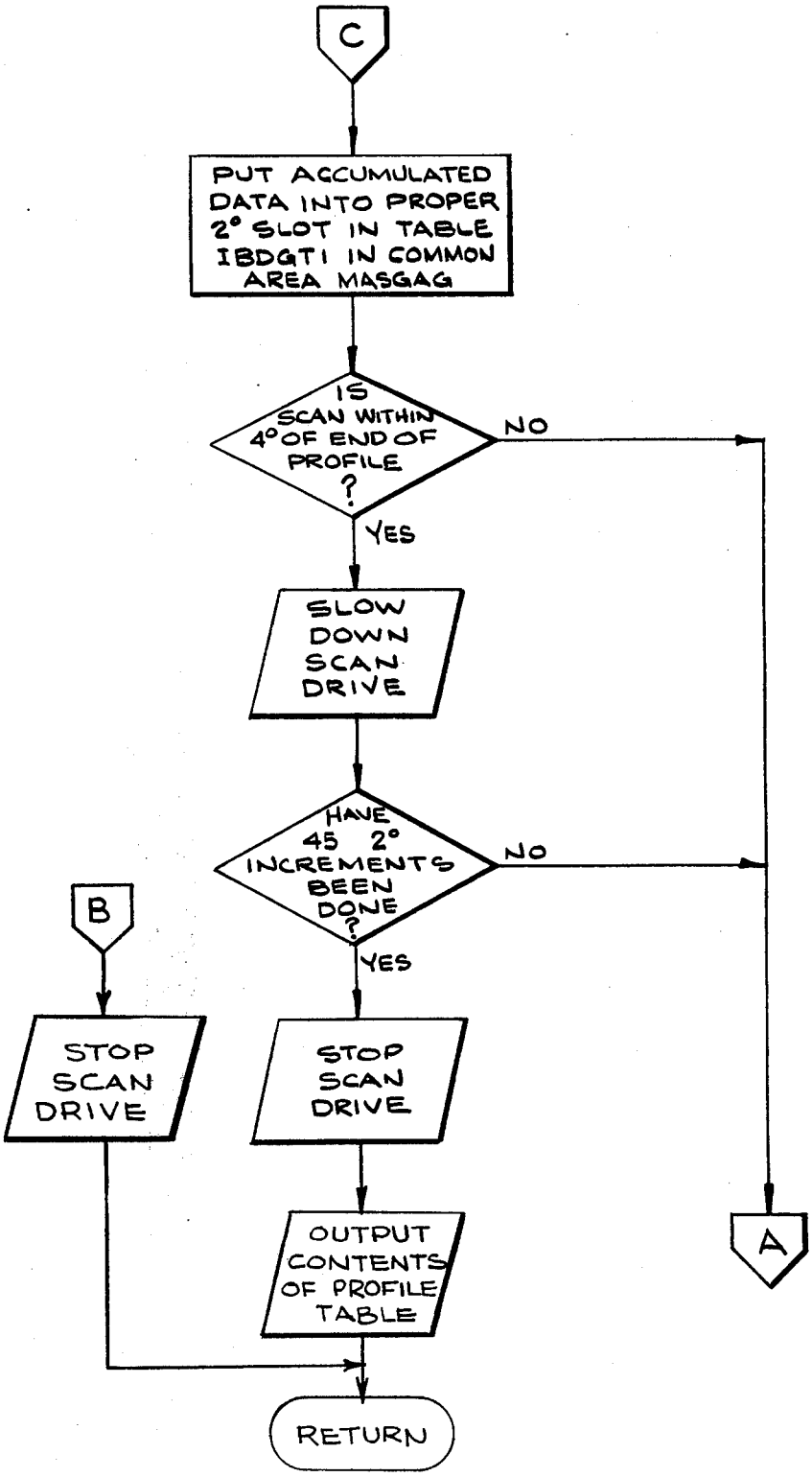
Figure 36D:
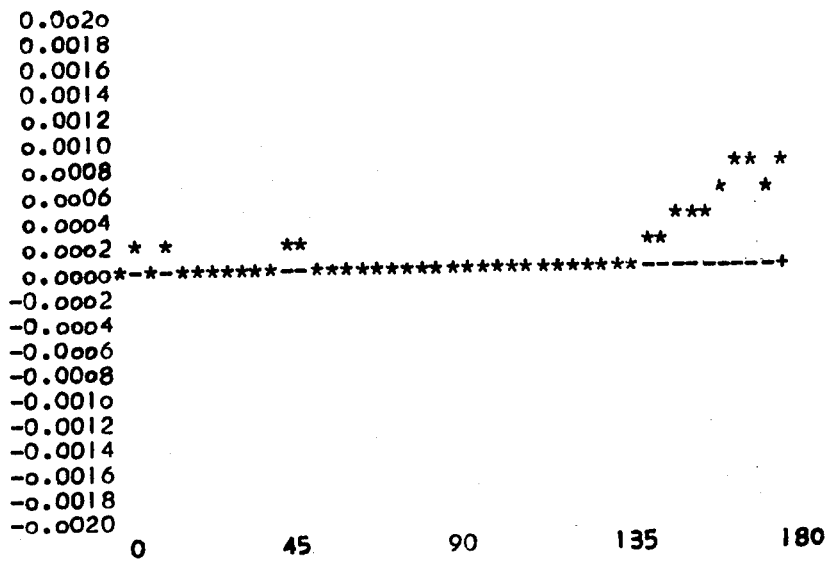
Figure 37A:
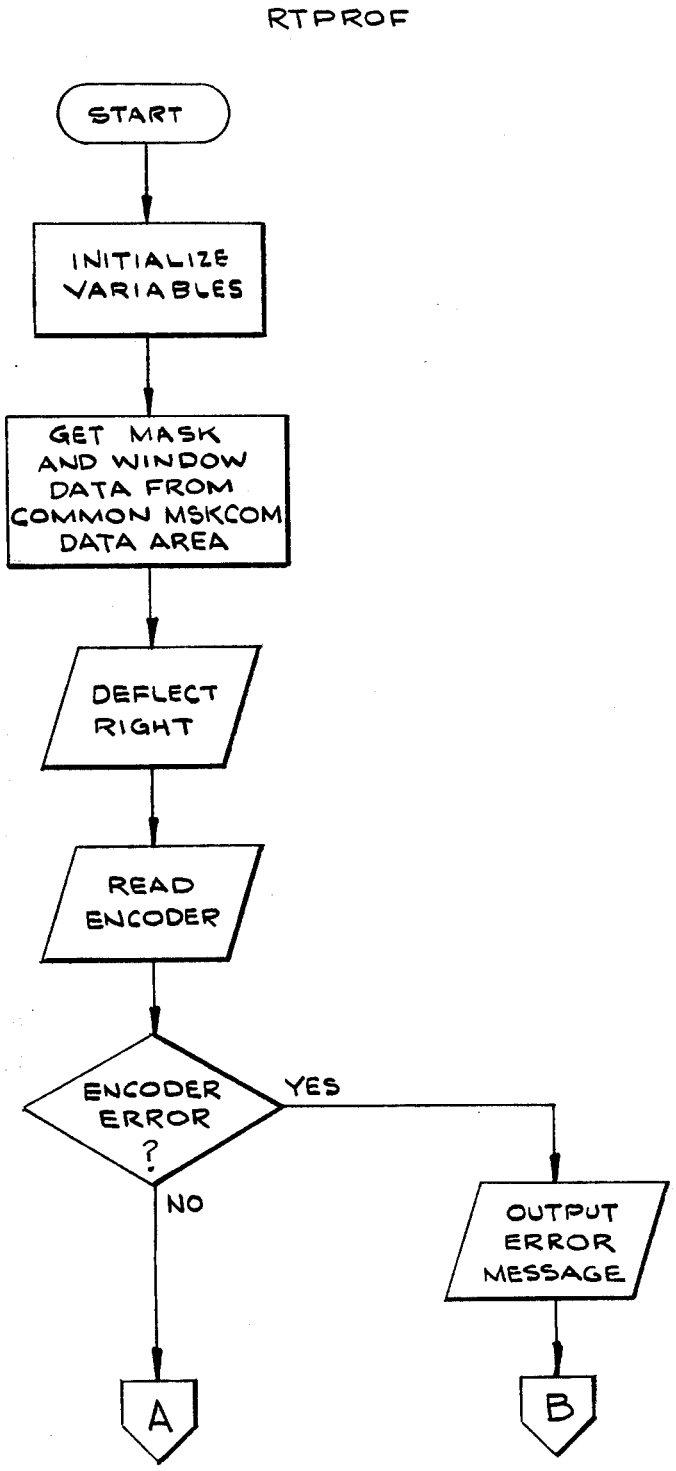
Figure 37B:
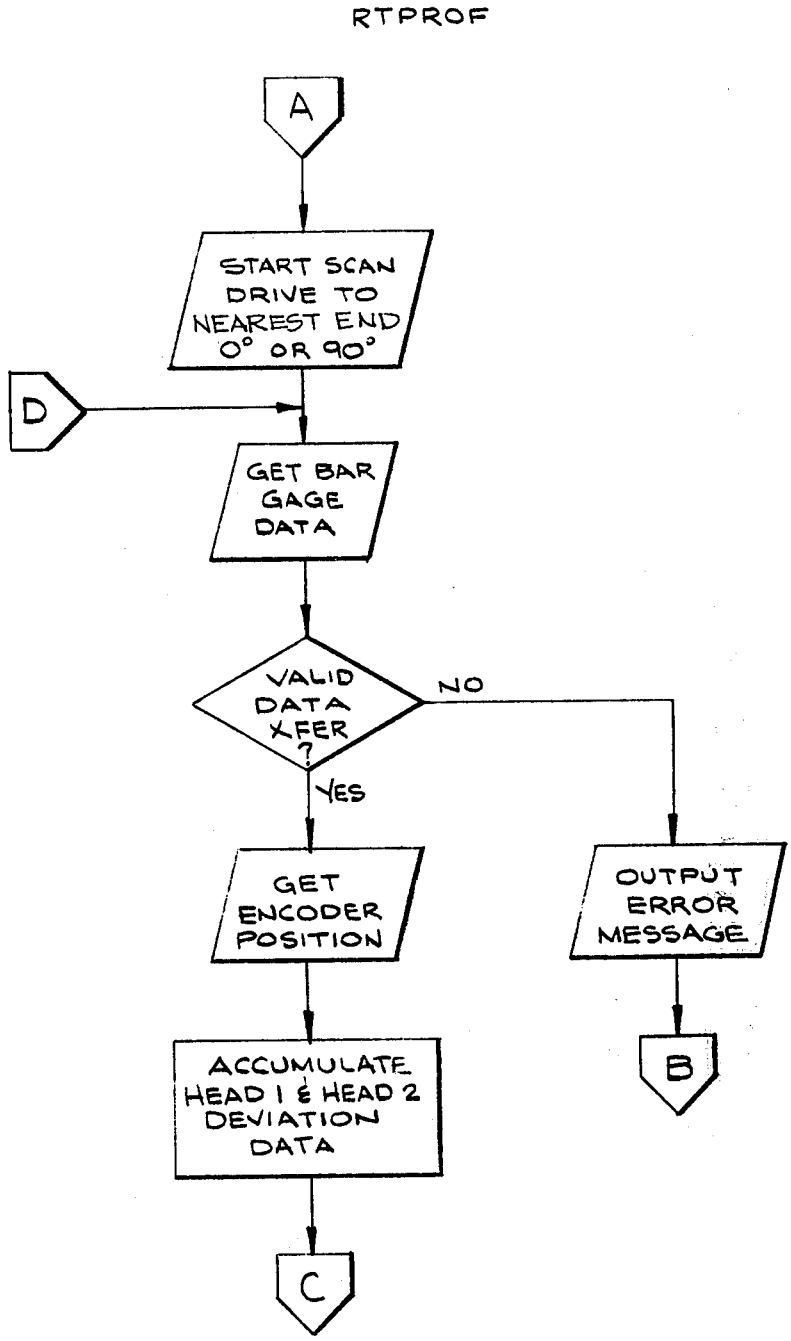
Figure 37C:
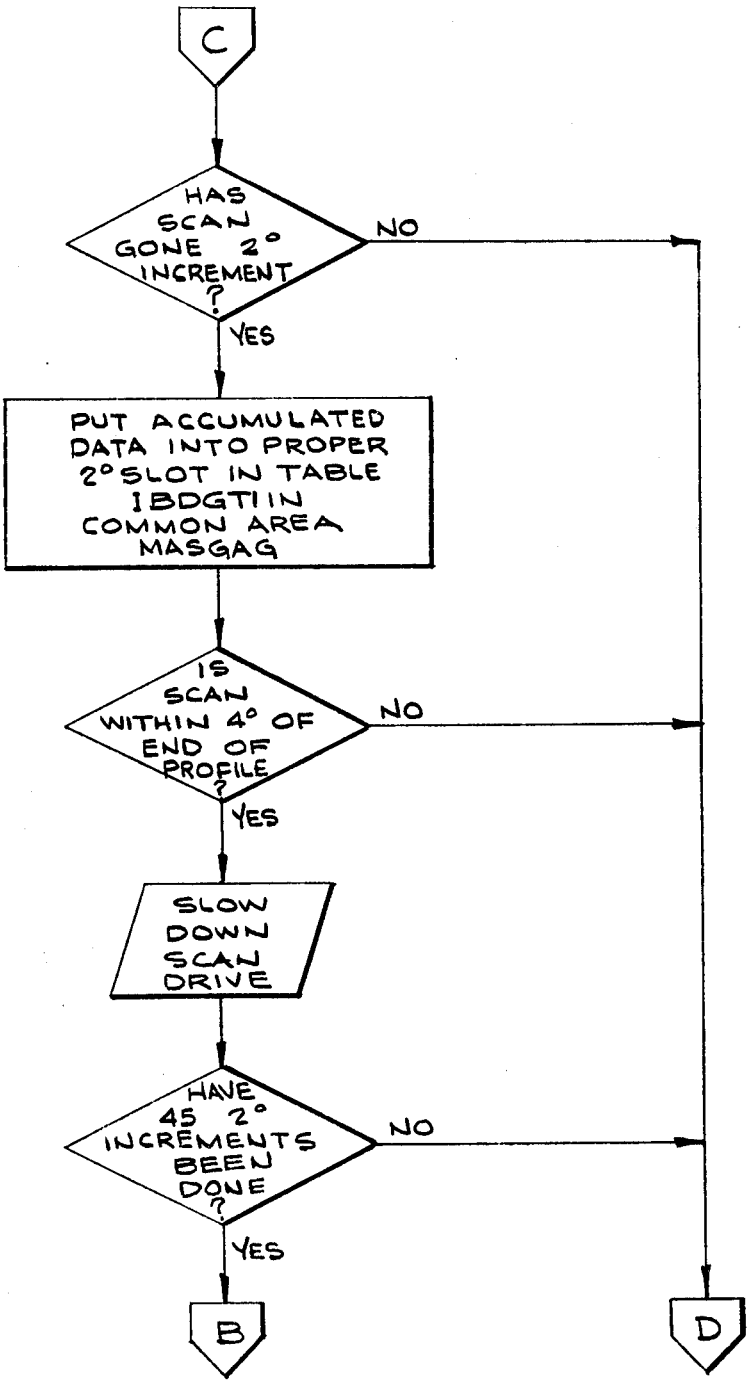
Figure 37D:
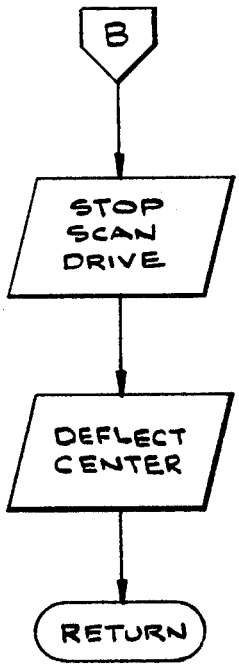
Figure 37E:
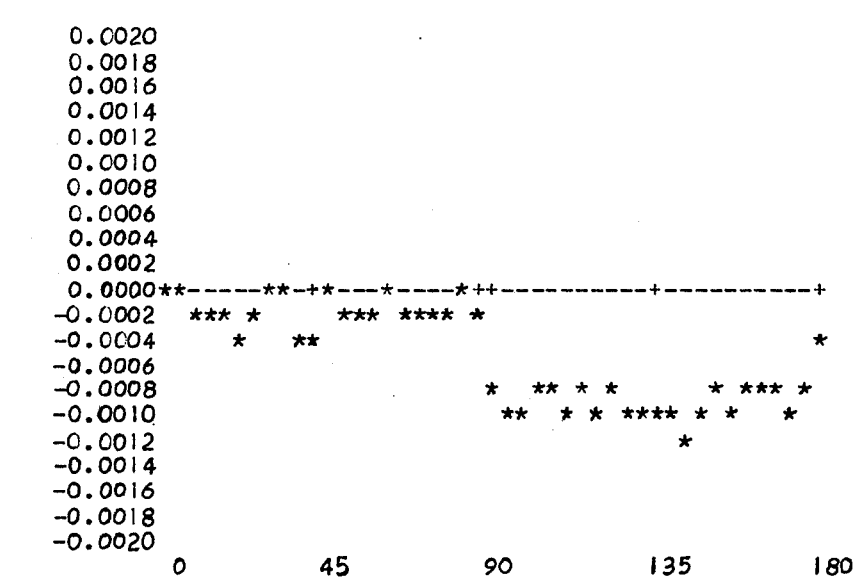

GAGPOS, see FIG. 35. This disc resident subroutine is an overlay, run under the off-line system, and requires operator interaction. It is invoked by the subroutine SUBCLL through the mnemonic SC. Its purpose is to drive the scanner to an angular position input through the terminal keyboard 1072, 1068. The following outline will aid in understanding the program:

1. If the target angle is greater than 10 degrees away from the scan position, full speed voltage is fed over cable 29 to scan motor controller 16 to drive toward the target angle. Less than 10 degrees, go to step 3.

2. Continue full speed until scanner is within 10 degrees of target.

3. When within 10 degrees of the target angle, output 16 is reduced to half-speed voltage.

4. When within 0.3 degrees of the target angle, apply zero volts to controller 16, and exit.

The operator is required to enter the target angle via the keyboard.

PROFIL, see FIGS. 36A–D. This program is run under the gage off-line system. It requires operator intervention. Its purpose is to scan the camera through a complete 90 degree cycle and build profile table FIG. 36D containing the deviations for each 2 degree increment IBDGT1(94). It does not plot this data. The PLOT routine PL run under the off-line system performs this task.

There are three possible error conditions generated.

1. Scan motor failure — indicates that the motor didn't start, or an end of the scan cycle was not found (0 or 90 degrees).

2. Encoder failure — generated if the ready bit was not generated by the encoder.

3. IDL failure — generated if an IDL transfer timeout occurs.

RTPROF, see FIGS. 37A–E. This program is run under the gage off-line system. Its purpose is to deflect to the right mask on both cameras while scanning the cameras through a complete 90 degree cycle and building a profile table FIG. 37E containing the deviations for each 2 degree increment IBDGT1(94). It does not plot this data. The plot routine PL run under the off-line system performs this task.

There are three possible error conditions generated.

1. Scan motor failure — indicates that the motor didn't start, or an end of the scan cycle was not found (0 or 90 degrees).

2. Encoder failure — generated if the ready bit was not generated by the encoder.

3. IDL failure — generated if an IDL transfer timeout occurs.

The program deflects scan right before beginning the profile and deflects back to center after the scan is complete.

Figure 38A:
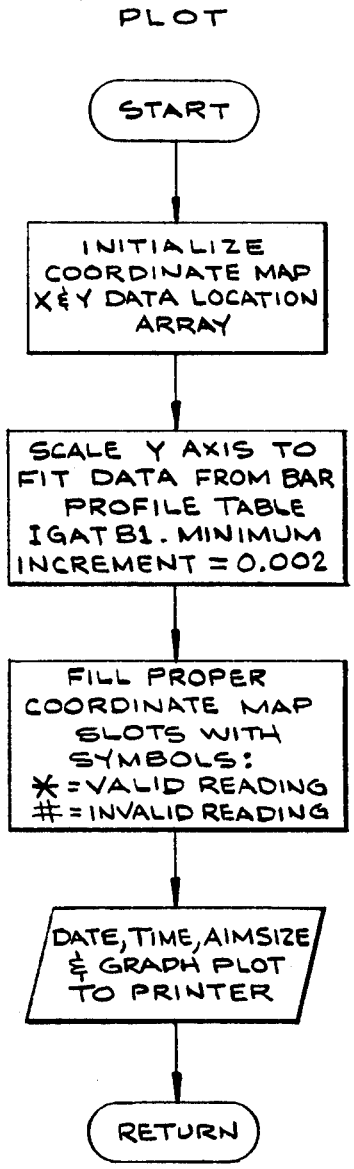
Figure 38B:
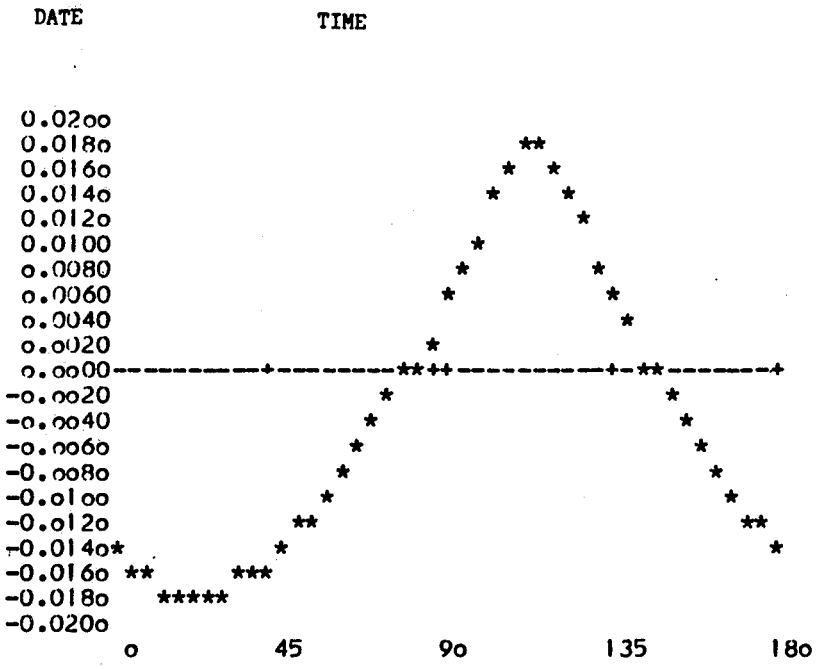

PLOT, see FIGS. 38A–B. This program runs under the off-line gage system. It does not require operator intervention. Its purpose is to plot the data contained in the profile table IBDGT1 stored in core 194, see FIG. 38B. The Y-axis is set to 10 rows above the axis and 10 rows below the axis. The scale is floating with a minimum of 0.0002 inches. Deviation is plotted along the Y-axis and angular position of the scanner is plotted along the X-axis in increments of 4 degrees per column. Data points which are blank or out of range are represented by a "#".

Figure 39A:
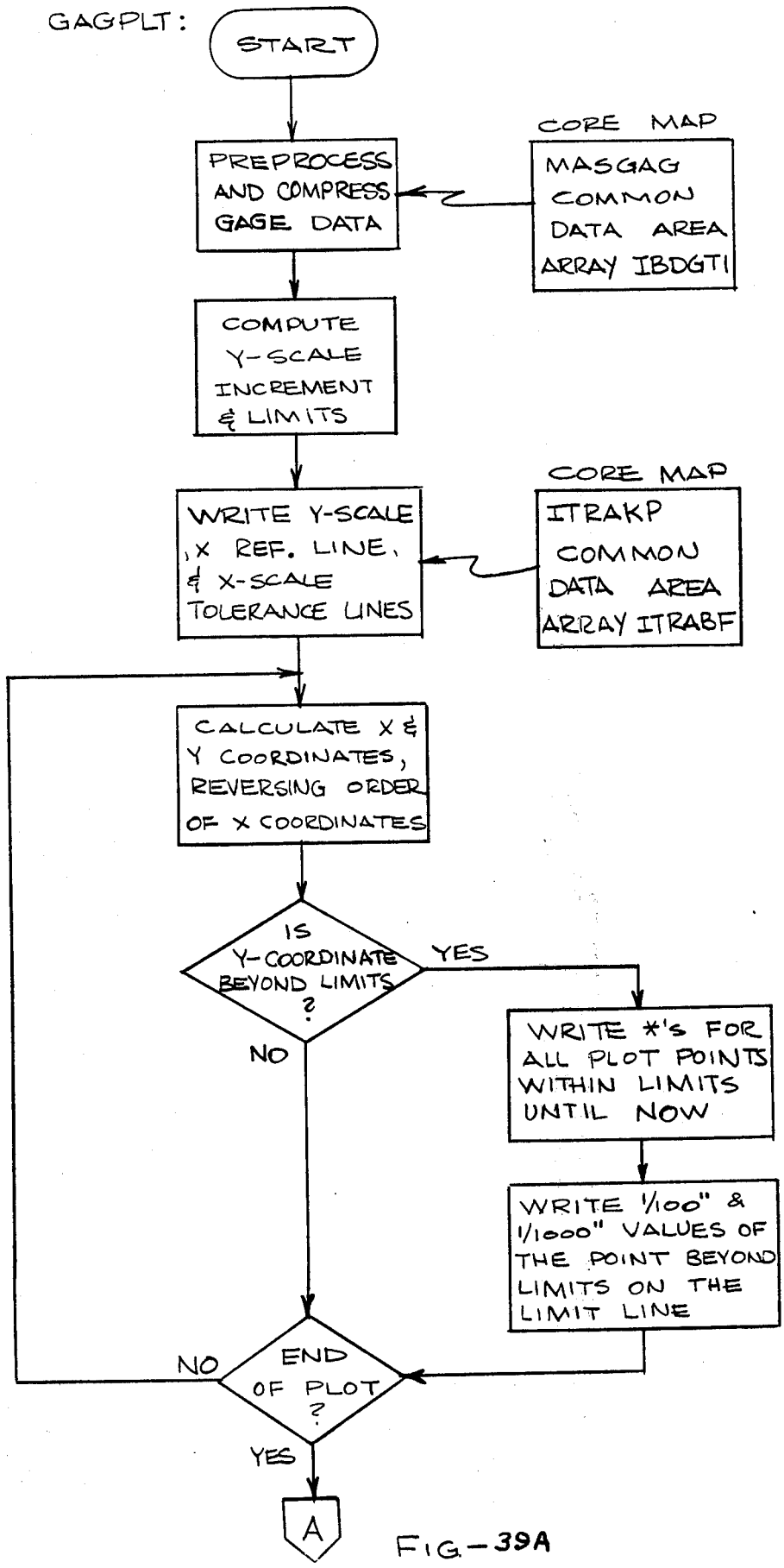
Figure 39B:
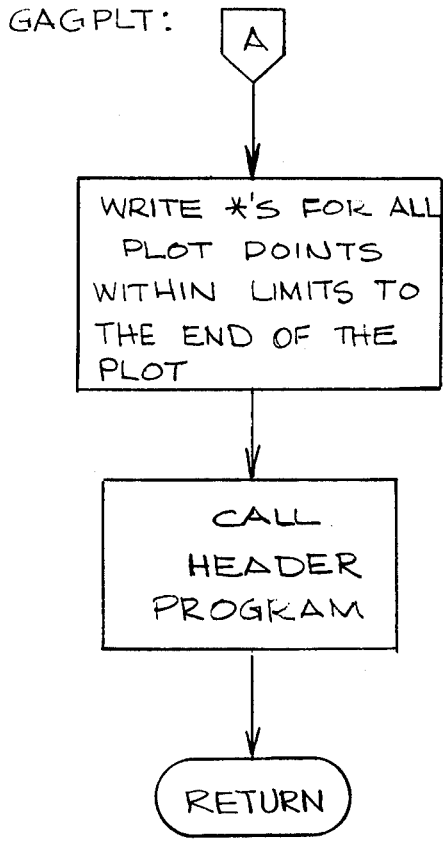

GAGPLT, see FIGS. 39A–B. This on-line program takes the 90 element profile table IBDGT1 stored in core 194 from common area MASGAG and compresses it to a 60 element table. Each table entry now represents 3 degrees. It scans the table and determines what Y-axis scale increments to use based on the maximum and minimum values in the profile table. This increment is either 0.001 inch or 0.002 inch. Next, it writes the aim size tolerance lines on CRT and printing terminals 1072, 1068. The program then calculates the Y displacement position of each 3 degree table entry and writes a "*" on the CRT and printing terminals 1072, 1068 corresponding to this X and Y location. Finally, it calls the HEADER program and exits. A bar profile display using the GAGPLT program is illustrated in FIG. 3 as printout 65 from printing terminal 1068.

Figure 40:
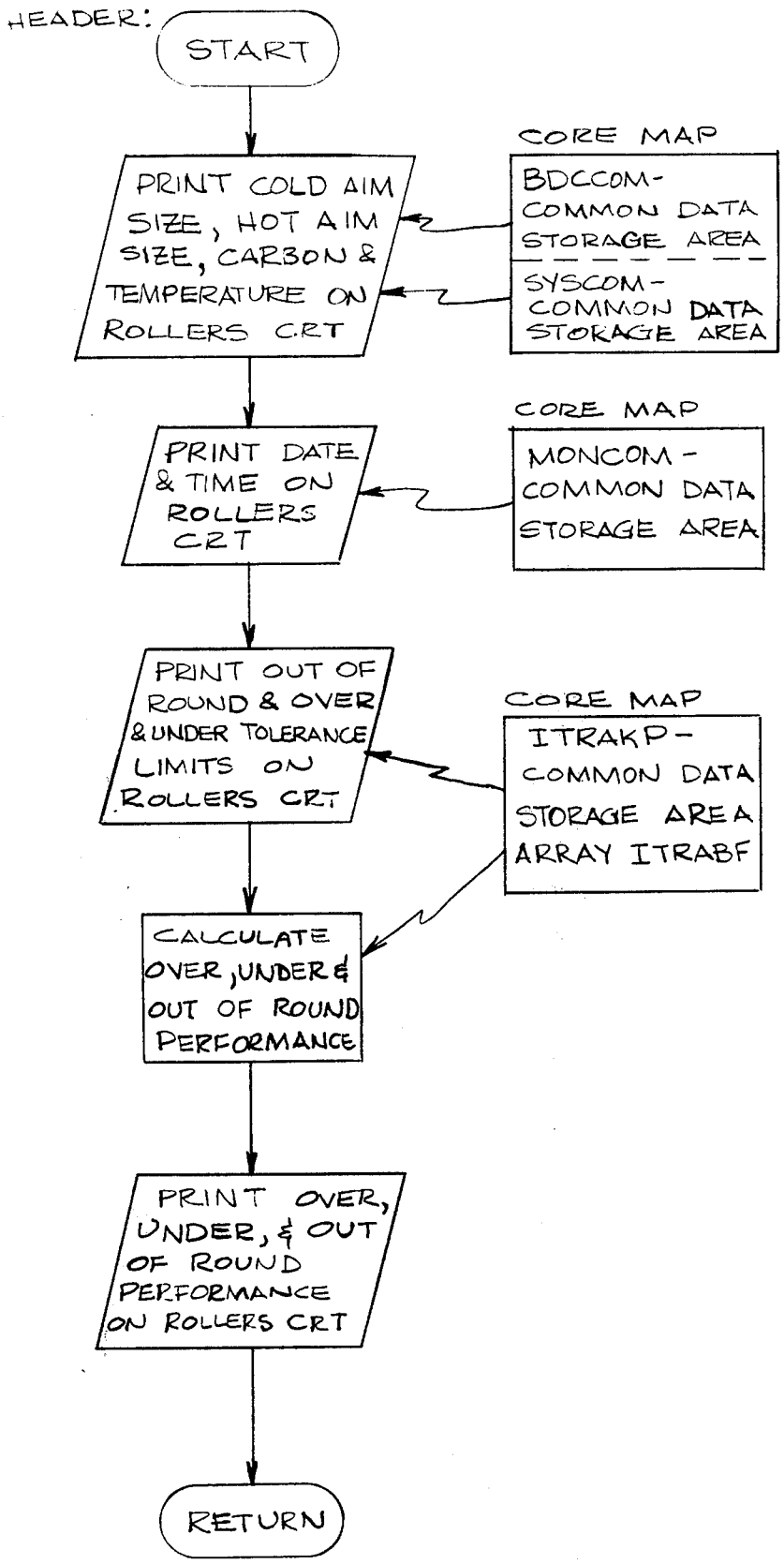

HEADER, see FIG. 40. This on-line program writes the bar cold aim size, carbon and temperature on CRT 1072. Next, it writes the date, time, maximum tolerance, minimum tolerance, and out-of-round tolerance on CRT 1072 also. Next, it scans the profile table IBDGT1 and calculates the over, under and out-of-round performance based on the respective tolerance limits. It then prints these values and exits.

Figure 41A:
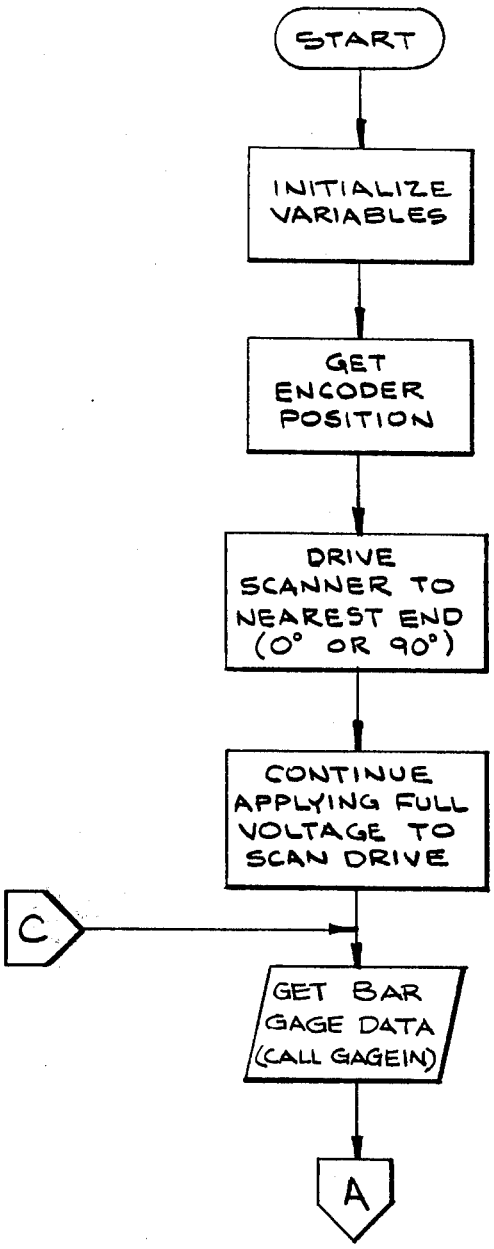
Figure 41B:
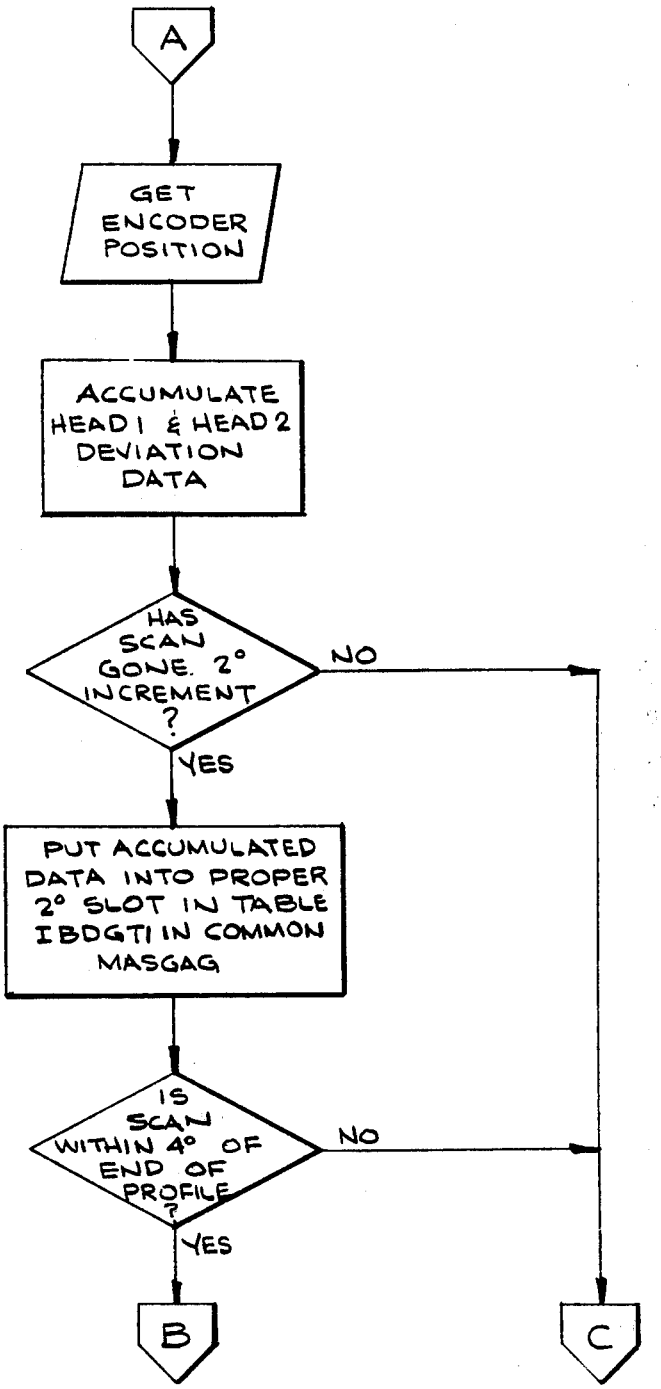
Figure 41C:
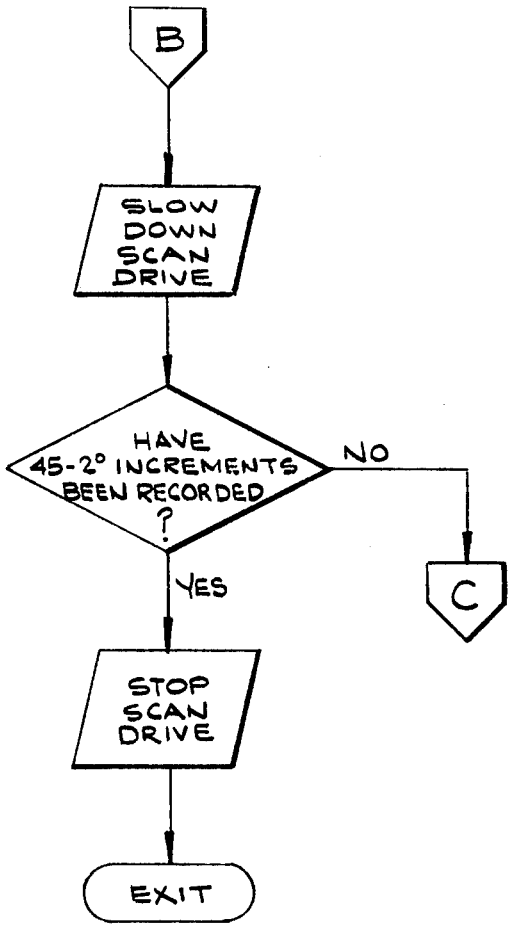
Figure 42A:
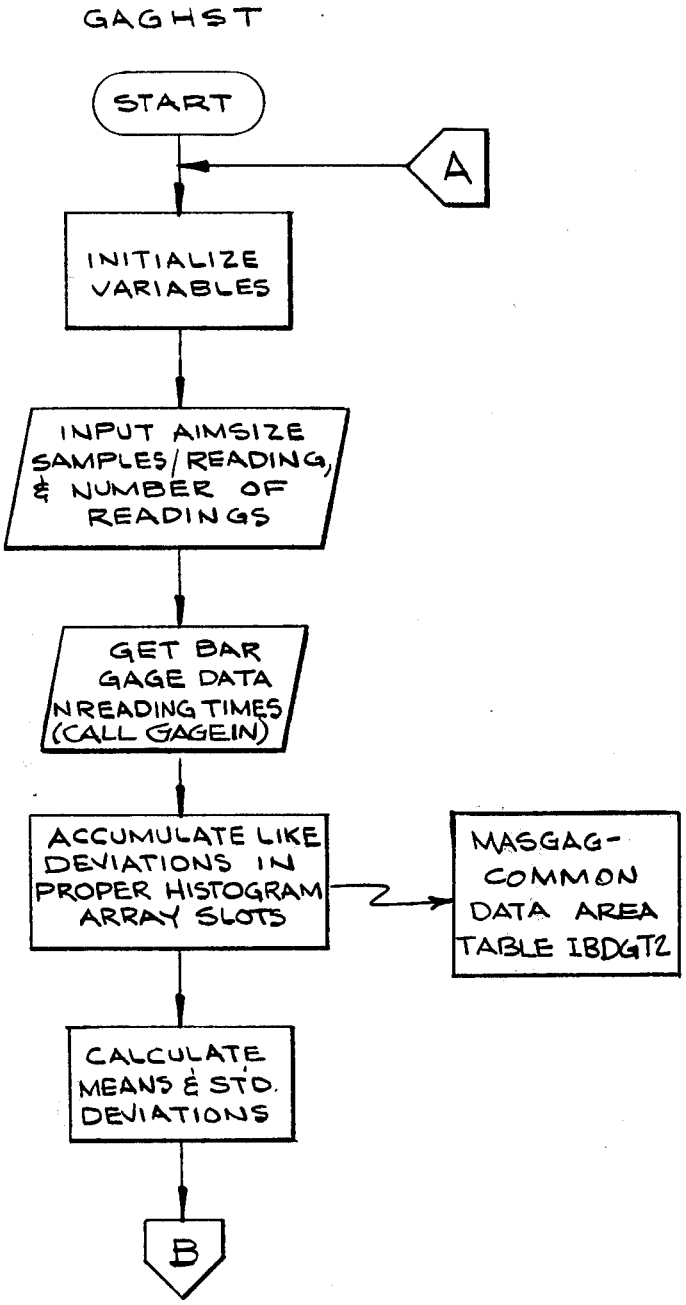
Figure 42B:
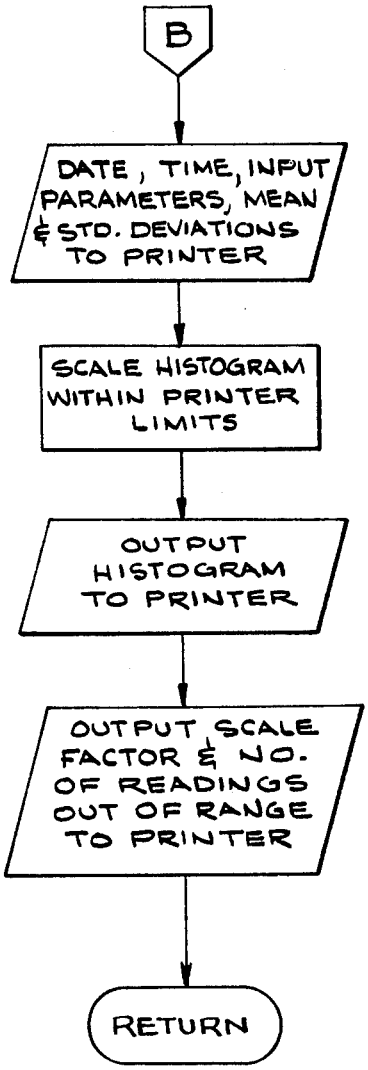

GAGPRO, see FIGS. 41A–C. This program is run under the gage on-line system. It requires no operator intervention. Its purpose is to scan the camera through a complete 90 degree cycle and build a profile table containing the deviations for each 2 degree increment IBDGT1(94). It does not plot this data.

There are three possible error conditions generated.

1. Scan motor failure — indicates that the motor didn't start, or an end of the scan cycle was not found (0 or 90 degrees).

2. Encoder failure — generated if the ready bit was not generated by the encoder.

3. IDL failure — generated if an IDL transfer timeout occurs.

HISTOGRAM PROGRAM (204)

GAGHST, see FIGS. 42A–D. This program runs under the on-line and off-line gage system. It requires operator intervention. Its purpose is to gather a number of readings from each head and print a histogram for each head binned at 0.0002 inch increments for a range of 0.005 to −0.005 inch. In addition, it calculates and prints the mean and standard deviation of all readings from each head. The operator must enter the number of readings desired and the aim size.

Remainder of Preferred System-Optimizing Diametric Bar Size

FIG. 44 shows a cross section of a bar 10 in a pass 1058 between vertical rolls 1020 and 1022. In the drawing the bar is moving out of the paper. The diameters referred to hereinafter are defined as follows. The diameter perpendicular to the roll gap is called the A diameter, the diameter 45° clockwise relative thereto is called the B diameter, the diameter at the parting line 1063 is called the C diameter, and the diameter 45° clockwise of the C diameter is called the D diameter.

The roll pass 1058 is designed with radii 1064 and 1066 to provide for some overfill adjacent the parting line 1063 without resulting in the production of fins on the bar 10. The second radius intercepts the first radius about 20° on each side of the parting line 1063. The bar 10 may be considered to be divided into two zones, viz., Zone I, in which the bar 10 is normally in contact with the pass, and Zone II, in which the bar 10 is normally out of contact with the pass 1058.

Figure 45:
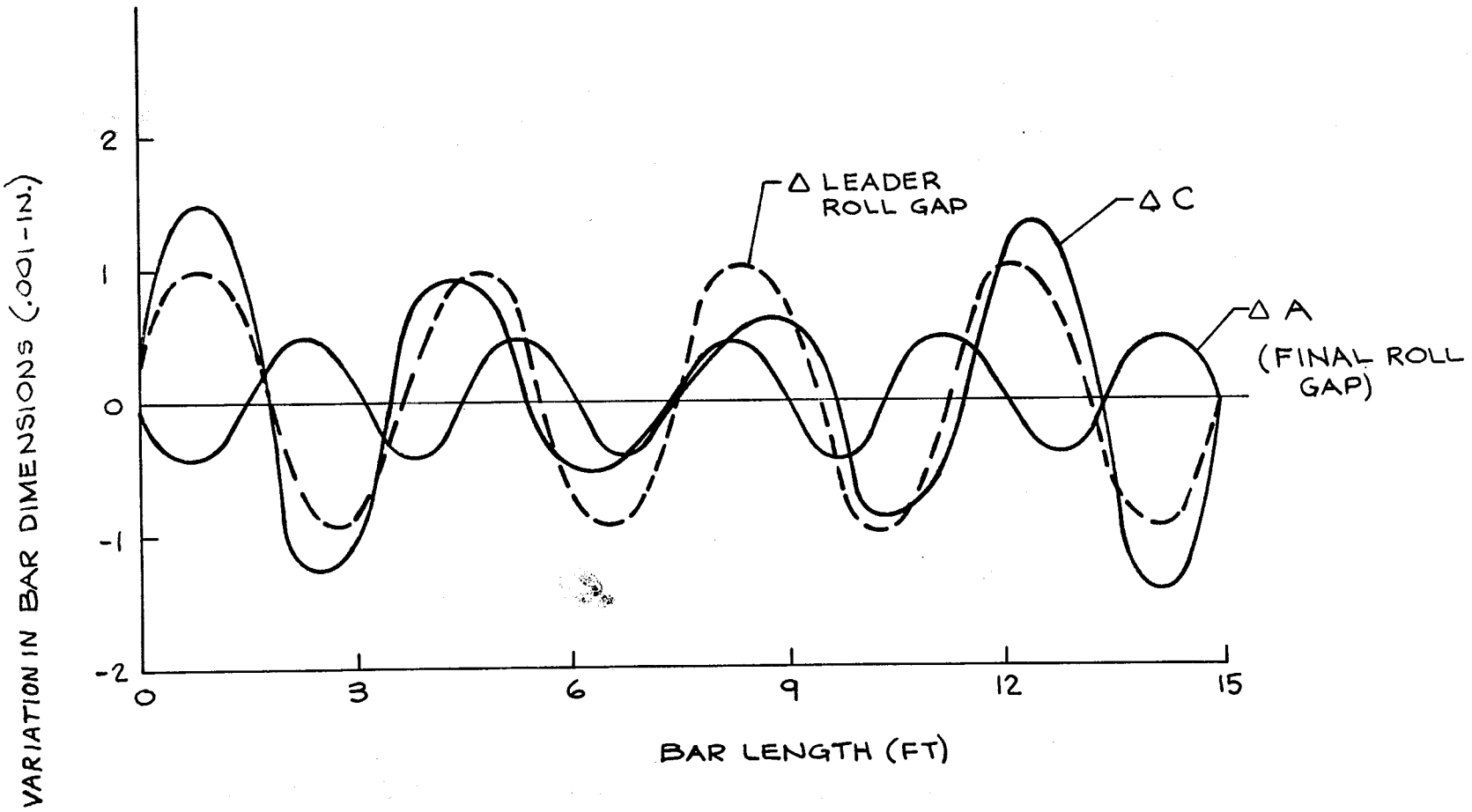

FIG. 45 is a graph showing the effect of roll eccentricity on the diameter of the bar lengthwise thereof. The abscissa is bar length, in feet, and the ordinate is variation in diameter, in $10^{-3}$ inches. The solid line ΔA shows variations in the A diameter, the solid line ΔC shows variations in the C diameter, and the dashed line shows variations in the roll gap of stand 1010. The variations in the C diameter are seen to be much larger than those in the A diameter. This is because the variations in C are a function, inter alia, of variations in the roll gap of stand 1010 as well as variations in the A dimension of stand 11. Due to roll eccentricity, variations in the A diameter typically approach a thousandth of an inch, whereas variations in the C diameter typically amount to as much as more than two thousandths of an inch. When other factors besides roll eccentricity are considered, total variations in the A diameter may be as high as $2\frac{1}{2}$ thousandths of an inch and variations in the C diameter may be as high as four thousandths of an inch. Both these variations are significant. Thus, unless these variations can be substantially reduced, by decreasing roll eccentricity, for example, these lengthwise variations in diameter must be considered in a mill control system such as the subject system. Larger bars are characterized by larger variations in the A and C diameters.

These lengthwise variations in diameters are taken into consideration by means of histograms taken along predetermined diameters of the bar. The frequency distribution of diameter variation is determined by applying independent probability combination techniques to these histograms. A broad description of how these histograms are used will be provided later in the specification.

Figure 46:
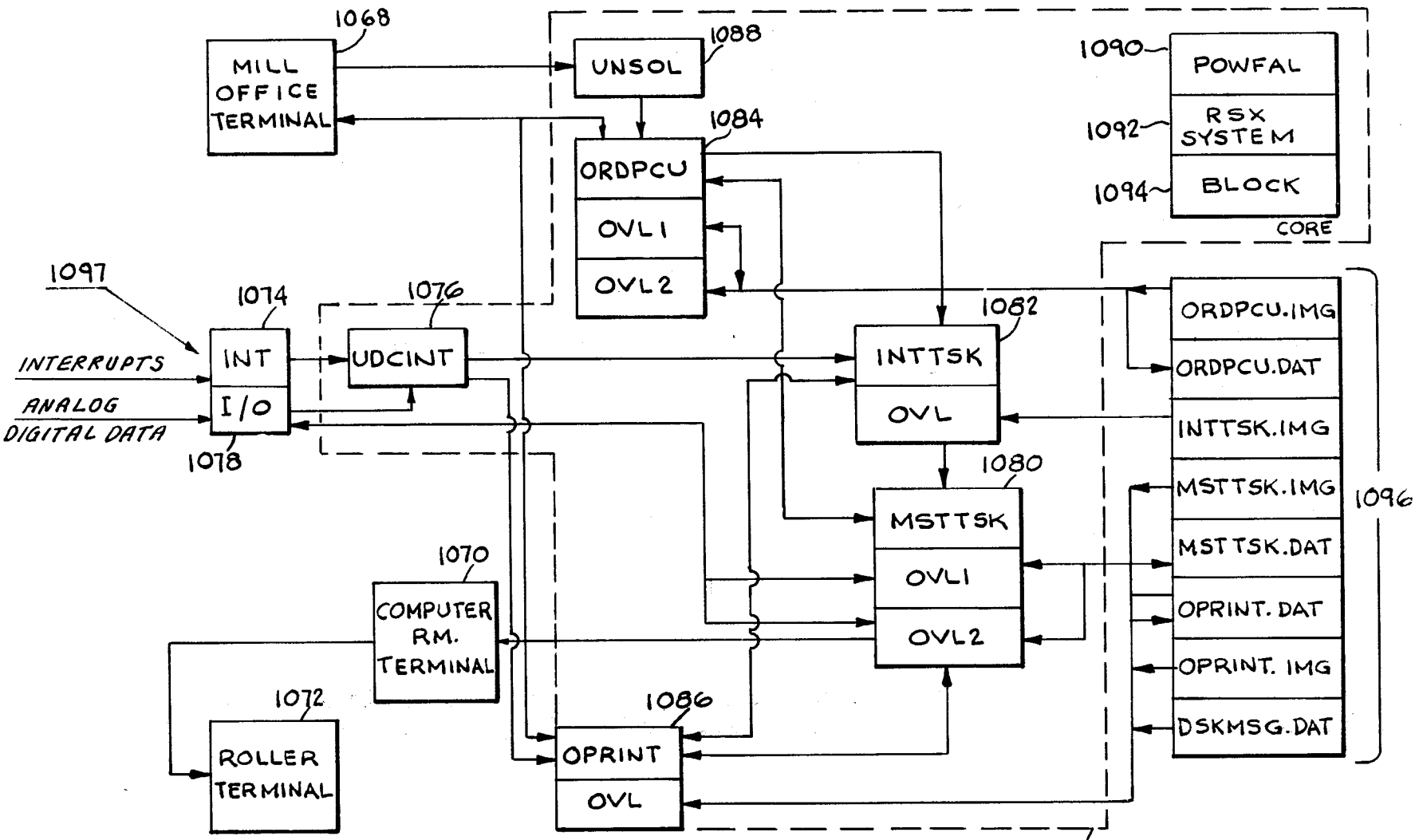

FIG. 46 is a block diagram of the computer 1028 and its peripherals for the subject invention. External to the computer 1028 are gage computer 27 and three computer terminals, viz., (1) a mill office terminal 1068 that supplies order data to the computer 1028 and receives mill performance data, etc., from the computer 1028; (2) a computer room terminal 1070; and (3) a roller terminal 1072 where the bar profile is continually displayed.

The computer 1028 comprises a core storage area 1029, a disk storage area 1096, and a UDC module 1097. The UDC module 1097 comprises an interrupt module 1074 and a digital and analog (A/D) input-output module 1078.

The interrupt handler 1076: (1) responds to interrupts from the interrupt module 1074 in the UDC, and (2) collects and outputs information from the A/D I/O module in the UDC.

Interrupt handler 1076 is scheduled by an RSX block 1092, described later, whenever one of the contacts in interrupt module 1074 changes state. Handler 1076 then interrupt module 1074 to determine which contacts changed state and the state to which they changed.

Events, for example, that cause such a change in state, may be: (1) the bar diameter gage 1051 is malfunctioning, (2) the hot metal detector 55, which is used to determine the presence of a bar at a certain point in the mill, has either begun to receive a signal or has stopped receiving a signal, and (3) the last bar 10 of an order has been pushed out of the heating furnace and is entering the mill.

Information collected includes, e.g., measurements shown in FIG. 1 from the bar diameter gage 1051, looper 1032, 1034 and pyrometer 48, as well as other information from the mill panels such as carbon content 44 as shown in FIG. 1A. Information outputted includes, e.g., bar position and screw down reference information.

The input/output module 1078 also communicates with a master task module 1080 (MSTTSK). The master task module 1080 is programmed as a core resident director program with six first-level control overlays OVL1 and thirty-one second-level data processing overlays OVL2. This task directs the operation of the subject mill control system in response to: (1) bar tracking and hardware status data from an interrupt servicing task module 1082 (INTTSK), and (2) item data from an order processing module 1084 (ORDPCU) and an operator's interrupt servicing module 1086 (OPRINT). The six overlays OVL2 of master task module 1080 (MSTTSK) directs: (1) the mill control system startup, (2) the initial, (3) optimization, and (4) monitor control sequences of the system, (5) the calculation of system performance, (6) it also directs manual bar diameter gage 1051 operation if automatic operation by computers 27 and/or 1028 are not desired. It executes sequence control logging upon request and exits when the control function is inactive.

The interrupt task module 1082 receives all interrupts from the interrupt handler module 1076 directed toward the mill control system. Such interrupts include, for example, a change in the state of the hot metal detector 55 in the system. The interrupt task module 1082 also responds to operator-related interrupts from OPRINT module 1086. Such interrupts include, for example, item changes, aim size changes, and pass changes.

The order processing module 1084 receives order information from the mill office terminal 1068 via a scheduling command from an unsolicited input module 1088 (UNSOL). Module 1088 buffers all unsolicited input data from alternate teletype, checks the validity of input code mnemonic, and transfers control to the various functions of the order entry system. Such unsolicited data include, for example, a request from the mill office terminal for a bar profile plot.

The order processing module 1084 simply controls the order entry functions for the subject control system. Such functions include, for example, entering carbon content, aim size, and customer order number.

The operator interrupt servicing module 1086 functions as an interface between the mill operator and the various interrupts. In addition, module 1086 acts as a low level executive in that it provides control over other dimension control tasks. For example, module 1086 may provide the operator with a visual display of important instructions such as "enter aim size". On the other hand, if the operator initiates a request for a change in aim size, module 1086 will carry out this request in the proper priority sequence.

The computer 1028 is provided with a POWFAL module 1090, a RSX SYSTEM module 1092, and a block module 1094. Module 1090 provides instructions for starting up the subject mill control system, for example. Module 1092 is a real time system executive, e.g., (1) it schedules the modules based on scheduling requests according to predefined user-specified priorities; (2) it handles real time system error conditions; and (3) it allocates system peripheral equipment such as keyboard, printer, etc. This system module 1092 is preferably Digital Equipment Corporation RSX 11BC-VSA. Module 1094 provides storage space for data that are common to all the control tasks.

The computer 1028 is also provided with an image and a data disk file 1096. As shown in FIG. 46, the image file stores programs ORDPCU.IMG, INTTSK.IMG, MSTTSK.IMG and OPRINT.IMG that will be executed in the task overlay space, while the disk data file stores data ORDPCU.DAT, MSTTSK.DAT, OPRINT.DAT and DSKMSG.DAT that are used by the task program overlays.

Figure 47:
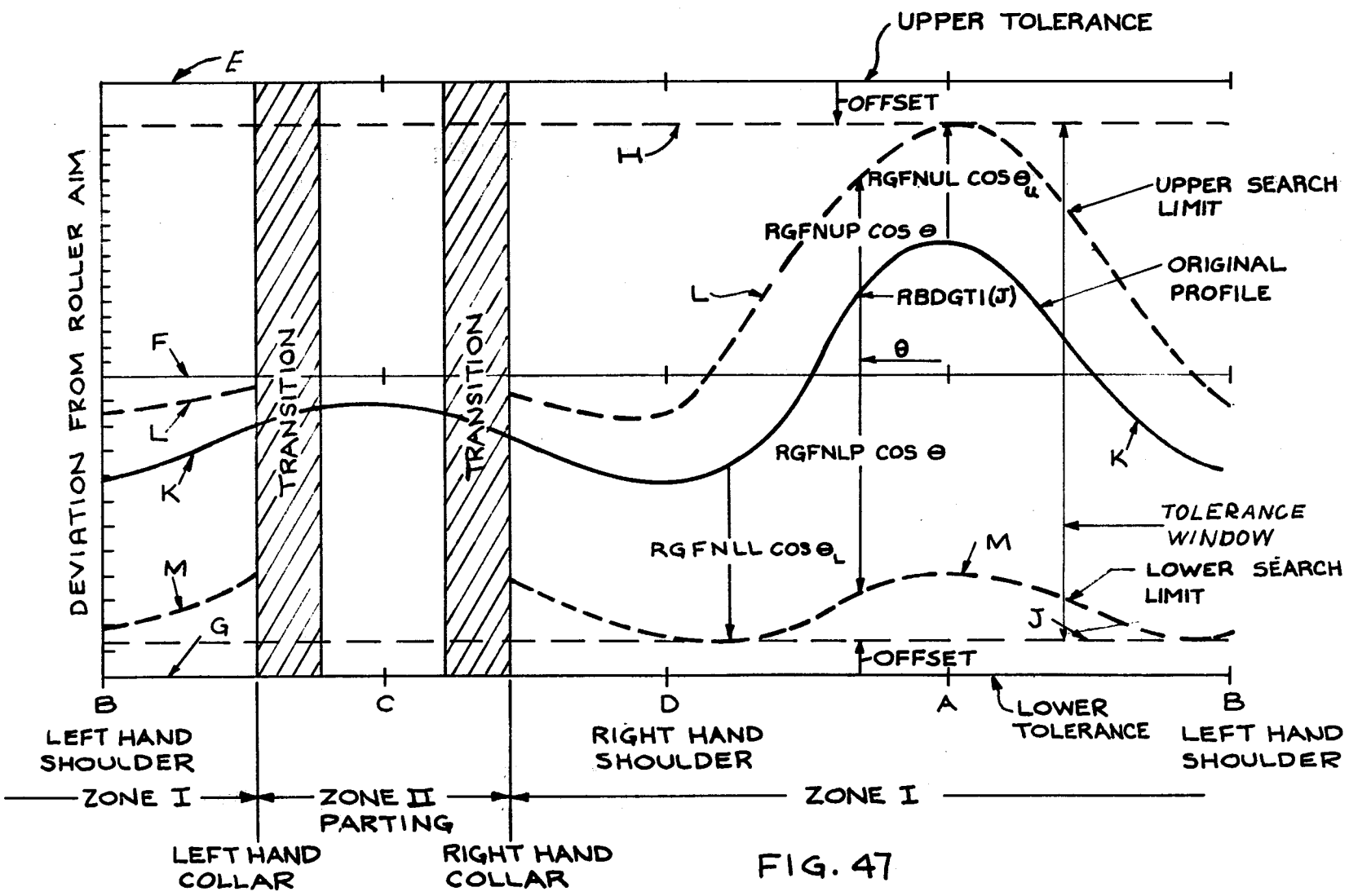

A typical bar diameter profile is shown in FIG. 47. This profile is obtained by rotating the bar diameter gauge 1051 through a 90° angle while collecting bar diameter data and averaging these values in 2° segments to produce an average bar diameter profile. This technique removes the effects of longitudinal variations in bar diameter. The abscissa is in terms of diameter position, from B clockwise about the bar, and the ordinate is in terms of deviation from aim size in $10^{-3}$ inch ($2.54\times10^{-3}$cm). The abscissa is further divided into Zone I and Zone II.

Points B and D are designated as the left hand and right hand shoulders, respectively. The junctions of Zone I and Zone II are called the collars. Those regions extending in from the collars toward C are called the transition areas, inasmuch as it is uncertain whether the roll is in contact with the bar in these areas.

The uppermost line E is the upper tolerance limit for the bar being rolled. The roller's aim, at the middle of FIG. 47, is marked F. The lowermost line G is the lower tolerance limit.

Because of the longitudinal variations in diameter values, the upper tolerance limit is offset downwardly to line H. At and below line H, at least 95% of the maximum bar diameters are below the upper tolerance. Similarly, the lower tolerance limit is offset upwardly to line J.

A typical bar profile K is shown in FIG. 47. Computed upper and lower profile search limits L and M, respectively, to be described in detail later in the specification, are shown in dashed lines.

Very broadly, the bar mill controlled by the subject control system operates as follows. As the first bar of an ordered item is threaded through the mill, the bar diameter gage 1051 is positioned with one of the scanning heads 12 stopped at the C diameter and the other head stopped at the A diameter.

Control of dimensions begins only when the signals from the loop height regulators 1036 and 1038 to the computer 1028 are stable and show that the bar is under substantially no tension as it enters and leaves the penultimate stand 1010. At this point, computer 1028 begins to process the output from the heads 31, 33.

Figure 48A:
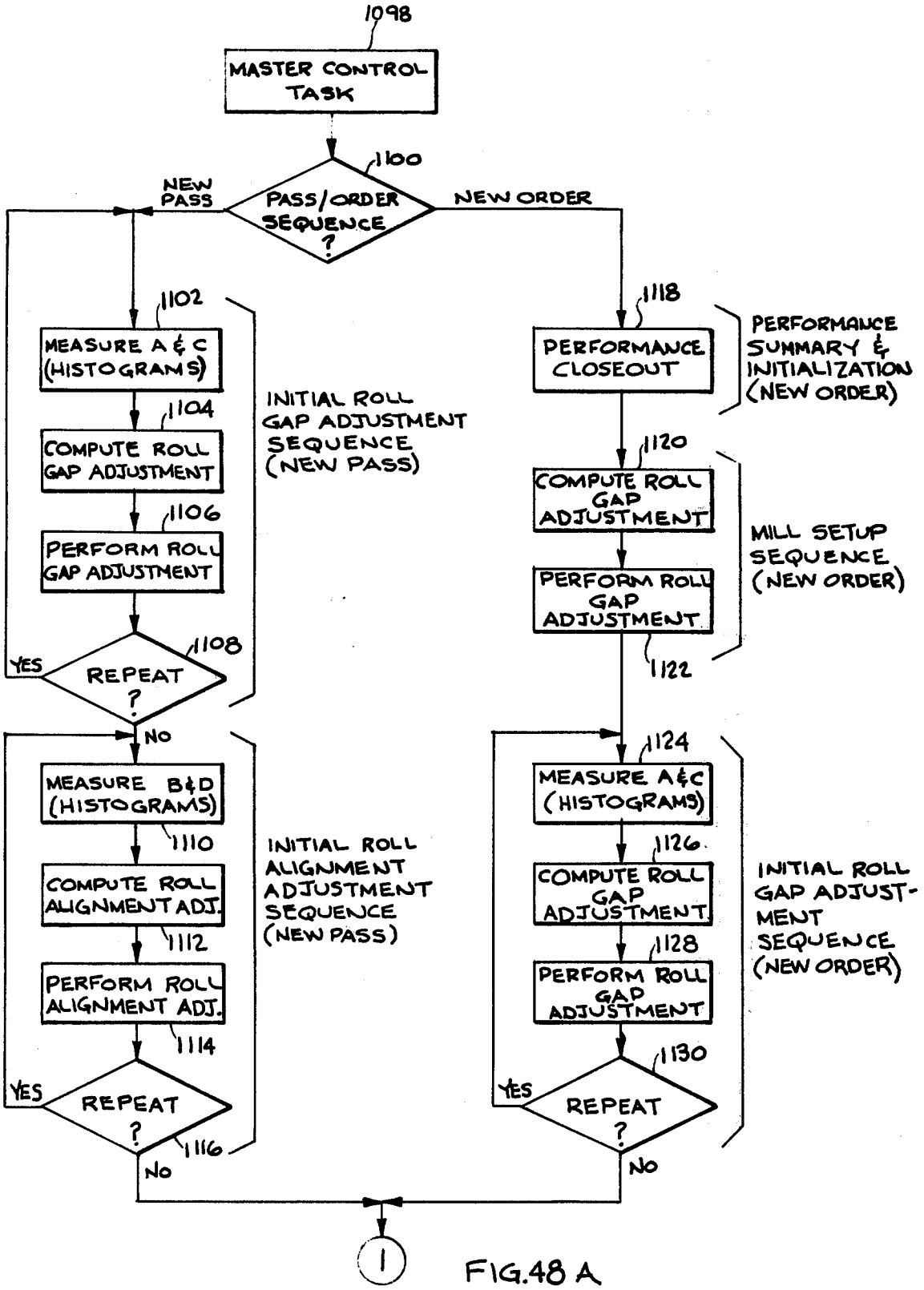
FIGS. 48A and 48B are flow charts of the broad control exercised by the programmed computer means.
Figure 48B:
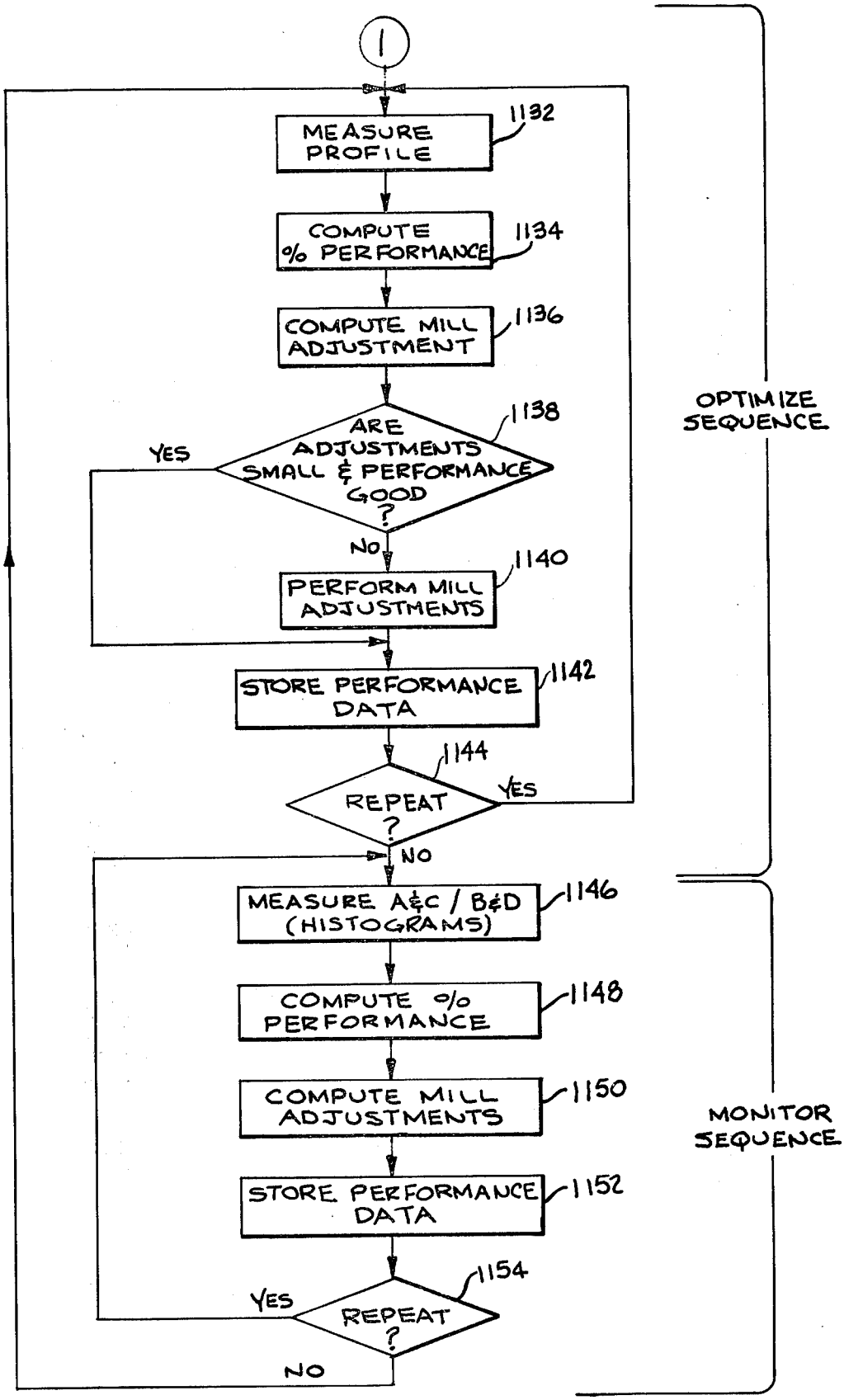

Reference is here made to FIGS. 48A and 48B, which show the flow charts for the initial sequence, the optimization sequence, and the monitor sequence of the subject bar mill control system.

The purpose of the initial sequence is to: (1) collect data for making histograms by way of computer 27 and program 202 which is to be used later in the optimizing sequence; and (2) make coarse adjustments to the rolls after a pass or item change has occurred. The purpose of the optimizing sequence is to more accurately control the diametric dimensions of the bar as a result of more complete data. The purpose of the monitor sequence is to minimize gage scanning and mill adjustments by observing variations from representative diametric dimensions obtained during the optimizing sequence.

Redirection of the program to another sequence is not allowed, if an interrupt occurs during any sequence, until the steps in the sequence reach a logical break point, e.g., the repeat blocks 1108, 1116, 1130, 1144, and 1154.

The master control task 1098, when scheduled or redirected by an interrupt, begins in the initial sequence by asking decision symbol 1100 whether the bar coming into the mill is a new order only, or whether the bar will also require a new pass in the rolls. Assuming that a new pass is required, block 1102 orders the bar diameter gage 1051 to obtain histograms along both the A and the C diameters. These histograms, as well as the A-C difference histogram, are stored in the computer 1028. To achieve this goal, diameter readings must be taken through at least eight full cycles of rolls 1020, 1022 rotation in the last stand 11. In the subject system, this takes about one second, and about 80 readings are taken during this time interval.

Each of these readings is modified by a factor based upon the bar temperature sensed by the pyrometer 48.

As the readings from the gage 1051 are received by the computer 1028, computer 1028 converts each reading to a reference temperature, e.g., room temperature. All of the A and the C readings are then respectively averaged to yield an average value for both the A and the C diameters.

Block 1104 then orders computer 1028 to calculate how much the average diameters vary from the aim size and to compute the required adjustment to the roll gaps in the penultimate and the last stands 1010, 11 to obtain the aim size. Regardless of the amount of change computed, the computer limits the adjustment in a single initial control iteration to b 0.0075 inch. This limitation aids system stability.

Block 1106 then orders the computer 1028 to adjust the screwdowns on the last two stands 1010, 11 to obtain the desired adjustments.

After the adjustments to the roll gaps have been made, block 1108 decides whether this sequence should be repeated.

If the calculated adjustment just executed was less than a programmed limit, e.g., 0.002 inch, the computer 1028 directs the process into a new control sequence. If not, the computer 1028 directs up to two additional iterations of measuring and roll adjustments relative to the A and C diameters. The same limitations relative to the measurements and adjustments hold true, of course, during this second and third iteration. The process then moves on, provided valid distributions have been obtained.

Block 1110 next initiates the roll alignment part of the initial control sequence by directing the drive means 14 to rotate the bar diameter gage 1051 through 45° so that the scanning heads 12 are positioned to measure the B and D diameters. These measurements are done in the same manner as were the measurements for the A and C diameters, and histograms are made of the B diameter, the D diameter, and the B-D difference. Block 1112 then directs the computer 1028 to use the average value of the B and D measurements, respectively, to calculate the change in roll alignment in the last stand 11 needed to make the B and D diameters more equal.

Block 1114 then orders the computer 1028 to command controller 1026 to change the alignment of the rolls in last stand 11. The extent of the change is limited in the same fashion as were the roll gap changes.

As was the case with the roll gap adjustments, block 1116 decides whether this sequence should be repeated. If so, the roll alignment adjustment cycle may be iterated up to a maximum of three times in the same manner as described in the A and C diameter initial control sequence.

Assuming that a new order is received, but a new pass is not required, the initial sequence is somewhat different. First, block 1118 orders the computer 1028 to compute a performance closeout. This is a summary of significant data relating to the previous order and includes, for example, order data distributions, the percentage out-of-tolerance values, and customer-oriented order information. Next, block 1120 orders the computer 1028 to compute the required roll gap adjustment for the new order, and block 1122 orders the computer 1028 to cause the screwdown controllers 1016, 1026 to perform the computed roll gap adjustment.

Block 1124 then causes histograms of the A and C diameters to be made in the same manner as ordered by block 1102, block 1126 causes roll gap adjustments to be computed in the same manner as did block 1104, and block 1128 causes these computed adjustments to be performed in the same manner as did block 1106. Block 1130 decides, in the same manner as did block 1108, whether this roll gap adjustment sequence should be repeated. Roll alignment adjustment is not required, since there was no change in the roll pass.

The first step of the optimization sequence, shown in FIG. 48B, comprises an order from block 1132 for a measurement of the profile of the bar.

Computer 1028 first checks whether there are at least five seconds of running time left in the bar. At least five seconds are essential, since this amount of time is required for bar diameter gage 1051 to scan the entire periphery of the bar 10, and such a scan is essential to the optimization stage. To determine that at least five seconds are left, a speed trap is provided upstream in the mill.

At this point in the process, only raw diameter data is available. Thus, validity of the data is ascertained before proceeding. In addition, the data is subjected to well-known techniques to provide a continuous, smooth bar diameter profile.

Under some operating conditions, the bar 10 rotates, or twists, as it is leaving the last stand 11. Inasmuch as a finite distance exists between the stand 11 and the gage 1051, the bar 10 will have rotated relative to the presumed frame of reference. Thus, this angular shift must be corrected by computer 1028. The magnitude of this angular shift is proportional to the distance between the gage and the last stand 11 and to the difference in magnitude between the collars of the bar.

Next, block 1134 orders the computer 1028 to compute the control system performance of this bar sample length. This performance is expressed as the percentage of the product that is within the ordered tolerance specification. The distribution of values, reflecting roll eccentricity, etc., as recorded by the histograms, is utilized in a well known statistical manner, to be described briefly later in the specification, to determine this performance. During the first iteration, the histograms are based on data collected during the initial sequence. During subsequent iterations, these histograms are based on data collected during the last-performed monitor sequence.

Block 1136 then calculates the required adjustments in the roll gaps of the last two stands 1010, 11 and in the alignment of the rolls in the last stand 11 to obtain an optimum bar profile, i.e., a profile with the least out-of-round within the over/under tolerance limits shown in FIG. 47.

Block 1138 then decides whether computer 1028 should act on gap controllers 1016, 1024, 1026 to cause the screwdowns to perform the calculated adjustments. If at least 95% of the product is within tolerance, in all three categories, and the calculated adjustment is less then 0.001 inch, or less than 95% of the product is within tolerance but the calculated adjustment is under 0.0005 inch, the adjustment will not be performed. The reasoning behind this decision is as follows. If at least 95% of the sample length is satisfactory and only a 0.001 inch adjustment is calculated, the probability of improving this performance by performing the adjustment is not high. On the other hand, performing an adjustment of less than 0.0005 inch is unlikely to have any significant effect upon performance.

If none of the three adjustments are not to be performed, block 1138 directs the control sequence to block 1142. If these adjustments are to be performed, block 1140 directs the computer 1028 to cause the roll gap and alignment adjustments to be performed. Block 1142 causes the performance data to be stored, and block 1144 decides whether the sequence should be repeated. The criteria for repeating the sequence are: (1) the optimizing sequence is to be iterated no more than five times, or (2) all roll gap and alignment adjustments are small, e.g., less than 0.0005 inch.

The bar mill control system then moves into the monitor sequence. Block 1146: (1) causes the bar diameter gage 1051 to move into position to measure the A and the C diameters; and (2) collects and stores data to prepare histograms for these diameters as well as the A-C difference. The gage 1051 takes 500 samples of data and then block 1148 computes the percent out-of-tolerance performance of the system referenced to the control sample length. This performance is based upon a profile simulated from the last measured profile, since the gage 1051 did not actually scan the bar. The mean A and C diameters obtained from the histograms ordered by block 1146 are used to simulate this profile. Block 1150 then computes the required mill adjustments, block 1152 stores the performance data for the current sample length of bar, and block 1154 decides whether the computed adjustments are sufficiently small to maintain the system in the monitor sequence or whether the system must be returned to the optimize sequence. These computed adjustments are not made.

After five iterations of the monitor sequence, using the mean A and C diameters obtained from the histograms ordered by block 1146, block 1146 causes the bar diameter gage 1051 to rotate so that one iteration can be done using the B and D diameters before returning to the optimizing sequence.

As pointed out earlier, blocks 1134 and 1148 of FIG. 48B direct the computer to compute the percentage of the bar that is within tolerance. More specifically, the computer 1028 is directed to compute the percentage out-of-tolerance of the bar control sample length that is over a maximum tolerance, the percentage of the bar that is under a minimum tolerance, and the percentage of the bar that is outside of the out-of-round tolerance. These percentages are then used, inter alia, in the computation of the roll gap and alignment adjustments as directed by block 1136.

Figure 49:
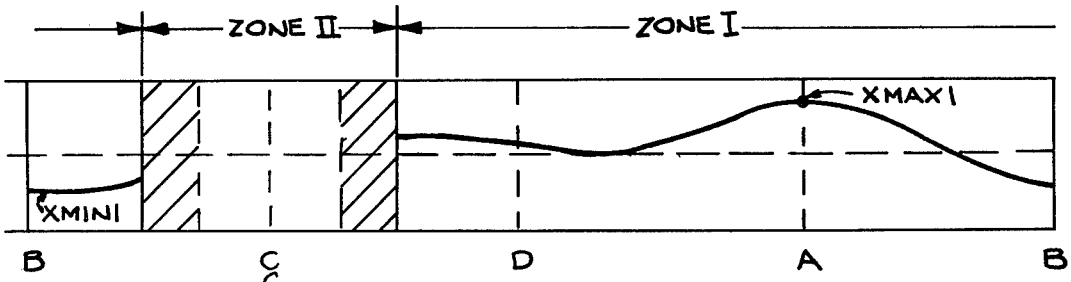
Figure 50:
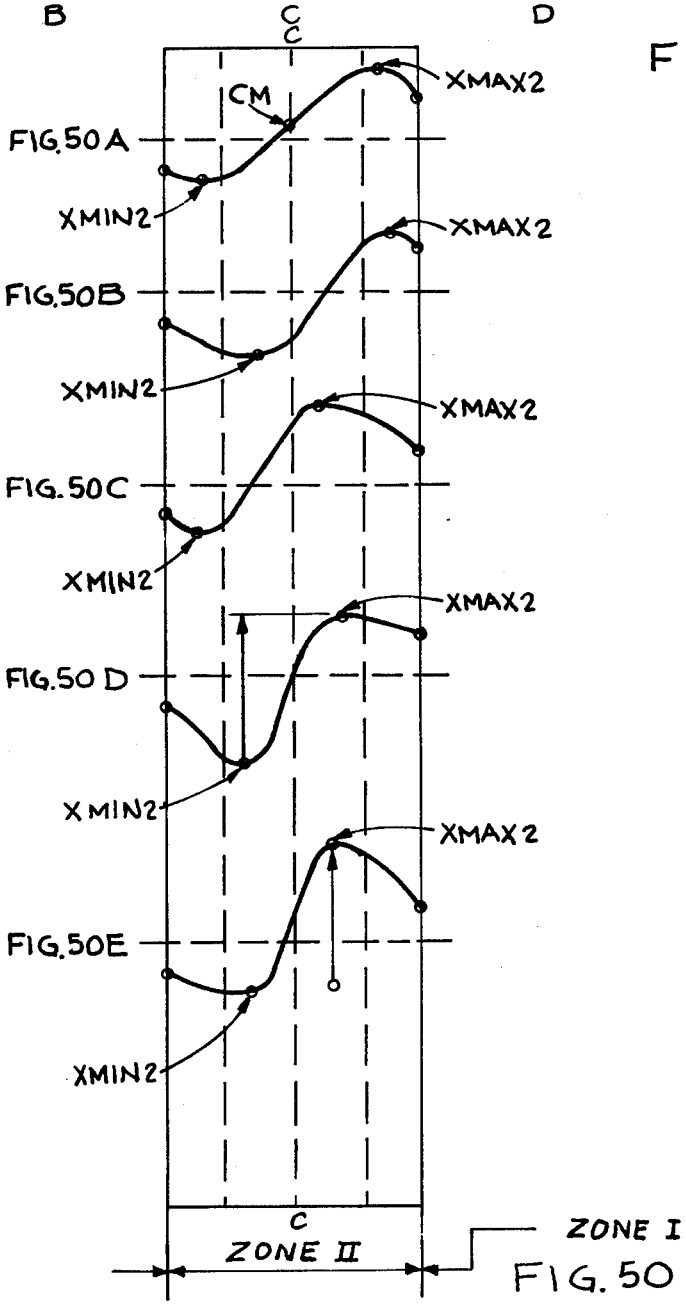

Each diameter around the bar profile varies according to a predetermined distribution. This distribution is different for each zone. As shown in FIGS. 45, 49 and 50, the widest statistical distribution is in Zone II, whereas the narrowest distribution is in Zone I. The A diameter variability is due primarily to the roll eccentricity of the last finishing stand 11, whereas the C diameter variability is effected by roll eccentricity and interaction of the preceding leader stand 1010.

In order to specify bar mill performance, only three points, hereinafter referred to as the "critical points", along the profile are considered as points about which statistical distributions are to be applied. These critical points are: (1) "Cm", which is a critical value in Zone II, (2) "max", which is the maximum value in either Zone I or Zone II, and (3) "min", which is the minimum value in either Zone I or Zone II. Each critical point is determined by computer 1028 in a conventional manner as described below.

Reference is here made to FIG. 49, which is a plot of the Zone I profile of a typical bar 10. The abscissa is in terms of diameter positions, from B clockwise around bar 10, and the ordinate is in terms of deviation of bar 10 from aim gage. As can be seen, Zone II is devoid of profile information. The maximum and minimum profile values in Zone I are marked Xmax1 and Xmin1, respectively. The shaded area in FIG. 49 is the transition area in Zone II.

FIGS. 50A–50E show the five basic configurations of bar 10 profile encountered in Zone II. The abscissa and ordinate are the same as in FIG. 49. The maximum and minimum values in Zone II are marked Xmax2 and Xmin2, respectively. In addition, FIG. 50A has a point marked "Cm".

FIG. 50A depicts the condition where the maximum and minimum critical values in Zone II are both within the transition area. In this case, these values would behave according to a statistical distribution more like the distribution about the A dimension than that about the C dimension. Thus, Cm is chosen to be equal to C, max is chosen as the larger value between Xmax1 and Xmax2, and min is chosen as the smaller value between Xmin1 and Xmin2.

In FIG. 50B, the condition is depicted where the maximum value in Zone II is within the transition area, whereas the minimum value in Zone II is not. In this case, Cm is chosen as Xmin2, max is chosen as the larger value between Xmax1 and Xmax2, and min is chosen as Xmin1.

In FIG. 50C, the condition is depicted where the maximum value in Zone II is outside the transition area, whereas the minimum value in Zone II is within this transition area. In this case, Cm is chosen as Xmax2, max is chosen as Xmax1, and min is chosen as the smaller value between Xmin1 and Xmin2.

In FIG. 50D, the condition is depicted where neither the maximum nor the minimum value in Zone II is within the transition area, and the minimum value in Zone II is of larger magnitude than the maximum value in Zone II. In this case, Cm is chosen as Xmin2, max is chosen as the larger value between Xmax1 and Xmax2, and min is chosen as Xmin1.

FIG. 50E is similar to FIG. 50D, except that the maximum value in Zone II is of larger magnitude than the minimum value in Zone II. In this case, Cm is chosen as Xmax2, max as Xmax1, and min as the smaller value between Xmin1 and Xmin2.

Figure 51:
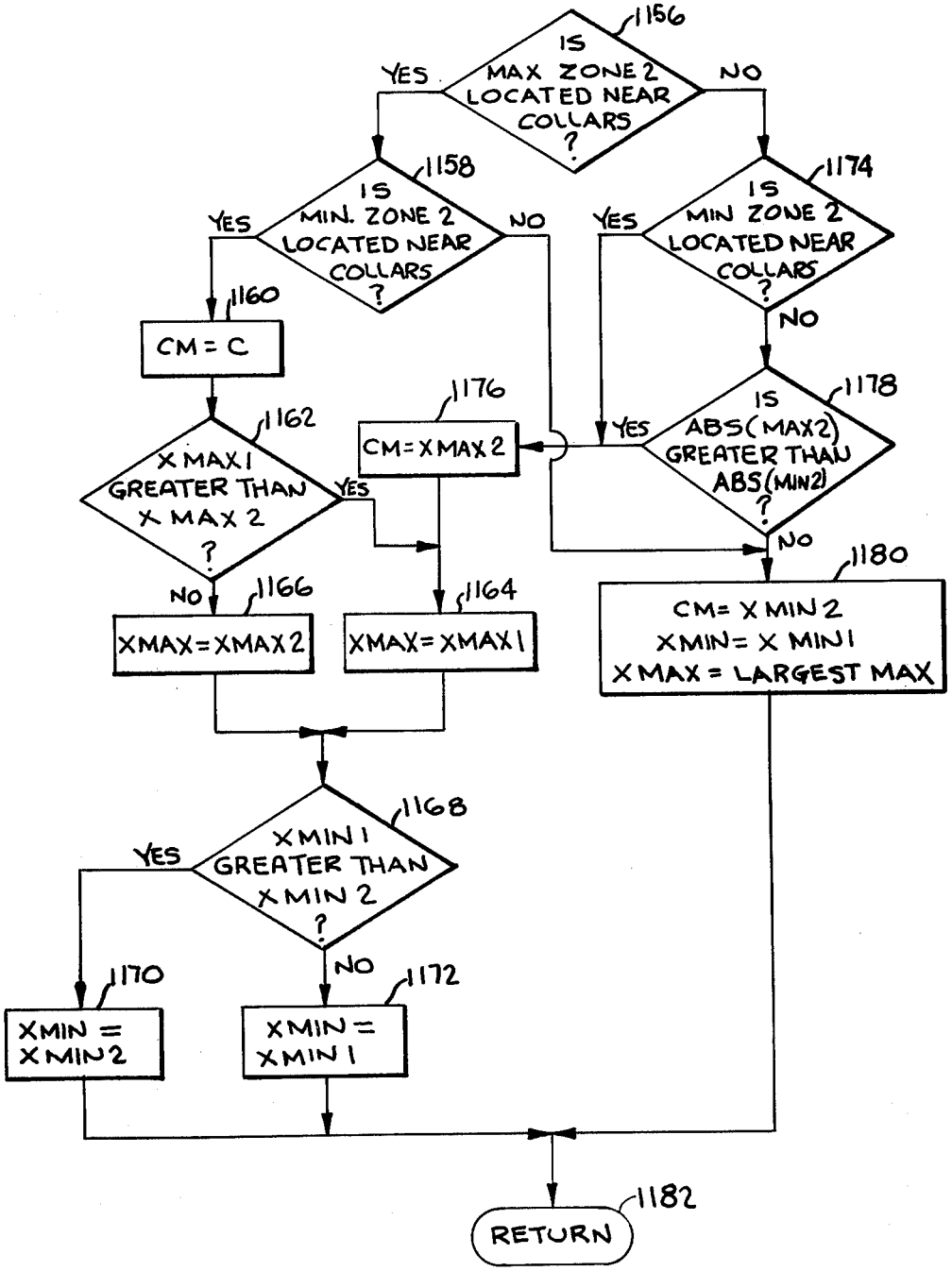

FIG. 51 is the flow sheet for determining the critical points just described. Block 1156 first asks if the maximum value in Zone II is located near the collars. If so, block 1158 then asks if the minimum value in Zone II is located near the collars. If so, block 1160 sets Cm=C and block 1162 asks if Xmax1 is greater than Xmax2. If not, control is passed to block 1180. If so, block 1164 sets max=Xmax1. If not, block 1166 sets max=Xmax2. Block 1168 then asks if Xmin1 is greater than Xmin2. If so, block 1170 sets min equal to Xmin2. If not, block 1172 sets min equal to Xmin1.

Similarly, if the answer to the query of block 1156 is no, block 1174 asks if the minimum value in Zone II is located near the collars. If so, block 1176 sets Cm equal to Xmax2 and the remaining critical points are determined as earlier described. If not, block 1178 asks if the absolute value of Xmax2 is greater than the absolute value of Xmin2. If yes, the flow is directed to block 1176 and the determination of critical points continues as earlier described. If not, block 1180 sets Cm equal to Xmin2, min equal to Xmin1, and max equal to the larger value between Xmax1 and Xmax2. Block 1182 returns the program to block 1134 or block 1148 of FIG. 48B.

Having determined the critical points along bar 10 profile values, it is now possible to calculate a composite distribution for the maximum critical value of the entire profile, i.e., both Zone I and zone II, a composite distribution for the minimum value of the entire profile, and a composite distribution for the maximum out-of-round value between any two points on the periphery of the bar 10. These composite distributions are calculated by combining individual distributions, using statistical techniques for combining independent probabilities.

The maximum composite distribution is calculated by combining the distributions of Cm and the maximum profile value. The distribution of Cm is based upon the C diameter histogram, whereas the distribution of the maximum value is based upon the A diameter histogram.

Similarly, the minimum composite distribution is calculated by combining the distribution of Cm, based upon the C diameter histogram, and the distribution of the minimum profile value, based upon the A diameter histogram.

The composite out-of-round distribution is calculated by combining the distributions of the following three absolute values: (1) the maximum profile value minus the minimum value, (2) the maximum profile value minus Cm, and (3) Cm minus the minimum profile value. The distribution for (1) is based upon the B-D diameter difference distribution. The distribution for (2) is based upon either (a) the C-A diameter difference distribution, if the maximum value is greater than Cm, or (b) the A-C diameter difference distribution of the A diameter minus the C diameter, if Cm is greater than the maximum value. Similarly, the distribution for (3) is based upon either (a) the C-A diameter difference distribution, if Cm is greater than the minimum value, or (b) the A-C diameter difference distribution, if the minimum value is greater than Cm.

Figure 52:
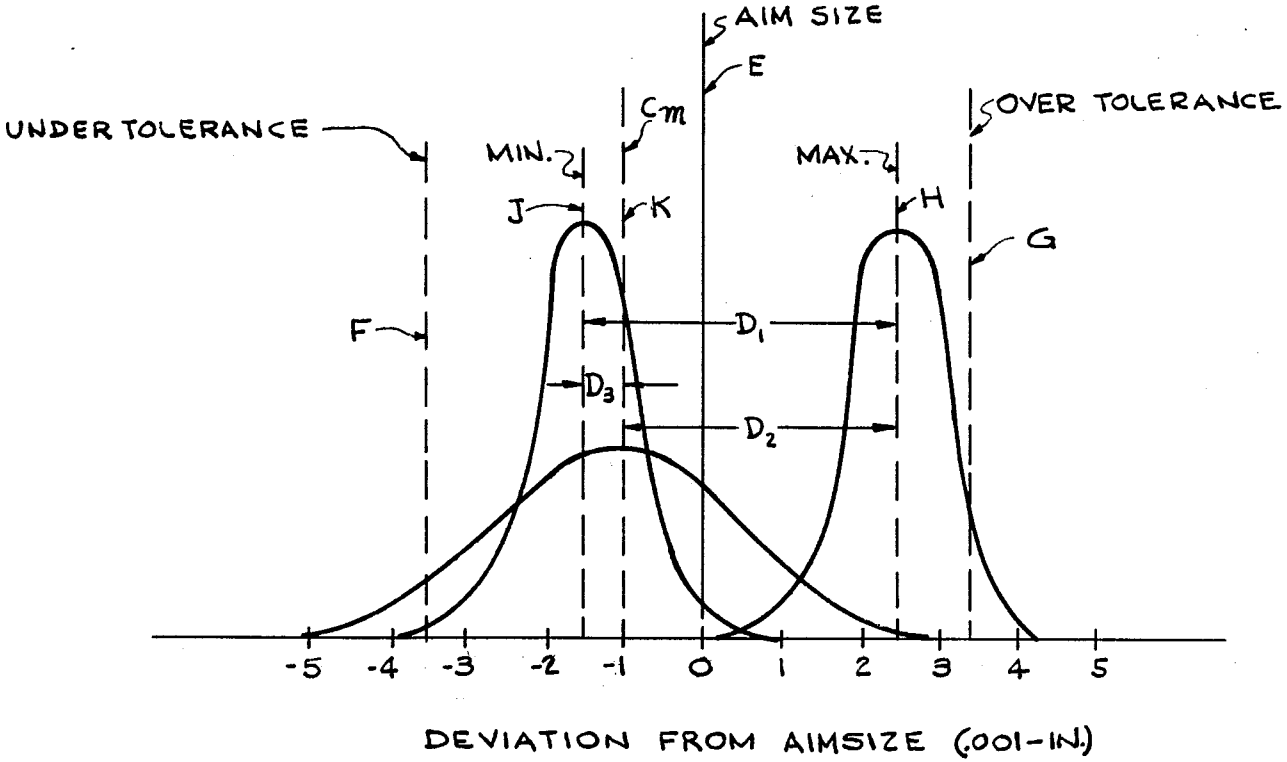

As an example of the computation of performance values, reference is made to FIG. 52, which is a typical performance model. The abscissa depicts deviation from aim size in $10^{-3}$ inches. The solid vertical line E is the aim size, and the dashed vertical lines F and G are the under and over tolerances, respectively.

Dashed line H is the critical point "max" described above. Its distribution is based upon the A diameter histogram characteristic of Zone I. Similarly, dashed line J is the critical point "min" described above. Its distribution is also based upon the A diameter histogram. Dashed line K is the critical point Cm described above. Its distribution is based upon the C diameter histogram characteristic of Zone II.

Figure 53B:
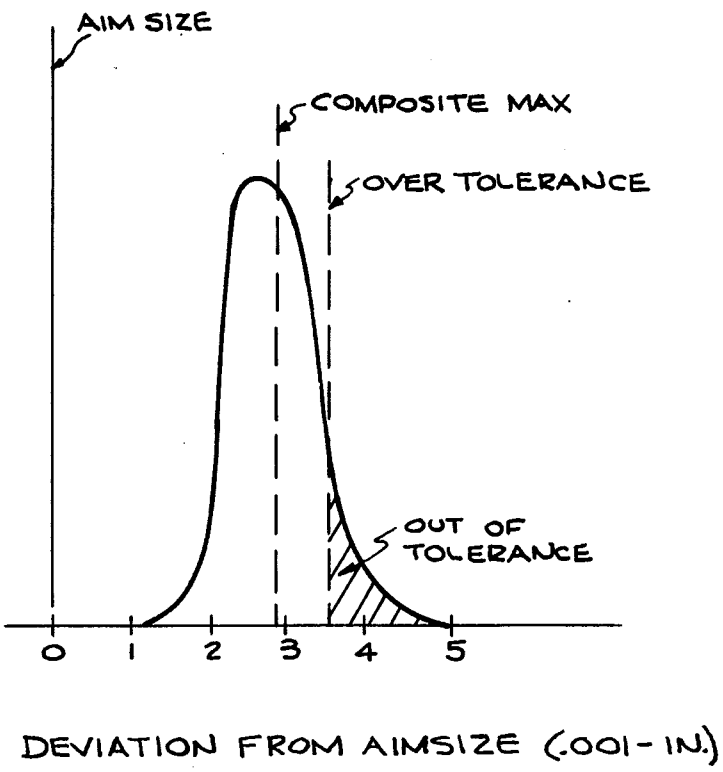
FIG. 53B shows this composite distribution.
Figure 53A:
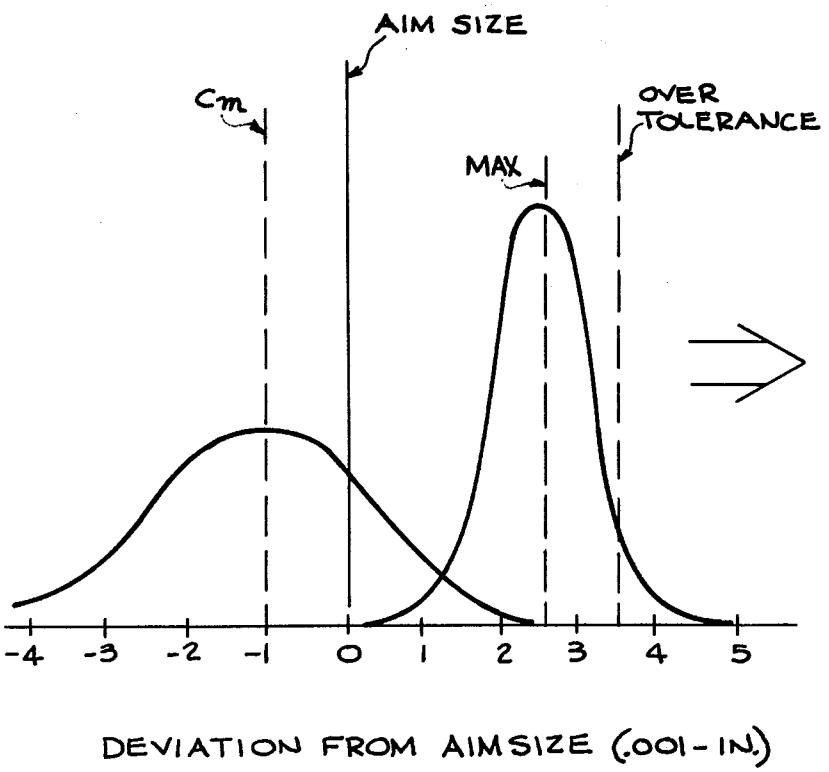
FIG. 53A is a plot of the distributions of those critical points used to compute a composite distribution of the maximum value.

FIGS. 53A and 53B show how the appropriate distributions are combined, using statistical techniques for combining independent probabilities, to provide a composite distribution of the maximum value. The shaded area in FIG. 53B represents the percentage of the product that is over tolerance.

Figures 54A, 54B:
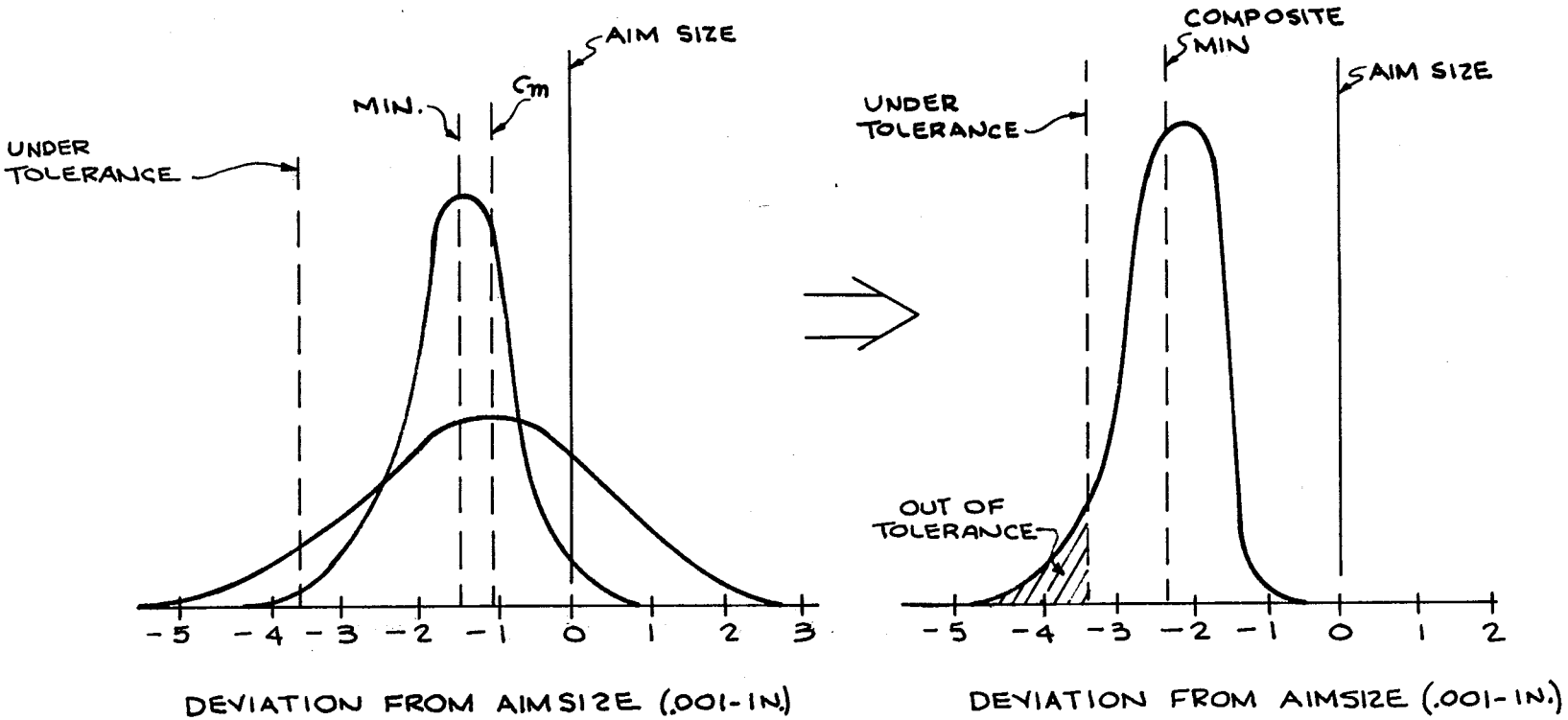
FIG. 54A is a plot of the distributions of those critical points used to compute a composite distribution of the minimum value.
FIG. 54B shows this composite distribution.

FIGS. 54A and 54B similarly show how the appropriate distributions are combined to provide a composite distribution of the minimum value. The shaded area in FIG. 54B represents the percentage of the product that is under tolerance.

Figure 55B:
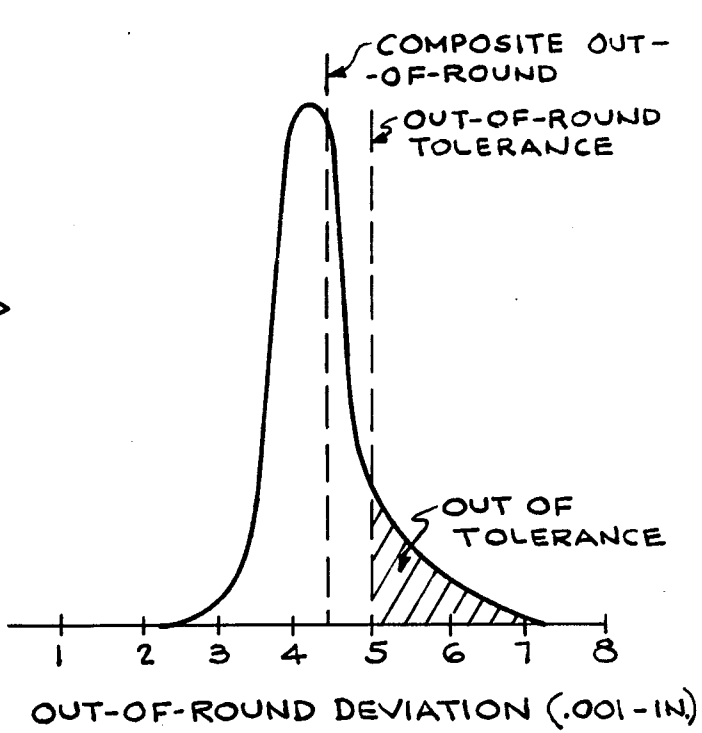
FIG. 55B shows the composite distribution of these values.
Figure 55A:
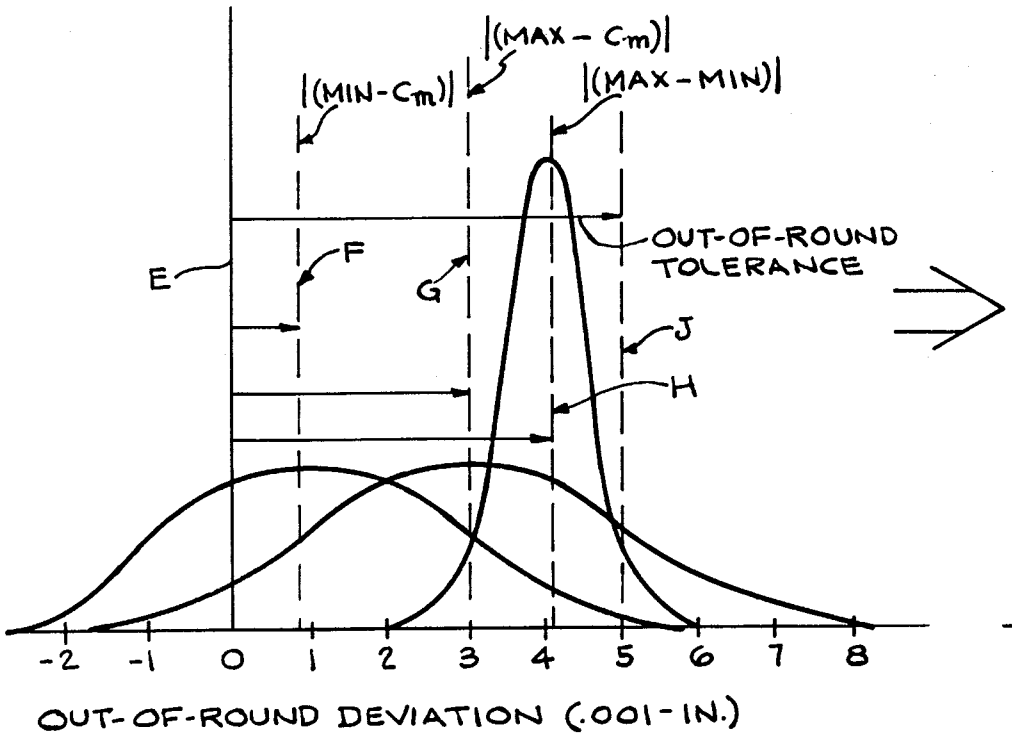
FIG. 55A is a plot of the distributions of the out-of-round values, based upon the distances between the critical points.

In FIG. 55A, the solid vertical line E represents zero out-of-round. Dashed line F represents the absolute value of "min" minus Cm. Its distribution is based upon the (C-A) diameter difference histogram. Similarly, dashed line G represents the absolute value of "max" minus Cm. Its distribution is based upon the (A-C) diameter histogram. Dashed line H represents the absolute value of "max" minus "min". Its distribution is based upon the (B-D) diameter difference histogram. Dashed line J represents the out-of-round tolerance.

Although part of the distribution in FIG. 55A falls in what appears to be a negative region, negative out-of-round values are of course impossible. These "negative" values must be "folded over" into the positive regions of the FIGURE to determine the composite out-of-round.

FIG. 55B shows how the distributions of FIG. 55A were combined, also using statistical techniques for combining independent probabilities, to provide a composite. The shaded area represents the percentage of the product that is out of tolerance.

The percentage of the bar 10 that is out of tolerance in each of the categories of oversize, undersize, and out-of-round is then calculated by summing those elements of the respective composites that fall outside of the tolerance stored in computer 1028.

Figure 56A:
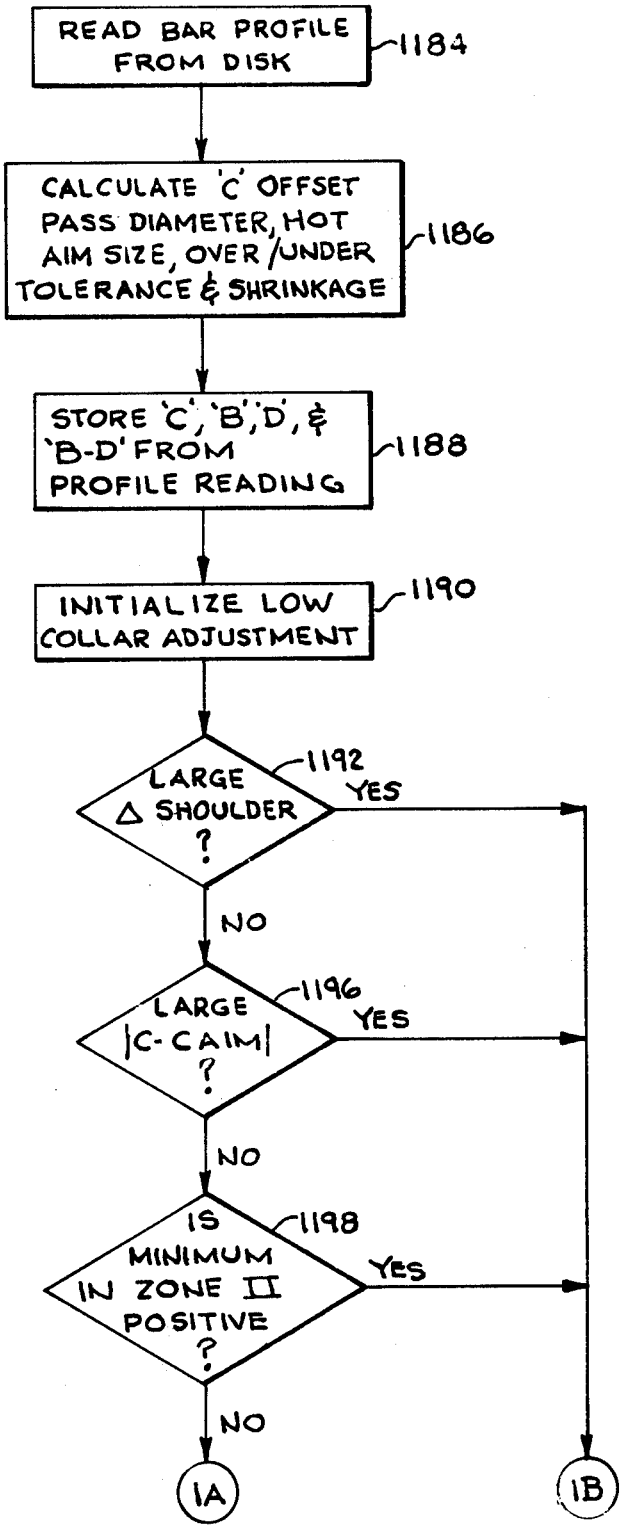
FIGS. 56A–56L are flow charts of the method of computing the roll adjustments required to obtain optimum bar profile.
Figure 56A:
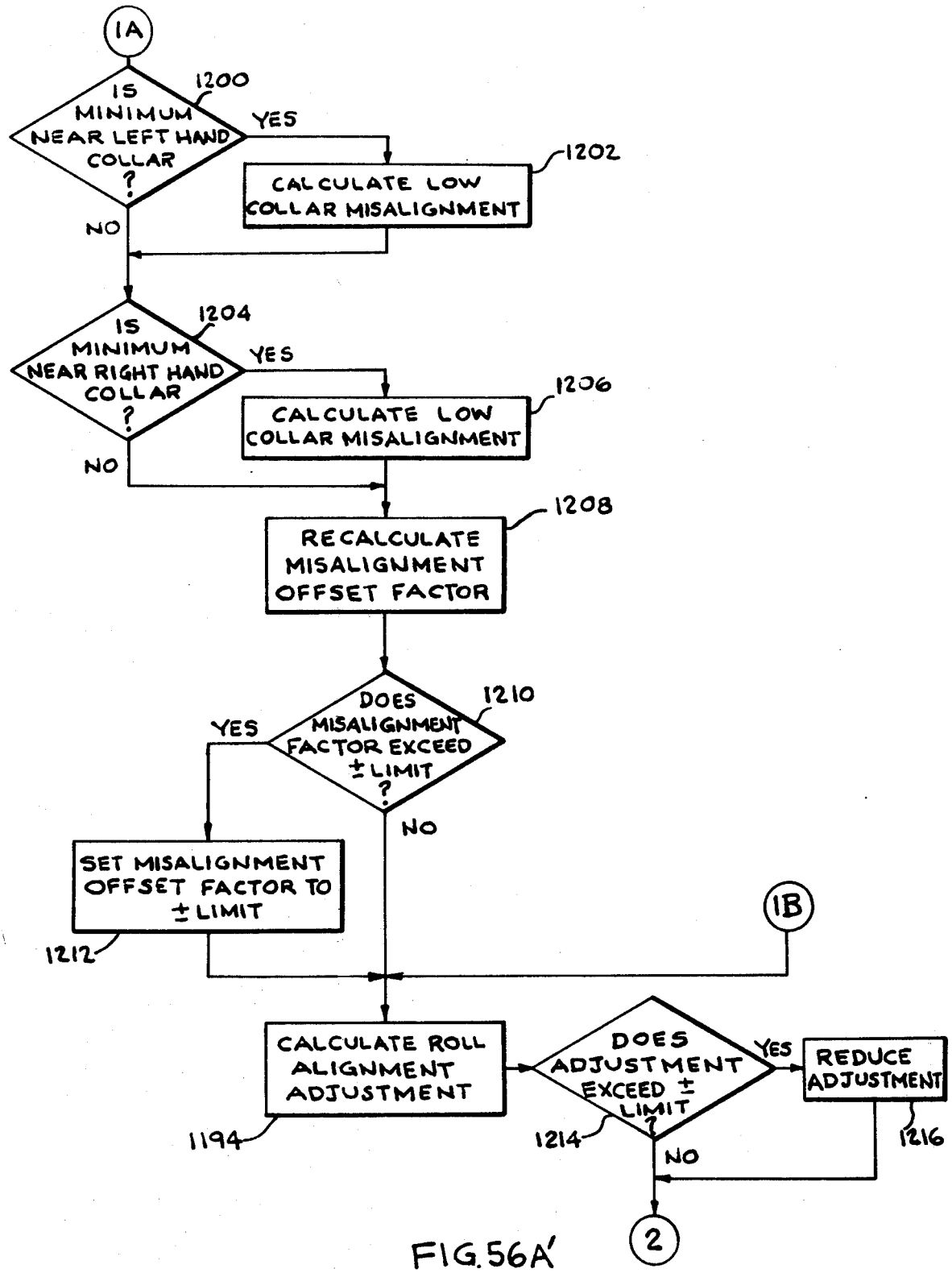

The subroutines for computer 1028 to cause rolling mill controllers 1016, 1024, 1026 to perform the mill adjustments on leader stand 1010 roll gap and finishing stand 11 roll gap and alignment called for in block 1136, FIG. 48B, are shown in the flow charts of FIGS. 56A–56L. As shown in FIG. 56A, block 1184 reads the bar profile from the disk to make these data available for subsequent use. Next, certain variables needed for the subsequent calculations performed during these subroutines are converted in block 1186 into units compatible with this particular program. These variables consist of the "C Offset", the pass diameter, the hot aim size, the over/under tolerance, and the shrinkage factor.

The C Offset is a factor that permits the biasing of stand 1010 independently of stand 11. This factor is used to eliminate the formation of a fin if the roller's aim size of bar 10 is substantially higher than the collar dimensions. C Aim is equal to the roller's aim size of bar 10 minus the C Offset, and is calculated by the computer 1028. It is, inter alia, a function of the pass diameter relative to the hot aim size of bar 10. In the case of a small pass relative to aim size, it is desirable to calculate a C Aim somewhat less than the roller's aim, since small variations in process variables may result in the occurrence of a fin at parting line 1063 shown in FIG. 44. On the other hand, if the pass 1058 diameter is substantially larger than the hot aim size, the C dimension of the bar may increase to a much greater extent before a fin is formed. In this case, the C Aim is chosen to be equal to some value between the collar dimension and the roller's aim, since this would tend to result in a bar having a minimum out-of-roundness.

Block 1188 stores the significant points on the profile for future use during the calculations. These points are the C, B, and D readings, and the B-D value.

The next step in the calculations is to determine whether there is an underfill condition at either one of the roll collars. As shown in FIG. 47, each of these collars is at the junction of a transition zone and Zone I. An underfill condition at only one of the collars is caused by the entering oval bar twisting in the roll pass of stand 11. This condition results from one or both of the following two conditions: (1) the rolls are misaligned, and (2) the guides that direct the oval bar from stand 1010 into stand 11 are improperly set up.

The first step in determining which of these conditions applies is to initialize the low collar misalignment factor. This is done by block 1190. Thus, it is necessary to determine if the rolls are unintentionally grossly misaligned. This is done as follows: if the absolute difference between the dimensions of the bar shoulders, i.e., |B-D|, is greater than a predetermined amount, e.g., 0.003 inch, the rolls must be realigned before any steps are taken to correct he underfill at one of the collars by deliberate roll misalignment. Block 1192 then bypasses all the collar misalignment calculations, to be described shortly, and directs the process to block 1194, which causes recalculation of the misalignment offset factor (to be defined later).

If the output of block 1192 is NO, it is clear that, if there is an underfill at one of the collars, it is a result of improper guide set-up. However, before proceeding with roll misalignment, which is a "fine tuning" procedure, decision block 1196 is tested. This test determines whether the absolute value of C is much larger than C Aim, which means that an overfill or underfill condition exists at the pass line. If the answer is YES, the collar misalignment factors are again bypassed, since it is more important at this time to deal with this overfill or underfill condition by changing the roll gap at stand 1010.

If the output of block 1196 is NO, a third test is made. If the minimum value in Zone II is positive, i.e., if its value exceeds the roller's aim, the collar misalignment factor is bypassed, since the quality of the bar product in this case would not be significantly improved by such a correction.

If the output of blocks 1192, 1196, and 1198 are all NO, block 1200 in FIG. 56A determines if the minimum value is near the left collar. If so, block 1202 calculates the roll misalignment required to reduce the underfill near this collar. Block 1204 then determines if the minimum value is near the right collar. If so, block 1206 calculates the roll misalignment required to reduce the underfill near the right collar. If there is no underfill at either collar, both these calculations are bypassed.

The calculated misalignment correction factor is dampened by block 1208. This block sums this calculated factor with the previous calculated value and divides this sum by two. If the resultant value exceeds a predetermined limit, e.g., 0.002 inch, block 1210 directs block 1212 to set the misalignment offset factor to this limit.

The outputs from blocks 1210 and 1212 are fed to block 1194, which calculates the total roll alignment adjustment for stand 11. This adjustment is equal to the misalignment offset factor minus the shoulder alignment. This adjustment is fed to block 1214, which tests to determine if this adjustment is within the prescribed limits. If not, block 1216 reduces this value by 50%. If it is within limits, this value is stored. The roll alignment calculations are now complete with respect to rolls 1020, 1022 in finishing stand 11.

The next step in the rolling mill control system comprises determining the roll gap adjustment for stand 11. Considering Zone I only, the first step in this determination is to determine the upper and lower search limits of roll gap adjustments that will result in a bar within the size tolerance limits. Then, that adjustment is chosen which will result in a minimum out-of-roundness within these size tolerance limits.

Reference is here made to FIG. 47, which shows the upper and lower tolerance limits E and G, respectively. Because of the variations in the diameter values lengthwise of the roll, because of roll eccentricity, for example, the usable upper and lower tolerances are offset by an amount determined by the standard deviation of the A diameter histogram. This amount is called the "Offset" in FIG. 47. By offsetting the tolerances by this amount, it is guaranteed that, if a maximum or minimum profile critical point lies on line H or J, respectively, 95% of the points making up its variability will lie within the tolerance boundaries. The distance between these lines H and J is called the "tolerance window".

Figure 56B:
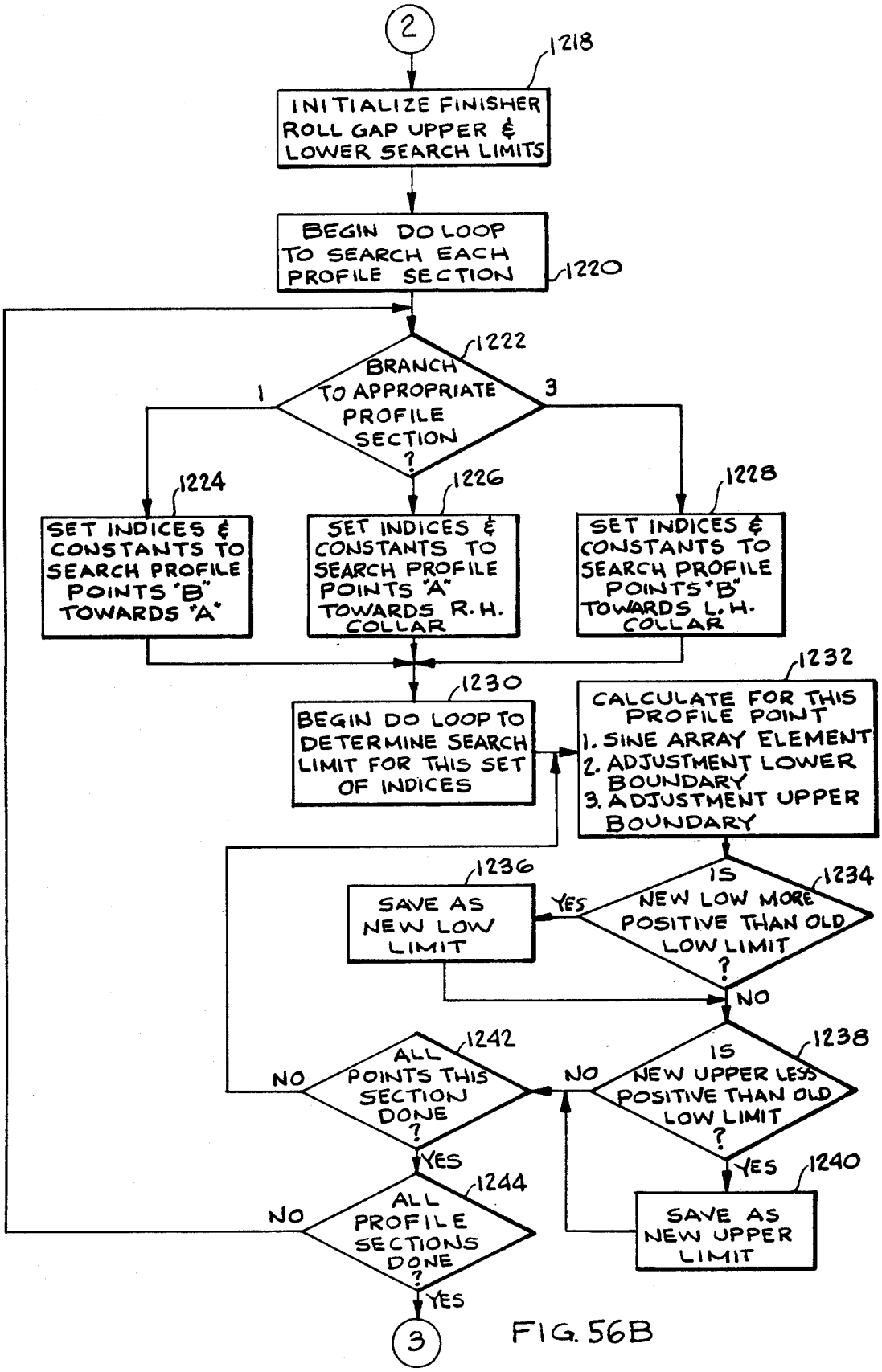

To determine the lower and upper search limits of roll gap adjustment, block 1218 in FIG. 56B initializes the search limit values in the program. Block 1220 then instructs decision block 1222 to sequentially search through three sections of the bar profile. Blocks 1224, 1226, and 1228 instruct the computer to set the parameters for searching the profile from B toward A, from A toward the right hand collar, and from B toward the left hand collar, respectively.

Block 1230 instructs the computer to begin a DO loop for the first set of parameters through the first region. The object of this DO loop is to calculate the adjustment required to move each of a plurality of points on the profile to the lowermost limit J and the uppermost limit H of the profile window.

The equations for calculating these adjustments are as follows:

(1) Lowermost point adjustment $$RGFNLP = -\frac{[(OVUNTL - \text{OFFSET}) + AVG\ RBDGTI(J) + RAFN \sin\theta]}{\cos\theta}$$

where $OVUNTL$ = the over-under tolerance,
$AVG\ RBDGTI(J)$ = the average profile value,
$RAFN \sin\theta$ = the roll alignment correction for stand 11
and $\theta$ = the angle measured from the A dimension, positive for profile points $A$ toward $B$ and negative for profile points $A$ toward $D$ (2) uppermost point adjustment $$RGFNUP = \frac{(OVUNTL - \text{OFFSET})) \times 2}{\cos\theta} + RGFNLP$$

Figure 57A:
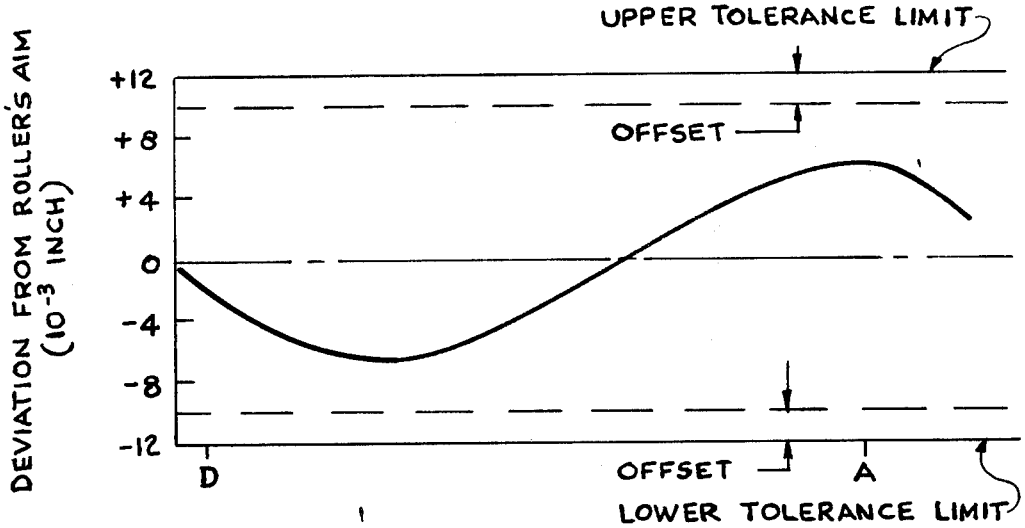
FIGS. 57A and 57B are plots showing the method of calculating values used in determining uppermost and lowermost adjustment search limits for the last stand of the mill. Adjustments made within these limits insure that a bar can be rolled without falling outside of the over and under tolerance values at any point about the periphery of the bar.
Figure 57B:
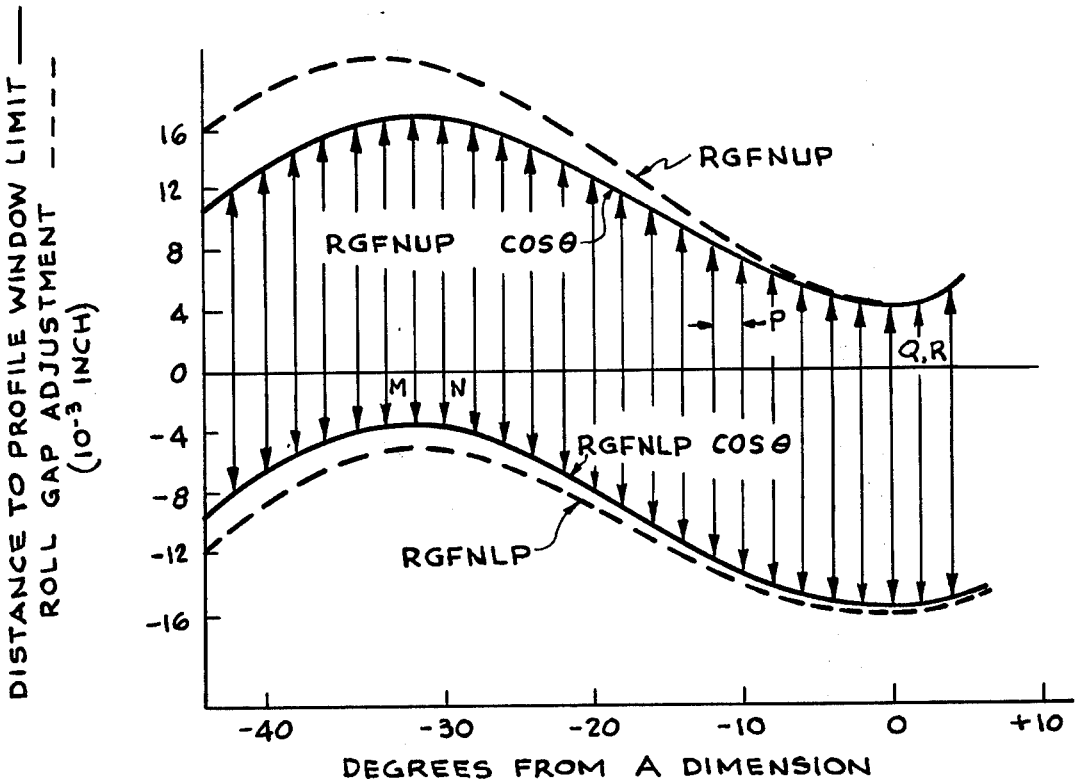

Reference is here made to FIGS. 57A 57B, which show: (1) part of a profile similar to that shown in FIG. 47; (2) the actual distance that each of a plurality of points must move vertically to reach the uppermost and lowermost limits, respectively, of the profile window; and (3) the actual distance the entire roll must move radially for that particular point to reach its desired position.

In FIG. 57A shows the profile of bar 10. The abscissa is angular position and the ordinate is deviation from aim. In FIG. 57, B shows, in solid lines the distances to the uppermost and lowermost limits and, in dashed lines, the required adjustments to reach these positions, as a function of angular position.

Block 1232 instructs the computer to search a sine array to obtain the proper values for sin Θ and cos Θ and to calculate the required upper and lower adjustments.

As is clear from FIG. 57B, the most positive adjustment N is the only value that will result in a new profile totally above the lowermost limit. Because of its position within the roll pass, however, this point moves a distance M.

Similarly, the least positive adjustment Q is the only value that will result in a new profile totally below the uppermost limit. Although, in general, the entire roll must move a greater distance R for this point to move the calculated distance Q, in this particular case the distances Q and R are equal.

The profile is searched in angular increments of width P. Block 1234 in FIG. 56B checks each lower adjustment value and determines if this new value is more positive than the most positive previous saved lower adjustment value. If so, block 1236 saves this value as a new lower adjustment search limit. If not, this value is discarded.

Similarly, block 1238 checks each new upper adjustment value and determines if this value is less positive than the least positive previous saved upper adjustment value. If so, block 1240 saves this value as a new upper adjustment search limit. If not, this value is discarded.

After each point is calculated and checked, block 1242 asks whether all the points in this region have been calculated and compared. If not, the profile is checked one increment P away. This process is repeated until every increment P of this first region has been treated, at which time decision block 1244 directs the computer to the next region of the profile. After all regions have been done, the uppermost and lowermost adjustment search limits of the profile are stored in block 1094 in FIG. 46.

Block 1246 is next queried to determine if the pass size is satisfactory. If bar 10 hot aim size is approximately equal to the pass diameter, this question is answered in the affirmative. If bar 10 hot aim size is slightly smaller than the pass diameter, this question is also answered in the affirmative, since it is relatively simple to select a C Aim that will neither detract from the out-of-round nor result in the formation of a fin. However, if the hot aim size is substantially larger than the pass diameter, the probability of the formation of a fin is quite large. This is because this condition produces a bar in which the A dimension is relatively large with respect to the collar dimensions. Thus, the C dimension must approach the same magnitude as the collar dimensions, rather than the A dimensions, if a fin is to be avoided.

Block 1248 instructs the computer to recalculate the C Aim if the last-named condition exists. The C Aim is equal to the roller's aim, or nominal value, minus the C Offset. The computer selects a C Offset that will bring the C Aim close to the collar dimensions.

The output of block 1248 is sent to block 1250, which substantiates that there is a pass fill problem and sends this message to a CRT at the roller's terminal. In response to this message, the roller checks his control panel to determine if he has inputted the correct cold aim size into the computer. He also checks the roll pass to determine if the bar is passing through the proper pass. If neither of these conditions need correction, the value of C Aim recalculated by block 1248 should be used.

If the pass size is good, block 1252 checks to see if all prior "Pass Fill Problem" messages have been cleared from the roller's display on CRT terminal 1072. If so, the program is directed to the next step in the process. If not, block 1254 first directs the message to be cleared before progressing to this next step.

Figures 56C, 56D:
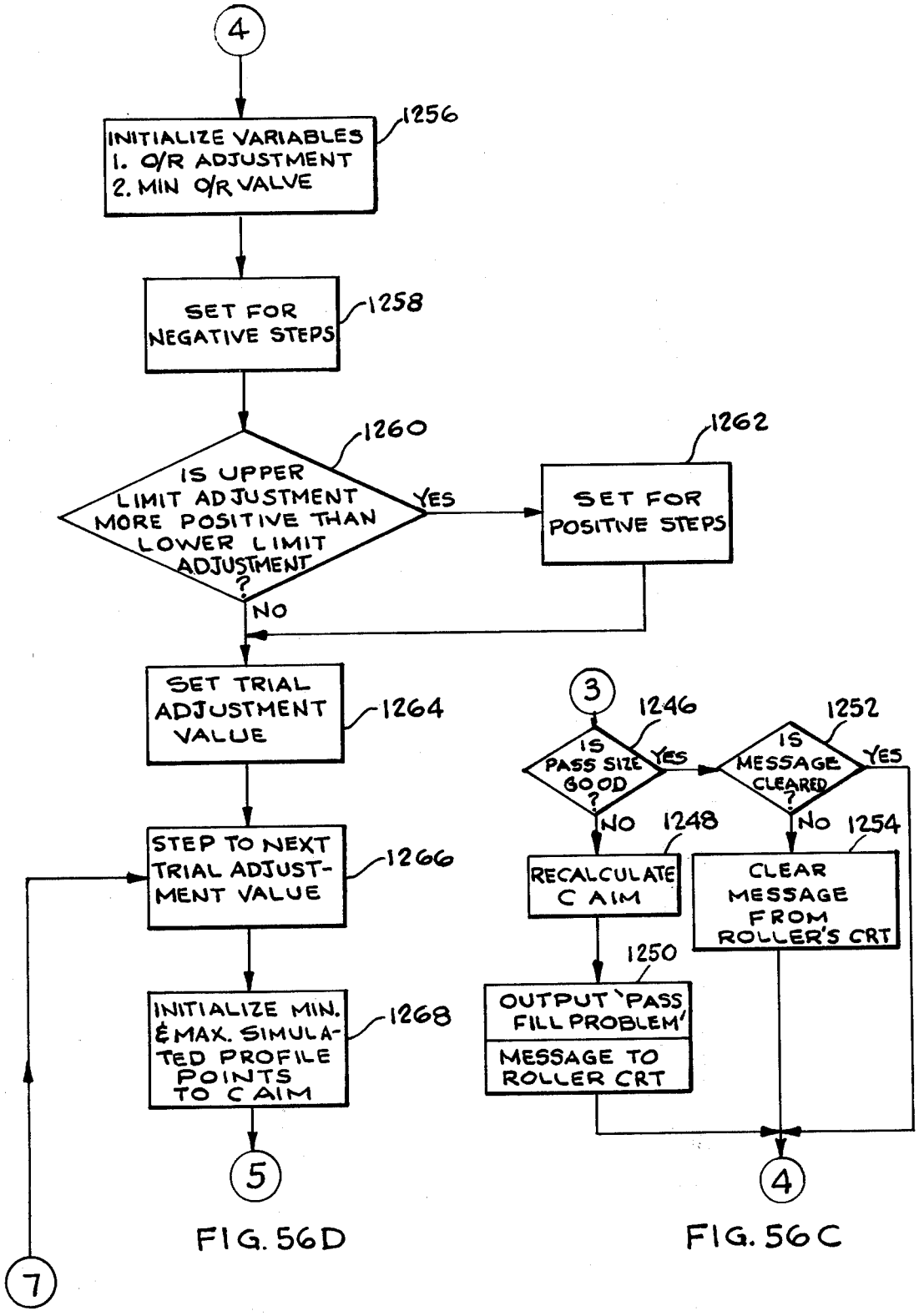

FIG. 56D shows the next step in the optimization process comprises finding the adjustment required to produce that profile of bar 10 which will result in a minimum out-of-round value within the tolerance window. Broadly, this is accomplished by generating a simulated profile at the lowermost limit within the tolerance window and determining the out-of-round for this profile. Additional simulated profiles are then generated for other trial adjustments, in stepwise limits, e.g., increments of 0.0005 in., upwardly within the tolerance window until the uppermost adjustment search limit is reached or until the out-of-tolerance for the generated profile is higher than the value for the previous simulated profile. The calculated adjustment required to produce this least out-of-round is saved.

Block 1256 first initializes the variables required to calculate the out-of-round adjustments, including the minimum out-of-round value.

Blocks 1258, 1260, and 1262 are provided to provide the proper sign in the event that the roll gap adjustment needed to obtain the lowermost simulated profile is more positive than the roll gap adjustment needed to obtain the uppermost simulated profile. This may occur, for example, if the bar is sufficiently out-of-round to exceed both the upper and lower tolerances simultaneously.

Block 1264 then sets the first trial adjustment value to one increment below RGFNLL in FIG. 47. Block 1266 then increases the trial adjustment, used to calculate the simulated profile, by one step and block 1268 initializes the system by setting the minimum and maximum profile points equal to C Aim. This initialization guarantees that the C Aim is included in the overall calculation of the out-of-round profile.

Figure 56E:
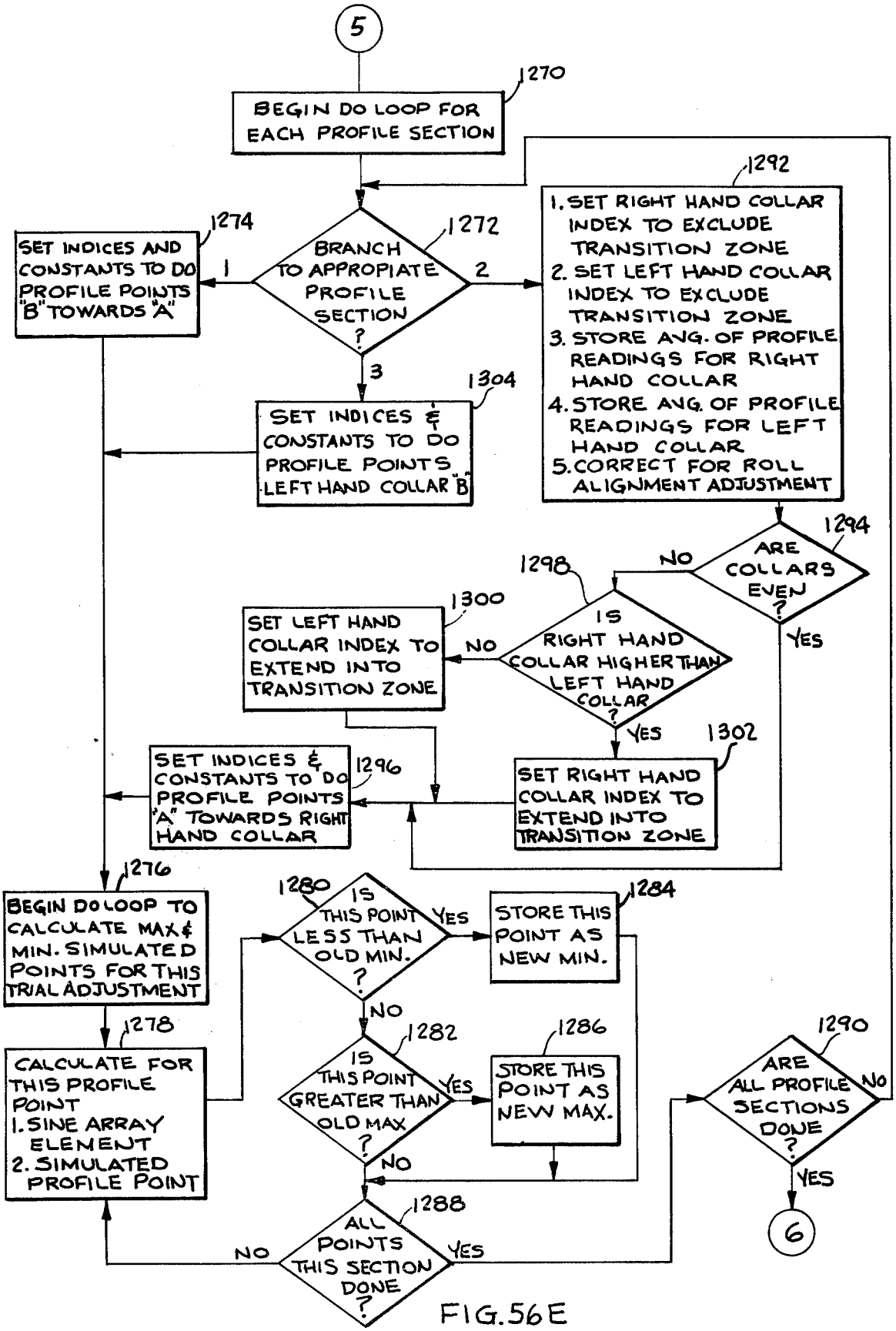
Figure 56F:
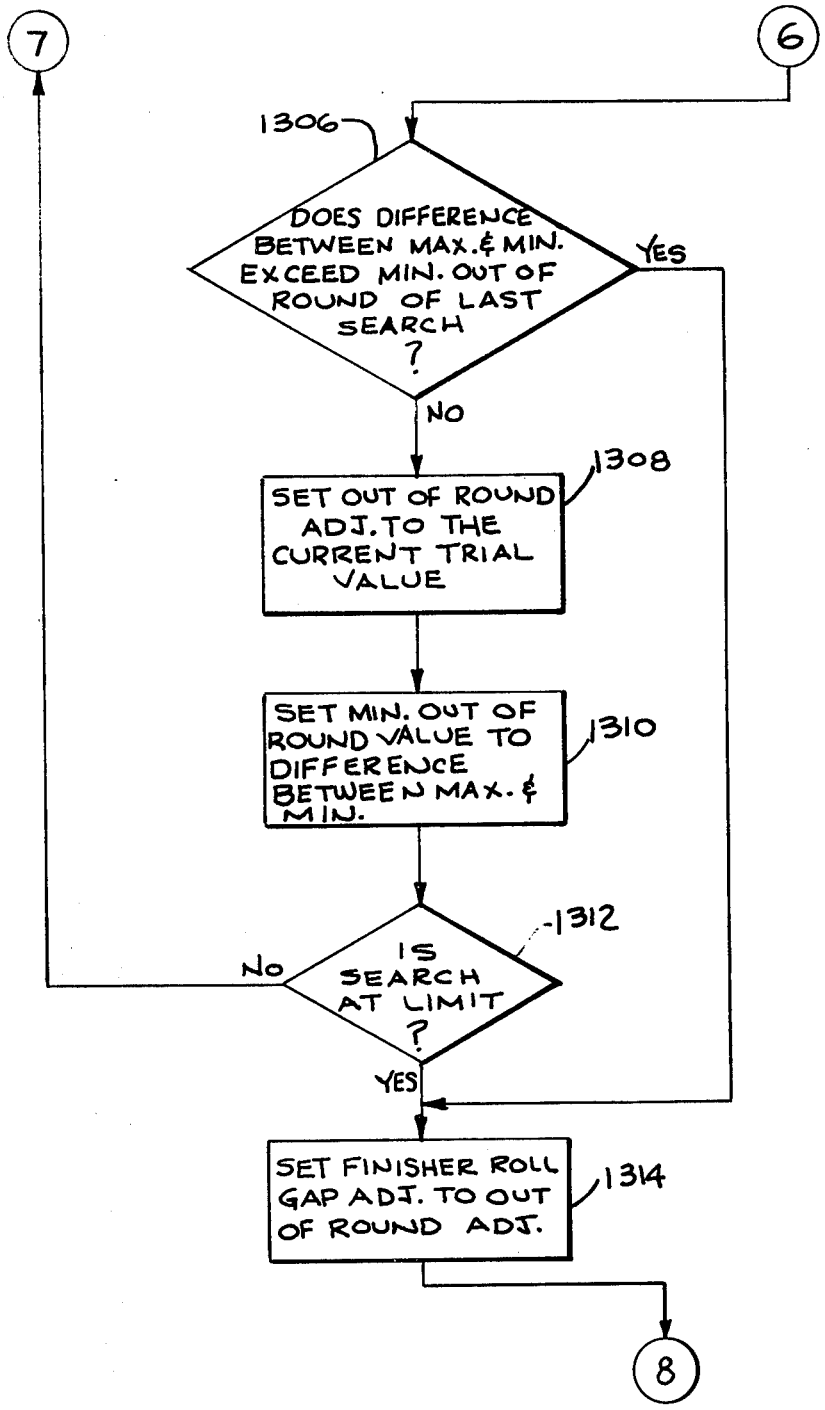
Figure 56G:
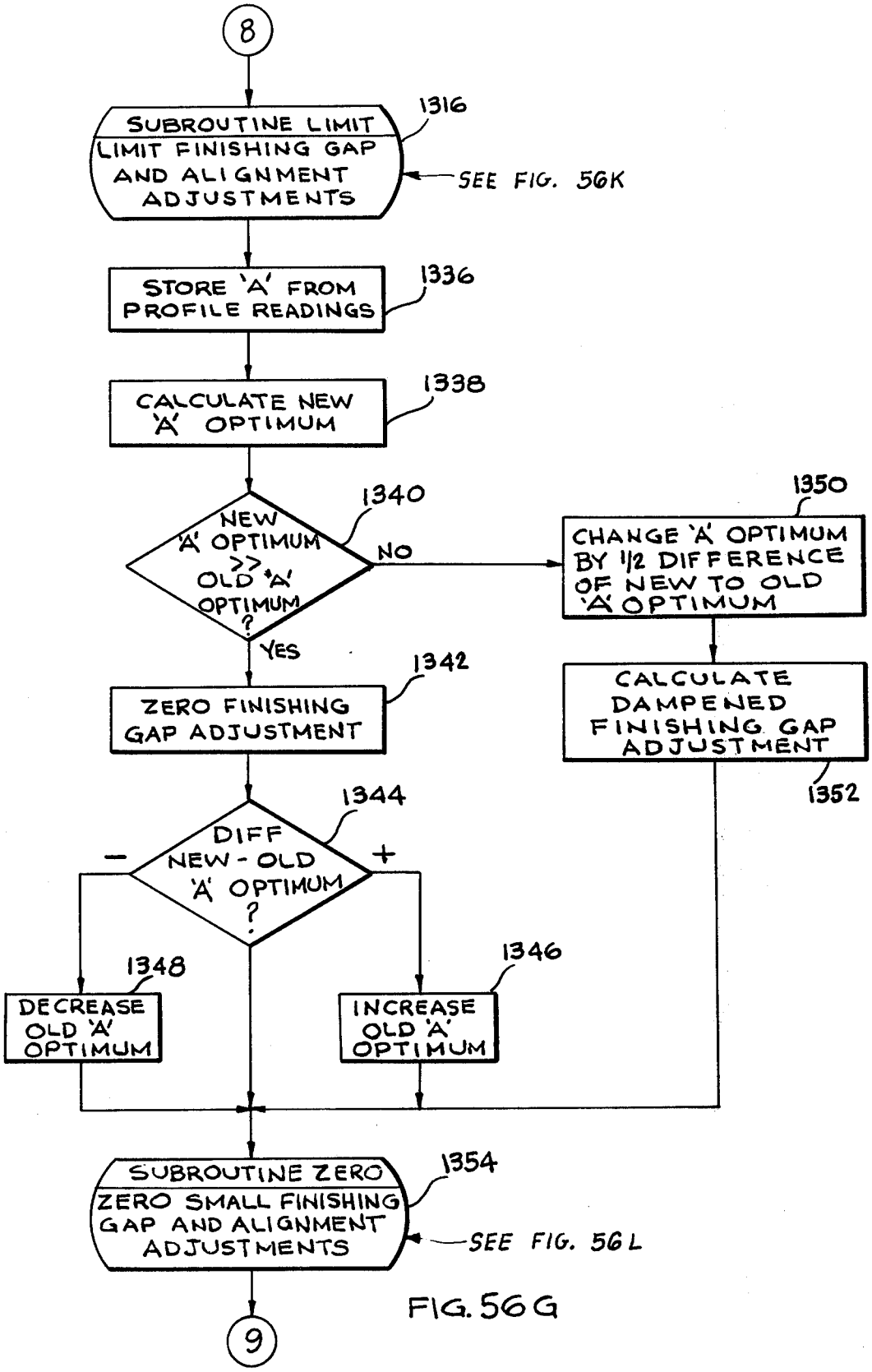

Block 1270 in FIG. 56E then directs the computer 1028 to go through a DO loop for each section of the lowermost simulated profile, this profile being divided into the same three sections as was the case for the determination of the adjustment search limits for the tolerance window. Block 1272 then directs block 1274 to initialize the system for the first section to be searched, viz., the profile points from 'B' toward 'A'. Block 1276 directs the computer 1028 to begin a DO loop to calculate the maximum and minimum simulated profile points for this trial adjustment. As a first step in this DO loop, block 1278 calculates the required sine array element and the simulated profile point at a first point, e.g., at B. Blocks 1280, 1282, 1284, and 1286 then function to determine whether this point is greater or less than the stored values of maximum and minimum points, respectively, for this profile. Block 1288 then directs block 1278 to calculate the sine array element and simulated profile point for a point one increment P to the left of B, and the loop starting with block 1280 is repeated for this point.

After all the points in this section are checked for maximum and minimum values, block 1290 directs the program back to block 1272, which directs the computer 1028 to block 1292. This block checks the transition zones to determine if any points within these zones should be considered by reason of their being in contact with the roll pass. Such a condition will exist for the high collar points if the bar is lying in the pass 1058.

Block 1292 first sets the collar indices to exclude the transition zones. Then, a weighted average of the simulated value for each collar, adjusted for the roll alignment previously calculated, is calculated and stored. Block 1294 then queries if the collars are even. If so, the points are considered out of contact with the roll, and the computer 1028 is directed to block 1296. If not, blocks 1298, 1300, and 1302 determine which collar is high and move the index from this collar into the transition zone adjacent thereto. The computer continues at block 1296, which sets the required indices and constants to test the profile section from A to the right hand collar for minimum and maximum critical points.

Block 1276 then causes the DO loop to determine if minimum and maximum values for the simulated points reside within this section. This is determined by comparing each value in this section with the previously stored values determined during the search of the first section of the profile.

Block 1304 similarly directs a search for minimum and maximum values in the profile section from the left hand collar to B. After the completion of this portion of the search, block 1290 directs the computer 1028 to consider the question in decision block 1306, viz., is the out-of-round of this simulated profile larger than the out-of-round of the last search?

If the answer to this question is no, which it will be for the first search because of the initialization, block 1308 sets the out-of-round adjustment to the current value. Block 1310 then stores the difference between the minimum and maximum as the minimum out-of-round. Block 1312 asks whether the simulated trial adjustments have passed throughout the entire range within the upper and lower search limits. If so, the gap adjustment for the rolls 1020, 1022 in stand 11 is stored by block 1314 so as to obtain the last trial adjustment. If not, block 1312 directs the computer 1028 back to block 1266 and the profile search is repeated for a new trial adjustment value one increment larger than that for the previous search.

If, at any time during the search, the out-of-round value ever increases, the search is stopped, and the previous out-of-round adjustment value is used to determine the desired roll gap adjustment for stand 11.

The next step in the optimization sequence comprises limiting the adjustments and insuring the stability of the dimension control system by dampening those adjustments that would change the A dimension of the bar. Block 1316 in FIG. 56G first directs the computer 1028 to subroutine limit, shown in FIG. 56K. This subroutine limits the gap and alignment adjustments of stand 11. Large adjustments are limited because they will upset the material flow between the mill stands 1010, 11 to such a degree that the speed regulators 1040, 1042 could not adjust quickly enough to the change. This would result in a cobble in the mill.

The subroutine limit is a generalized subroutine used to limit any of the roll adjustments, viz., finishing gap, leader gap, and finishing axial adjustment, individually or in combination. The leader gap adjustment, to be discussed below, is dependent on the finishing gap adjustment. Because of this dependency, any change to the original finishing gap adjustment, due to limiting of these adjustments, requires that the unused portion of the adjustment to the finishing gap be backed out of the leader gap adjustment.

Figure 56H:
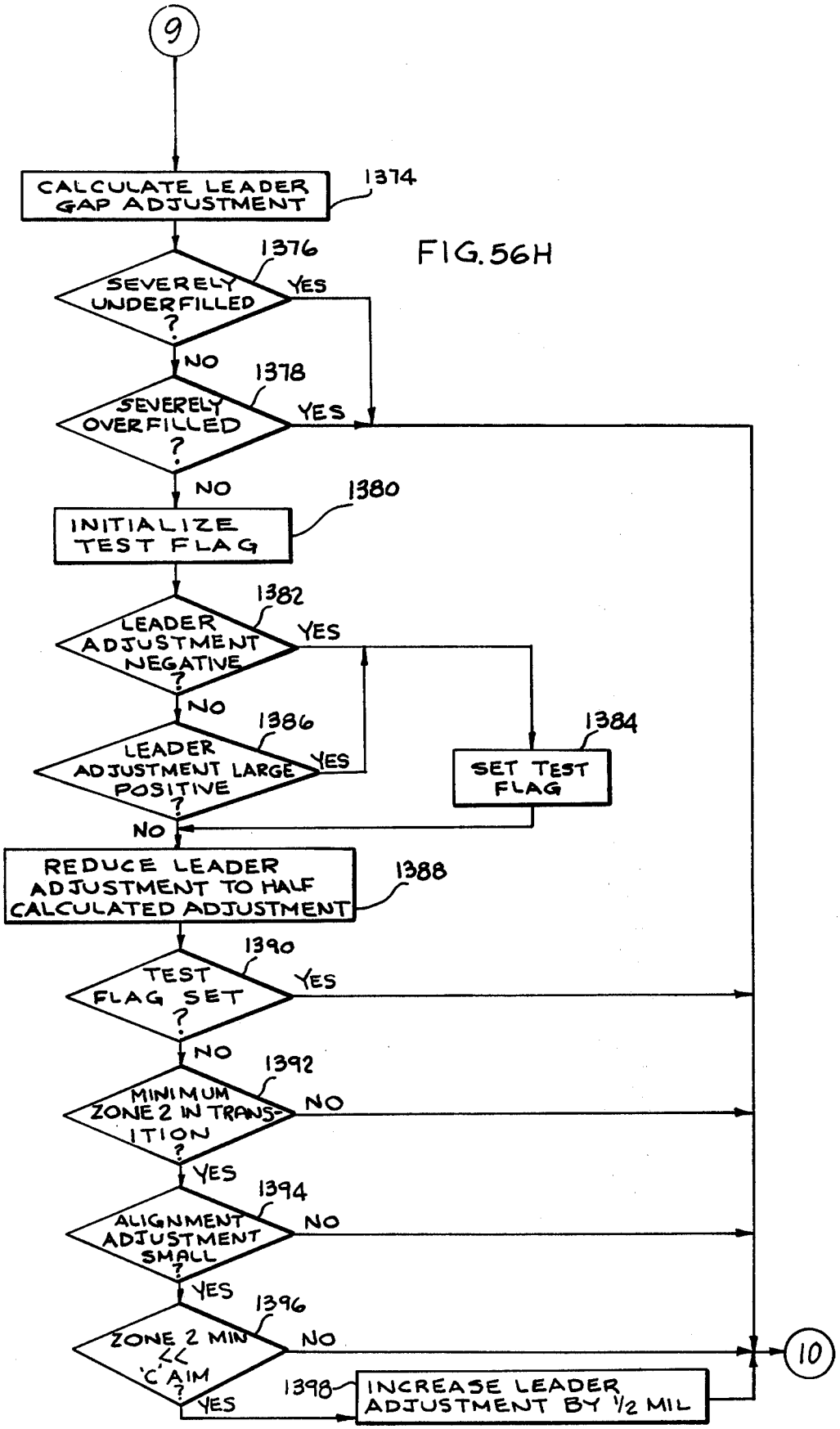
Figure 56I:
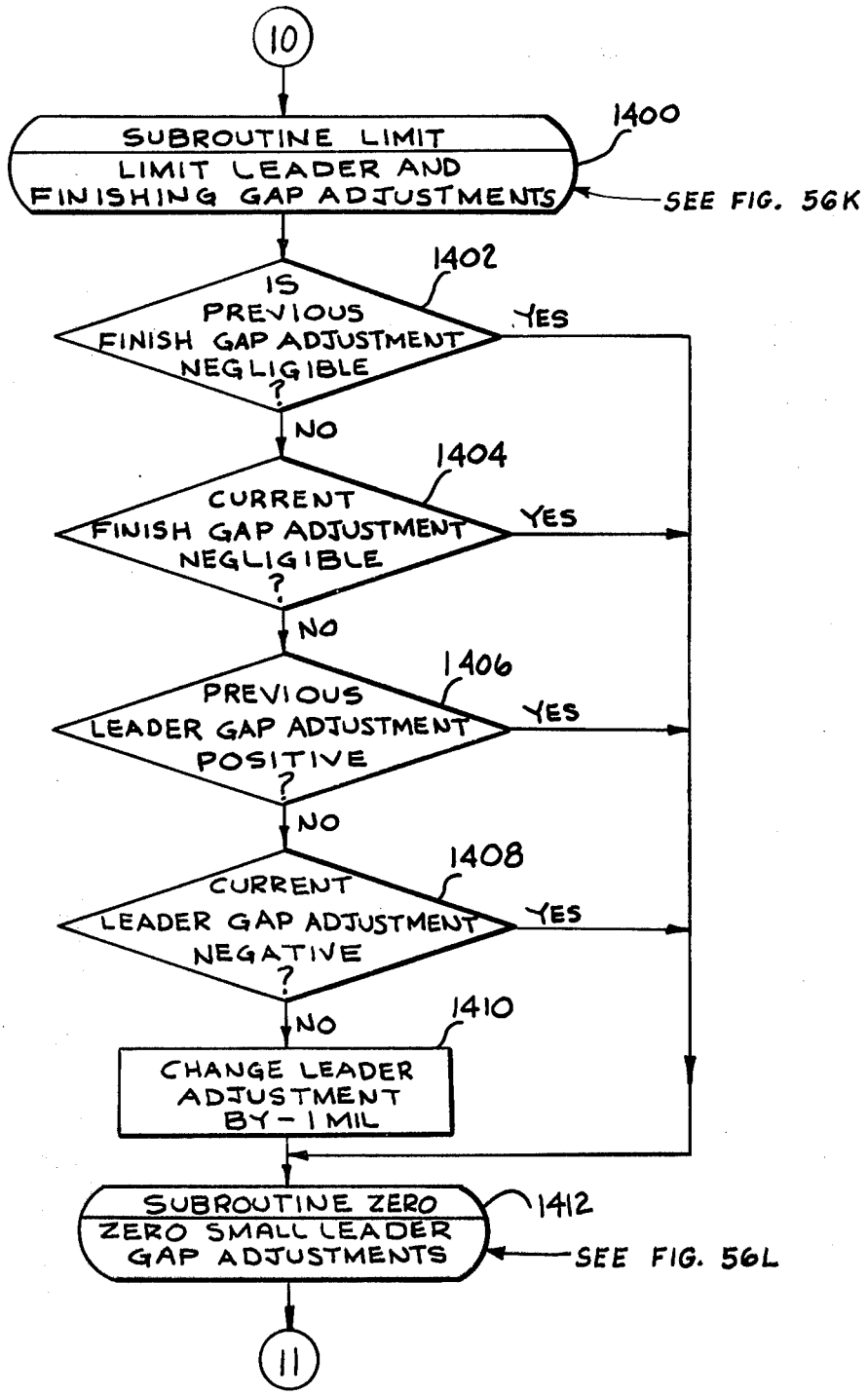
Figure 56J:
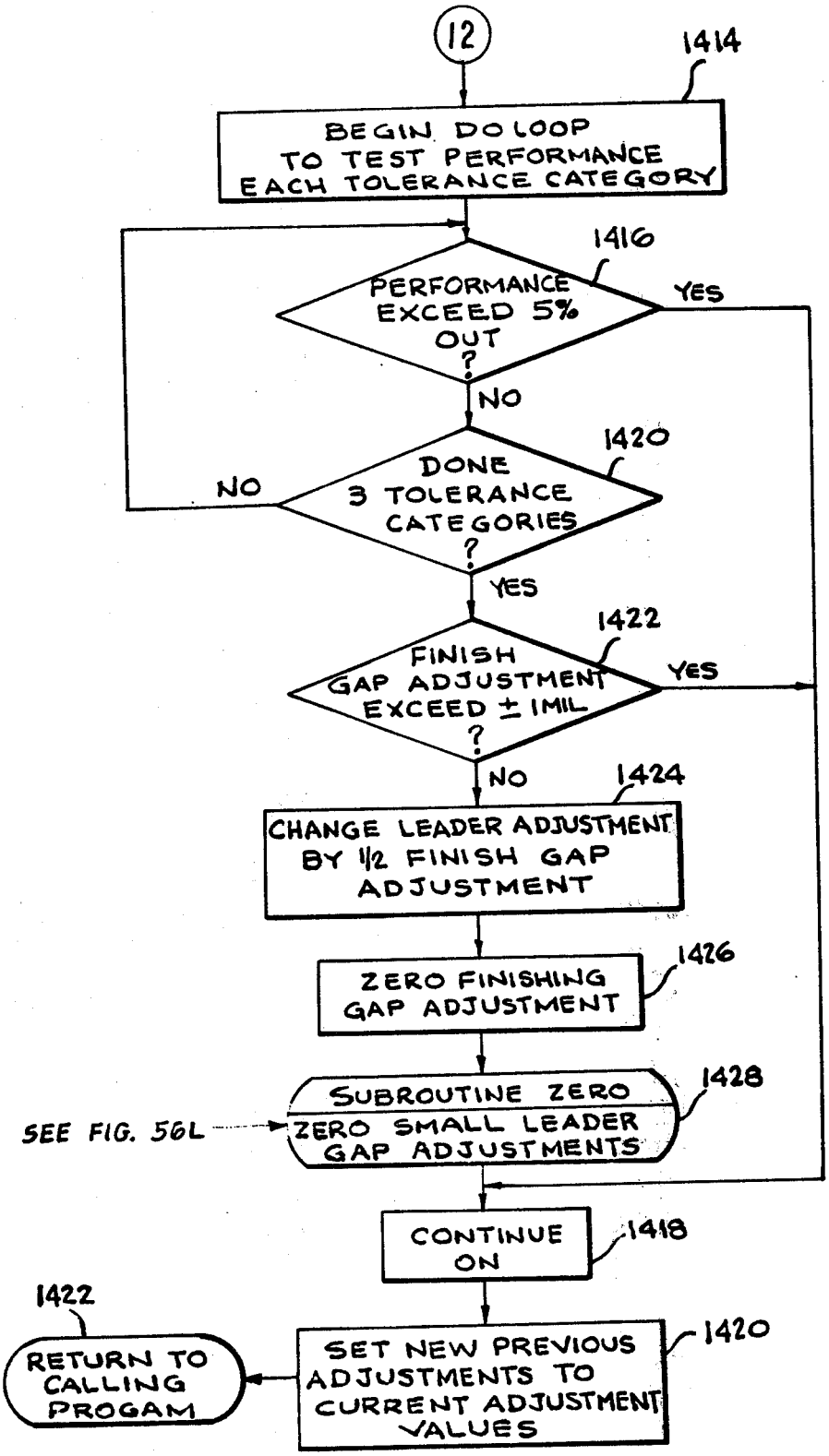
Figure 56L:
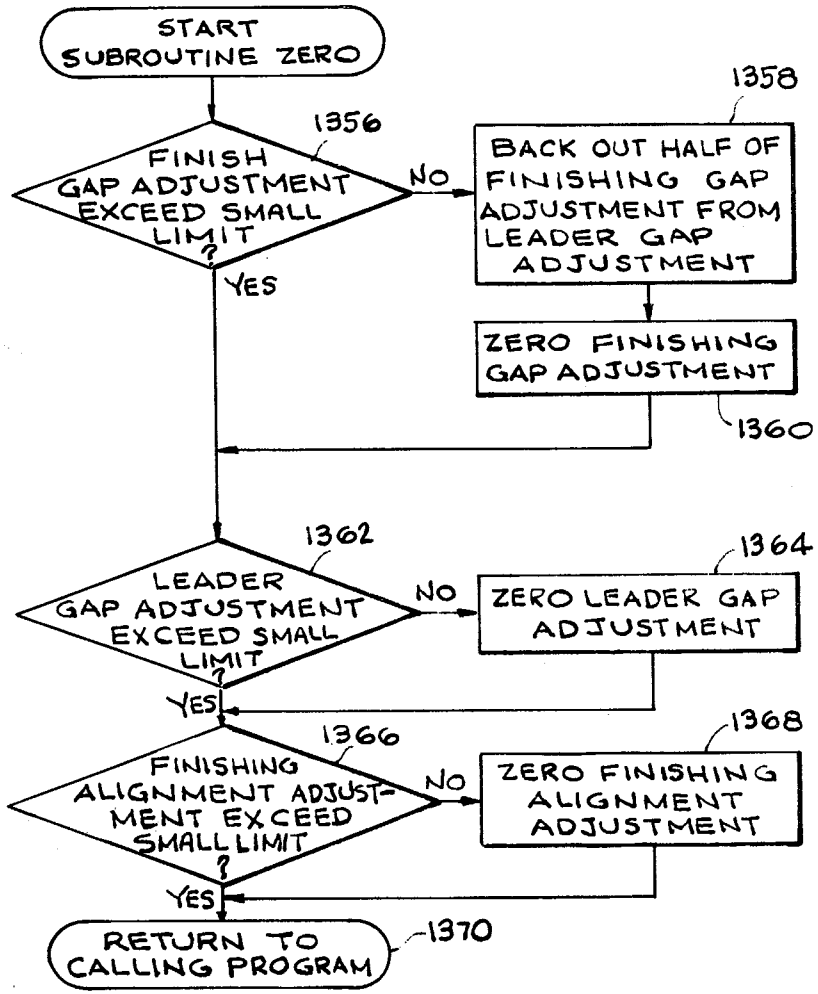
Figure 56K:
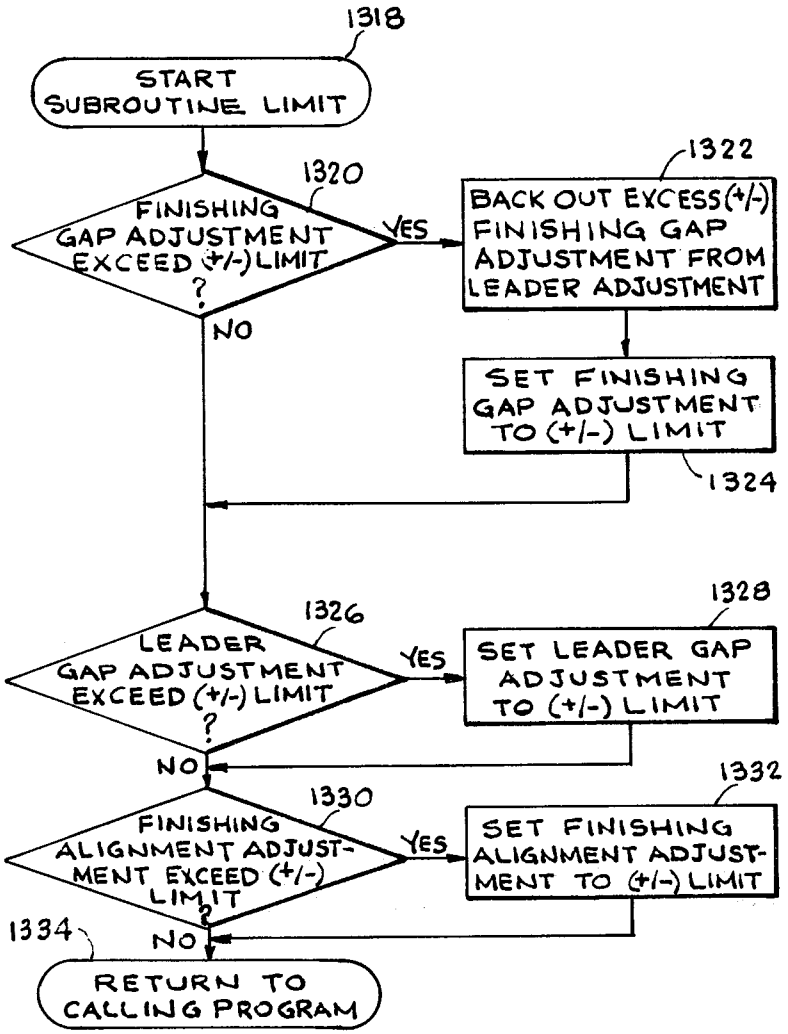

As shown in FIG. 56K, block 1318 first directs the computer 1028 to start the subroutine limiting procedure. The first step comprises querying block 1320 to determine if the gap adjustment exceeds preset maximum and minimum limits, e.g., ±0.005 inch. If so, block 1322 directs this excess amount to be removed from the roll gap adjustment calculated for stand 1010, and block 1324 sets the calculated roll gap adjustment on stand 11 to the particular limit that was exceeded.

After these adjustments have been calculated by blocks 1322 and 1324, or if the output from block 1320 is in the negative, block 1326 checks to see if the calculated roll gap adjustment on stand 1010 exceeds preset maximum and minimum limits.

Next, block 1330 checks to see if the calculated roll axial alignment adjustment to stand 11 exceeds preset maximum and minimum limits. As in the previous two limit checks, if the answer is yes, block 1332 sets the roll alignment adjustment calculation to the preset limit before directing the process back to the caling program block 1316 via block 1334. If the answer is no, block 1334 directs the process back to block 1316 of FIG. 56G and then block 1336.

Block 1336 of the main program then stores the value of "A" from the profile reading. Next, block 1338 calculates, from the simulated profile, a new "A Optimum" that yields the minimum out-of-round. Block 1340 then tests to determine if this value of A Optimum is much greater than the previous value of A Optimum. If the answer is yes, it implies that either the instant value or the previous value of A Optimum was calculated with incorrect data, since this value cannot realistically change drastically for any other reason, It is assumed that, due to the historical nature of previous A Optimum values, the instant value was based on incorrect data. Therefore, block 1342 sets the finishing gap adjustment to zero. Block 1344 then queries if the difference between the new and the old values of A Optimum is positive or negative. If the answer is positive, block 1346 forms a corrected old A Optimum, used during the next iteration, by adding a small value to the old A Optimum. If the answer is negative, block 1348 forms a corrected old A Optimum by subtracting this same small value from the old A Optimum.

If the answer to decision block 1340 is no, block 1350 changes the calculated A Optimum by one half the difference between the old and the new value, thereby introducing a dampening factor into the process. Block 1352 then calculates the corresponding dampened roll gap adjustment to stand 11.

Block 1354 next directs the computer 1028 to subroutine zero, shown in FIG. 56L. This subroutine determines whether either of the gap adjustments of stands 1010 and 18 or the alignment adjustment of stand 11 should be set to zero. The subroutine zero is similar to the subroutine limit in that it is used to zero any or all of the roll adjustments. Because of the dependency of the leader gap adjustment on the finishing gap adjustment, zeroing of the finishing stand 11 roll adjustment results in a need to back out the unused portion of the adjustment to the leader stand 1010 roll gap. As is the case of subroutine limit, subroutine zero is used at a number of places throughout the program. Because of the generality of these subroutines, at times backing out of the leader stand 1010 roll adjustment is irrelevant because the leader gap adjustment has not yet been calculated.

Decision block 1356 first asks if the roll gap adjustment at stand 11 exceeds a small limit, e.g., 0.0005 inch. If not, block 1358 directs the computer 1028 to deduct half of the calculated gap adjustment for stand 11 from the calculated roll gap adjustment for stand 1010. Block 1360 then directs the computer 1028 to zero the gap adjustment calculated for stand 11, inasmuch as this calculated value is too small to significantly affect the process.

If the calculated roll gap adjustment for stand 11 exceeds this small limit, the computer 1028 goes to block 1362, which checks to see if the roll gap adjustment for stand 1010 exceeds this small value. If not, block 1364 zeros this gap adjustment. If yes, block 1366 checks to see if the roll alignment adjustment calculated for stand 11 exceeds a small value, e.g., 0.0005 inch. If not, block 1368 zeros this alignment adjustment before proceeding to block 1370. If yes, block 1370 returns the computer 1028 from this subroutine to the calling program block 1354 of the.

In the next step in the optimization procedure, block 1374 in FIG. 56H directs the computer 1028 to calculate the roll gap adjustment for stand 1010. First, blocks 1376 and 1378 check to see if a gross adjustment is to be made. Block 1376 checks for a severely underfilled condition in the profile. This would be indicated by a required adjustment comprising opening the roll gap of stand 1010 by more than 0.008 inch. Block 1378 then checks for a severely overfilled condition. This would be indicated by a required adjustment comprising closing the roll gap of stand 1010 by more than 0.004 inch. If either condition exists, the program shifts directly to FIG. 56K limit subroutine, described earlier.

The program next directs the computer to see if a moderate adjustment is to be made to the roll gap of stand 1010. Block 1380 initializes for a test flag. Decision block 1382 then asks if the adjustment to the roll gap in stand 1010 is negative. This means that the gap would be closed by the adjustment, signifying the presence of an overfilled roll pass. If the answer is yes, block 1384 sets a test flag. If the answer is no, decision block 1386 asks if the required roll gap adjustment to stand 1010 is large and positive, e.g., greater than 0.003 inch. If so, block 1384 sets the test flag. If the answer is no, only a fine adjustment to the roll gap of stand 1010 is required.

At this point, block 1388 contributes to the stability of the system by reducing the calculated medium or small adjustment to the roll gap of stand 1010 by 50%. Decision block 1390 is next checked to see if the test flag is set. If so, the program goes directly to the FIG. 56K limit subroutine, since a medium adjustment is indicated.

If the test flag is not set, decision block 1392 is checked to see if the minimum value in Zone II is in the transition zone. If so, this means that the bar 10 is lying in the pass and the performance of the mill could be somewhat improved by filling the low underfill area of the bar 10. This condition is caused by one of two phenomena. Either the rolls in stand 11 are misaligned or the guides in stand 11 are improperly set. If the answer to block 1392 is no, then the bar 10 is not lying in the pass, and the computer 1028 continues at block 1400 in FIG. 56I.

Block 1394 then checks to see if the alignment adjustment is small. If not, the rolls should be aligned, and the program is directed to block 1400 in FIG. 56I. If so, it means that the guides are improperly set, and decision block 1396 then checks to see if the minimum value in Zone II is much less, e.g., by more than 0.0025 inch, than C Aim. If the answer is no, the computer 1028 is directed to continue at block 1400. If the answer is yes, block 1398 increases the calculated adjustment to the roll gap of stand 1010 by 0.0005 inch before being advanced to block 1400.

Subroutine limit 1400 in FIG. 56I limits the values of the roll gap adjustments to stands 1010 and 11 as previously described. Block 1402 then asks if the previous roll gap adjustment for stand 11 was negligible, e.g., less than 0.00001 inch. If so, the computer 1028 is directed to subroutine zero. If not, block 1404 checks to see if the current roll gap adjustment for stand 11 is negligible. If so, the computer 1028 is directed to subroutine zero. If not, blocks 1406 and 1408 check to see if the sense of the calculated adjustment to the roll gap of stand 1010 implies that there is instability in the system.

Block 1406 checks to see if the previous adjustment to the roll gap of stand 1010 was positive, i.e., if the roll gap were opened. If so, the computer 1028 is directed to subroutine zero shown in FIG. 56L. However, if the previous roll gap adjustment were negative, i.e., if the roll gap were closed, the computer 1028 directs block 1408 to check to see if the current roll gap is negative. If so, the computer is again directed to subroutine zero. However, if the current roll gap adjustment to stand 1010 is positive, indicating that the sense of the adjustment has changed, block 1410 changes the calculated roll gap adjustment to stand 1010 by −0.001 inch. This change in sense to a positive adjustment is then dampened, thereby tending to keep the parting area 1063 in FIG. 44 more stable and slightly underfilled. Block 1412 then directs the computer 1028 to subroutine zero.

The next step in the process comprises determining if the performance of the subject bar mill control system is so good that the parameters of the system should not be disturbed if the calculated roll gap adjustment to stand 11 is small. More specifically, if at least 95% of the product is within the tolerance for each category of minimum, maximum, and out-of-round, and the calculated roll gap adjustment for stand 11 is 0.001 inch or less, no adjustment will be made for stand 11 and the gap adjustment to stand 1010 will be dampened.

Block 1414 in FIG. 56J first directs the computer 1028 to go through a DO loop for each of the above tolerance categories. Decision block 1416 asks if the performance for a first one of these categories is more than 5% out. If so, the computer 1028 is directed to block 1418, and the process continues on. If not, block 1420 directs the second and third categories to be sequentially tested. If either of these are more than 5% out, the process similarly continues on.

If none of the categories is more than 5% out of tolerance, block 1422 asks if the roll gap adjustment in stand 11 exceeds ±0.001 inch. If so, block 1418 directs the process to continue on. If not, block 1424 changes the roll gap adjustment in stand 1010 to be equal to one half the roll gap adjustment calculated for stand 11, and block 1426 sets the roll gap adjustment in stand 11 equal to zero.

Block 1428 then directs the computer 1028 to subroutine zero shown in FIG. 56L, and then block 1418 directs the process on. Block 1420 then prepares for the next iteration by setting the new previous adjustments to the current adjustment values. Block 1422 then returns the computer 1028 to the calling program.

We claim:

1. In a bar mill comprising a penultimate and a last reducing stand, the axes of the rolls of one of said stands being perpendicular to the axes of the rolls of the other of said stands, and means for maintaining said bar in a state of substantially nonvarying tension as it enters and leaves said stands, a system for optimizing the diametric size of said bar within predetermined limits, comprising:

(a) sensor means for detecting at least one diametric dimensions of a bar leaving said last stand, comprising:

(i) means for producing at least one diameter signal each indicative of a different diameter of said bar; and (ii) means for causing said means (i) to scan the bar periphery in response to a scanning control signal, said means (ii) producing a scanner position signal;

(b) programmed computer means for:

(i) producing said scanning control signal;

(ii) receiving each said diameter signal, and said scanner position signal;

(iii) receiving the aim diameter of the bar, roll position signals, and any data fed from an operating source and needed for compensating at least one diameter signal received;

(iv) producing and storing a sequence of data representative of the diameter profile of said bar; and (v) computing and outputting at least one adjustment signal for the rolls in said stands as required to optimize said diametric size; and (c) means responsive to at least one adjustment signal for performing at least one roll adjustment.

2. A system as recited in claim 1, in which the computer means computed adjustment signals for adjustments to the rolls in said stands comprise an axial adjustment signal to the rolls in said last stand and gap adjustment signals to the rolls in both said last and said penultimate stands.

3. A system as recited in claim 2, in which:

(a) means in the operating source is provided for producing a signal indicative of the temperature of said bar as it exits from said last stand; and (b) said programmed computer means:

(i) receives said temperature signal and converts the data representative of said diameter profile into profile data relative to a reference temperature;

(ii) produces histograms of: (A) lengthwise variations in a predetermined one or more diameters of said bar; and (B) lengthwise variations in differences between certain of said diameters;

(iii) computes a modified diameter profile of said bar that would result from an optimized axial alignment of the rolls in said last stand;

(iv) computes a sequence of variations in said modified diameter profile that would result from a sequence of roll gap adjustments to said last stand, whereby the adjustment that results in the optimum diameter profile is determined; and (v) computes and outputs said adjustment signals based on said penultimate stand, utilizing said optimized axial roll alignment and the roll gap adjustment computed for said last stand to obtain the optimum diameter profile, the desired value for the diameter of the bar at the roll parting line after said bar leaves said last stand, and the actual value of the diameter of said bar at said roll parting line as said bar leaves said last stand.

4. A system a recited in claim 1, in which said programmed computer means produces at least one histogram or lengthwise variations in at least one predetermined diameter of said bar and utilizes at least one histogram in combination with said diameter profile in the computation of the adjustment signals for the rolls in said stands to optimize said bar diametric size.

5. A system as recited in claim 4, in which said programmed computer means computes and outputs at least one adjustment signal, in sequence:

(a) a modified diameter profile of said bar that would result from an optimized axial alignment of the rolls in said last stand;

(b) a sequence of variations in said modified diameter profile that would result from a sequence of roll gap adjustments to said last stand, whereby the adjustment that results in the optimum diameter profile is determined;

(c) a roll gap adjustment to said penultimate stand, utilizing said optimized axial roll alignment and the roll gap adjustment computed for said last stand to obtain the optimum diameter profile, the desired value for the diameter of the bar at the roll parting line after said bar leaves the last stand, and the actual value of the diameter of said bar at said roll parting line as said bar leaves said last stand.

6. A system as recited in claim 4, in which at least one of the predetermined diameters along which at least one histogram is produced by said computer means comprise the diameter of the bar parting line, the diameter perpendicular thereto, the diameter 45° clockwise of said bar parting line, and the diameter 45° counterclockwise of said parting line.

7. A system as recited in claim 6, in which additional histograms are produced by said computer means of lengthwise variations in differences between certain of said diameters.

8. A system as recited in claim 1, in which:

(a) means in the operating source is provided for producing a signal indicative of the temperature of said bar as it exits said last stand, and (b) said programmed computer means receives said temperature signal and converts the data representative of said diameter profile into profile data relative to a reference temperature.

9. In a bar mill comprising a penultimate and a last reducing stand, the axes of the rolls of one of said stands being perpendicular to the axes of the rolls of the other of said stands, and means for maintaining said bar in a state of substantially nonvarying tension as it enters and leaves said stands, a machine method of optimizing the diametric size of the bar within predetermined lines, comprising:

(a) detecting at least one diametric dimension during scanning about the periphery of the bar leaving said least stand, thereby producing at least one diameter signal and a scanner position signal;

(b) producing and storing data in computer means representative of the diameter profile of said bar based on at least one said diameter signal and said scanner postition signal;

(c) computing and outputting at least one adjustment signal for the rolls in said stands as required to optimize said diametric size; and (d) performing at least one said roll adjustment in response to at least one adjustment signal.

10. A method as recited in claim 9, including the steps of:

(e) producing a temperature signal of said bar temperature as it exits said last stand; and (f) converting the stored data representative of said diameter profile into profile data corrected by said temperature signal relative to a reference temperature, said latter data being used to compute said one or more adjustment signals for the rolls.

11. A method as recited in claim 9, including the steps of:

(g) producing histograms in said computer means of: (A) lengthwise variations in at least one predetermined diameter of said bar; and (B) lengthwise variations in differences between certain of said diameters; and (h) utilizing said histograms in combination with said diameter profile to compute and output at least one said adjustment signal for the rolls.

12. A method as recited in claim 11, in which outputting said adjustment signals for the rolls comprise generating:

(i) a first signal for axially adjusting the rolls in said last stand;

(ii) a second signal for adjusting the gap between the rolls in said last stand; and (iii) a third signal for adjusting the gap between the rolls in said penultimate stand.

13. In a bar mill comprising a penultimate and a last reducing stand, the axes of the rolls of one of said stands being perpendicular to the axes of the rolls of the other of said stands, and means for maintaining said bar in a state of substantially nonvarying tension as it enters and leaves said stands, a machine method of optimizing the diametric size of the bar within predetermined lines, comprising:

(a) detecing at least one diametric dimension during scanning about the periphery of a bar leaving said last stand, thereby producing at least one diameter signal and a scanner position signal;

(b) producing a temperature signal of said bar temperature as it exits said last stand;

(c) producing and storing temperature-compensated data in computer means representative of the diameter profile of said bar based on at least one said diameter signal, the scanner position signal; and said bar temperature signal;

(d) producing histograms in said computer means of: (A) lengwise variations in at least one predetermined diameter of said bar; and (B) lengthwise variations in differences between certain of said diameters;

(e) producing in said computer means a modified diameter profile of said bar that would result from an optimized axial alignment of the rolls in said last stand;

(g) performing said roll adjustment in response to the aforesaid roll adjustment signals.

* * * * *

UNITED STATES PATENT AND TRADEMARK OFFICE

CERTIFICATE OF CORRECTION

PATENT NO. : 4,141,071

DATED : February 20, 1979

INVENTOR(S) : Ronald W. Yerkes et al.

It is certified that error appears in the above-identified patent and that said Letters Patent are hereby corrected as shown below:

Col. 14, line 12, "8F" should read --$\bar{8}$F--.

Col. 14, line 27, "11" should read --111--.

Col. 26, after line 64, the following has been omitted and should be inserted:

--Example:

Top Edges 83 = (2.048" + 0.016" + 0.5"/2) ÷ 0.016" = 144 (Eq.3)

Bottom Edges 82 = (2.048" + 0.016" - 0.5"/2) + 0.016" = 113 (Eq. 4)--.

Col. 34, line 40, after "then" the word --interrogates-- should be added.

Col. 35, line 23, "teletype" should be --Teletype-- (capital "T"_.

Col. 38, line 36, "difference" should read --differences--.

Col. 37, line 18, after "to" delete "b".

Col. 42, line 26, after "tolerance" insert the word --limits--.

Col. 43, line 12, "he" should read --the--.

Col. 44, line 41, in the equation delete the second ")" parenthesis mark after "Offset".

UNITED STATES PATENT AND TRADEMARK OFFICE

CERTIFICATE OF CORRECTION

PATENT NO. : 4,141,071

DATED : February 20, 1979

INVENTOR(S) : Ronald W.Yerkes et al.

It is certified that error appears in the above-identified patent and that said Letters Patent are hereby corrected as shown below:

Col. 45, line 21, "increment P" should read --P increment--.

Col. 45, line 22, "increment P" should read --P increment--.

Col. 46, line 57, after the word "pass" insert --1058--.

Col. 48, line 8, "caling" should read --calling--.

Col. 49, line 6, after "of the" the words --main program-- should be added.

Col. 50, line 52, after "previous" add the word --roll--.

Col. 51, claim 4, line 59, the second "a" should read --as--.

Col. 54, claim 13, subparagraph (f) has been omitted, the following should be inserted:

--(f) utilizing in said computer means said histograms, in combination with said modified diameter profile of said bar, to:

UNITED STATES PATENT AND TRADEMARK OFFICE

CERTIFICATE OF CORRECTION

DATED : February 20, 1979

INVENTOR(S) : Ronald W.Yerkes et al.

It is certified that error appears in the above-identified patent and that said Letters Patent are hereby corrected as shown below:

(i) compute and output an axial roll adjustment signal and a first roll gas adjustment signal for a sequence of variations in said modified diameter profile that would result from a sequence of roll gap adjustments to said last stand, whereby the roll adjustments that result in the optimum diameter profile is determined; and (ii) compute and output a roll gap adjustment signal for said penultimate stand, utilizing said optimized axial roll alignment signal and the roll gap adjustment signal computed for said last stand to obtain the optimum diameter profile, the desired value for the diameter of the bar at the roll parting line after said

UNITED STATES PATENT AND TRADEMARK OFFICE

CERTIFICATE OF CORRECTION

PATENT NO. : 4,141,071

DATED : February 20, 1979

INVENTOR(S) : Ronald W. Yerkes et al.

It is certified that error appears in the above-identified patent and that said Letters Patent are hereby corrected as shown below:

bar leaves said last stand, and the actual value of the diameter of said bar at said roll parting line as said bar leaves said last stand; and--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*